US007172855B2

(12) United States Patent
Yasuda et al.

(10) Patent No.: US 7,172,855 B2
(45) **Date of Patent: *Feb. 6, 2007**

(54) SILVER HALIDE PHOTOGRAPHIC LIGHT-SENSITIVE MATERIAL AND PACKAGE THEREOF

(75) Inventors: Shoji Yasuda, Minami-ashigara (JP); Yoshihisa Tsukada, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/941,936

(22) Filed: Sep. 16, 2004

(65) Prior Publication Data

US 2005/0287485 A1 Dec. 29, 2005

(30) Foreign Application Priority Data

Sep. 18, 2003 (JP) ..... 2003-325425
Mar. 19, 2004 (JP) ..... 2004-079635

(51) Int. Cl.
*G03C 1/46* (2006.01)
*G03C 1/76* (2006.01)
*G03C 1/005* (2006.01)
*G03C 1/494* (2006.01)
*G03C 1/85* (2006.01)

(52) U.S. Cl. ..... 430/502; 430/503; 430/505; 430/523; 430/528; 430/529; 430/634; 430/635; 430/636; 430/637; 430/639; 430/631

(58) Field of Classification Search ..... 430/502, 430/503, 505, 523, 528, 529, 634, 637, 639, 430/631
See application file for complete search history.

(56) References Cited

U.S. PATENT DOCUMENTS 6,686,139 B2 * 2/2004 Kanazawa et al. ..... 430/529
6,897,013 B2 * 5/2005 Yanagi et al. ..... 430/528
2002/0039710 A1 4/2002 Hashimoto

FOREIGN PATENT DOCUMENTS

EP 1 283 443 A1 2/2003
EP 1 345 074 A1 9/2003
JP 11-316441 A 11/1999

* cited by examiner

*Primary Examiner*—Geraldina Visconti
(74) *Attorney, Agent, or Firm*—Birch, Stewart, Kolasch & Birch, LLP

(57) ABSTRACT

Disclosed is a silver halide photographic light-sensitive material having a layer containing a compound of the following formula and a fluorine compound, and has a gamma of 5.0 or more for the optical density range of 0.3 to 3.0:

wherein $R^1$ is alkyl or alkenyl, $R^2$ are H, alkyl, alkenyl, aralkyl or aryl, $l^1$ is 1–10, $m^1$ is 1–30, $n^1$ is 0–4, a is 0 or 1, and $Z^1$ is $OSO_3M$ or $SO_3M$ where M is cation.

20 Claims, 5 Drawing Sheets

SILVER HALIDE PHOTOGRAPHIC LIGHT-SENSITIVE MATERIAL AND PACKAGE THEREOF

This Nonprovisional application claims priority under 35 U.S.C. § 119(a) on Patent Application No(s). 2003-325425 and 2004-079635 filed in Japan on Sep. 18, 2003 and Mar. 19, 2004, respectively, the entire contents of which are hereby incorporated by reference.

BACKGROUND OF THE INVENTION

1. Field of the Invention

The present invention relates to a silver halide photographic light-sensitive material, in particular, a silver halide photographic light-sensitive material used for a photomechanical process and a photographic light-sensitive material used for IC printed boards. The present invention also relates to a package comprising a stack of the photographic light-sensitive materials packaged with a packaging bag.

2. Description of the Background

It is the integrated circuits (ICs) that support the today's highly information-oriented society from the aspect of hardware. It can be said that ICs are used because of their characteristics such as high processing speed, high reliability, low power consumption, low price, high functionality, light weight and small size. Meanwhile, for photographic light-sensitive materials, for example, light-sensitive materials for making printing plates, especially those used for IC printed boards, high reliability is required, and they play an important role. For example, a circuit pattern is prepared with the aid of computer-aided design (CAD), and a photographic light-sensitive material is exposed in this pattern in a full scale or reduced scale, developed and fixed to prepare a negative. A copper plate (or copper foil) applied with a resist is exposed using this negative as a mask by contact exposure or projection exposure in a reduced size usually using a mercury lamp as a light source so that the resist should be chemically denatured by ultraviolet rays emitted by the mercury lamp. There are a negative type resist and a positive type resist. In the former type, a portion irradiated with ultraviolet rays is not dissolved and remains in the subsequent development step, and a portion not irradiated with ultraviolet rays is dissolved in a developer. The reverse is applied to the positive type resist. In the both cases, for use of a negative of photographic light-sensitive material as a mask in contact exposure or projection exposure in a reduced size on a copper plate (or copper foil) applied with a resist, reproducibility of the negative image on the photographic light-sensitive material (stability for the development) is important.

In photomechanical processes used in the field of graphic arts, used is a method in which photographic images of continuous tone are converted into so-called dot images in which variable image density is represented by sizes of dot areas, and such images are combined with photographed images of characters or line originals to produce printing plates. For silver halide photographic light-sensitive materials used for such a purpose, ultrahigh contrast photographic characteristic enabling clear distinction between image portions and non-image portions has been required in order to obtain favorable reproducibility of characters, line originals and dot images. Silver halide photographic light-sensitive materials having such an ultrahigh photographic characteristic have a characteristic that they shows higher density (higher practice density) compared with low contrast materials even when laser exposure is performed with exposure giving the same half tone percentage. Therefore, for use in IC printed boards, suitability of resist for exposure is markedly improved.

As a system responding to such a requirement, there has been known the so-called lithographic development method, in which a silver halide light-sensitive material comprising silver chlorobromide is treated with a hydroquinone developer having an extremely low effective concentration of sulfite ions to form images of high contrast. However, in this method, the developer is extremely unstable against oxidation by air since the sulfite ion concentration in the developer is extremely low, and therefore a lot of developer must be replenished in order to stably maintain the developer activity.

As image forming systems in which the instability of the image formation according to the lithographic development method is eliminated and light-sensitive materials are processed with a developer showing good storage stability to obtain ultrahigh contrast photographic characteristic, for example, the one described in U.S. Pat. No. 5,650,746 and so forth can be mentioned. These are systems in which a silver halide photographic light-sensitive material of surface latent image type containing a hydrazine derivative is processed with a developer containing hydropuinone/metol or hydroquinone/phenidone as main developing agents and 0.15 mol/l or more of sulfite preservative and having pH of 11.0 to 12.3 to form ultrahigh contrast negative images having a gamma of 10 or higher. According to these systems, photographic characteristics of ultrahigh contrast and high practice density can be obtained, and because sulfite can be added to the developer at a high concentration, stability of the developer to air oxidation is markedly improved compared with conventional lithographic developers.

In order to form sufficiently ultrahigh contrast images with use of a hydrazine derivative, it is necessary to perform processing with a developer having pH of 11 or higher, usually 11.5 or higher. Although it has become possible to increase the stability of the developer by use of a sulfite preservative at a high concentration, it is still necessary to use such a developer of high pH as described above in order to obtain ultrahigh contrast photographic images, and the developer is likely to suffer from air oxidation and hence instable even with the presence of the preservative. Therefore, various attempts have been made in order to realize ultrahigh contrast images with a lower pH to further improve stability of the developer.

For example, Japanese Patent Laid-open Publication (Kokai, henceforth referred to as "JP-A") No. 8-272023 discloses a method of using a highly active hydrazine derivative and a nucleation accelerator in order to obtain ultrahigh contrast images of high practice density by using a developer having pH of less than 11.0. However, silver halide photographic light-sensitive materials used for such an image-forming system have problems concerning storage stability such as fluctuation of sensitivity and increase of fog during storage due to incorporated highly active compounds, and they are desired to be solved.

Further, one of the drawbacks of nucleating high contrast negative image systems using a highly active hydrazine derivative and a nucleation accelerator, of which improvement is desired, is occurrence of the unfavorable phenomenon, uneven processing, and it poses a problem in their use for photomechanical processes and IC printed boards. The uneven processing referred to herein means difference in the sizes of half tone dots or unevenness of line widths caused by uneven nip pressure of development rollers during development process observed in half tone dot images in which half tone dots should have the same areas and images of the same line widths. Because this phenomenon greatly affects finish of half tone and highlight of printed matter, or precision of wiring for use in IC printed boards, improvement thereof is strongly desired.

Meanwhile, when a circuit pattern is prepared with the aid of computer-aided design (CAD) and photographed on a photographic light-sensitive material, a plotter provided with an automatic transportation system is used. In the automatic transportation system, transportation troubles due to influences of lubricity, static electricity and to forth may often occur and greatly degrade the productivity. Therefore, improvement of such troubles is strongly desired.

SUMMARY OF THE INVENTION

In consideration of the aforementioned problems of the conventional techniques, the present invention first aimed at providing a silver halide photographic light-sensitive material that suppresses uneven processing and is usable in a stable processing system. The second object is to provide a silver halide photographic light-sensitive material that does not easily cause transportation troubles. The third object is to provide a silver halide photographic light-sensitive material that exhibits superior storage stability. The forth object is to provide a package of silver halide photographic light-sensitive materials that suppresses generation of scratches and pressure-induced fog (black peppers) in the light-sensitive materials and enables expression of high contrast and highly sensitive photographic characteristics upon use of the silver halide photographic light-sensitive materials.

As a result of various researches of the inventors of the present invention, it was found that the aforementioned objects could be achieved by a silver halide photographic light-sensitive material having one or more layers including at least one light-sensitive silver halide emulsion layer on a support, which contains a compound represented by the following formula (1) and a fluorine compound in at least one layer among the layers formed on the support, and has a characteristic curve drawn in orthogonal coordinates of logarithm of light exposure x-axis) and optical density (y-axis) using equal unit lengths for the both axes, on which gamma is 5.0 or more for the optical density range of 0.3 to 3.0, and thus the present invention was accomplished.

Formula (1)

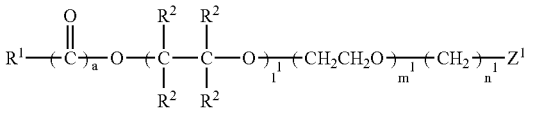

In the formula, $R^1$ represents a substituted or unsubstituted alkyl group having 6 to 25 carbon atoms or a substituted or unsubstituted alkenyl group having 6 to 25 carbon atoms, the groups of $R^2$ may be identical or different, and represent a hydrogen atom, a substituted or unsubstituted alkyl group having 1 to 14 carbon atoms, a substituted or unsubstituted alkenyl group having 1 to 14 carbon atoms, a substituted or unsubstituted aralkyl group having 7 to 20 carbon atoms or a substituted or unsubstituted aryl group having 6 to 18 carbon atoms, $l^1$ represents an integer of 1 to 10, $m^1$ represents an integer of 1 to 30, $n^1$ represents an integer of 0 to 4, and a represents 0 or 1. $Z^1$ represents $OSO_3M$ or $SO_3M$, where M represents a cation.

The fluorine compound is preferably a compound represented by the following formula (2A), (2B), (2C) or (2D).

Formula (2A)

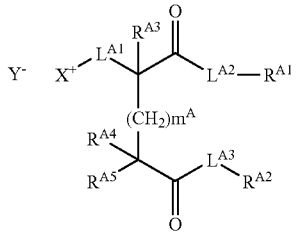

In the formula, $R^{A1}$ and $R^{A2}$ each represent a substituted or unsubstituted alkyl group provided that at least one of $R^{A1}$ and $R^{A2}$ represents an alkyl group substituted with one or more fluorine atoms. $R^{A3}$, $R^{A4}$ and $R^{A5}$ each independently represent a hydrogen atom or a substituent, $L^{A1}$, $L^{A2}$ and $L^{A3}$ each independently represent a single bond or a divalent bridging group, and $X^+$ represents a cationic substituent. $Y^-$ represents a counter anion, provided that $Y^-$ may not be present when the intramolecular charge is 0 without $Y^-$. $m^A$ is 0 or 1.

Formula (2B)

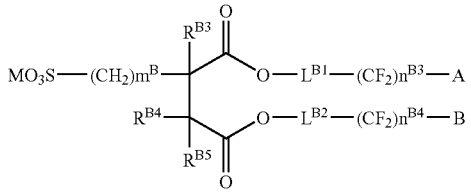

In the formula, $R^{B3}$, $R^{B4}$ and $R^{B5}$ each independently represent a hydrogen atom or a substituent. A and B each independently represent a fluorine atom or a hydrogen atom. $n^{B3}$ and $n^{B4}$ each independently represent an integer of 4 to 8. $L^{B1}$ and $L^{B2}$ each independently represent a substituted or unsubstituted alkylene group, a substituted or unsubstituted alkyleneoxy group or a divalent bridging group consisting of a combination of these. $m^B$ represents 0 or 1. M represents a cation.

Formula (2C)

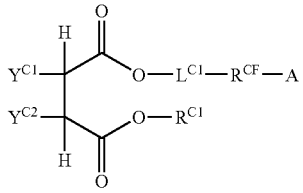

In the formula, $R^{C1}$ represents a substituted or unsubstituted alkyl group, and $R^{CF}$ represents a perfluoroalkylene group. A represents a hydrogen atom or a fluorine atom, and $L^{C1}$ represents a substituted or unsubstituted alkylene group, a substituted or unsubstituted alkyleneoxy group or a divalent bridging group consisting of a combination of these. One of $Y^{C1}$ and $Y^{C2}$ represents a hydrogen atom, and the other represents —$L^{C2}$—$SO_3M$, where M represents a cation. $L^{C2}$ represents a single bond or a substituted or unsubstituted alkylene group.

$$[Rf^D—(L^D)_{nD}]_{mD}—W \quad \text{Formula (2D)}$$

In the formula, $Rf^D$ represents a perfluoroalkyl group, $L^D$ represents an alkylene group, W represents a group having an anionic, cationic or betaine group or nonionic polar group required for imparting surface activity. $n^D$ represents 0 or 1, and $m^D$ represents an integer of 1 to 3.

The silver halide photographic light-sensitive material of the present invention preferably contains a compound represented by the following formula (4).

Formula (4)

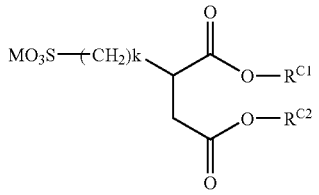

In the formula, $R^{C1}$ and $R^{C2}$ each represent an alkyl group having 4 to 22 carbon atoms or an alkylene group having 4 to 22 carbon atoms. k represents 0 or 1. M represents a cation.

In the silver halide photographic light-sensitive material of the present invention, the support preferably comprises polyester filtered through a melt filter of 5-μm mesh or smaller mesh size.

The silver halide photographic light-sensitive material of the present invention is preferably in the form of a sheet, and a multiple number of the sheet-shaped silver halide photographic light-sensitive materials can be stacked and packaged with a packaging bag to form a package. The present invention also provides such a package wherein the packaging bag has a heat-sealing portion for packaging the stack in the bag, the heat-sealing portion has a rigidity of 0.0005 N·m or more, and relative humidity in the packaging bag is 30 to 55%.

The present invention provides a silver halide photographic light-sensitive material exhibiting superior properties concerning uneven processing, transportability, and storage stability. Further, by using the package of the present invention, generation of scratches and pressure-induced fog (black peppers) in silver halide photographic light-sensitive materials can be suppressed, which is likely to occur during transportation of sheet-shaped light-sensitive materials, and high contrast and highly sensitive photographic characteristics can be expressed upon use of the silver halide photographic light-sensitive materials.

BEST MODE FOR CARRYING OUT THE INVENTION

Figure 1:
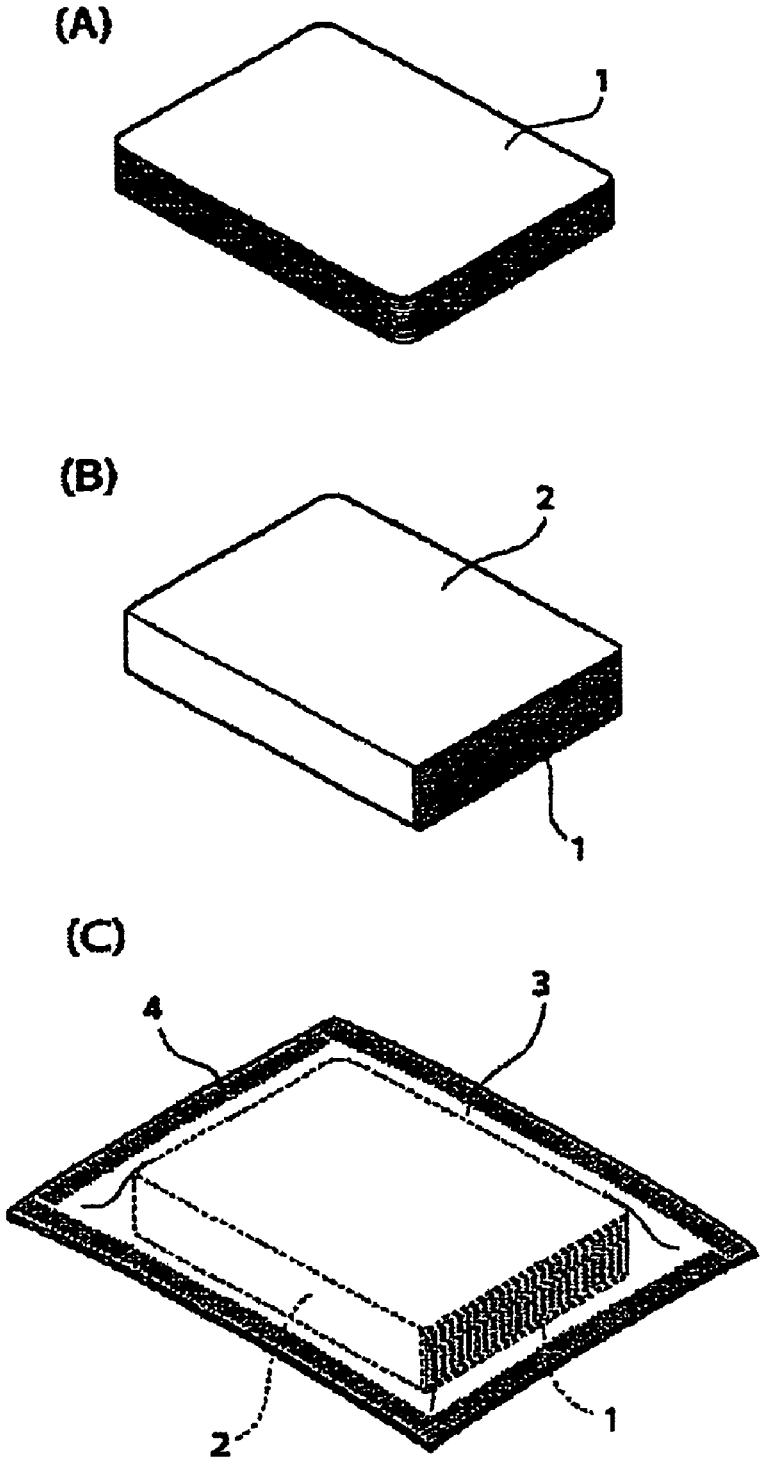
FIG. 1 includes perspective views showing an embodiment of the package of the present invention in which a stack of sheet-shaped silver halide photographic light-sensitive material is stored in a packaging bag (interior bag).

Hereafter, the silver halide photographic light-sensitive material and the package of the present invention will be explained in detail.

In the present specification, ranges indicated with "to" mean ranges including the numerical values before and after "to" as the minimum and maximum values, respectively.

First, the compounds of the following formula (1) used for the silver halide photographic light-sensitive material of the present invention will be explained in detail.

Formula (1)

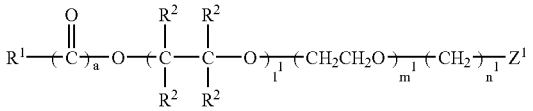

In the formula, $R^1$ represents a substituted or unsubstituted alkyl group having 6 to 25 carbon atoms or a substituted or unsubstituted alkenyl group having 6 to 25 carbon atoms, the groups of $R^2$ may be identical or different, and represent a hydrogen atom, a substituted or unsubstituted alkyl group having 1 to 14 carbon atoms, a substituted or unsubstituted alkenyl group having 1 to 14 carbon atoms, a substituted or unsubstituted aralkyl group having 7 to 20 carbon atoms or a substituted or unsubstituted aryl group having 6 to 18 carbon atoms, $l^1$ represents an integer of 1 to 10, $m^1$ represents an integer of 0 to 30, $n^1$ represents an integer of 0 to 4, and a represents 0 or 1. $Z^1$ represents $OSO_3M$ or $SO_3M$, where M represents a cation.

In the aforementioned formula (1), $R^1$ represents a substituted or unsubstituted alkyl group having 6 to 25 carbon atoms or a substituted or unsubstituted alkenyl group having 6 to 25 carbon atoms. The carbon atom number of $R^1$ is preferably 6 to 22, more preferably 6 to 20, particularly preferably 8 to 18. Although the alkyl group and alkenyl group may have a cyclic structure, an alkyl group and alkenyl group having a chain structure are more preferred. The alkyl group and alkenyl group having a chain structure may be branched. Although the alkyl group and alkenyl group may be substituted, they are preferably unsubstituted alkyl group and unsubstituted alkenyl group. The position of the double bond of the alkenyl group is not particularly limited. The alkyl group is more preferred than the alkenyl group.

In the aforementioned formula (1), $R^2$ represents a hydrogen atom, an alkyl group having 1 to 14 carbon atoms, an alkenyl group having 1 to 14 carbon atoms, an aralkyl group having 7 to 20 carbon atoms or an aryl group having 6 to 18 carbon atoms. The alkyl group and the alkenyl group preferably have 1 to 8 carbon atoms, more preferably 1 to 6 carbon atoms, particularly preferably 1 to 4 carbon atoms. The carbon atom number of the aralkyl group is preferably 7 to 13, particularly preferably 7 to 10. The carbon atom number of the aryl group is preferably 6 to 12, particularly preferably 6 to 10. The alkyl group, alkenyl group and aralkyl group may have a ring structure, or when they have a chain structure, they may be branched.

The groups represented as $R^2$ in the formula (1) may bond to each other to form a ring. For example, groups of $R^2$ bonding to adjacent carbon atoms may bond to each other to form a ring structure as an alkylene group.

Specific examples of the substituent, which the alkyl group, alkenyl group and aralkyl group represented by $R^2$ in the formula (1) may have, are mentioned below.

Examples of the substituent include a halogen atom (e.g., fluorine atom, chlorine atom, bromine atom), an alkyl group (e.g., methyl group, ethyl group, isopropyl group, n-propyl group, t-butyl group), an alkenyl group (e.g., allyl group, 2-butenyl group), an alkynyl group (e.g., propargyl group), an aralkyl group (e.g., benzyl group), an aryl group (phenyl group, naphthyl group), a hydroxyl group, an alkoxyl group (e.g., methoxy group, ethoxy group, butoxy group, ethoxyethoxy group), an aryloxy group (e.g., phenoxy group, 2-naphthyloxy group) and so forth.

In the aforementioned formula (1), $l^1$ represents an integer of 1 to 10, preferably 1 to 8, more preferably 1 to 6, particularly preferably 1 to 4. When two or more kinds of the compounds represented by the formula (1) are contained in the silver halide photographic light-sensitive material of the present invention, the average of $l^1$ is preferably 1 to 10, more preferably 1 to 8, further preferably 1 to 6, particularly preferably 1 to 4.

In the aforementioned formula (1), $m^1$ represents an integer of 1 to 30, preferably 1 to 25, more preferably 1 to 20, particularly preferably 1 to 15. When two or more kinds of the compounds represented by the formula (1) are contained in the silver halide photographic light-sensitive material of the present invention, the average of $m^1$ is preferably 1 to 30, more preferably 1 to 25, further preferably 1 to 20, particularly preferably 1 to 15.

In the aforementioned formula (1), $n^1$ represents an integer of 0 to 4, particularly preferably 2 to 4.

In the aforementioned formula (1), $Z^1$ represents $OSO_3M$ or $SO_3M$, where M represents a cation. Examples of the cation represented by M include, for example, alkali metal ions (lithium ion, sodium ion, potassium ion etc.), alkaline earth metal ions (barium ion, calcium ion etc.), ammonium ions and so forth. Among these, particularly preferred are lithium ion, sodium ion, potassium ion and ammonium ions.

In the aforementioned formula (1), a represents 0 or 1.

Specific examples of the compound represented by the aforementioned formula (1) are shown below. However, the compounds represented by the formula (1) that can be used for the present invention are not limited by the following specific examples at all.

TABLE 1

| No | $R^1$ | a | 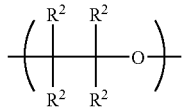 | $l^1$ | $m^1$ | $n^1$ | $Z^1$ |
|---|---|---|---|---|---|---|---|
| WX-1 | $C_6H_{13}$— | 0 | 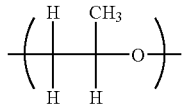 | 2 | 3 | 2 | —$SO_3Na$ |
| WX-2 | $C_6H_{13}$— | 0 | 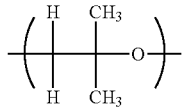 | 1 | 2 | 3 | —$SO_3Na$ |
| WX-3 | $C_6H_{13}$— | 0 | 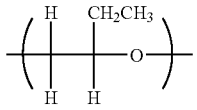 | 1 | 1 | 4 | —$SO_3Na$ |
| WX-4 | $C_8H_{17}$— | 0 | 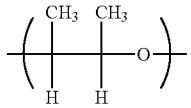 | 1 | 3 | 0 | —$SO_3Na$ |
| WX-5 | $C_8H_{17}$— | 0 | 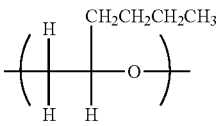 | 2 | 1 | 1 | —$SO_3Na$ |
| WX-6 | $C_8H_{17}$— | 0 | 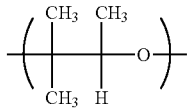 | 2 | 4 | 2 | —$SO_3Na$ |

TABLE 1-continued
| No | $R^1$ | a | 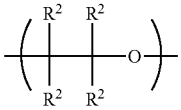 | $l^1$ | $m^1$ | $n^1$ | $Z^1$ |
|---|---|---|---|---|---|---|---|
| WX-7 | $C_{10}H_{21}$— | 0 | 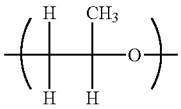 | 1 | 1 | 4 | —$SO_3Na$ |
| WX-8 | $C_{10}H_{21}$— | 0 | 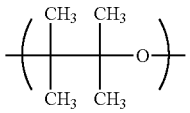 | 1 | 2 | 2 | —$SO_3Na$ |
| WX-9 | $C_{10}H_{21}$— | 0 | 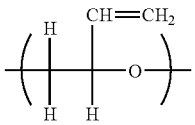 | 1 | 2 | 3 | —$SO_3Na$ |
| WX-10 | $C_{10}H_{21}$— | 0 | 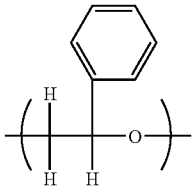 | 1 | 1 | 4 | —$SO_3K$ |
TABLE 2
| No | $R^1$ | a | 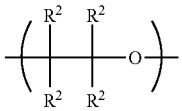 | $l^1$ | $m^1$ | $n^1$ | $Z^1$ |
|---|---|---|---|---|---|---|---|
| WX-11 | $C_{11}H_{23}$— | 0 | 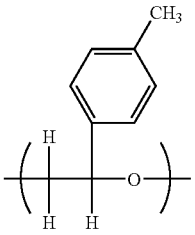 | 3 | 1 | 2 | —$SO_3Na$ |
| WX-12 | $C_{11}H_{23}$— | 0 | 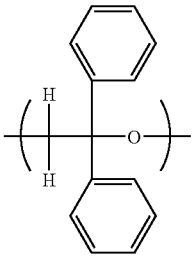 | 2 | 4 | 3 | —$SO_3Na$ |
| WX-13 | $C_{11}H_{23}$— | 0 | 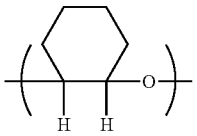 | 1 | 3 | 4 | —$SO_3Na$ |

TABLE 2-continued
| No | $R^1$ | a | 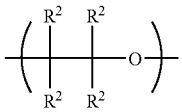 | $l^1$ | $m^1$ | $n^1$ | $Z^1$ |
|---|---|---|---|---|---|---|---|
| WX-14 | $C_{12}H_{25}$— | 0 | 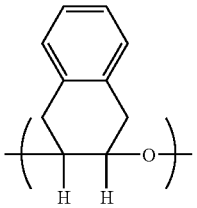 | 1 | 8 | 0 | —$SO_3Na$ |
| WX-15 | $C_{12}H_{25}$— | 0 | 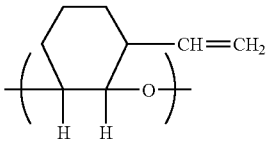 | 1 | 2 | 1 | —$SO_3Na$ |
| WX-16 | $C_{12}H_{25}$— | 0 | 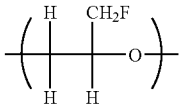 | 2 | 1 | 2 | —$SO_3Na$ |
| WX-17 | $C_{14}H_{29}$— | 0 | 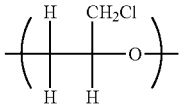 | 1 | 1 | 3 | —$SO_3Na$ |
| WX-18 | $C_{14}H_{29}$— | 0 | 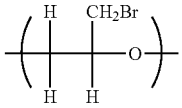 | 2 | 1 | 4 | —$SO_3Na$ |
| WX-19 | $C_{14}H_{29}$— | 0 | 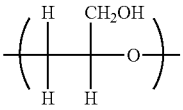 | 1 | 3 | 2 | —$SO_3Na$ |
| WS-20 | $C_{14}H_{29}$— | 0 | 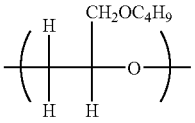 | 1 | 4 | 4 | —$SO_3NH_4$ |
TABLE 3
| No | $R^1$ | a | 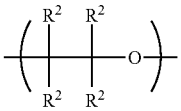 | $l^1$ | $m^1$ | $n^1$ | $Z^1$ |
|---|---|---|---|---|---|---|---|
| WX-21 | $C_{16}H_{33}$— | 1 | 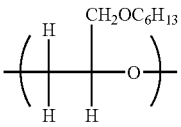 | 1 | 2 | 2 | —$SO_3Li$ |
| WX-22 | $C_{16}H_{33}$— | 1 | 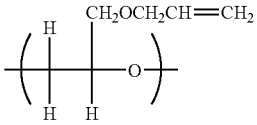 | 2 | 3 | 3 | —$SO_3K$ |

TABLE 3-continued
| No | $R^1$ | a | 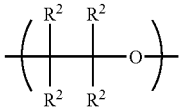 | $l^1$ | $m^1$ | $n^1$ | $Z^1$ |
|---|---|---|---|---|---|---|---|
| WX-23 | $C_{16}H_{33}$— | 1 | 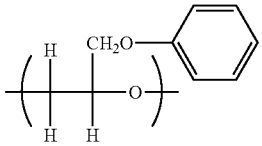 | 1 | 1 | 4 | —$SO_3Na$ |
| WX-24 | $C_{18}H_{37}$— | 1 | 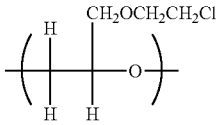 | 3 | 1 | 0 | —$SO_3Na$ |
| WX-25 | $C_{18}H_{37}$— | 1 | 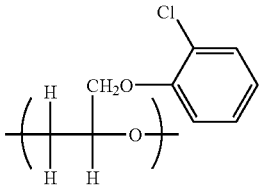 | 1 | 1 | 1 | —$SO_3Na$ |
| WX-26 | $C_{18}H_{37}$— | 1 | 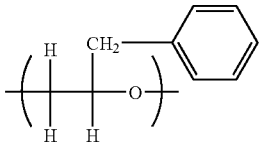 | 1 | 3 | 2 | —$SO_3Na$ |
| WX-27 | $C_{20}H_{41}$— | 1 | 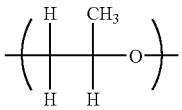 | 1 | 2 | 3 | —$SO_3Na$ |
| WX-28 | $C_{20}H_{41}$— | 1 | 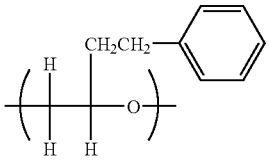 | 1 | 1 | 4 | —$SO_3Na$ |
| WX-29 | $C_{20}H_{41}$— | 1 | 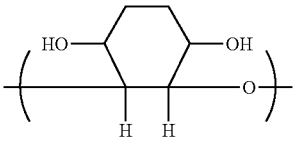 | 1 | 1 | 2 | —$SO_3Na$ |
| WX-30 | $C_{22}H_{43}$— | 1 | 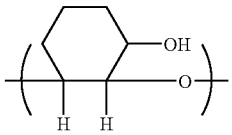 | 1 | 1 | 4 | —$SO_3NH_4$ |

TABLE 4
| No | $R^1$ | a | 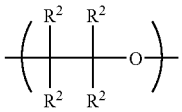 | $l^1$ | $m^1$ | $n^1$ | $Z^1$ |
|---|---|---|---|---|---|---|---|
| WX-31 | $C_{24}H_{49}$— | 0 | 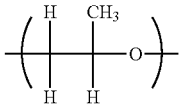 | 1 | 3 | 2 | —$SO_3Na$ |
| WX-32 | $C_{24}H_{49}$— | 0 | 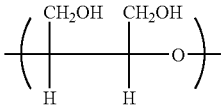 | 1 | 1 | 3 | —$SO_3Na$ |
| WX-33 | $C_{24}H_{49}$— | 0 | 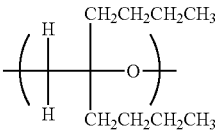 | 1 | 1 | 4 | —$SO_3Na$ |
| WX-34 | $C_{25}H_{51}$— | 0 | 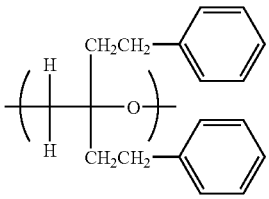 | 2 | 2 | 0 | —$SO_3Na$ |
| WX-35 | $C_{25}H_{51}$— | 0 | 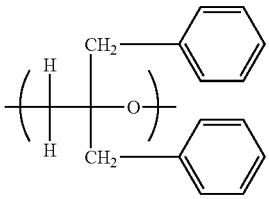 | 1 | 1 | 1 | —$SO_3Na$ |
| WX-36 | $C_{25}H_{51}$— | 0 | 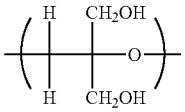 | 1 | 1 | 2 | —$SO_3Na$ |
| WX-37 | $C_6H_{13}$— | 0 | 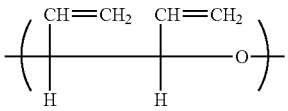 | 2 | 1 | 3 | —$SO_3Na$ |
| WX-38 | $C_6H_{13}$— | 0 | 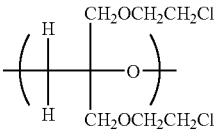 | 1 | 3 | 4 | —$SO_3Na$ |
| WX-39 | $C_6H_{13}$— | 0 | 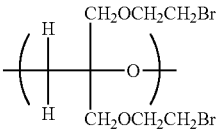 | 1 | 1 | 2 | —$SO_3Na$ |

TABLE 4-continued
| No | $R^1$ | a | 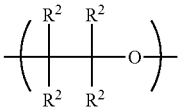 | $l^1$ | $m^1$ | $n^1$ | $Z^1$ |
|---|---|---|---|---|---|---|---|
| WX-40 | $C_7H_{15}$— | 0 | 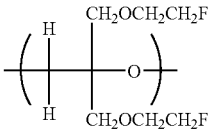 | 1 | 1 | 4 | —$SO_3NH_4$ |
TABLE 5
| No | $R^1$ | a | 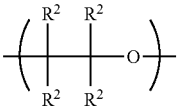 | $l^1$ | $m^1$ | $n^1$ | $Z^1$ |
|---|---|---|---|---|---|---|---|
| WX-41 | $C_7H_{15}$— | 0 | 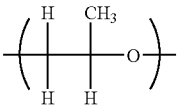 | 1 | 3 | 2 | —$SO_3Na$ |
| WX-42 | $C_8H_{17}$— | 0 | 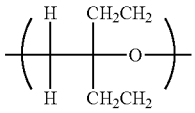 | 2 | 1 | 3 | —$SO_3K$ |
| WX-43 | $C_8H_{17}$— | 0 | 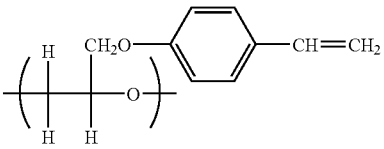 | 1 | 3 | 4 | —$SO_3Na$ |
| WX-44 | $C_8H_{17}$— | 0 | 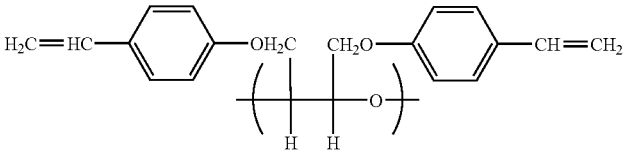 | 1 | 1 | 0 | —$SO_3Na$ |
| WX-45 | $C_9H_{19}$— | 0 | 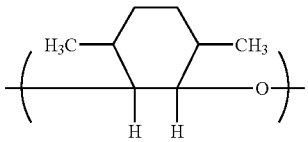 | 1 | 1 | 1 | —$SO_3Na$ |
| WX-46 | $C_9H_{19}$— | 0 | 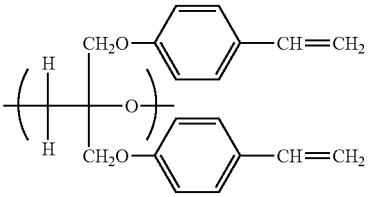 | 2 | 1 | 2 | —$SO_3Na$ |
| WX-47 | $C_9H_{19}$— | 0 | 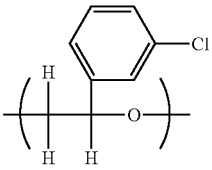 | 1 | 4 | 3 | —$SO_3Na$ |

TABLE 5-continued

| No | $R^1$ | a | 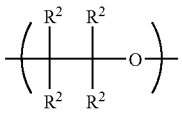 | $l^1$ | $m^1$ | $n^1$ | $Z^1$ |
|---|---|---|---|---|---|---|---|
| WX-48 | $C_{11}H_{23}$— | 0 | 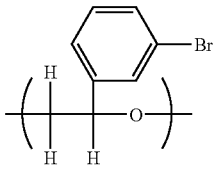 | 1 | 8 | 4 | —$SO_3Na$ |
| WX-49 | $C_{16}H_{33}$— | 0 | 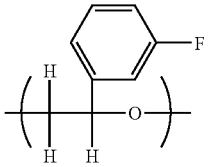 | 1 | 1 | 2 | —$SO_3Na$ |
| WX-50 | $C_{18}H_{37}$— | 0 | 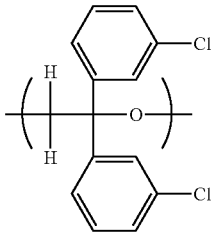 | 1 | 1 | 4 | —$SO_3NH_4$ |

The compounds represented by the aforementioned formula (1) can be synthesized by known methods described in JP-A-2001-3263, J. Amer. Chem. Soc., 65, 2196 (1943), J. Phys. Chem., 90, 2413 (1986), J. Dispersion Sci. and Tech., 4, 361 (1983), U.S. Pat. No. 5,602,087 and so forth.

As for specific synthesis examples of the compounds represented by the formula (1), Synthesis Examples 1 and 2 described in Japanese Patent Application No. 2002-235913 can be referred to.

Hereafter, the fluorine compounds that can be used for the present invention will be explained in detail. Preferred examples of the fluorine compounds include the compounds represented by the following formulas (2A) to (2D).

Hereafter, the formulas (2A) to (2D) will be explained in detail.

Formula (2A)

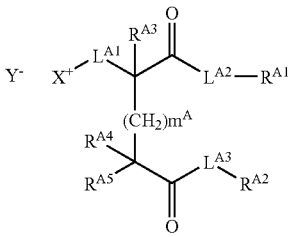

In the formula, $R^{A1}$ and $R^{A2}$ each represent a substituted or unsubstituted alkyl group, provided that at least one of $R^{A1}$ and $R^{A2}$ represents an alkyl group substituted with one or more fluorine atoms. $R^{A3}$, $R^{A4}$ and $R^{A5}$ each independently represent a hydrogen atom or a substituent, $L^{A1}$, $L^{A2}$ and $L^{A3}$ each independently represent a single bond or a divalent bridging group, and $X^+$ represents a cationic substituent. $Y^-$ represents a counter anion, provided that $Y^-$ may not be present when the intramolecular charge is 0 without $Y^-$. $m^A$ is 0 or 1.

In the aforementioned formula (2A), $R^{A1}$ and $R^{A2}$ each represent a substituted or unsubstituted alkyl group. The alkyl group contains one or more carbon atoms and may be a straight, branched or cyclic alkyl group. Examples of the substituent include a halogen atom, an alkenyl group, an aryl group, an alkoxyl group, a carboxylic acid ester group, a carbonamido group, a carbamoyl group, an oxycarbonyl group, a phosphoric acid ester group and so forth. However, at least one of $R^{A1}$ and $R^{A2}$ represents an alkyl group substituted with one or more fluorine atoms (an alkyl group substituted with one or more fluorine atoms is referred to as "Rf" hereinafter).

Rf is an alkyl group having one or more carbon atoms and substituted with at least one fluorine atom. It is sufficient that Rf should be substituted with at least one fluorine atom, and it may have any of straight, branched and cyclic structures. It may be further substituted with a substituent other than fluorine atom or substituted with only a fluorine atom or atoms. Examples of the substituent of Rf other than fluorine atom include an alkenyl group, an aryl group, an alkoxyl group, a halogen atom other than fluorine, a carboxylic acid ester group, a carboneamido group, a carbamoyl group, an oxycarbonyl group, a phosphoric acid ester group and so forth.

Rf is preferably a fluorine-substituted alkyl group having preferably 1 to 16 carbon atoms, more preferably 1 to 12 carbon atoms, further preferably 4 to 10 carbon atoms. Preferred examples of Rf include the followings.

—$(CH_2)_2$—$(CF_2)_4F$, —$(CH_2)_2$—$(CF_2)_6F$,
—$(CH_2)_2$—$(CF_2)_8F$, —$CH_2$—$(CF_2)_4H$, $—CH_2—(CF_2)_6H$, $—CH_2—(CF_2)_8H$,
$—(CH_2)_3—(CF_2)_4F$, $—(CH_2)_6—(CF_2)_4F$,
$—CH(CF_3)—CF_3$

Rf is more preferably an alkyl group having 4 to 10 carbon atoms and substituted with a trifluoromethyl group at its end, particularly preferably an alkyl group having 3 to 10 carbon atoms represented as $—(CH_2)_\alpha—(CF_2)_\beta F$ ($\alpha$ represents an integer of 1 to 6, and $\beta$ represents an integer of 3 to 8). Specific examples thereof include the followings.

$—CH_2—(CF_2)_2F$, $—(CH_2)_6—(CF_2)_4F$,
$—(CH_2)_3—(CF_2)_4F$, $—CH_2—(CF_2)_3F$,
$—(CH_2)_2—(CF_2)_4F$, $—(CH_2)_6—(CF_2)_4F$,
$—(CH_2)_2—(CF_2)_6F$, $—(CH_2)_3—(CF_2)_6F$

Among these, $—(CH_2)_2—(CF_2)_4F$ and $—(CH_2)_2—(CF_2)_6F$ are particularly preferred.

In the aforementioned formula (2A), it is preferred that both of $R^{A1}$ and $R^{A2}$ represent Rf.

When $R^{A1}$ and $R^{A2}$ represent an alkyl group other than Rf, i.e., an alkyl group that is not substituted with a fluorine atom, the alkyl group is preferably a substituted or unsubstituted alkyl group having 1 to 24 carbon atoms, more preferably a substituted or unsubstituted alkyl group having 6 to 24 carbon atoms. Preferred examples of the unsubstituted alkyl group having 6 to 24 carbon atoms include n-hexyl group, n-heptyl group, n-octyl group, tert-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, eicosyl group, 2-octyldodecyl, docosyl group, tetracosyl group, 2-decyltetradecyl group, tricosyl group, cyclohexyl group, cycloheptyl group and so forth. Further, preferred examples of the substituted alkyl group having a total carbon number of 6 to 24 include 2-hexenyl group, oleyl group, linoleyl group, linolenyl group, benzyl group, β-phenethyl group, 2-methoxyethyl group, 4-phenylbutyl group, 4-acetoxyethyl group, 6-phenoxyhexyl group, 12-phenyldodecyl group, 18-phenyloctadecyl group, 12-(p-chlorophenyl) dodecyl group, 2-(diphenyl phosphate)ethyl group and so forth.

The alkyl group other than Rf represented by $R^{A1}$ or $R^{A2}$ is more preferably a substituted or unsubstituted alkyl group having 6 to 18 carbon atoms. Preferred examples of the unsubstituted alkyl group having 6 to 18 carbon atoms include n-hexyl group, cyclohexyl group, n-heptyl group, n-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, 4-tert-butylcyclohexyl group and so forth. Further, preferred examples of the substituted alkyl group having a total carbon number of 6 to 18 include phenethyl group, 6-phenoxyhexyl group, 12-phenyldodecyl group, oleyl group, linoleyl group, linolenyl group and so forth.

The alkyl group other than Rf represented by $R^{A1}$ or $R^{A2}$ is particularly preferably n-hexyl group, cyclohexyl group, n-heptyl group, n-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, oleyl group, linoleyl group or linolenyl group, most preferably a straight, cyclic or branched unsubstituted alkyl group having 8 to 16 carbon atoms.

In the aforementioned formula (2A), $R^{A3}$, $R^{A4}$ and $R^{A5}$ each independently represent a hydrogen atom or a substituent. As the substituent, Substituent T described later may be used. $R^{A3}$, $R^{A4}$ and $R^{A5}$ preferably represent an alkyl group or a hydrogen atom, more preferably an alkyl group having 1 to 12 carbon atoms or a hydrogen atom, further preferably methyl group or a hydrogen atom, particularly preferably a hydrogen atom.

In the aforementioned formula (2A), $L^{A1}$ and $L^{A2}$ each independently represent a single bond or a divalent bridging group. Although it is not particularly limited so long as it is a single bond or a divalent bridging group, it is preferably an arylene group, —O—, —S—, $—NR^{A100}—$ ($R^{A100}$ represents a hydrogen atom or a substituent, and the substituent may be any of the groups exemplified later as Substituent T. $R^{A100}$ is preferably an alkyl group, the group Rf mentioned above or a hydrogen atom, more preferably a hydrogen atom) or a group consisting a combination of these groups, more preferably —O—, —S— or $—NR^{A100}—$. $L^{A1}$ and $L^{A2}$ more preferably represent —O— or $—NR^{A100}—$, further preferably —O— or —NH—, particularly preferably —O—.

In the aforementioned formula (2A), $L^{A3}$ represents a single bond or a divalent bridging group. Although the divalent bridging group is not particularly limited, it is preferably an alkylene group, an arylene group, —C(=O)—, —O—, —S—, —S(=O)—, $—S(=O)_2—$, $—NR^{A100}—$ ($R^{A100}$ represents a hydrogen atom or a substituent, the substituent may be any of the groups exemplified later as Substituent T, and $R^{A100}$ is preferably an alkyl group or a hydrogen atom, more preferably a hydrogen atom) or a group consisting a combination of these groups, more preferably an alkylene group having 1 to 12 carbon atoms, an arylene group 6 to 12 carbon atoms, —C(=O)—, —O—, —S—, —S(=O)—, $—S(=O)_2—$, $—NR^{A100}—$ or a group consisting a combination of the foregoing groups. $L^{A3}$ is more preferably an alkylene group having 1 to 8 carbon atoms, —C(=O)—, —O—, —S—, —S(=O)—, $—S(=O)_2—$, $—NR^{A100}—$ or a group consisting a combination of these groups, and examples thereof include the followings.

$—(CH_2)_2—S—$, $—(CH_2)_2—NH—$, $—(CH_2)_3—NH—$,
$—(CH_2)_2—C(=O)—NH—$, $—(CH_2)_2—S—CH_2—$,
$—(CH_2)_2—NHCH_2—$, $—(CH_2)_3—NH—CH_2—$

In the aforementioned formula (2A), $X^+$ represents a cationic substituent, preferably an organic cationic substituent, more preferably an organic cationic substituent containing a nitrogen or phosphorus atom. It is further preferably a pyridinium cation or ammonium cation group, and it is particularly preferably a trialkylammonium cation group represented by the following formula (3).

Formula (3)

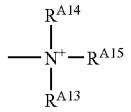

In the aforementioned formula (3), $R^{13A}$, $R^{14A}$ and $R^{15A}$ each independently represent a substituted or unsubstituted alkyl group. As the substituent, those exemplified later as Substituent T can be used. Further, if possible, $R^{13A}$, $R^{14A}$ and $R^{15A}$ may bond to each other to form a ring. $R^{13A}$, $R^{14A}$ and $R^{15A}$ preferably represent an alkyl group having 1 to 12 carbon atoms, more preferably an alkyl group having 1 to 6 carbon atoms, further preferably methyl group or ethyl group, particularly preferably methyl group.

In the aforementioned formula (3), $Y^-$ represents a counter anion, and it may be an inorganic anion or an organic anion. When the charge is 0 within the molecule without $Y^-$, there may not be $Y^-$. The inorganic anion is preferably iodide ion, bromide ion, chloride ion or the like, and the organic ion is preferably p-toluenesulfonate ion, benzenesulfonate ion or the like. $Y^-$ is more preferably iodide ion, p-toluenesulfonate ion, or benzenesulfonate ion, particularly preferably p-toluenesulfonate ion.

In the aforementioned formula (2A), $m^A$ represents 0 or 1, preferably 0.

Among the compounds represented by the aforementioned formula (2A), compounds represented by the following formula (2A-1) are preferred.

Formula (2A-1)

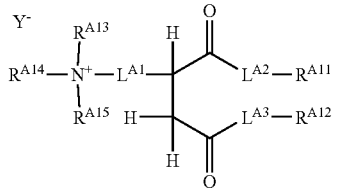

In the formula (2A-1), $R^{A11}$ and $R^{A12}$ each represent a substituted or unsubstituted alkyl group, provided that at least one of $R^{A11}$ and $R^{A12}$ represents an alkyl group substituted with one or more fluorine atoms, and the total carbon atom number of $R^{A11}$ and $R^{A12}$ is 19 or less. $L^{A2}$ and $L^{A3}$ each independently represent —O—, —S— or —$NR^{100}$— where $R^{100}$ represents a hydrogen atom or a substituent, and $L^{A1}$ represents a single bond or a divalent bridging group. $L^{A1}$ and $Y^-$ have the same meanings as defined in the aforementioned formula (2A), respectively, and preferred ranges thereof are also the same as those explained for them in the formula (2A). $R^{13A}$, $R^{14A}$ and $R^{15A}$ have the same meanings as defined in the aforementioned formula (3), respectively, and preferred ranges thereof are also the same as those explained for them in the formula (3).

In the formula (2A-1), $L^{A2}$ and $L^{A3}$ each represent —O—, —S— or —$NR^{100}$— ($R^{A100}$ represents a hydrogen atom or a substituent, and the substituent may be any of the groups exemplified later as Substituent T. $R^{100}$ is preferably an alkyl group, the aforementioned Rf or a hydrogen atom, more preferably a hydrogen atom). $L^{A2}$ and $L^{A3}$ more preferably represent —O— or —NH—, further preferably —O—.

In the aforementioned formula (2A-1), $R^{A11}$ and $R^{21}$ have the same meanings as $R^{A1}$ and $R^{A2}$ in the formula (2A-1), respectively, and the preferred ranges thereof are also the same as those of $R^{A1}$ and $R^{A2}$. However, the total carbon atom number of $R^{A11}$ and $R^{21}$ is 19 or less.

Among the compounds represented by the aforementioned formula (2), compounds represented by the following formula (2A-2) are more preferred.

Formula (2A-2)

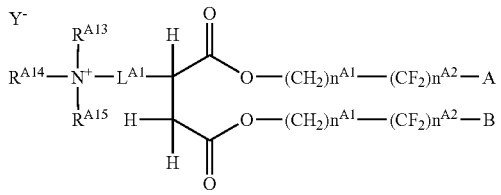

In the aforementioned formula (2A-2), $R^{13}A$, $R^{14}A$, $R^{15}A$, $L^{A1}$ and $Y^-$ have the same meanings as those mentioned in the formulas (2A) and (3), and preferred ranges thereof are also the same. A and B each independently represent a fluorine atom or a hydrogen atom. It is preferred that both of A and B represent a fluorine atom or both of A and B represent a hydrogen atom, and it is more preferred that both of A and B represent a fluorine atom. In the formula (2A-2), $n^{A1}$ represents an integer of 1 to 6, and $n^{A2}$ represents an integer of 3 to 8.

Among the compounds represented by the aforementioned formula (2A), compounds represented by the following formula (2A-3) are further preferred.

Formula (2A-3)

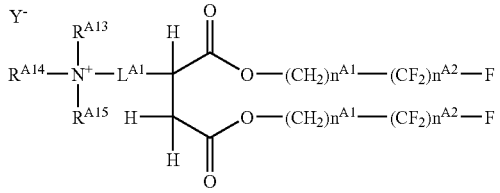

In the formula (2A-3), $n^{A1}$ represents an integer of 1 to 6, and $n^{A2}$ represents an integer of 3 to 8, provided that $2(n^{A1}+n^{A2})$ is 19 or less. $R^{13A}$, $R^{14A}$, $R^{15A}$, $L^{A1}$ and $Y^-$ have the same meanings as those mentioned in the formulas (2A) and (3), and preferred ranges thereof are also the same.

$n^{A1}$ represents an integer of 1 to 6, preferably an integer of 1 to 3, further preferably 2 or 3, most preferably 2. $n^{A2}$ represents an integer of 3 to 8, more preferably 3 to 6, further preferably 4 to 6. As for preferred combination of $n^{A1}$ and $n^{A2}$, it is preferred that $n^{A1}$ should be 2 or 3, and $n^{A2}$ should be 4 or 6.

Specific examples of the compounds represented by the aforementioned formula (2A) are mentioned below. However, the compounds represented by the formula (2A) that can be used for the present invention are not limited by the following specific examples at all. The alkyl groups and perfluoroalkyl groups mentioned in the structures of the following exemplary compounds have straight chain structures unless otherwise indicated.

FS-101

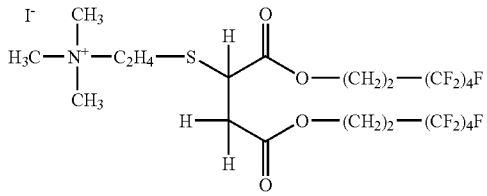

FS-102

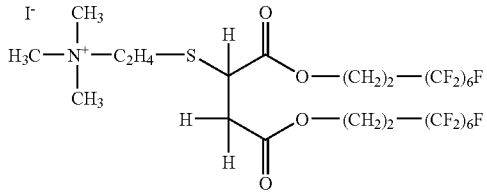

-continued
FS-103
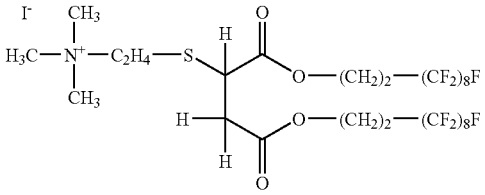
FS-104
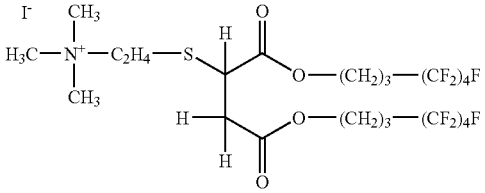
FS-105
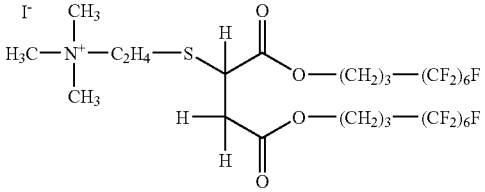
FS-106
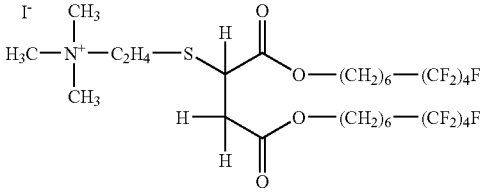
FS-107
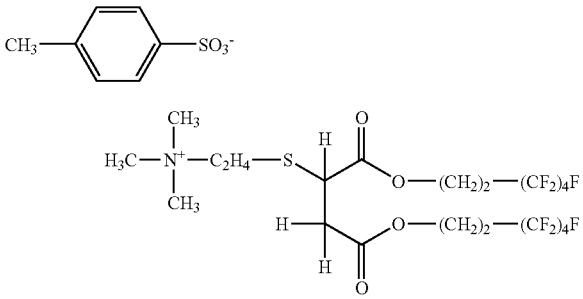
FS-108
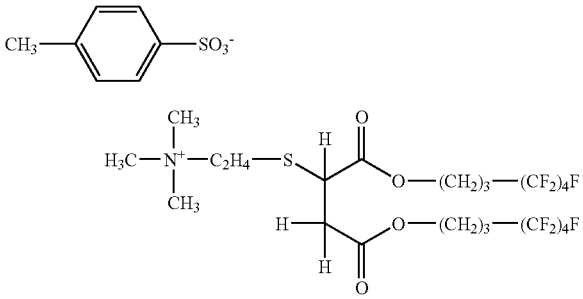
-continued
FS-109
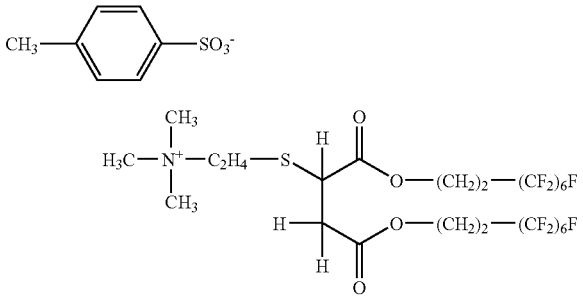
FS-110
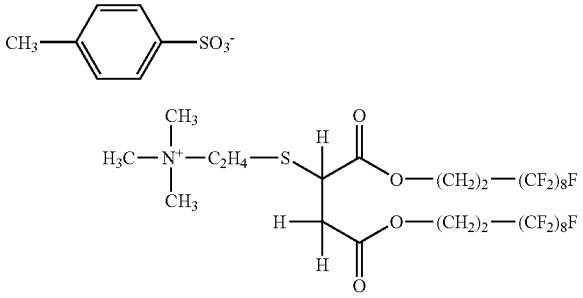
FS-111
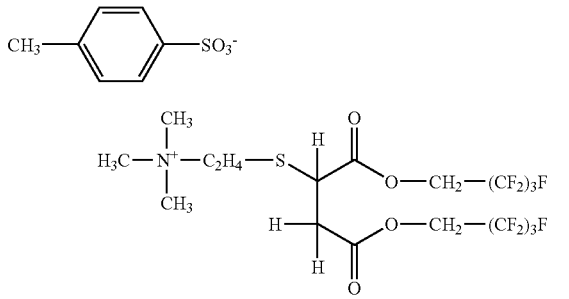
FS-112
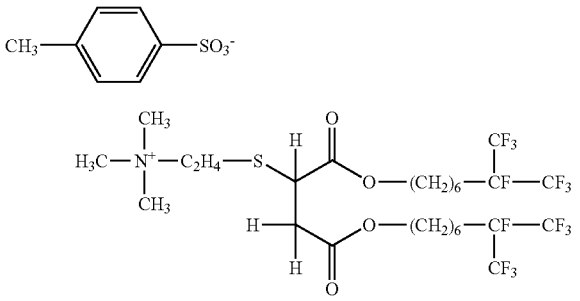
FS-125
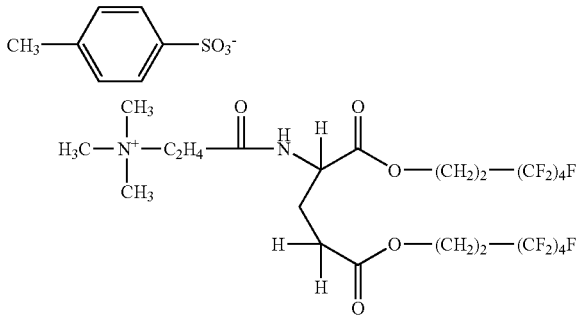

-continued
FS-126
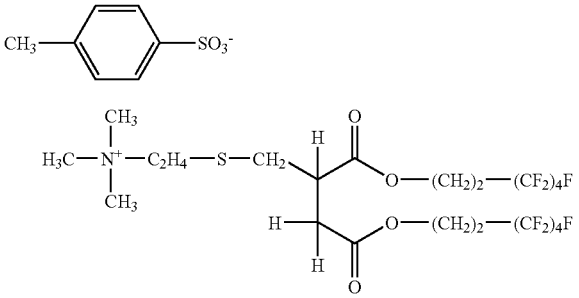
FS-127
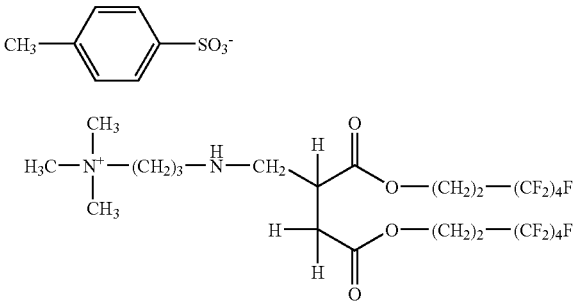
FS-128
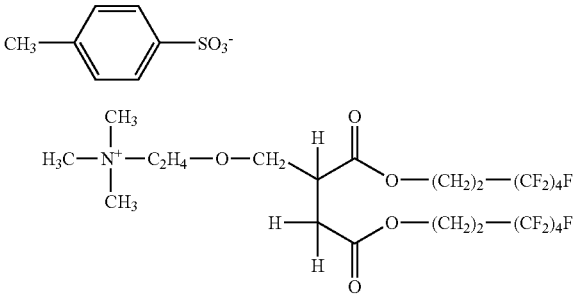
FS-129
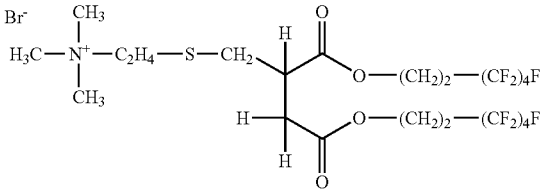
FS-130
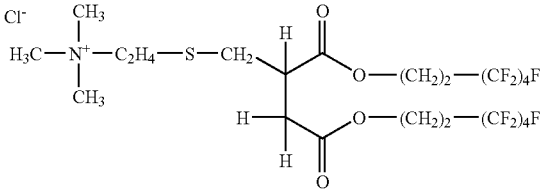
-continued
FS-131
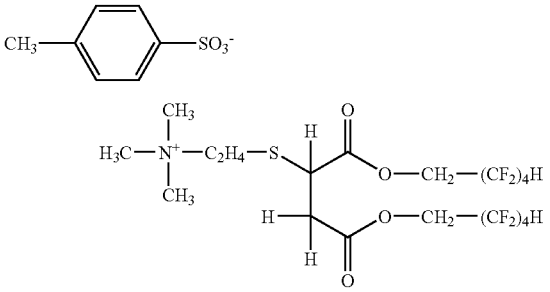
FS-132
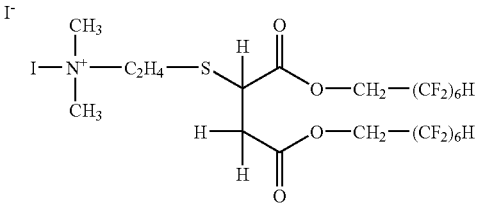
FS-133
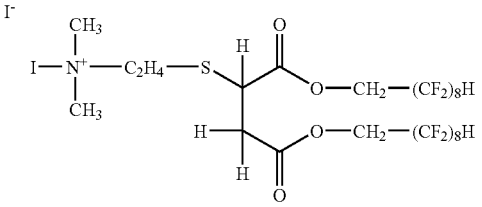
FS-134
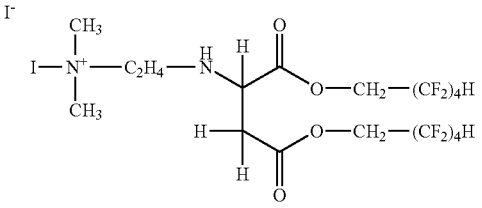
FS-135
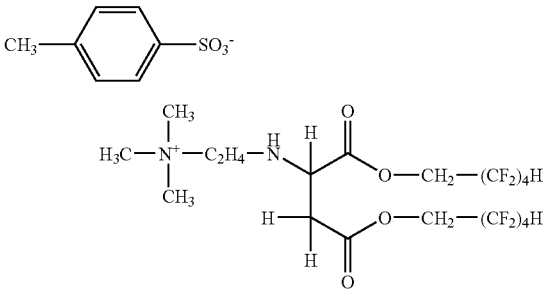

-continued
FS-136
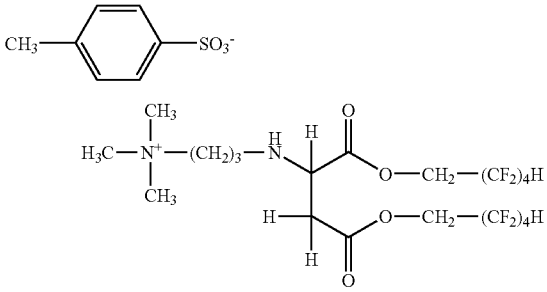
FS-137
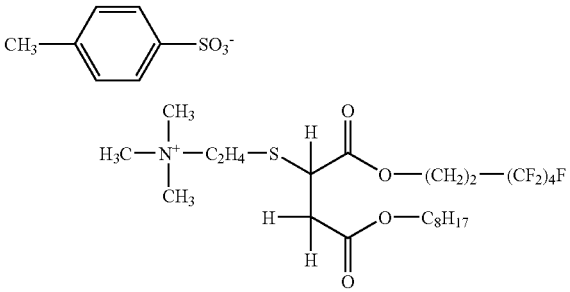
FS-138
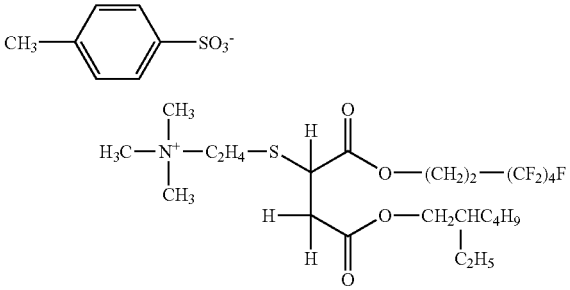
FS-139
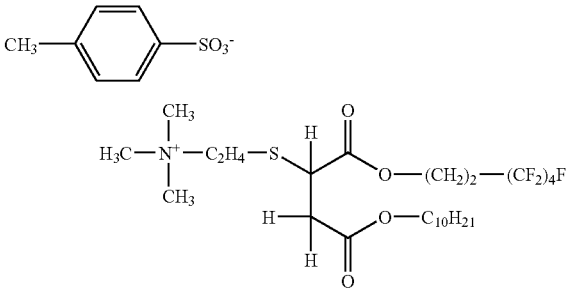
FS-140
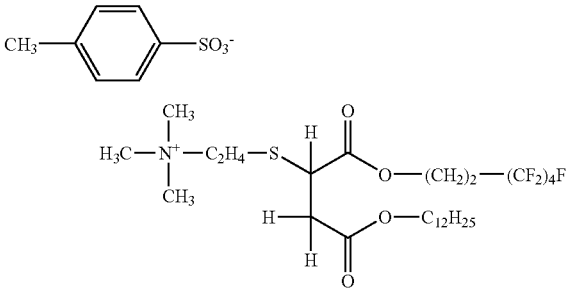
-continued
FS-141
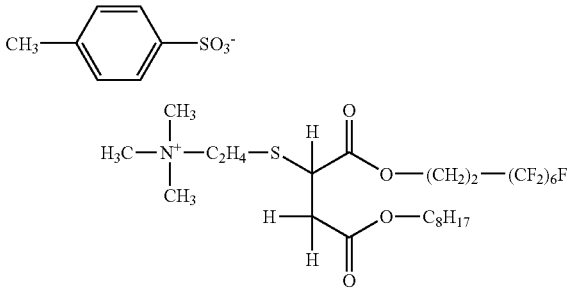
FS-142
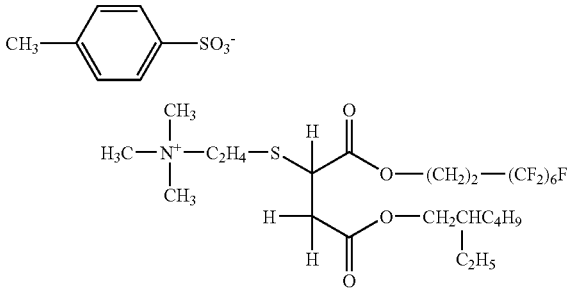
FS-143
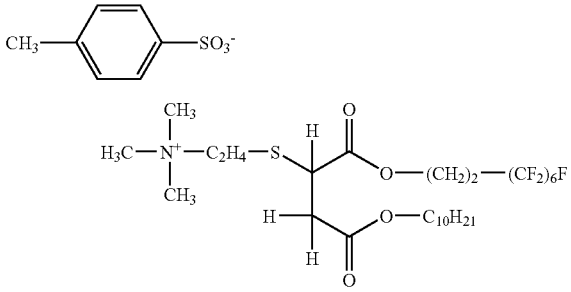
FS-144
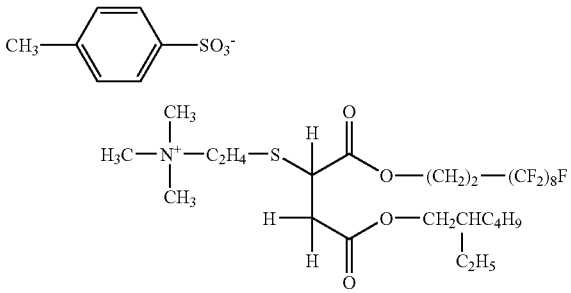
FS-145
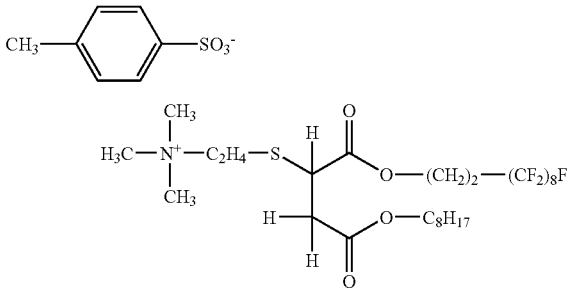

-continued
FS-146
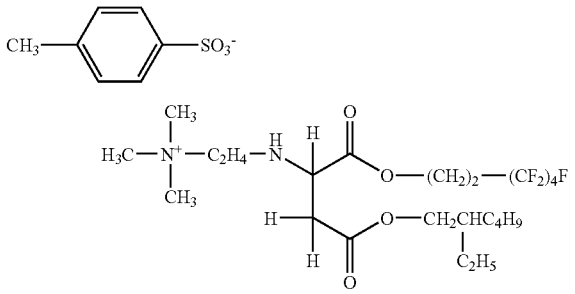
FS-147
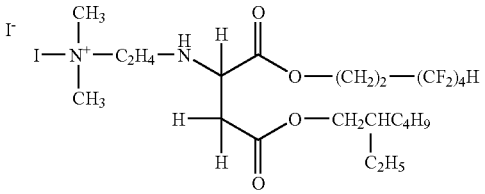
FS-148
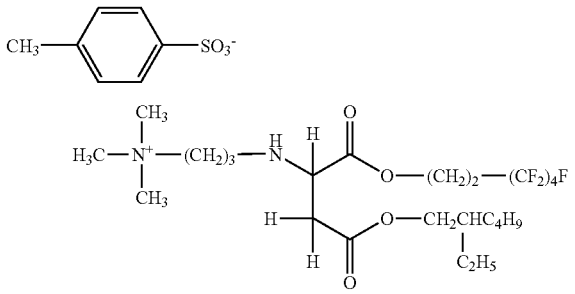
FS-149
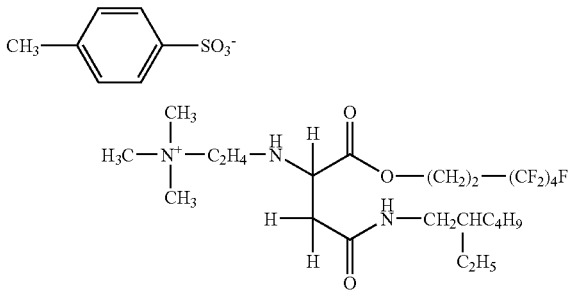
FS-150
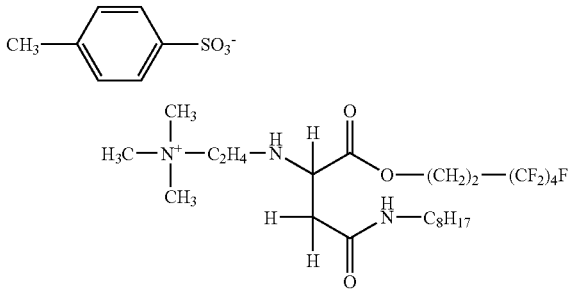
-continued
FS-151
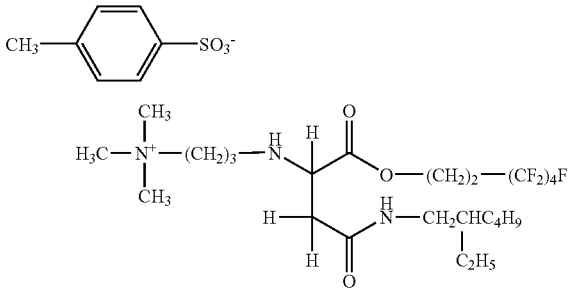
FS-152
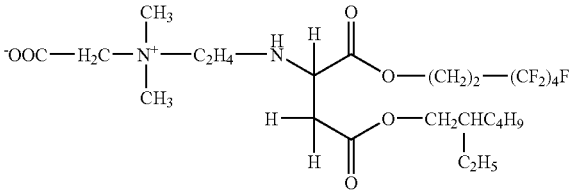
FS-153
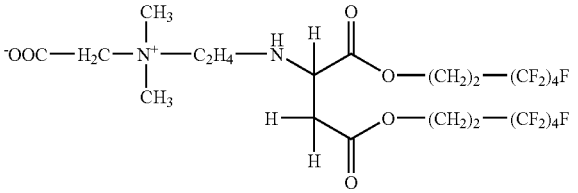
FS-154
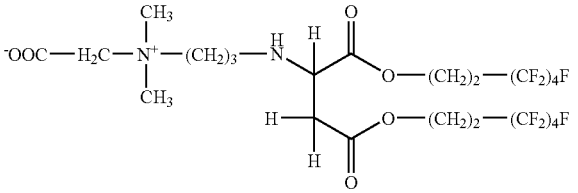
FS-155
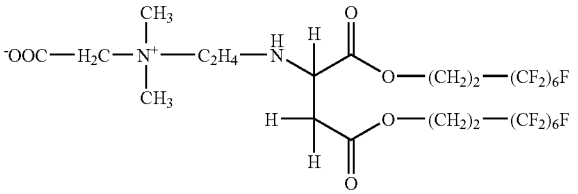
FS-156
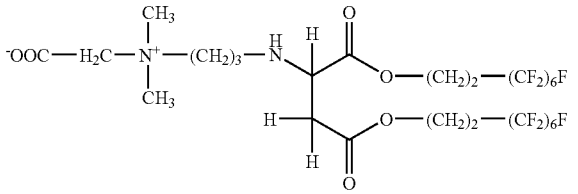

-continued
FS-157
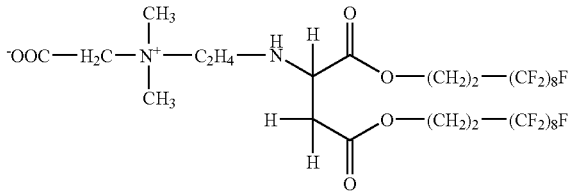
FS-158
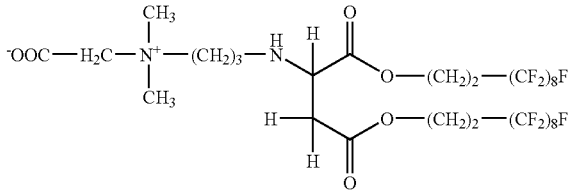
FS-159
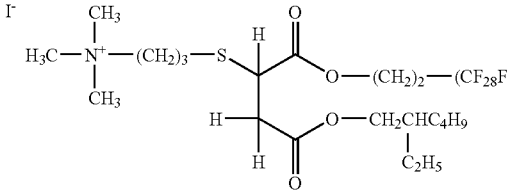
FS-160
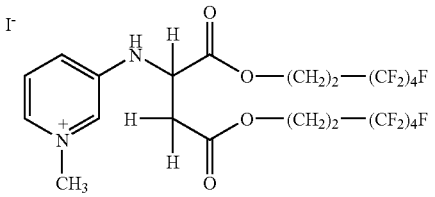
FS-161
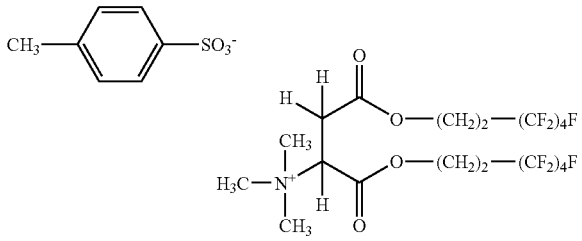
FS-162
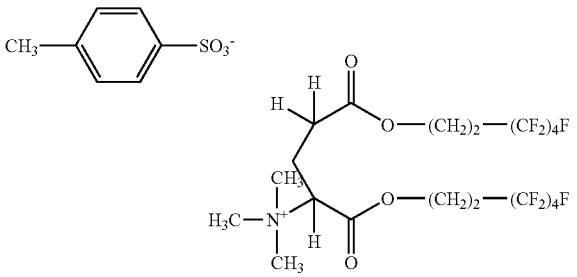
-continued
FS-163
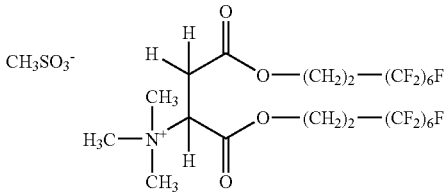
FS-164
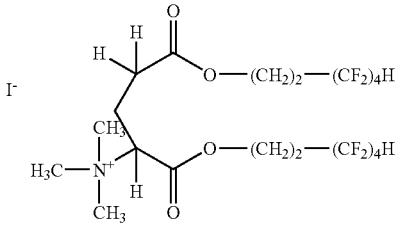
FS-165
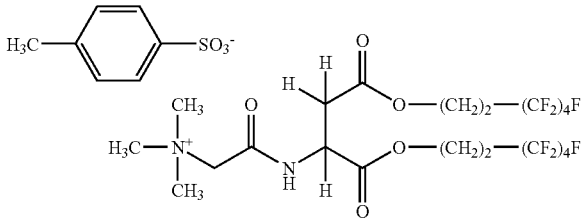
FS-166
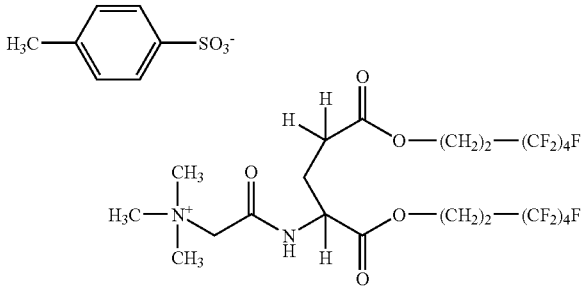
FS-167
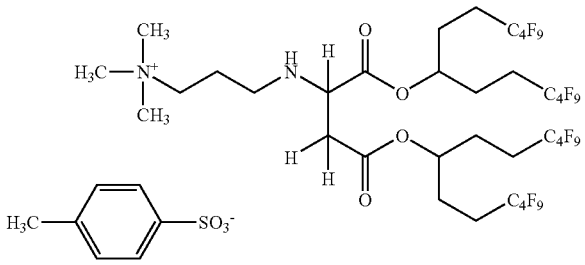
FS-168
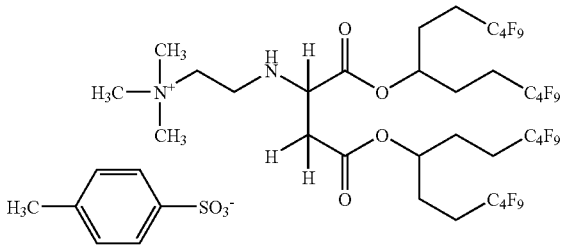

-continued
FS-170
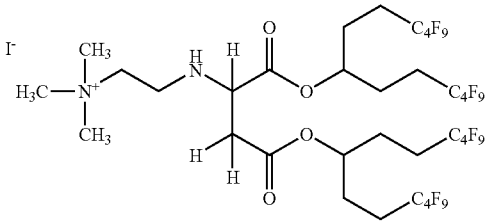
FS-171
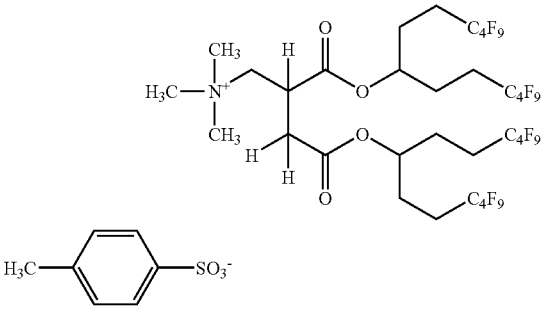
FS-113
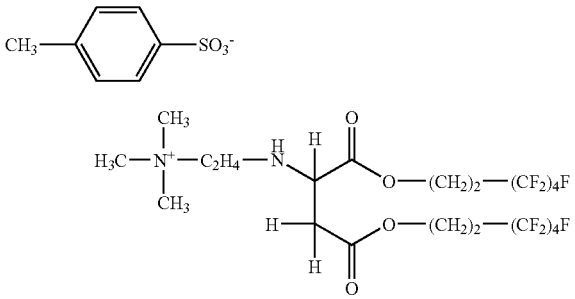
FS-114
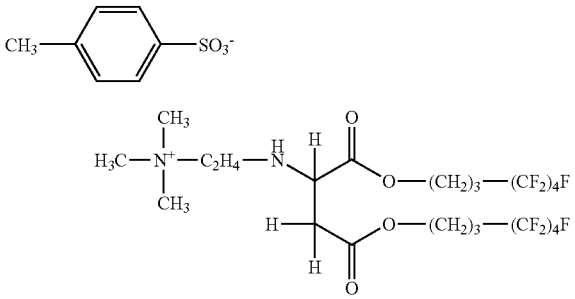
FS-115
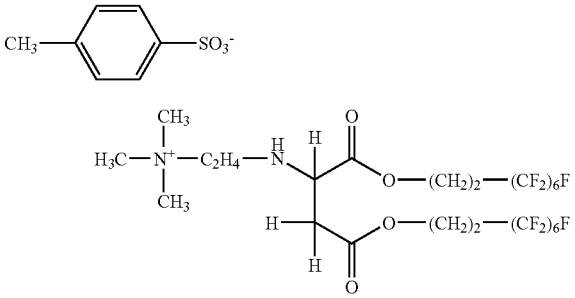
-continued
FS-116
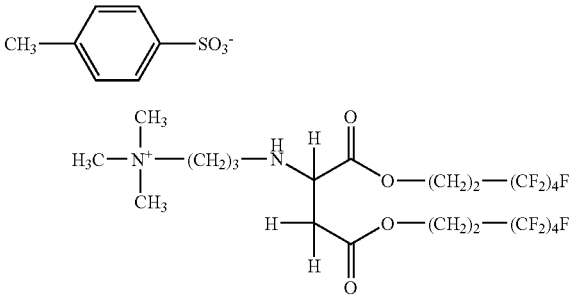
FS-117
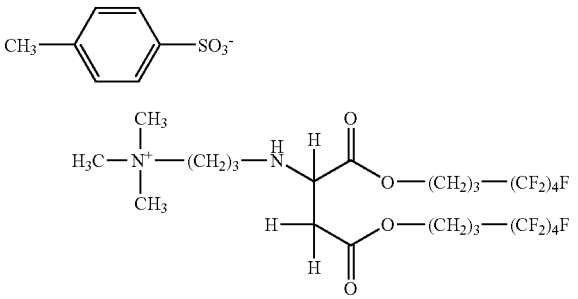
FS-118
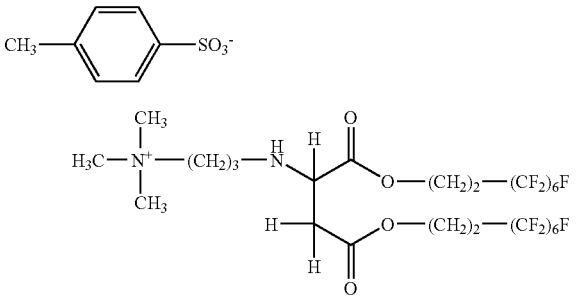
FS-119
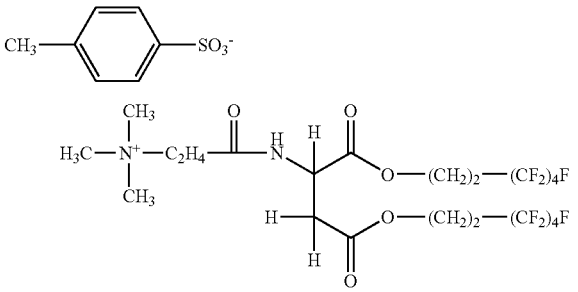
FS-120
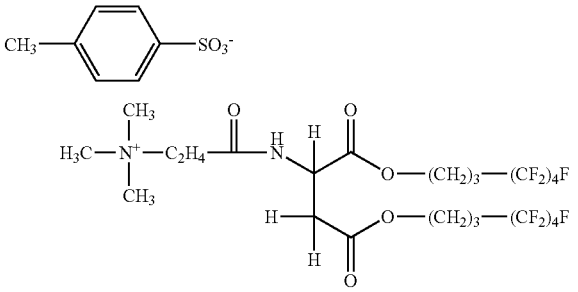

-continued

FS-121

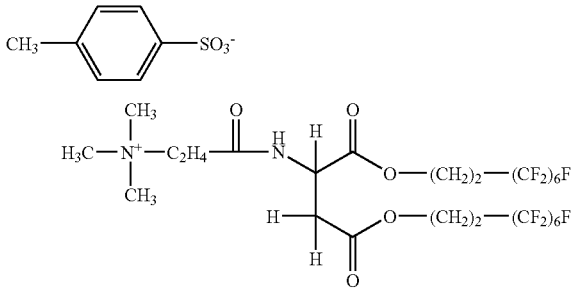

FS-122

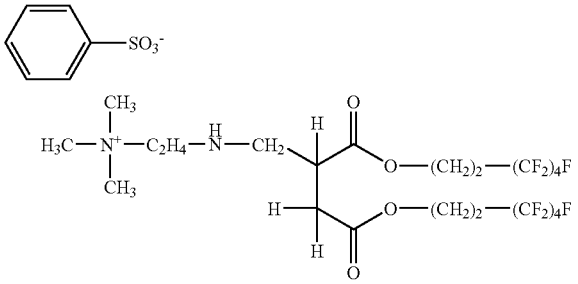

FS-123

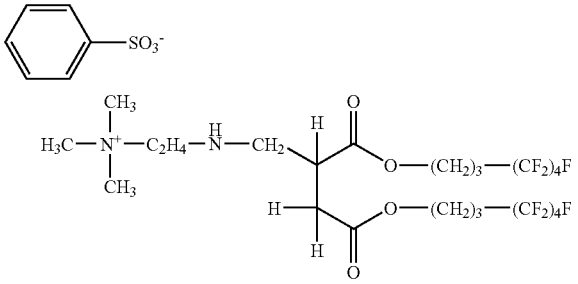

FS-124

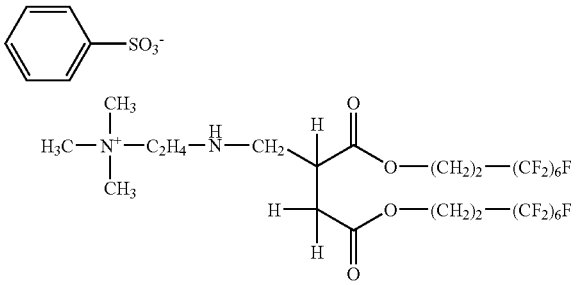

The compounds represented by the aforementioned formula (2A) can be synthesized from a fumaric acid derivative, maleic acid derivative, itaconic acid derivative, glutamic acid derivative, aspartic acid derivative or the like. For example, when a fumaric acid derivative, maleic acid derivative or itaconic acid derivative is used as a raw material, they can be synthesized by performing the Michael addition reaction for a double bond of the raw material using a nucleophilic species and then making the product into a cation using an alkylating agent.

As for specific synthesis examples of the compounds represented by the formula (2A), Synthesis Example 3 described in Japanese Patent Application No. 2002-235913 can be referred to.

Hereafter, the compound represented by the following formula (2B) will be explained in detail.

Formula (2B)

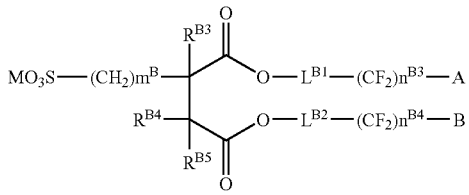

In the aforementioned formula (2B), $R^{B3}$, $R^{B4}$ and $R^{B5}$ each independently represent a hydrogen atom or a substituent. A and B each independently represent a fluorine atom or a hydrogen atom. $n^{B3}$ and $n^{B4}$ each independently represent an integer of 4 to 8. $L^{B1}$ and $L^{B2}$ each independently represent a substituted or unsubstituted alkylene group, a substituted or unsubstituted alkyleneoxy group or a divalent bridging group consisting of a combination of these. $m^B$ represents 0 or 1. M represents a cation.

In the aforementioned formula (2B), $R^{B3}$, $R^{B4}$ and $R^{B5}$ each independently represent a hydrogen atom or a substituent. As the substituent, Substituent T described later may be used. $R^{B3}$, $R^{B4}$ and $R^{B5}$ preferably represent an alkyl group or a hydrogen atom, more preferably an alkyl group having 1 to 12 carbon atoms or a hydrogen atom, further preferably methyl group or a hydrogen atom, particularly preferably a hydrogen atom.

In the aforementioned formula (2B), A and B each independently represent a fluorine atom or a hydrogen atom. It is preferred that both of A and B represent a fluorine atom or both of A and B represent a hydrogen atom, and it is more preferred that both of A and B represent a fluorine atom.

In the aforementioned formula (2B), $n^{B3}$ and $n^{B4}$ each independently represent an integer of 4 to 8. It is preferred that $n^{B3}$ and $n^{B4}$ represent an integer of 4 to 6 and $n^{B3}=n^{B4}$ and it is more preferred that $n^{B3}$ and $n^{B4}$ represent an integer of 4 or 6 and $n^{B3}=n^{B4}$ further preferably $n^{B3}=n^{B4}=4$.

In the aforementioned formula (2B), $m^B$ represents 0 or 1, and the both are similarly preferred.

In the aforementioned formula (2B), $L^{B1}$ and $L^{B2}$ each independently represent a substituted or unsubstituted alkylene group, a substituted or unsubstituted alkyleneoxy group or a divalent bridging group consisting of a combination of these. As the substituent, Substituent T described later may be used. $L^{B1}$ and $L^{B2}$ each preferably have 4 or less carbon atoms, and preferably represent an unsubstituted alkylene group.

M represents a cation and has the same meaning as M mentioned in the aforementioned formula (1). M is preferably lithium ion, sodium ion, potassium ion or ammonium ion, more preferably lithium ion, sodium ion or potassium ion, further preferably sodium ion.

Among the compounds represented by the aforementioned formula (2B), compounds represented by the following formula (2B-1) are preferred.

Formula (2B-1)

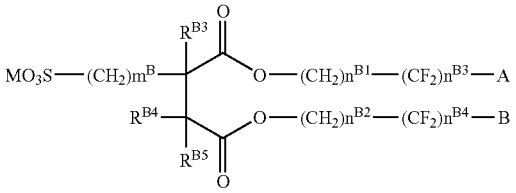

In the aforementioned formula (2B-1), $R^{B3}$, $R^{B4}$, $R^{B5}$, $n^{B3}$, $n^{B4}$, $m^{B}$, A, B and M have the same meanings as those defined in the aforementioned formula (2B), and the preferred ranges are also the same. $n^{B1}$ and $n^{B2}$ each independently represent an integer of 1 to 6.

In the aforementioned formula (2B-1), $n^{B1}$ and $n^{B2}$ each independently represent an integer of 1 to 6. It is preferred that $n^{B1}$ and $n^{B2}$ represents an integer of 1 to 6 and $n^{B1}=n^{B2}$, it is more preferred that $n^{B1}$ and $n^{B2}$ represents an integer of 2 or 3 and $n^{B1}=n^{B2}$, and it is still more preferred that $n^{B1}=n^{B2}=2$.

Among the compounds represented by the aforementioned formula (2B), compounds represented by the following formula (2B-2) are more preferred.

Formula (2B-2)

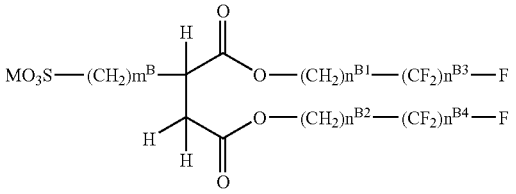

In the aforementioned formula (2B-2), $n^{B3}$, $n^{B4}$, $m^{B}$ and M have the same meanings as those defined in the aforementioned formula (2B), and the preferred ranges are also the same. In the aforementioned formula (2B-2), $n^{B1}$ and $n^{B2}$ have the same meanings as those defined in the aforementioned formula (2B), and the preferred ranges are also the same.

Among the compounds represented by the aforementioned formula (2B), compounds represented by the following formula (2B-3) are still more preferred.

Formula (2B-3)

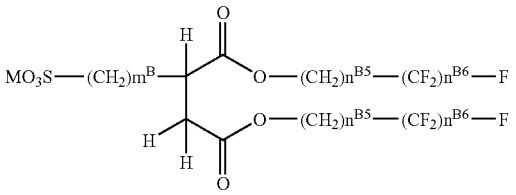

In the aforementioned formula (2B-3), $n^{B5}$ represents 2 or 3, and $n^{B6}$ represents an integer of 4 to 6. $m^{B}$ represents 0 or 1, and the both are similarly preferred. M has the same meaning as M mentioned in the aforementioned formula (2B), and the preferred range is also the same.

Specific examples of the compounds represented by the aforementioned formula (2B) are shown below. However, the compounds represented by the formula (2B) that can be used for the present invention are not limited by the following specific examples at all.

FS-201

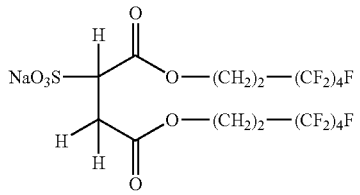

FS-207

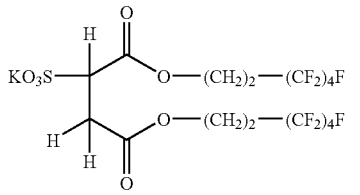

FS-202

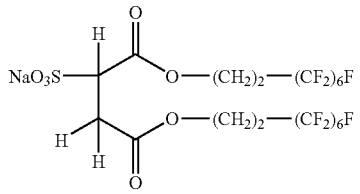

FS-208

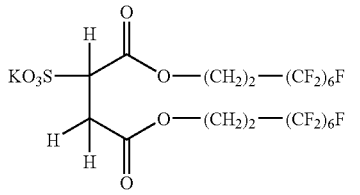

FS-203

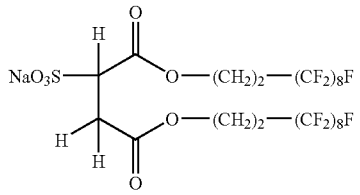

FS-209

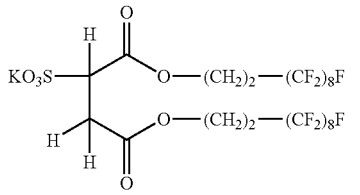

FS-204

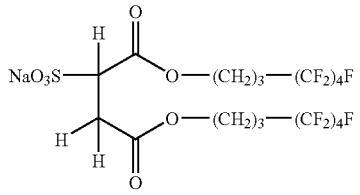

-continued
FS-210
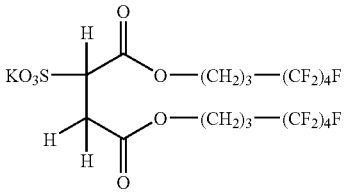
FS-205
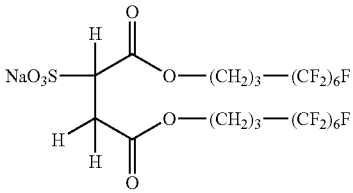
FS-211
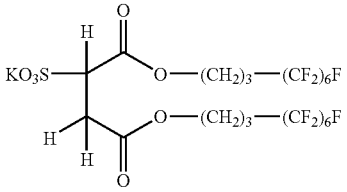
FS-206
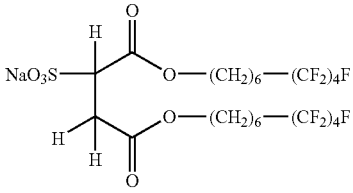
FS-212
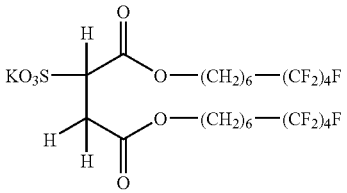
FS-213
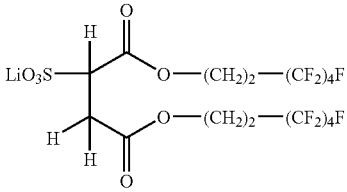
FS-219
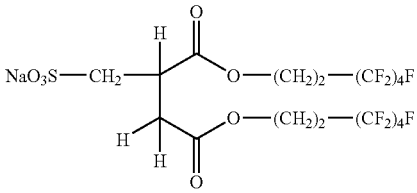
FS-214
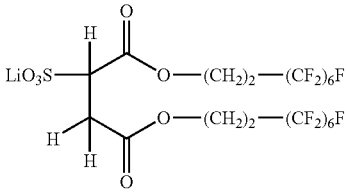
-continued
FS-220
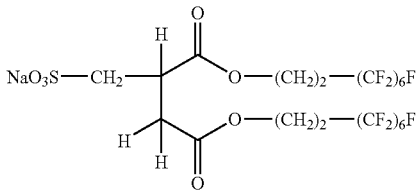
FS-215
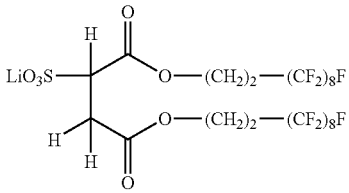
FS-221
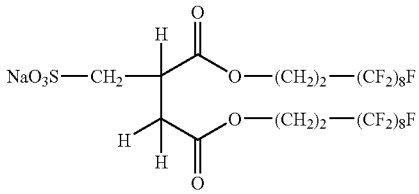
FS-216
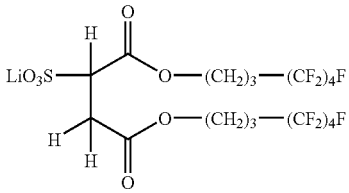
FS-222
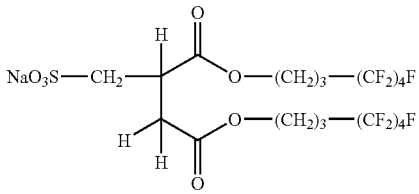
FS-217
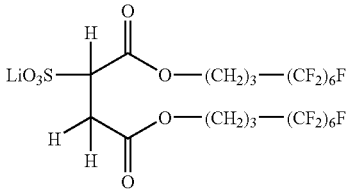
FS-223
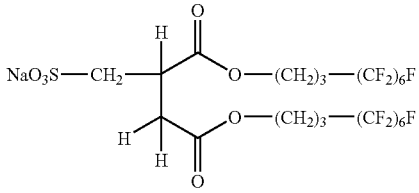
FS-218
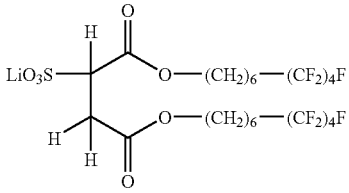

-continued
FS-224
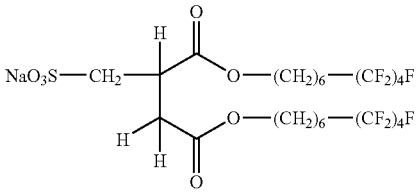
FS-225
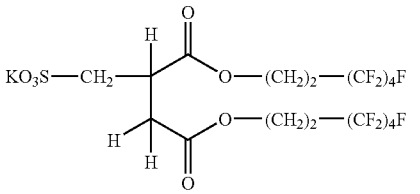
FS-230
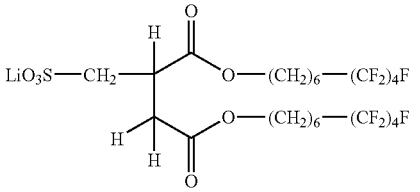
FS-226
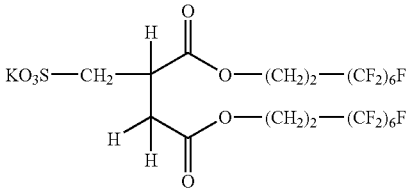
FS-231
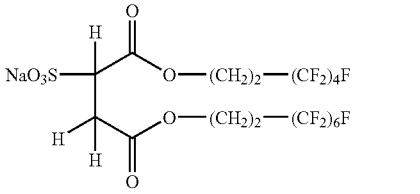
FS-227
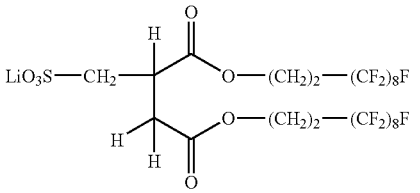
FS-232
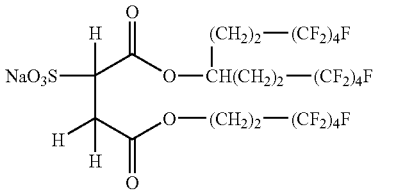
FS-228
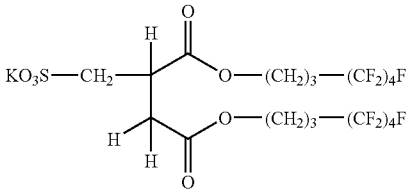
-continued
FS-233
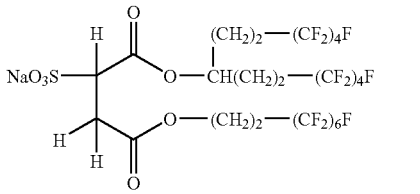
FS-229
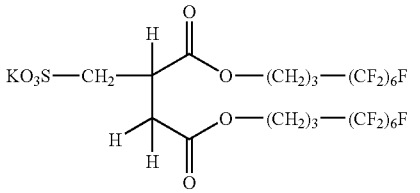
FS-234
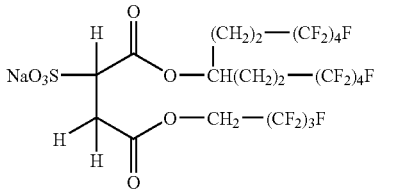
FS-235
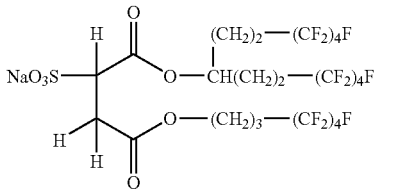
FS-238
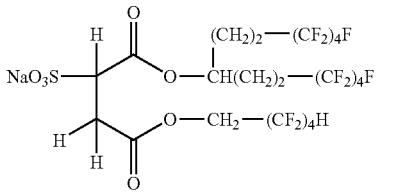
FS-236
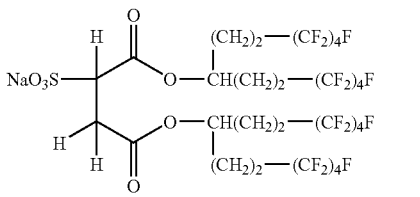
FS-239
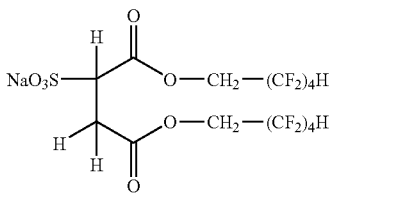
FS-237
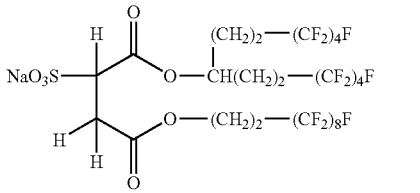

-continued

FS-240

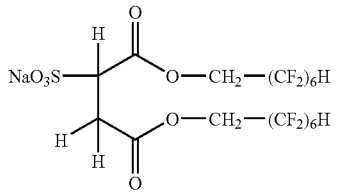

The compounds represented by the aforementioned formula (2B) can be easily synthesized by combining a usual esterification reaction and a sulfonation reaction. Moreover, the counter cation can easily be changed by using an ion exchange resin. As for specific example of typical synthetic method, Synthesis Example 4 described in Japanese Patent Application No. 2002-235913 can be referred to.

Hereafter, the compounds represented by the following formula (2C) will be explained in detail.

Formula (2C)

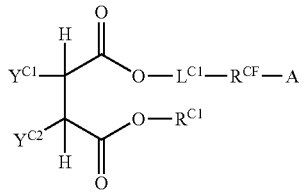

In the aforementioned formula (2C), $R^{C1}$ represents a substituted or unsubstituted alkyl group, and $R^{CF}$ represents a perfluoroalkylene group. A represents a hydrogen atom or a fluorine atom, and $L^{C1}$ represents a substituted or unsubstituted alkylene group, a substituted or unsubstituted alkyleneoxy group or a divalent bridging group consisting of a combination of these. One of $Y^{C1}$ and $Y^{C2}$ represents a hydrogen atom, and the other represents $—L^{C2}—SO_3M$, where M represents a cation. $L^{C2}$ represents a single bond or a substituted or unsubstituted alkylene group.

In the aforementioned formula (2C), $R^{C1}$ represents a substituted or unsubstituted alkyl group. The substituted or unsubstituted alkyl group represented by $R^{C1}$ may be linear or branched, and may have a cyclic structure. As the substituent, Substituent T described later can be used. The substituent is preferably an alkenyl group, an aryl group, an alkoxyl group, a halogen atom (preferably Cl), a carboxylic acid ester group, a carbonamido group, a carbamoyl group, an oxycarbonyl group, a phosphoric acid ester group or the like.

$R^{C1}$ is preferably an unsubstituted alkyl group, more preferably an unsubstituted alkyl group having 2 to 24 carbon atoms, further preferably an unsubstituted alkyl group having 4 to 20 carbon atoms, particularly preferably an unsubstituted alkyl group having 6 to 24 carbon atoms.

$R^{CF}$ represents a perfluoroalkylene group. The perfluoroalkylene group used herein means an alkylene group all of which hydrogen atoms are replaced with fluorine atoms. The perfluoroalkylene group may be straight or branched, or it may have a cyclic structure. $R^{CF}$ preferably has 1 to 10 carbon atoms, more preferably 1 to 8 carbon atoms.

A represents a hydrogen atom or a fluorine atom, preferably a fluorine atom.

$L^{C1}$ represents a substituted or unsubstituted alkylene group, a substituted or unsubstituted alkyleneoxy group or a divalent bridging group consisting of a combination of these. The preferred range of the substituent is the same as that of the substituent mentioned for $R^{C1}$. $L^{C1}$ preferably has 4 or less carbon atoms, and it is preferably an unsubstituted alkylene group.

One of $Y^{C1}$ and $Y^{C2}$ represents a hydrogen atom, and the other represents $—L^{C2}—SO_3M$, where M represents a cation. Examples of the cation represented by M include, for example, alkali metal ions (lithium ion, sodium ion, potassium ion etc.), alkaline earth metal ions (barium ion, calcium ion etc.), ammonium ions and so forth. Among these, more preferred are lithium ion, sodium ion, potassium ion and ammonium ions, and still more preferred are lithium ion, sodium ion and potassium ion. It can be suitably selected depending on the total carbon atom number, substituents, branching degree and so forth of the alkyl group of the compounds of the formula (2C). When the total carbon atom number of $R^{C1}$, $R^{CF}$ and $L^{C1}$ is 16 or more, M is preferably lithium ion in view of compatibility of solubility (especially for water) and antistatic property or coatability for uniform coating. $L^{C2}$ represents a single bond or a substituted or unsubstituted alkylene group. The preferred range of the substituent is the same as that of the substituent for $R^{C1}$. $L^{C2}$ is preferably a single bond or an alkylene group having 2 or less carbon atoms, more preferably a single bond or an unsubstituted alkylene group, further preferably a single bond or methylene group, particularly preferably a single bond.

Among the compounds represented by the aforementioned formula (2C), compounds represented by the following formula (2C-1) are preferred.

Formula (2C-1)

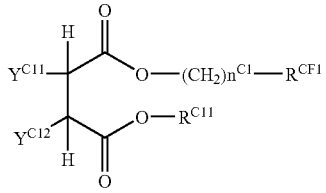

In the aforementioned formula (2C-1), $R^{C11}$ represents a substituted or unsubstituted alkyl group having 6 or more carbon atoms. $R^{CF1}$ represents a perfluoroalkyl group having 6 or less carbon atoms. One of $Y^{C11}$ and $Y^{C12}$ represents a hydrogen atom, and the other represents $SO_3M^C$, where $M^C$ represents a cation. $n^{C1}$ represents an integer of 1 or more.

In the aforementioned formula (2C-1), $R^{C11}$ represents a substituted or unsubstituted alkyl group having 6 or more carbon atoms in total. However, $R^{C11}$ is not an alkyl group substituted with a fluorine atom. The substituted or unsubstituted alkyl group represented by $R^{C11}$ may be linear or branched, or may have a cyclic structure. Examples of the substituent include an alkenyl group, an aryl group, an alkoxyl group, a halogen atom other than fluorine, a carboxylic acid ester group, a carbonamido group, a carbamoyl group, an oxycarbonyl group, a phosphoric acid ester group and so forth.

The substituted or unsubstituted alkyl group represented by $R^{C11}$ preferably has 6 to 24 carbon atoms in total. Preferred examples of the unsubstituted alkyl group having 6 to 24 carbon atoms include n-hexyl group, n-heptyl group, n-octyl group, tert-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, eicosyl group, 2-octyldodecyl group, docosyl group, tetracosyl group, 2-decyltetradecyl group, tricosyl group, cyclohexyl group, cycloheptyl group and so forth. Further, preferred examples of the substituted alkyl group having 6 to 24 carbon atoms in total including carbon atoms of substituent include 2-hexenyl group, oleyl group, linoleyl group, linolenyl group, benzyl group, β-phenethyl group, 2-methoxyethyl group, 4-phenylbutyl group, 4-acetoxyethyl group, 6-phenoxyhexyl group, 12-phenyldodecyl group, 18-phenyloctadecyl group, 12-(p-chlorophenyl)dodecyl group, 2-(diphenyl phosphate)ethyl group and so forth.

The substituted or unsubstituted alkyl group represented by $R^{C11}$ more preferably has 6 to 18 carbon atoms in total. Preferred examples of the unsubstituted alkyl group having 6 to 18 carbon atoms include n-hexyl group, cyclohexyl group, n-heptyl group, n-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, 4-tert-butylcyclohexyl group and so forth. Further, preferred examples of the substituted alkyl group having 6 to 18 carbon atoms in total including carbon atoms of substituent include phenethyl group, 6-phenoxyhexyl group, 12-phenyldodecyl group, oleyl group, linoleyl group, linolenyl group and so forth. Among these, $R^{C11}$ is more preferably n-hexyl group, cyclohexyl group, n-heptyl group, n-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, oleyl group, linoleyl group or linolenyl group, particularly preferably a linear, cyclic or branched unsubstituted alkyl group having 8 to 16 carbon atoms.

In the aforementioned formula (2C-1), $R^{CF1}$ represents a perfluoroalkyl group having 6 or less carbon atoms. The perfluoroalkyl group used herein means an alkyl group all of which hydrogen atoms are replaced with fluorine atoms. The alkyl group in the perfluoroalkyl group may be linear or branched, or it may have a cyclic structure. Examples of the perfluoroalkyl group represented by $R^{CF1}$ include, for example, trifluoromethyl group, pentafluoroethyl group, heptafluoro-n-propyl group, heptafluoroisopropyl group, nonafluoro-n-butyl group, undecafluoro-n-pentyl group, tridecafluoro-n-hexyl group, undecafluorocyclohexyl group and so forth. Among these, perfluoroalkyl groups having 2 to 4 carbon atoms (e.g., pentafluoroethyl group, heptafluoro-n-propyl group, heptafluoroisopropyl group, nonafluoro-n-butyl group etc.) are preferred, and heptafluoro-n-propyl group and nonafluoro-n-butyl group are particularly preferred.

In the aforementioned formula (2C-1), $n^{C1}$ represents an integer of 1 or more. It is preferably an integer of 1 to 4, particularly preferably 1 or 2. Further, as for the combination of $n^{C1}$ and $R^{CF1}$, when $n^{C1}=1$, $R^{CF1}$ is preferably heptafluoro-n-propyl group or nonafluoro-n-butyl-group; and when $n^{C1}=2$, $R^{CF1}$ is more preferably nonafluoro-n-butyl group.

In the aforementioned formula (2C-1), one of $Y^{C11}$ and $Y^{C12}$ represents a hydrogen atom, and the other represents $SO_3M^C$, where $M^C$ represents a cation. Examples of the cation represented by $M^C$ include, for example, alkali metal ions (lithium ion, sodium ion, potassium ion etc.), alkaline earth metal ions (barium ion, calcium ion etc.), ammonium ions and so forth. Among these, particularly preferred are lithium ion, sodium ion, potassium ion and ammonium ions, and most preferred is sodium ion.

Specific examples of the compounds represented by the aforementioned formula (2C) are shown below. However, the compounds represented by the formula (2C) that can be used for the present invention are not limited by the following specific examples at all.

FS-301

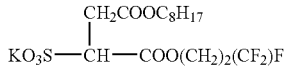

FS-307

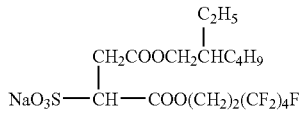

FS-302

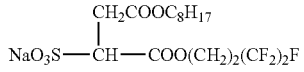

FS-308

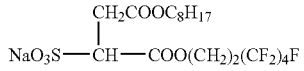

FS-303

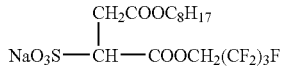

FS-309

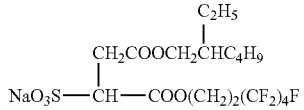

FS-304

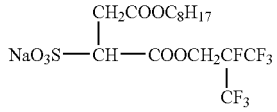

FS-310

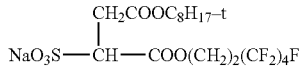

FS-305

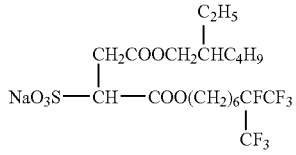

FS-311

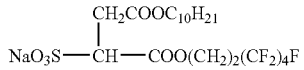

FS-306

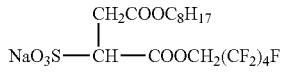

FS-312

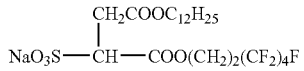

FS-313

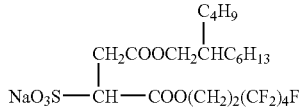

FS-319

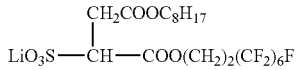

FS-314

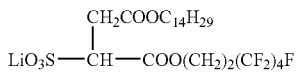

-continued

FS-320

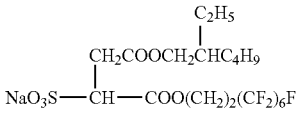

FS-315

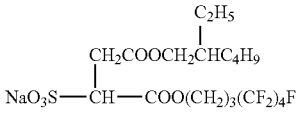

FS-321

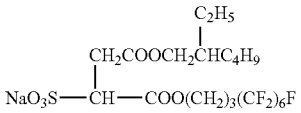

FS-316

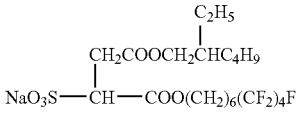

FS-322

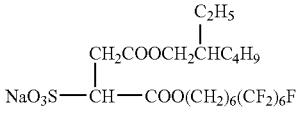

FS-317

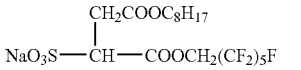

FS-323

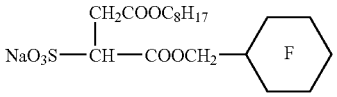

FS-318

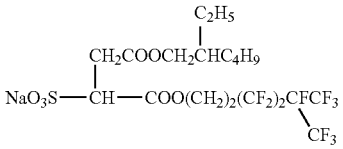

FS-324

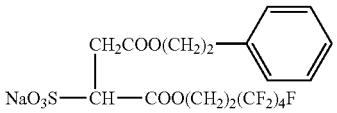

FS-325

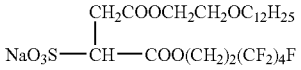

FS-329

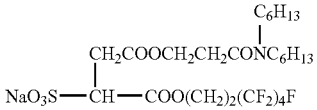

FS-326

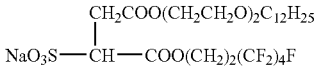

FS-330

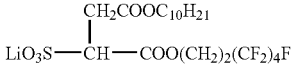

FS-327

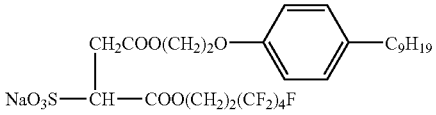

-continued

FS-331

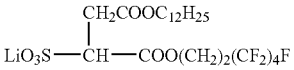

FS-328

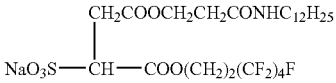

FS-332

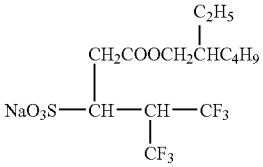

FS-333

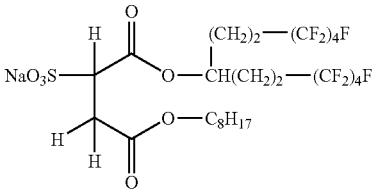

FS-335

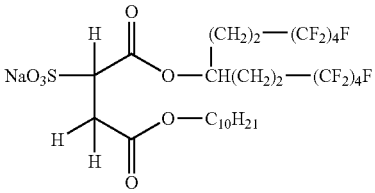

FS-334

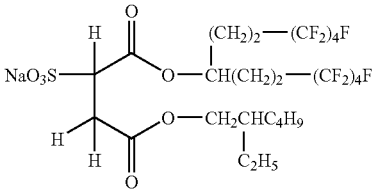

The compounds represented by the aforementioned formula (2C) can be easily synthesized by successively performing monoesterification reaction, acid halide formation, esterification reaction and sulfonation reaction using usual maleic anhydride or the like as a raw material. Further, the counter cation can easily be changed by using an ion exchange resin. As for specific example of typical synthetic method, Synthesis Examples 5 to 8 described in Japanese Patent Application No. 2002-235913 can be referred to.

Hereafter, the compounds represented by the following formula (2D) will be explained in detail.

$$[Rf^D—(L^D)_{nD}]_{mD}—W \qquad \text{Formula (2D)}$$

In the formula, $Rf^D$ represents a perfluoroalkyl group, $L^D$ represents an alkylene group, W represents a group having an anionic, cationic or betaine group or nonionic polar group required for imparting surface activity. $n^D$ represents an integer of 0 or 1, and $m^D$ represents an integer of 1 to 3.

$Rf^D$ represents a perfluoroalkyl group having 3 to 20 carbon atoms, and specific examples include $C_3F_7$— group, $C_4F_9$— group, $C_6F_{13}$— group, $C_8H_{17}$— group, $C_{12}F_{25}$— group, $C_{16}F_{33}$— group and so forth.

$L^D$ group represents an alkylene group. Although the alkylene group has one or more carbon atoms, it preferably has two or more carbon atoms, and it preferably has 20 or less carbon atoms. Specific examples thereof include methylene group, ethylene group, 1,2-propylene group, 1,3-propylene group, 1,2-butylene group, 1,4-butylene group, 1,6-hexylene group, 1,2-octylene group and so forth.

In the present invention, a mixture of multiple kinds of compounds having perfluoroalkyl groups of different lengths as $Rf^D$ may be used, or only compounds having a single kind of perfluoroalkyl group may be used. Further, a mixture of multiple kinds of compounds having the same $Rf^D$ and different $L^D$ may also be used. In the present invention, when a mixture of multiple kinds of compounds having perfluoroalkyl groups of different lengths as $Rf^D$ is used, the average chain length of the perfluoroalkyl groups is preferably 4 to 10, particularly preferably 4 to 9, in terms of a number of carbon atoms.

$n^D$ represents an integer of 0 or 1, and it is preferably 1. $m^D$ represents an integer of 1 to 3, and when $m^D$ is 2 or 3, groups of $[Rf^D—(L^D)n^D]$ may be identical or different. When W is not phosphoric acid ester group, it is preferred that $m^D=1$, when W represents a phosphoric acid group, $m^D$ may be any of 1 to 3, and when it is a mixture in which $m^D=1$ to 3, the average of $m^D$ is preferably 0.5 to 2.

W represents a group having an anionic, cationic or betaine group or nonionic polar group required for imparting surface activity. So long as W has such a group, W may bond to Rc in any manner. Examples of the anionic group required for imparting surface activity include sulfonic acid group and an ammonium or metal salt thereof, carboxylic acid group and an ammonium or metal salt thereof, phosphonic acid group and an ammonium or metal salt thereof, sulfuric acid ester group and an ammonium or metal salt thereof, and phosphoric acid ester group and an ammonium or metal salt thereof.

Examples of the cationic group required for imparting surface activity include a quaternary alkylammonium group such as trimethylammoniumethyl group and trimethylammoniumpropyl group; and an aromatic ammonium group such as a dimethylphenylammoniumalkyl group and N-methylpyridinium group. These groups contain a suitable counter ion. Examples thereof include a halide ion, benzenesulfonate anion, toluenesulfonate anion and so forth, and toluenesulfonate anion is preferred. Examples of the betaine group required for imparting surface activity include groups having a betaine structure such as $—N^+(CH_3)_2CH_2COO^-$ and $—N^+(CH_3)_2CH_2CH_2COO^-$. Examples of the nonionic group required for imparting surface activity include a polyoxyalkylene group, a polyhydric alcohol group and so forth, and a polyoxyalkylene group such as polyethylene glycol and polypropylene glycol is preferred. However, the terminals of these groups may consist of a group other than a hydrogen atom, for example, an alkyl group.

In the aforementioned formula (2D), $Rf^D$ is preferably a perfluoroalkyl group having 4 to 16 carbon atoms, more preferably a perfluoroalkyl group having 6 to 16 carbon atoms. $L^D$ preferably represents an alkylene group having 2 to 16 carbon atoms, more preferably an alkylene group having 2 to 8 carbon atoms, particularly preferably ethylene group. $n^D$ is preferably 1. L and the group required for imparting surface activity may bond to each other in any manner. For example, they can bond to each other via an alkylene chain, an arylene or the like, and these groups may have a substituent. These groups may have oxy group, thio group, sulfonyl group, sulfoxide group, sulfonamido group, amido group, amino group or the like on the backbone or side chain.

Specific examples of the compounds represented by the aforementioned formula (2D) are shown below. However, the compounds represented by the formula (2D) that can be used for the present invention are not limited by the following examples at all.

FS-401

$C_8F_{17}CH_2CH_2SO_3^- Li^+$

FS-402

$C_8F_{17}CH_2CH_2SO_3^- Na^+$

FS-403

$C_8F_{17}CH_2CH_2SO_3^- K^+$

FS-404

$C_6F_{13}CH_2CH_2SO_3^- K^+$

FS-405

$C_{10}F_{21}CH_2CH_2SO_3^- Li^+$

FS-406

$C_8F_{17}CH_2CH_2SCH_2COO^- Na^+$

FS-407

$C_8F_{17}CH_2CH_2SCH_2COO^- K^+$

FS-408

$C_8F_{17}CH_2CH_2SCH_2CH_2COO^- Na^+$

FS-409

$C_8F_{17}CH_2CH_2SCH_2CH_2COO^- Li^+$

FS-410

$C_8F_{17}CH_2COO^- K^+$

FS-411

$F(CF_2CF_2)nCH_2CH_2SO_3^- Na^+$ n=3-7

FS-412

$F(CF_2CF_2)nCH_2CH_2SO_3^- Li^+$ n=3-7

FS-413

$C_8F_{17}CH_2CH_2SO_2N(CH_2CH_2O)_4(CH_2)_4SO_3^- Na^+$
$\quad\quad\quad

-continued

FS-425

$C_8F_{17}CH_2CH_2SO_2NHCH_2CH_2CH_2OCH_2CH_2N^+(CH_3)_3$

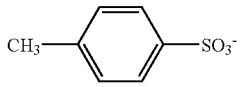

FS-426

$F(CF_2CF_2)nCH_2CH_2SO_2NHCH_2CH_2CH_2N^+(CH_3)_3$ n=1-7

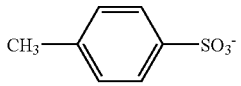

FS-427

$F(CF_2CF_2)nCH_2CH_2SO_2NHCH_2CH_2CH_2OCH_2CH_2N^+(CH_3)_3$ n=1-7

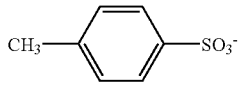

FS-428

$F(CF_2CF_2)nCH_2CH_2N^+(CH_3)_3\ Cl^-$ n=1-9

FS-429

$F(CF_2CF_2)nCH_2CH_2NHCH_2CH_2N^+(CH_3)_3\ I^-$ n=1-7

FS-430

$C_6F_{13}CH_2CH_2O(CH_2CH_2O)nH$ n=5-10

FS-431

$C_8F_{17}CH_2CH_2O(CH_2CH_2O)nH$ n=10-15

FS-432

$C_8F_{17}CH_2CH_2O(CH_2CH_2O)nH$ n=15-20

FS-433

$C_{10}F_{21}CH_2CH_2O(CH_2CH_2O)nH$ n=15-20

FS-434

$C_8F_{17}CH_2CH_2SO_2N(C_3H_7)CH_2CH_2O(CH_2CH_2O)_{15}H$

FS-435

$F(CF_2CF_2)mCH_2CH_2O(CH_2CH_2O)nH$ m=3-7 n=5-10

FS-436

$C_8F_{17}CH_2CH_2SO_2N(C_2H_5)(CH_2CH_2O)nH$ m=5-10

FS-437

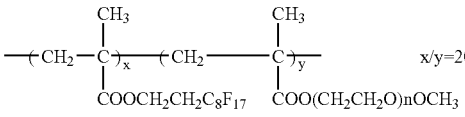

x/y=20/80 n=5-10

FS-438

$F(CF_2CF_2)mCH_2CH_2O(CH_2CH_2O)nH$ m=1-7 n=0-15

FS-439

$F(CF_2CF_2)mCH_2CH_2O(CH_2CH_2O)nH$ m=1-9 n=0-25

FS-440

$F(CF_2CF_2)mCH_2CH_2S(CH_2CH_2O)nH$ m=1-9 n=0-25

FS-441

$C_6F_{13}CH_2CH_2SO_2N(C_3H_7)CH_2CH_2O(CH_2CH_2O)nH$ n=0-15

FS-442

$C_8F_{17}CH_2CH_2SONH(CH_3)_2N^+(CH_3)_2CH_2CH_2COO^-$

The compounds represented by the aforementioned formula (2D) can be produced by usual synthetic methods, and those widely marketed as so-called telomer type perfluoroalkyl group-containing surfactants can also be used. Examples thereof include Zonyl FSP, FSE, FSJ, NF, TBS, FS-62, FSA, FSK (these are ionic surfactants), Zonyl 9075, FSO, FSN, FSN-100, FS-300, FS-310 (these are nonionic surfactants) produced by DUPONT, S-111, S-112, S-113, S-121, S-131, S-132 (these are ionic surfactants), S-141, S-145 (these are nonionic surfactants) produced by by Asahi Glass, Unidyne DS-101, DS-102, DS-202, DS-301 (these are ionic surfactants), DS-401, DS-403 (these are nonionic surfactants) produced by Daikin Industries, and so forth.

Further, among the aforementioned various compounds, the ionic surfactants can be used in the form of a salt obtained by ion exchange, neutralization or the like, or in the presence of one or more kinds of counter ions, depending on the purpose of use, required various characteristics and so forth.

Hereafter, Substituent T, which is an example of the substituent that may be contained in the groups that may have a substituent in the aforementioned formulas, will be explained.

Examples of Substituent T include, for example, an alkyl group having preferably 1 to 20 carbon atoms, more preferably 1 to 12 carbon atoms, particularly preferably 1 to 8 carbon atoms (e.g., methyl group, ethyl group, isopropyl group, tert-butyl group, n-octyl group, n-decyl group, n-hexadecyl group, cyclopropyl group, cyclopentyl group, cyclohexyl group etc.), an alkenyl group having preferably 2 to 20 carbon atoms, more preferably 2 to 12 carbon atoms, particularly preferably 2 to 8 carbon atoms (e.g., vinyl group, allyl group, 2-butenyl group, 3-pentenyl group etc.), an alkynyl group having preferably 2 to 20 carbon atoms, more preferably 2 to 12 carbon atoms, particularly preferably 2 to 8 carbon atoms (e.g., propargyl group, 3-pentynyl group etc.), an aryl group having preferably 6 to 30 carbon atoms, more preferably 6 to 20 carbon atoms, particularly preferably 6 to 12 carbon atoms (e.g., phenyl group, p-methylphenyl group, naphthyl group etc.), a substituted or unsubstituted amino group having preferably 0 to 20 carbon atoms, more preferably 0 to 10 carbon atoms, particularly preferably 0 to 6 carbon atoms (e.g., unsubstituted amino group, methylamino group, dimethylamino group, diethylamino group, dibenzylamino group etc.), an alkoxy group having preferably 1 to 20 carbon atoms, more preferably 1 to 12 carbon atoms, particularly preferably 1 to 8 carbon atoms (e.g., methoxy group, ethoxy group, butoxy group etc.), an aryloxy group having preferably 6 to 20 carbon atoms, more preferably 6 to 16 carbon atoms, particularly preferably 6 to 12 carbon atoms (e.g., phenyloxy group, 2-naphthyloxy group etc.), an acyl group having preferably 1 to 20 carbon atoms, more preferably 1 to 16 carbon atoms, particularly preferably 1 to 12 carbon atoms (e.g., acetyl group, benzoyl group, formyl group, pivaloyl group etc.), an alkoxycarbonyl group having preferably 2 to 20 carbon atoms, more preferably 2 to 16 carbon atoms, particularly preferably 2 to 12 carbon atoms (e.g., methoxycarbonyl group, ethoxycarbonyl group etc.), an aryloxycarbonyl group having preferably 7 to 20 carbon atoms, more preferably 7 to 16 carbon atoms, particularly preferably 7 to 10 carbon atoms (e.g., phenyloxycarbonyl group etc.), an acyloxy group having preferably 2 to 20 carbon atoms, more preferably 2 to 16 carbon atoms, particularly preferably 2 to 10 carbon atoms (e.g., acetoxy group, benzoyloxy group etc.), an acylamino group having preferably 2 to 20 carbon atoms, more preferably 2 to 16 carbon atoms, particularly preferably 2 to 10 carbon atoms (e.g., acetylamino group, benzoylamino group etc.), an alkoxycarbonylamino group having preferably 2 to 20 carbon atoms, more preferably 2 to 16 carbon atoms, particularly preferably 2 to 12 carbon atoms (e.g., methoxycarbonylamino group etc.), an aryloxycarbonylamino group having preferably 7 to 20 carbon atoms, more preferably 7 to 16 carbon atoms, particularly preferably 7 to 12 carbon atoms (e.g., phenyloxycarbonylamino group etc.), a sulfonylamino group having preferably 1 to 20 carbon atoms, more preferably 1 to 16 carbon atoms, particularly preferably 1 to 12 carbon atoms (e.g., methanesulfonylamino group, benzenesulfonylamino group etc.), a sulfamoyl group having preferably 0 to 20 carbon atoms, more preferably 0 to 16 carbon atoms, particularly preferably 0 to 12 carbon atoms (e.g., sulfamoyl group, methylsulfamoyl group, dimethylsulfamoyl group, phenylsulfamoyl group etc.), a carbamoyl group having preferably 1 to 20 carbon atoms, more preferably 1 to 16 carbon atoms, particularly preferably 1 to 12 carbon atoms (e.g., unsubstituted carbamoyl group, methylcarbamoyl group, diethylcarbamoyl group, phenylcarbamoyl group etc.), an alkylthio group having preferably 1 to 20 carbon atoms, more preferably 1 to 16 carbon atoms, particularly preferably 1 to 12 carbon atoms (e.g., methylthio group, ethylthio group etc.), an arylthio group having preferably 6 to 20 carbon atoms, more preferably 6 to 16 carbon atoms, particularly preferably 6 to 12 carbon atoms (e.g., phenylthio group etc.), a sulfonyl group having preferably 1 to 20 carbon atoms, more preferably 1 to 16 carbon atoms, particularly preferably 1 to 12 carbon atoms (e.g., mesyl group, tosyl group etc.), a sulfinyl group having preferably 1 to 20 carbon atoms, more preferably 1 to 16 carbon atoms, particularly preferably 1 to 12 carbon atoms (e.g., methanesulfinyl group, benzenesulfinyl group etc.), a ureido group having preferably 1 to 20 carbon atoms, more preferably 1 to 16 carbon atoms, particularly preferably 1 to 12 carbon atoms (e.g., unsubstituted ureido group, methylureido group, phenylureido group etc.), a phosphoric acid amido group having preferably 1 to 20 carbon atoms, more preferably 1 to 16 carbon atoms, particularly preferably 1 to 12 carbon atoms (e.g., diethylphosphoric acid amido group, phenylphosphoric acid amido group etc.), a hydroxyl group, a mercapto group, a halogen atom (e.g., fluorine atom, chlorine atom, bromine atom, iodine atom), a cyano group, a sulfo group, a carboxyl group, a nitro group, a hydroxamic acid group, a sulfino group, a hydrazino group, an imino group, a heterocyclic group having preferably 1 to 30 carbon atoms, more preferably 1 to 12, for example, such a heterocyclic group containing a hetero atom of nitrogen atom, oxygen atom, sulfur atom or the like (e.g., imidazolyl group, pyridyl group, quinolyl group, furyl group, piperidyl group, morpholino group, benzoxazolyl group, benzimidazolyl group, benzothiazolyl group etc.), a silyl group having preferably 3 to 40 carbon atoms, more preferably 3 to 30 carbon atoms, particularly preferably 3 to 24 carbon atoms (e.g., trimethylsilyl group, triphenylsilyl group, etc.) and so forth. These substituents may be further substituted with other substituents. Further, when two or more substituents exist, they may be identical to or different from each other or one another. If possible, they may bond to each other to form a ring.

The silver halide photographic light-sensitive material of the present invention is a silver halide photographic light-sensitive material having one or more layers including at least one light-sensitive silver halide emulsion layer on a support, which is characterized by comprising a compound represented by the aforementioned formula (1) and a fluorine compound in at least on of the layers formed on the support. Although the compound represented by the aforementioned formula (1) and the fluorine compound may be contained in different layers, they are preferably contained in the same layer. In a preferred embodiment of the silver halide photographic light-sensitive material of the present invention, it has a light-insensitive hydrophilic colloid layer as an outermost layer, and this outermost layer contains the compound represented by the aforementioned formula (1) and the fluorine compound. The layer can be formed by coating an aqueous coating solution containing the compound represented by the aforementioned formula (1) and the fluorine compound on or above a support (on the support or on a layer formed on the support). The aqueous coating solution may contain a single kind of fluorine compound, or two or more kinds of fluorine compounds as a mixture. As also for the compound represented by the aforementioned formula (1), a single kind of the compound may be used, or two or more kinds of the compounds may be used as a mixture. Further, those components may be used together with other surfactants. Surfactants that can be used together include various surfactants of anionic type, cationic type and nonionic type. Moreover, the surfactants used together may be polymer surfactants. The surfactants used together are more preferably anionic surfactants or nonionic surfactants. The surfactants that can be used together include, for example, those disclosed in JP-A-62-215272 (pages 649 to 706), Research Disclosure (RD) Items 17643, pages 26 to 27 (December, 1978), 18716, page 650 (November, 1979), 307105, pages 875 to 876 (November, 1989) and so forth.

Hereafter, the compound represented by the formula (4) usable for the silver halide photographic light-sensitive material of the present invention will be explained.

Formula (4)

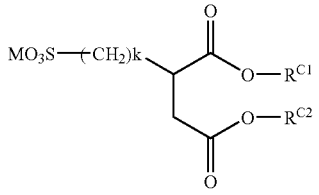

In the formula, $R^{C1}$ and $R^{C2}$ each represent an alkyl group or alkylene group having 4 to 22 carbon atoms. k represents 0 or 1. M represents a cation.

$R^{C1}$ and $R^{C2}$ represent an alkyl group or alkenyl group having 4 to 22 carbon atoms, preferably 5 to 20 carbon atoms, more preferably 6 to 18 carbon atoms. The alkyl group and alkenyl group may be linear or branched. k represents 0 or 1. M represents a cation, and as the cation, for example, alkali metal ions (lithium ion, sodium ion, potassium ion etc.), ammonium ions and so forth are preferably used. Among these, particularly preferred are lithium ion, sodium ion, potassium ion, and ammonium ions.

Specific examples of the compounds represented by the aforementioned formula (4) are shown below. However, the present invention is not limited by the following specific examples at all.

CW-1

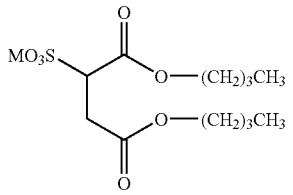

-continued
CW-2
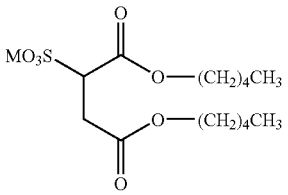
CW-3
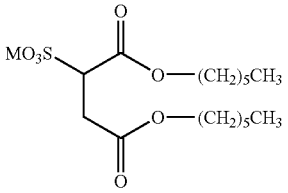
CW-4
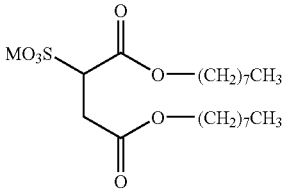
CW-5
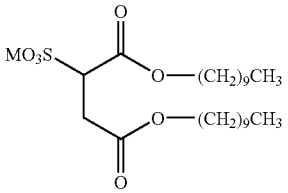
CW-6
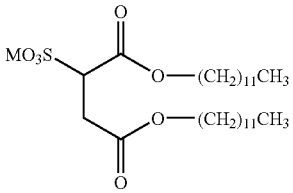
CW-7
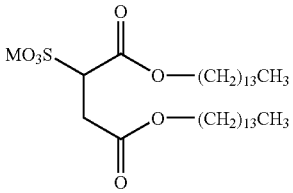
CW-8
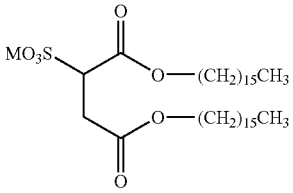
CW-9
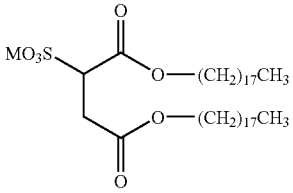
-continued
CW-10
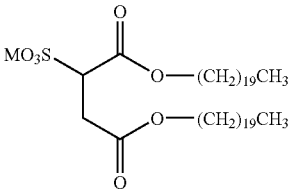
CW-11
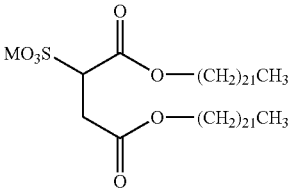
CW-12
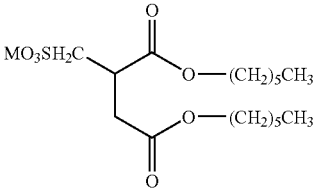
CW-13
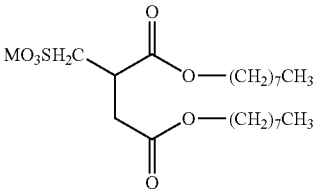
CW-14
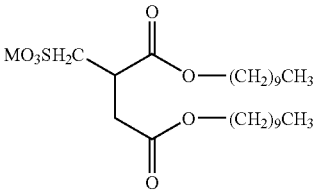
CW-15
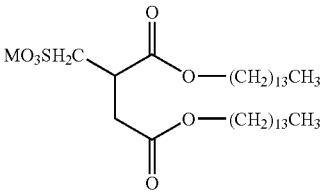
CW-16
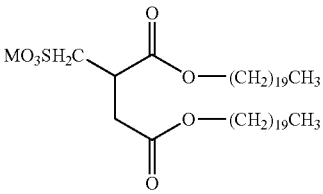
CW-19
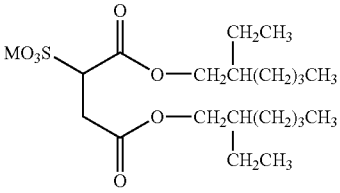

-continued

CW-20

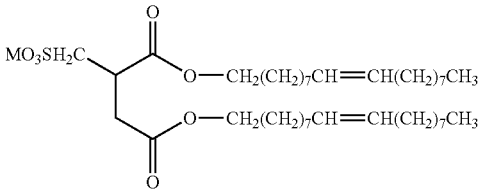

CW-21

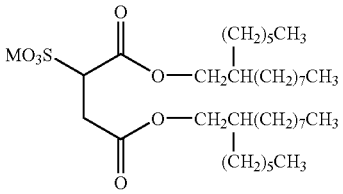

CW-22

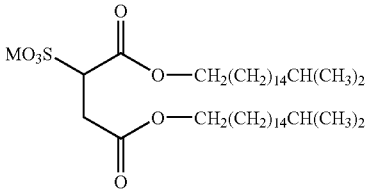

CW-23

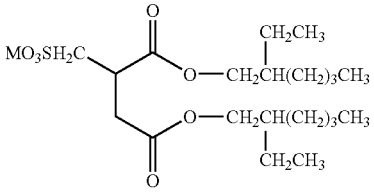

CW-24

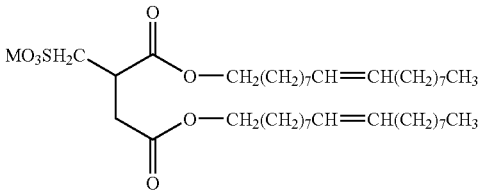

CW-25

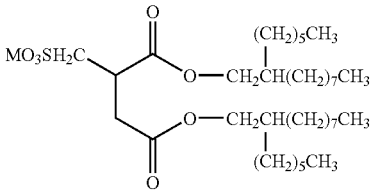

CW-26

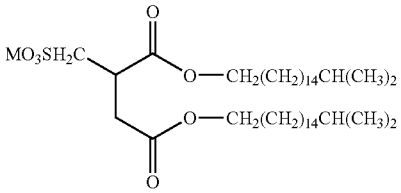

The compounds represented by the formula (4) used in the present invention can be synthesized by performing a usual esterification reaction in which, for example, maleic anhydride, itaconic anhydride or the like is reacted with an alcohol, and performing a sulfonation reaction in which, for example, sodium hydrogensulfite is added to a double bond. Moreover, they can also be obtained as commercial items such as those of the Rapizol series (Nippon Oil & Fats Co., Ltd.).

In the present invention, when the silver halide photographic light-sensitive material is in the form of a sheet, a stack of the sheet-shaped silver halide photographic light-sensitive materials can be packaged in a packaging bag to form a package. The packaging bag has a heat-sealing portion for packaging the stack in the bag. The heat-sealing portion is preferably formed on each of the four sides of the packaging bag. In the package of the present invention, the rigidity of the heat-sealing portion must be 0.0005 N·m or more. Moreover, in the package of the present invention, relative humidity in the packaging bag is controlled to be 30 to 55%. The relative humidity is more preferably 35 to 45%. By using these characteristics, generations of scratches and pressure-induced fog (black peppers) in sheet-shaped silver halide photographic light-sensitive materials can be suppressed, which are likely to occur during transportation of the light-sensitive materials, and high contrast and highly sensitive photographic characteristics can be expressed upon use of the silver halide photographic light-sensitive materials.

Hereafter, an embodiment of the package of the present invention will be explained with reference to the drawings. In this embodiment, a packaging bag is used as an interior bag.

As shown in FIG. 1, a stack 1 of the silver halide photographic light-sensitive materials in the form of a sheet having round corners is protected by a protection plate 2 consisting of a polypropylene sheet and having a section of a right-angled U-shape, and is stored in an interior bag 3, and the four sides of the storage bag 3 form heat-sealing portions 4 having a certain width.

Figure 2:
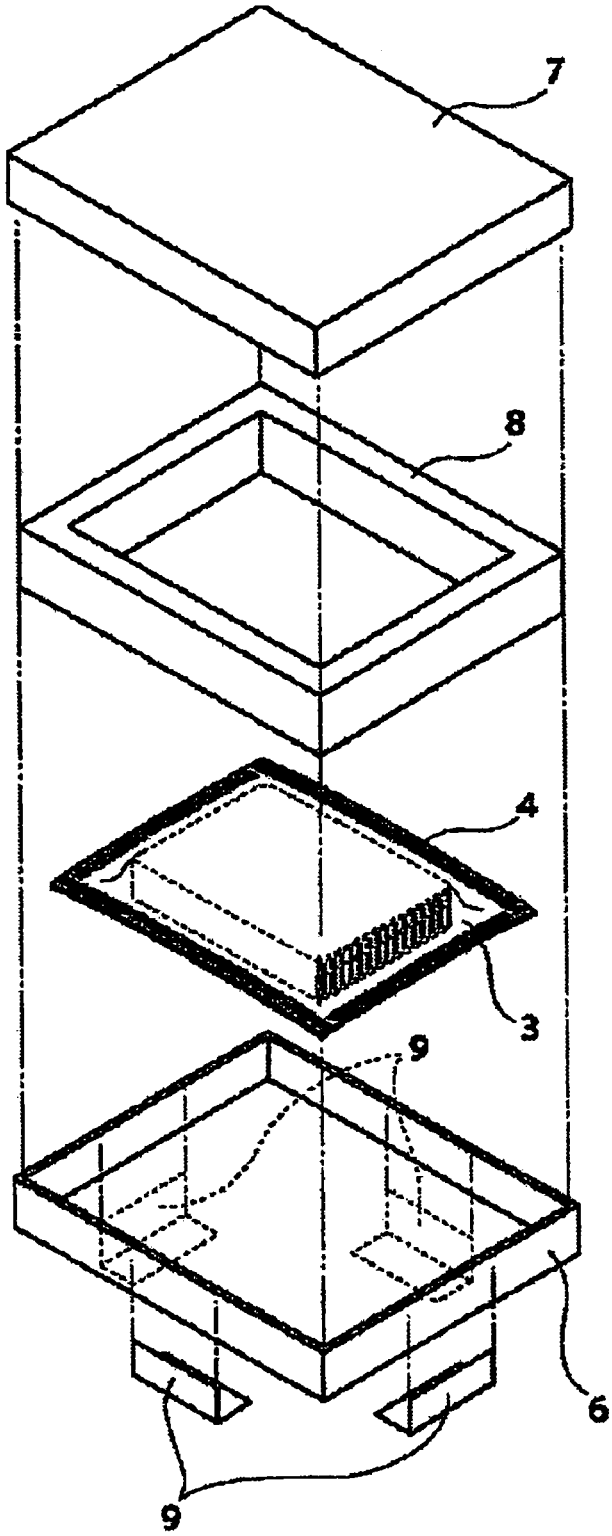
FIG. 2 is an exploded perspective view schematically showing an embodiment of the package of the present invention stored in a box.

As shown in FIG. 2, the interior bag 3 is stored in a rectangular parallelepiped container (box) consisting of a body 6 and a lid 7, and the body 6 and the lid 7 of the box are fixed with adhesive tape 9. A cushioning member 8 held between the body 6 and the lid 7 is designed so as to press at least a part of each heat-sealing portion against an inner surface of the bottom of the body 6 or an inner surface of a top plate of the lid 7, and thereby suppress movement of the interior bag.

Figure 3:
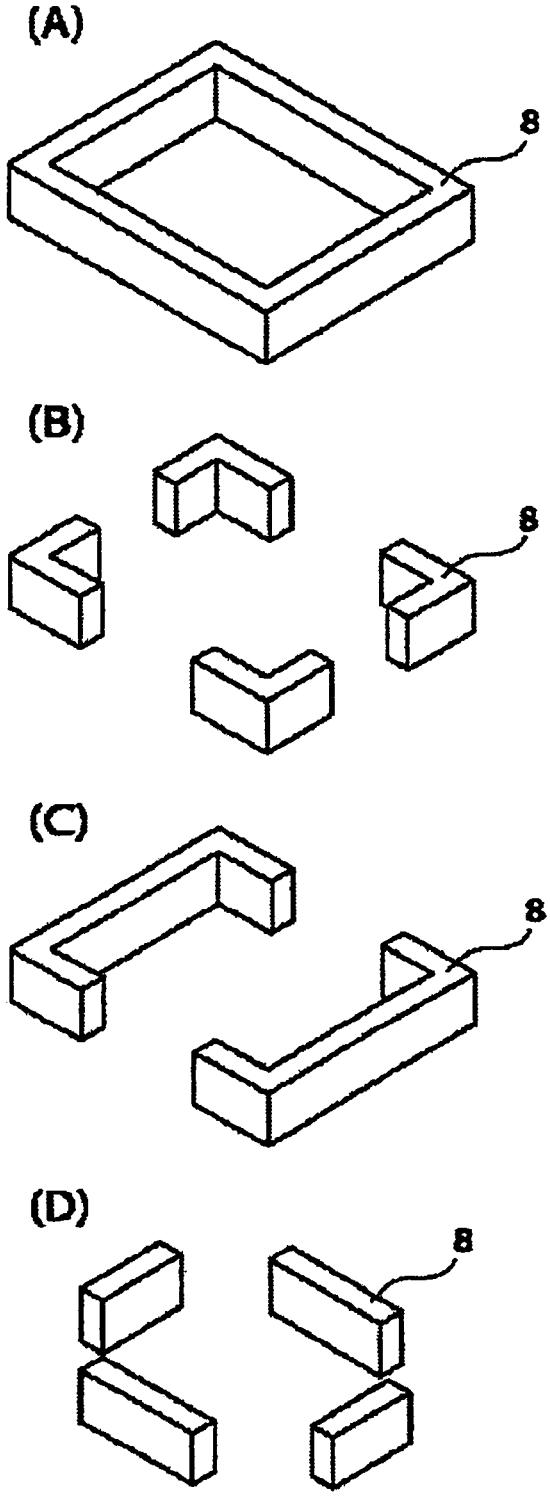
FIG. 3 includes perspective views schematically showing several types of arrangements of cushioning members used when the package of the present invention is stored in a box.
Figure 4:
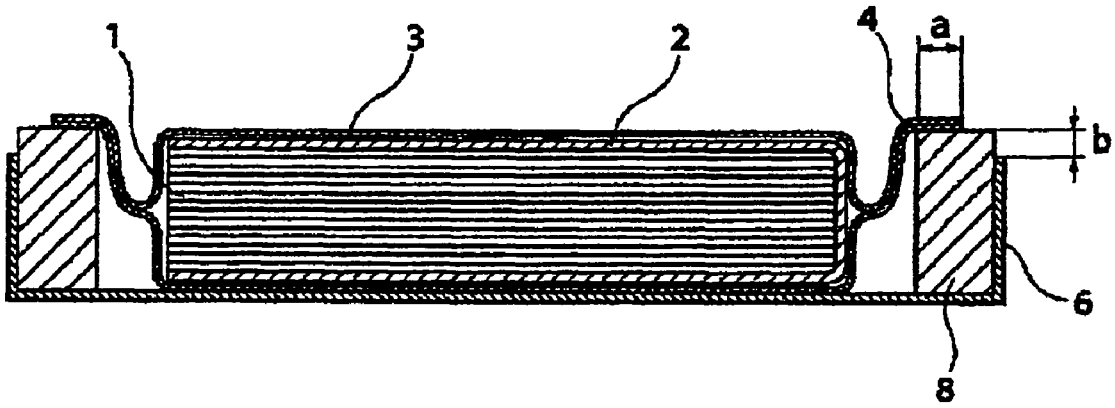
FIG. 4 is a sectional view of the package of the present invention stored in a box.

The cushioning member may have any of various shapes such as those shown in FIG. 3, and it preferably has such a shape that it should fix the four sides of the heat-sealing portions existing on the periphery of the interior bag with substantially equivalent strengths. As shown in FIG. 4, degree of the fixation strength depends on the widths a of the pressed heat-sealing portions and the height b for which the cushioning member is compressed.

In the present invention, it is preferable to use a bag having a light-shielding property as the packaging bag (interior bag). The silver halide photographic light-sensitive materials are enclosed in a bag having a light-shielding property, and this interior bag is stored in the outer packaging box, which can be fittably closed. The stack of light-sensitive materials may be directly enclosed in the light-shielding interior bag, or packaged with a protection plate and then stored in the interior bag. The protection plate is a packaging member for a stack of light-sensitive materials, and because it is brought into direct contact with the light-sensitive materials, it is desirable that it does not adversely affect the light-sensitive materials. The content of substances harmful to the light-sensitive materials in the protection plate is usually 1,000 ppm or less, and it is necessary that it does not substantially affect the light-sensitive materials. In addition, in order to prevent generation of spots upon exposure, a material having a low dusting property is preferably used for the protection plate.

Specifically, as for the protection plate, it is preferable to eliminate bad influences of photographically harmful substances by using a material containing such harmful substances at a content of 1000 ppm or less, providing a protection film consisting of a ultraviolet-curing resin on a protection plate surface, or the like. As the protection plate, various kinds of paper sheets manufactured from pulp having a fiber length of 3 mm or more, and various kinds of plastic sheets are preferably used. Specific examples of the paper include paper strengthening agent-added paper, resin-laminated paper, latex or resin-impregnated paper, paper surface-coated with resin, starch or PVA, paper surface-treated with a sizing agent, synthetic paper, non-dusting paper, and alkaline paper. Further, examples of the plastic sheets include polyethylene sheets, polypropylene sheets and so forth. The protection plate used for the present invention is preferably a plastic sheet, particularly preferably a polypropylene sheet.

The protection plate preferably has a thickness of 300 to 700 μm, and a rigidity of 0.0005 to 0.001 N·m. The rigidity means bending moment of the protection plate, and the details of the measurement method therefor are defined in JIS P8125. Further, the protection plate preferably has a surface roughness of 10 to 500 μm. The surface roughness means an average of intervals between protruding portions and dented portions of the protection plate, and the details of the measurement method therefor are defined in JIS B0601. Furthermore, the protection plate preferably has a wet tension of 0.040 to 0.050 N/m. The details of the measurement method of wet tension are defined in JIS K6768.

The sheet-shaped silver halide photographic light-sensitive material of the present invention preferably has rounded corners for the four corners of the rectangular in view of reduction of tearing of the bag.

The protection plate preferably has a shape for covering the whole bottom surface of a stack of the silver halide photographic light-sensitive materials, more preferably a shape for covering also the whole top surface of the stack in addition to the bottom surface, i.e., a shape having a right-angled U-shaped section.

The stack of sheet-shaped silver halide photographic light-sensitive materials is packaged directly with a light-shielding interior bag, or packaged with a protection plate and then stored in a light-shielding interior bag. The interior bag used in the present invention preferably consists of a completely light-shielding material having a moisture-proof property. For the interior bag, various kinds of known shapes of bag such as single flat bag, double flat bag, single gazet bag and double gazet bag can be used.

Specifically, as a single bag, an interior material obtained by extruding heat-melted PE (in an amount corresponding to a thickness of 13 μm) as an adhesive on BOPP (black oriented polypropylene) having a thickness of 40 μm, and adhering BPE (black polyethylene) having a thickness of 80 μm thereon is used. Further, as for a double bag, the aforementioned interior material is used for an outer bag, and an interior material obtained by extruding and laminating heat-melted PE (in an amount corresponding to a thickness of 13 μm) on the surface of BOPP of the aforementioned interior material is used for an inner bag.

The interior material preferably has a rigidity of 0.0001 N·m or more, and a tear strength of 0.015 N·m or more. The tear strength of the interior material is measured according to the definition of JIS P8116.

The methods for forming the bags can be selected from known conventional methods for sealing plastic films such as heat sealing, fusion sealing, impulse sealing, ultrasonic sealing and high frequency sealing depending on the properties of the interior material to be used, and used. Further, the bags can also be formed by using suitable adhesives, glues and so forth. In the present invention, it is preferable to heat-seal the four sides of the light-shielding interior bag. If rigidity of the heat-sealing portion 4 shown in FIG. 4 is insufficient, the interior bag moves in the box even if the bag is pressed with a cushioning material, and thus damages of the light-sensitive materials cannot be prevented. On the other hand, if the rigidity is too high, workability is degraded. For these reasons, the heat-sealing portion 4 must have a rigidity of 0.0005 N·m or more, and it is preferably 0.01 N·m or less.

The box in which the interior bag is stored is for protecting and storing the light-shielding interior bag storing a stack of the silver halide photographic light-sensitive materials. The box typically consists of fittable inner box (body) and lid in the shape of a thin rectangular parallelepiped as a whole.

The material of the box is not particularly limited, and it may be a paperboard box or a plastic box so long as it has a usable strength depending on size and weight of the stack of the silver halide photographic light-sensitive materials. A plastic box is preferred in view of prevention of dusting, and if a paperboard box is used, internal surfaces of the box are preferably lined with paper sheets using long fiber pulp and having a high surface strength, or lined with plastic films, non-dusting paper sheets, flexible sheets of low dusting property or the like. Further, addition of carbon black or conductive substance is preferred in view of prevention of adsorption of dusts or prevention of static electricity.

In the present invention, it is preferable to reduce the pressure in the interior bag immediately before or after the heat-sealing of the interior bag. If the pressure is reduced to about 10 to 500 mm·$H_2O$, movement of the stack of the silver halide photographic light-sensitive materials in the interior bag can be suppressed.

The package of the present invention can be stored in the box. In this case, the movement of the interior bag in the box can be suppressed by using a flexible cushioning member. By preventing the interior bag from moving in the box, troubles such as tear of the bag, scraches and friction-induced fog of the silver halide photographic light-sensitive materials, as well as dusting can be prevented.

The cushioning member can be disposed above (upper enclosure) or below (lower enclosure) the heat-sealing portion (henceforth also referred to as "edge") of the interior bag stored in the inner box (body). When the box is closed, the edge of the interior bag is pressed, and the interior bag can be prevented from moving in the box during transportation. When the cushioning member is disposed under the edge of the interior bag, the edge of the interior member is pressed with the cushioning member and the lid, and when the cushioning member is disposed on the edge of the interior bag, the edge of the interior member is pressed with the cushioning member and the inner box (body).

Although either the upper enclosure or lower enclosure may be used for the cushioning member, the lower enclosure is preferred in view of the workability. Further, the cushioning member may be disposed in any manner so long as movements of the interior bag in the box along both of the longitudinal and transverse direction can be suppressed. Although it is most effective to dispose cushioning members for the whole periphery including all of the four sides of the interior bag, disposition of cushioning members only at the corners or a part of the four sides of the interior bag may also be effective. That is, so long as the interior bag is stored in the box in a state that a part or all of the heat-sealing portions of the interior bag are pressed by the cushioning member, and thereby undesirable movements of the interior bag in the box can be prevented, the object of the present invention can be achieved.

The width of the heat-sealing portion pressed with the cushioning member (pressed width a) is preferably 2 to 10 mm, particularly preferably 4 to 6 mm.

When the box has a depth of 20 mm, and the lower enclosure is used, the height of the heat-sealing portion pressed with the cushioning member and the lid of the box (height pressed with box b) is preferably 1 to 5 mm, particularly preferably 2 to 4 mm, before the lid is attached.

In order that the cushioning member can exhibit the effect, the cushioning member holding the heat-sealing portion in the box must be compressed with the bottom plate and top plate of the box. When fittable body and lid are used for this purpose, the both are preferably fixed with a suitable means, and for example, a method of fixing the body and the lid with an adhesive tape for each box etc. can be mentioned. Outside of stacked several boxes may be fixed with a strong tape along the longitudinal and transverse directions.

Although known conventional materials may be suitably selected for the cushioning member so long as a flexible material is chosen, a material showing a low dusting property is preferred. Examples include, for example, foams obtained by adding a foaming agent to polyolefin resins such as various polyethylene resins, various polypropylene resins and polybutene resins, ethylene type copolymer resins such as polystyrene resins, mixed resins of one or more of the foregoing resins such as copolymer resins comprising propylene as a main component, cross-linked polyolefin resins and polyamide resins, polyurethane, natural rubbers (those in the shape of sponge produced from undiluted latex of rubber), synthetic rubbers such as SBR, and so forth.

Preferred foaming agents effectively usable for the present invention are thermoplastic resin foaming agents comprising polyolefin resins (including denatured and cross-linked resins etc.), various polyethylene resins such as those of high density, medium density, and low density, linear low density polyethylene (L-LDPE) resins, polypropylene resins, propylene/ethylene copolymer resins, ethylene/vinyl acetate copolymer resins, ethylene/acrylic ester copolymer resins, ethylene/acrylic acid copolymer resins, and polystyrene copolymer resins substantially as a main component. Polyethylene foam is particularly preferred in view of cost and characteristics. The expansion ratio is preferably 10 to 70 times, more preferably 20 to 40 times.

As the foaming agent, an inorganic foaming agent or an organic foaming agent may be used. Examples of the inorganic foaming agent include sodium hydrogencarbonate, ammonium carbonate, ammonium hydrogencarbonate and so forth, and examples of the organic foaming agent include azobisisobutyronitrile, azodicarbonamide, barium azodicarboxylate and so forth. Examples of the method for forming foams by incorporating a foaming agent into a plastic material or rubber material include the gas mixing method, foaming agent degradation method, solvent evaporating method, chemical reaction method, sintering method, elution method and so forth.

Further, in order to prevent adhesion of dirt or dusts due to electrification of the foam, an antistatic agent may also be added. Examples of the antistatic agent include phosphoric acid alkyl esters as those of anion type, alkylamino derivatives and quaternary ammonium salts as those of cation type, imidazoline type metal salts as those of amphoteric type, polyoxyethylenealkylamines, polyoxyethylene fatty acid esters, polyoxyethylene alkyl ethers as those of nonion type, and so forth, and specifically, dioxyethylene stearylamine, alkylamine type lubricants (e.g., Electrostripper (trade name)), and stearic acid monoglyceride and so forth can be suitably used.

In the package of the present invention, it is also possible to use air cushions and so forth instead of foam as the cushioning member.

The support used for the silver halide photographic light-sensitive material of the present invention preferably comprises a polymer filtered through a melt filter of 5-μm mesh or smaller mesh. By using a support containing such a polymer, it becomes possible to form images showing good processing stability and having definite fine lines and no defects, and thus demand of highly precise images in recent years can be satisfied. The support may consist only of such a polymer, or another material coated with such a polymer. Examples of the support usable in the present invention include, for example, polyethylene-coated paper, polypropylene synthetic paper, films of polyester such as cellulose acetate, cellulose nitrate, and polyethylene terephthalate, supports consisting of a styrene type polymer having a syndiotactic structure described in JP-A-7-234478 and U.S. Pat. No. 5,558,979, and supports formed by coating a polyester film with a vinylidene chloride copolymer, described in JP-A-64-538, U.S. Pat. Nos. 4,645,731, 4,933,267 and 4,954,430. These supports are appropriately chosen according to the purpose of the silver halide photographic light-sensitive material.

In the present invention, it is preferable to use a polymer having a high glass transition temperature (Tg) as the support. Specifically, it is preferable to use a polymer having Tg of 50 to 250° C., more preferably 50 to 200° C., still more preferably 60 to 150° C. Examples of preferred polymer materials include polyester type polymers, polycarbonate (PC) type polymers, polyarylate (PAr) type polymers, polyether-imide (PEI) type polymers, polysulfone (PSF) type polymers, polyethersulfone (PES) type polymers, syndiotactic polystyrene (SPS) type polymers, and so forth. Among these, polyester type polymers, polycarbonate type polymers, and polyarylate type polymers are more preferred, and polyester type polymers are still more preferred.

The polyester type polymers are usually synthesized by polycondensation of a dicarboxylic acid and a diol. Examples of preferred dicarboxylic acid include terephthalic acid (TPA), isophthalic acid (IPA), naphthalenedicarboxylic acid (NDCA), and so forth. These may be used in the polymerization as dicarboxylic acids, or as lower alcohol esters of these. Further, examples of preferred diol include ethylene glycol (EG), diethylene glycol (DEG), bisphenol A (BPA), ethylene oxide adducts (BPA·2ED), cyclohexanedimethanol (CHDM) and so forth. A homopolymer may be synthesized by using one kind of monomer for each of dicarboxylic acid and diol, or a copolymer may be synthesized by using two or more kinds of monomers for at least one of dicarboxylic acid and diol. Further, it is also preferable to use a polymer blend obtained by mixing two or more kinds of the aforementioned homopolymers.

A preferred method for producing a support by using these polymers will be described hereafter. First, a polymer is pelletized, then dried preferably at a temperature of 100 to 200° C. preferably for 0.1 to 100 hours, more preferably at 120 to 180° C. usually for 1 to 24 hours, put into a single-screw or multi-screw extruder, melted by heating at a temperature of from the melting temperature to the heat decomposition temperature of the polymer, and then filtered through a melt filter. In the present invention, it is preferable to filter the polymer by using a melt filter of 5 μm or smaller mesh (capturing efficiency of 98% or more). More preferably, a melt filter of 3 to 5-μm mesh is used. For this filtration, the filter described in JP-A-63-31511 may be used as the filter.

After the above filtration is performed, the polymer is extruded from a die having a predetermined gap, and solidified by cooling on a smooth band or drum. For this cooling, the temperature of the band or drum is 0° C. to (Tg)° C., more preferably room temperature to (Tg−5)° C., further preferably 40° C. to (Tg−20)° C. In this solidification operation, the static voltage applying method is preferably used in order to secure more favorable flatness. The applied voltage for this method is preferably 2 to 20 kV, more preferably 4 to 15 kV.

The film solidified by cooling as described above is peeled, and then a film is preferably formed by performing simultaneous or sequential biaxial stretching, heat fixation, and heat relaxation. Degrees of the orientation along the longitudinal and transverse directions are not limited. Specifically, a film can be prepared by stretching an unstretched film 2.5 to 5.0 times along one direction (longitudinal or transverse direction) at a temperature of (Tg−10)° C. to (Tg+70)° C., and then stretching the monoaxially stretched film 3.0 to 5.0 times along the direction perpendicular to the direction of the former stretching (when the first stretching is performed along the longitudinal direction, the second stretching is performed along the transverse direction) at a temperature of (Tg)° C. to (Tg+70)° C. The longitudinal stretching is performed preferably 3.2 to 4.8 times, and the transverse stretching is performed preferably 3.3 to 4.8 times, more preferably 3.5 to 4.7 times.

Further, the oriented film is preferably subjected to heat fixation at a temperature of preferably (Tg+30)° C. to the melting temperature (Tm), more preferably (Tg+40)° C. to (Tm−10)° C., further preferably (Tg+60)° C. to (Tm−20)° C. Tm used herein means the temperature at which the aforementioned crystal melting peak rises on the lower temperature side. The treatment time of the heat fixation is preferably 3 to 120 seconds, more preferably 5 to 60 seconds, further preferably 10 to 40 seconds. Furthermore, it is also preferable to relax the film along the transverse direction at the final stage of the heat fixation. The degree of relaxation is preferably 1 to 10%, more preferably 2 to 8%, further preferably 3 to 6%. The supports obtained as described above have a thickness of preferably 80 to 250 μm, more preferably 90 to 220 μm, further preferably 95 to 200 μm, for both of amorphous polymers and crystalline polymers.

The silver halide of the silver halide emulsion used for the silver halide photographic light-sensitive material of the present invention is not particularly limited, and silver chloride, silver chlorobromide, silver bromide, silver chloroiodobromide or silver iodobromide can be used. In particular, silver chlorobromide or silver chloroiodobromide having a silver chloride content of 30 mol % or more is preferably used. Although the form of silver halide grain may be any of cubic, tetradecahedral, octahedral, variable and tabular forms, a cubic form is most preferred. The silver halide grains preferably have a mean grain size of 0.1 to 0.7 μm, more preferably 0.1 to 0.5 μm, and preferably has a narrow grain size distribution in terms of a variation coefficient of grain size, which is represented as {(Standard deviation of grain size)/(mean grain size)}×100, of preferably 15% or less, more preferably 10% or less.

The silver halide grains may have uniform or different phases for the inside and the surface layer. Further, they may have a localized layer having a different halogen composition inside the grains or as surface layers of the grains.

The photographic emulsion used for the present invention can be prepared by using the methods described in P. Glafkides, Chimie et Physique Photographique, Paul Montel (1967); G. F. Duffin, Photographic Emulsion Chemistry, The Focal Press (1966); V. L. Zelikman et al, Making and Coating Photographic Emulsion, The Focal Press (1964) and so forth.

That is, any of an acidic process and a neutral process may be used. In addition, a soluble silver salt may be reacted with a soluble halogen salt by any of the single jet method, double jet method and a combination thereof. A method of forming grains in the presence of excessive silver ions (so-called reverse mixing method) may also be used.

As one type of the double jet method, a method of maintaining the pAg constant in the liquid phase where silver halide is produced, that is, the so-called controlled double jet method, may also be used. Further, it is particularly preferable to form grains using the so-called silver halide solvent such as ammonia, thioether or tetra-substituted thiourea. More preferred as the silver halide solvent is a tetra-substituted thiourea compound, and it is described in JP-A-53-82408 and JP-A-55-77737. Preferred examples of the thiourea compound include tetramethylthiourea and 1,3-dimethyl-2-imidazolidinethione. While the amount of the silver halide solvent to be added may vary depending on the kind of the compound used, the desired grain size and halide composition of silver halide to be desired, it is preferably in the range of from $10^{-5}$ to $10^{-2}$ mol per mol of silver halide.

According to the controlled double jet method or the method of forming grains using a silver halide solvent, a silver halide emulsion comprising regular crystal form grains and having a narrow grain size distribution can be easily prepared, and these methods are useful for preparing the silver halide emulsion used for the present invention.

In order to achieve a uniform grain size, it is preferable to rapidly grow grains within the range of not exceeding the critical saturation degree by using a method of changing the addition rate of silver nitrate or alkali halide according to the grain growth rate as described in British Patent No. 1,535,016, JP-B-48-36890 and JP-B-52-16364, or a method of changing the concentration of the aqueous solution as described in U.S. Pat. No. 4,242,445 and JP-A-55-158124.

The silver halide emulsion used for the present invention preferably contains a metal complex having one or more cyanide ligands in an amount of $1\times10^{-6}$ mol or more, more preferably $5\times10^{-6}$ to $1\times10^{-2}$ mol, particularly preferably $5\times10^{-6}$ to $5\times10^{-3}$ mol, in the silver halide per mol of silver.

The metal complex having one or more cyanide ligands used for the present invention is added in the form of a water-soluble complex salt. Particularly preferred complexes include hexa-coordinated complexes represented by the following formula.

$$[M(CN)_{n1}L_{6-n1}]^{n-}$$

In the formula, M represents a metal belonging to any one of Groups V to VIII, and Ru, Re, Os and Fe are particularly preferred. L represents a ligand other than cyanide, and halide ligand, nitrosyl ligand, thionitrosyl ligand and so forth are preferred. n1 represents an integer of 1 to 6, and n represents 0, 1, 2, 3 or 4. n1 is preferably 6. In these compounds, the counter ion does not play any important role, and an ammonium ion or alkali metal ion is used.

Specific examples of the complexes used for the present invention are mentioned below. However, complexes that can be used for the present invention are not limited to these.

| | |
|---|---|
| $[Re(NO)(CN)_5]^{2-}$ | $[Re(O)_2(CN)_4]^{3-}$ |
| $[Os(NO)(CN)_5]^{2-}$ | $[Os(CN)_6]^{4-}$ |
| $[Os(O)_2(CN)_4]^{4-}$ | |
| $[Ru(CN)_6]^{4-}$ | $[Fe(CN)_6]^{4-}$ |

Although the metal complex used for the present invention may present at any site of silver halide grains, it preferably exists in the inside of silver halide grains. It is preferably exist in the inside of silver halide grains containing 99 mol % or less, preferably 95 mol % or less, more preferably 0 to 95 mol %, of silver of the silver halide crystals. To obtain such a structure, the light-sensitive silver halide grains are preferably formed so that they should contain multiple layers.

The silver halide emulsion used for the present invention preferably contains, besides the metal complex having one or more cyanide ligands, a rhodium compound, iridium compound, rhenium compound, ruthenium compound, osmium compound or the like in order to achieve high contrast and low fog.

As the rhodium compound used for the present invention, a water-soluble rhodium compound can be used. Examples thereof include rhodium(III) halide compounds and rhodium complex salts having a halogen, amine, oxalato, aquo or the like as a ligand, such as hexachlororhodium(III) complex salt, pentachloroaquorhodium complex salt, tetrachlorodiaquorhodium complex salt, hexabromorhodium(III) complex salt, hexaaminerhodium(III) complex salt and trioxalatorhodium(III) complex salt. The rhodium compound is dissolved in water or an appropriate solvent prior to use, and a method commonly used for stabilizing the rhodium compound solution, that is, a method of adding an aqueous solution of hydrogen halide (e.g., hydrochloric acid, hydrobromic acid or hydrofluoric acid) or an alkali halide (e.g., KCl, NaCl, KBr or NaBr), may be used. In place of using a water-soluble rhodium, separate silver halide grains that have been previously doped with rhodium may be added and dissolved at the time of preparation of silver halide.

The rhenium, ruthenium or osmium compound used for the present invention is added in the form of a water-soluble complex salt described in JP-A-63-2042, JP-A-1-285941, JP-A-2-20852, JP-A-2-20855 and so forth. Particularly preferred examples are six-coordinate complex salts represented by the following formula:

$$[ML_6]^{n-}$$

In the formula, M represents Ru, Re or Os, L represents a ligand, and n represents 0, 1, 2, 3 or 4. In these complex salts, the counter ion plays no important role and an ammonium or alkali metal may be used. Preferred examples of the ligand include a halide ligand, a nitrosyl ligand, a thionitrosyl ligand and so forth. Specific examples of the complex that can be used for the present invention are shown below. However, the complexes that can be used for the present invention are not limited to these examples.

| | |
|---|---|
| $[ReCl_6]^{3-}$ | $[ReBr_6]^{3-}$ |
| $[ReCl_5(NO)]^{2-}$ | $[Re(NS)Br_5]^{2-}$ |
| $[RuCl_6]^{3-}$ | $[RuCl_4(H_2O)_2]^{-}$ |

-continued

| | |
|---|---|
| $[RuCl_5(NO)]^{2-}$ | $[RuBr_5(NS)]^{2-}$ |
| $[Ru(CO)_3Cl_3]^{2-}$ | $[Ru(CO)Cl_5]^{2-}$ |
| $[Ru(CO)Br_5]^{2-}$ | $[OsCl_6]^{3-}$ |
| $[OsCl_5(NO)]^{2-}$ | $[Os(NS)Br_5]^{2-}$ |

The amount of these compounds is preferably $1\times10^{-9}$ to $1\times10^{-5}$ mol, particularly preferably $1\times10^{-8}$ to $1\times10^{-6}$ mol, per mole of silver halide.

The iridium compounds used in the present invention include hexachloroiridium, hexabromoiridium, hexaammineiridium, pentachloronitrosyliridium and so forth.

The silver halide emulsion used for the present invention is preferably subjected to chemical sensitization. The chemical sensitization may be performed by using a known method such as sulfur sensitization, selenium sensitization, tellurium sensitization and noble metal sensitization. These sensitization methods may be used each alone or in any combination. When these sensitization methods are used in combination, preferable combinations include sulfur and gold sensitizations, sulfur, selenium and gold sensitizations, sulfur, tellurium and gold sensitizations and so forth.

The sulfur sensitization used in the present invention is usually performed by adding a sulfur sensitizer and stirring the emulsion at a high temperature of 40° C. or above for a predetermined time. The sulfur sensitizer may be a known compound, and examples thereof include, in addition to the sulfur compounds contained in gelatin, various sulfur compounds such as thiosulfates, thioureas, thiazoles and rhodanines, among which thiosulfates and thioureas compounds are preferred. As the thiourea compounds, the tetra-substituted thiourea compounds described in U.S. Pat. No. 4,810,626 are particularly preferred. Although the amount of the sulfur sensitizer to be added varies depending on various conditions such as pH, temperature and grain size of silver halide at the time of chemical ripening, it is preferably $10^{-7}$ to $10^{-2}$ mol, more preferably $10^{-5}$ to $10^{-3}$ mol, per mol of silver halide.

The selenium sensitizer used for the present invention may be a known selenium compound. That is, the selenium sensitization is usually performed by adding a labile and/or non-labile selenium compound and stirring the emulsion at a high temperature of 40° C. or above for a predetermined time. Examples of the labile selenium compound include those described in JP-B-44-15748, JP-B-43-13489, JP-A-4-109240 and JP-A-4-324855. Among these, particularly preferred are those compounds represented by formulas (VIII) and (IX) described in JP-A-4-324855.

The tellurium sensitizer that can be used for the present invention is a compound capable of producing silver telluride, presumably serving as a sensitization nucleus, on the surface or inside of silver halide grains. The formation rate of silver telluride in a silver halide emulsion can be examined according to the method described in JP-A-5-313284.

Specifically, there can be used the compounds described in U.S. Pat. Nos. 1,623,499, 3,320,069 and 3,772,031; British Patents Nos. 235,211, 1,121,496, 1,295,462 and 1,396,696; Canadian Patent No. 800,958; JP-A-4-204640, JP-A-4-271341, JP-A-4-333043, JP-A-5-303157; J. Chem. Soc. Chem. Commun., 635 (1980); ibid., 1102 (1979); ibid., 645 (1979); J. Chem. Soc. Perkin. Trans., 1, 2191 (1980); S. Patai (compiler), The Chemistry of Organic Selenium and Tellurium Compounds, Vol. 1 (1986); and ibid., Vol. 2

(1987). The compounds represented by the formulas (II), (III) and (IV) described in JP-A-4-324855 are particularly preferred.

The amount of the selenium or tellurium sensitizer used for the present invention varies depending on silver halide grains used, chemical ripening conditions and so forth. However, it is generally about $10^{-8}$ to about $10^{-2}$ mol, preferably about $10^{-7}$ to about $10^{-3}$ mol, per mol of silver halide. The conditions for chemical sensitization in the present invention are not particularly restricted. However, in general, pH is 5 to 8, pAg is 6 to 11, preferably 7 to 10, and temperature is 40 to 95° C., preferably 45 to 85° C.

Noble metal sensitizers that can be used for the present invention include gold, platinum, palladium, iridium and so forth, and gold sensitization is particularly preferred. Specific examples of the gold sensitizers used for the present invention include chloroauric acid, potassium chloroaurate, potassium aurithiocyanate, gold sulfide and so forth, which can be used in an amount of about $10^{-7}$ to about $10^{-2}$ mol per mol of silver halide.

As for the silver halide emulsion used for the present invention, production or physical ripening process for the silver halide grains may be performed in the presence of a cadmium salt, sulfite, lead salt, thallium salt or the like.

In the present invention, reduction sensitization may be used. Examples of the reduction sensitizer include stannous salts, amines, formamidinesulfinic acid, silane compounds and so forth.

To the silver halide emulsion used in the present invention, a thiosulfonic acid compound may be added according to the method described in EP293917A.

In the silver halide photographic light-sensitive material of the present invention, one to three kinds of silver halide emulsions are preferably used. When two or more kinds of silver halide emulsions are used, for example, those having different average grain sizes, different halogen compositions, those containing different amount and/or types of metal complexes, those having different crystal habits, those subjected to chemical sensitizations with different conditions or those having different sensitivities, may be used in combination. In order to obtain high contrast, it is especially preferable to coat an emulsion having higher sensitivity as it becomes closer to a support as described in JP-A-6-324426.

The photosensitive silver halide emulsion of the present invention may be spectrally sensitized with a sensitizing dye for comparatively long wavelength, i.e., blue light, green light, red light or infrared light. The compounds of the formula [I] mentioned in JP-A-55-45015 and the compounds of the formula [I] mentioned in JP-A-9-160185 are preferred, and the compounds of the formula [I] mentioned in JP-A-9-160185 are particularly preferred. Specifically, the compounds of (1) to (19) mentioned in JP-A-55-45015, the compounds of I-1 to I-40 and the compounds of I-56 to I-85 mentioned in JP-A-9-160185 and so forth can be mentioned.

Examples of the other sensitizing dyes include a cyanine dye, merocyanine dye, complex cyanine dye, complex merocyanine dye, holopolar cyanine dye, styryl dye, hemicyanine dye, oxonol dye, hemioxonol dye and so forth.

Other useful sensitizing dyes that can be used for the present invention are described in, for example, Research Disclosure, Item 17643, IV-A, page 23 (December, 1978); ibid., Item 18341×, page 437 (August, 1979) and references cited in the same.

In particular, sensitizing dyes having spectral sensitivity suitable for spectral characteristics of light sources in various scanners, image setters or photomechanical cameras can also be advantageously selected.

For example, A) for an argon laser light source, Compounds (I)-1 to (I)-8 described in JP-A-60-162247, Compounds I-1 to I-28 described in JP-A-2-48653, Compounds I-1 to I-13 described in JP-A-4-330434, compounds of Examples 1 to 14 described in U.S. Pat. No. 2,161,331, and Compounds 1 to 7 described in West Germany Patent No. 936,071; B) for a helium-neon laser light source, Compounds I-1 to I-38 described in JP-A-54-18726, Compounds I-1 to I-35 described in JP-A-6-75322, and Compounds I-1 to I-34 described in JP-A-7-287338; C) for an LED light source, Dyes 1 to 20 described in JP-B-55-39818, Compounds I-1 to I-37 described in JP-A-62-284343, and Compounds I-1 to I-34 described in JP-A-7-287338; D) for a semiconductor laser light source, Compounds I-1 to I-12 described in JP-A-59-191032, Compounds I-1 to I-22 described in JP-A-60-80841, Compounds I-1 to I-29 described in JP-A-4-335342, and Compounds I-1 to I-18 described in JP-A-59-192242; and E) for a tungsten or xenon light source of a photomechanical camera, besides the aforementioned compounds, Compounds I-41 to I-55 and Compounds I-86 to I-97 described in JP-A-9-160185, and Compounds 4-A to 4-S, Compounds 5-A to 5-Q, and Compounds 6-A to 6-T described in JP-A-6-242547 and so forth may also be advantageously selected.

These sensitizing dyes may be used individually or in combination, and a combination of sensitizing dyes is often used for the purpose of, in particular, supersensitization. In combination with a sensitizing dye, a dye which itself has no spectral sensitization effect, or a material that absorbs substantially no visible light, but exhibits supersensitization effect may be incorporated into the emulsion.

Useful sensitizing dyes, combinations of dyes that exhibit supersensitization effect, and materials that show supersensitization effect are described in, for example, Research Disclosure, Vol. 176, 17643, page 23, Item IV-J (December 1978); JP-B-49-25500, JP-B-43-4933, JP-A-59-19032, JP-A-59-192242 mentioned above and so forth.

The sensitizing dyes used for the present invention may be used in a combination of two or more of them. The sensitizing dye may be added to a silver halide emulsion by dispersing it directly in the emulsion, or by dissolving it in a sole or mixed solvent of such solvents as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide, and then adding the solution to the emulsion.

Alternatively, the sensitizing dye may be added to the emulsion by the method disclosed in U.S. Pat. No. 3,469,987, in which a dye is dissolved in a volatile organic solvent, the solution is dispersed in water or a hydrophilic colloid and the dispersion is added to the emulsion; the methods disclosed in JP-B-44-23389, JP-B-44-27555, JP-B-57-22091 and so forth, in which a dye is dissolved in an acid and the solution is added to the emulsion, or a dye is made into an aqueous solution in the presence of an acid or base and the solution is added to the emulsion; the method disclosed in U.S. Pat. Nos. 3,822,135, 4,006,025 or the like, in which a dye is made into an aqueous solution or a colloid dispersion in the presence of a surfactant, and the solution or colloid dispersion is added to the emulsion; the method disclosed in JP-A-53-102733 and JP-A-58-105141, in which a dye is directly dispersed in a hydrophilic colloid and the dispersion is added to the emulsion; or the method disclosed in JP-A-51-74624, in which a dye is dissolved by using a compound capable of red-shift and the solution is added to the emulsion. Ultrasonic waves may also be used for the preparation of the solution.

The sensitizing dye used for the present invention may be added to a silver halide emulsion at any step known to be useful during the preparation of emulsion. For example, the dye may be added at a step of formation of silver halide grains and/or in a period before desalting or at a step of desilverization and/or in a period after desalting and before initiation of chemical ripening, as disclosed in, for example, U.S. Pat. Nos. 2,735,766, 3,628,960, 4,183,756, 4,225,666, JP-A-58-184142, JP-A-60-196749 etc., or the dye may be added in any period or at any step before coating of the emulsion, such as immediately before or during chemical ripening, or in a period after chemical ripening but before coating, as disclosed in, for example, JP-A-58-113920. Further, a sole kind of compound alone or compounds different in structure in combination may be added as divided portions, for example, a part is added during grain formation, and the remaining during chemical ripening or after completion of the chemical ripening, or a part is added before or during chemical ripening and the remaining after completion of the chemical ripening, as disclosed in, for example, U.S. Pat. No. 4,225,666 and JP-A-58-7629. The kinds of compounds or the kinds of the combinations of compounds added as divided portions may be changed.

The addition amount of the sensitizing dye used for the present invention varies depending on the shape, size, halogen composition of silver halide grains, method and degree of chemical sensitization, kind of antifoggant and so forth, but the addition amount may be $4\times10^{-6}$ to $8\times10^{-3}$ mol per mol of silver halide. For example, when the silver halide grain size is from 0.2 to 1.3 μm, the addition amount is preferably from $2\times10^{-7}$ to $3.5\times10^{-6}$, more preferably from $6.5\times10^{-7}$ to $2.0\times10^{-6}$ mol, per $m^2$ of the surface area of silver halide grains.

The silver halide photographic light-sensitive material of the present invention has a characteristic curve with a gamma of 5.0 or more, preferably 5.0 to 100, more preferably 5.0 to 30.

The "gamma" used in the present invention means inclination of a straight line connecting two points corresponding to optical densities of 0.1 and 1.5 on a characteristic curve drawn in orthogonal coordinates of optical density (y-axis) and common logarithm of light exposure x-axis), in which equal unit lengths are used for the both axes. That is, when the angle formed by the straight line and the x-axis is represented by θ, the gamma is represented by tan θ.

In the present invention, in order to obtain the characteristic curve, the silver halide photographic light-sensitive material is processed by using a developer (QR-$D^1$ produced by Fuji Photo Film Co., Ltd) and a fixer (NF-1 produced by Fuji Photo Film Co., Ltd.) in an automatic developing machine (FG-680AG produced by Fuji Photo Film Co., Ltd) with development conditions of 35° C. for 30 seconds.

Various methods can be used as the method for obtaining a silver halide photographic light-sensitive material having the characteristic curve defined by the present invention. For example, gamma of the silver halide photographic light-sensitive material can be controlled by using silver halide emulsion containing a heavy metal that can realize high contrast (e.g., a metal belonging to Group VIII). It is particularly preferable to use a silver halide emulsion containing a rhodium compound, iridium compound, ruthenium compound or the like. Further, it is also preferable to add at least one kind of compound selected from hydrazine derivatives, amine compounds, phosphonium compounds and so forth as a nucleating agent on the side having an emulsion layer.

The silver halide photographic light-sensitive material of the present invention can contain a hydrazine compound as a nucleating agent. It particularly preferably contains at least one kind of compound represented by the following formula (D).

Formula (D)

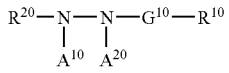

In the formula, $R^{20}$ represents an aliphatic group, an aromatic group or a heterocyclic group, $R^{10}$ represents a hydrogen atom or a blocking group, and $G^{10}$ represents —CO—, —COCO—, —C(═S)—, —$SO_2$—, —SO—, —PO($R^{30}$)— group ($R^{30}$ is selected from the same range of groups defined for $R^{10}$, and $R^{30}$ may be different from $R^{10}$) or an iminomethylene group. $A^{10}$ and $A^{20}$ both represent a hydrogen atom, or one of them represents a hydrogen atom and the other represents a substituted or unsubstituted alkylsulfonyl group, a substituted or unsubstituted arylsulfonyl group or a substituted or unsubstituted acyl group.

In the formula (D), the aliphatic group represented by $R^{20}$ is preferably a substituted or unsubstituted straight, branched or cyclic alkyl, alkenyl or alkynyl group having 1 to 30 carbon atoms.

In the formula (D), the aromatic group represented by $R^{20}$ is a monocyclic or condensed-ring aryl group. Examples of the ring include benzene ring and naphthalene ring. The heterocyclic group represented by $R^{20}$ is a monocyclic or condensed-ring, saturated or unsaturated, aromatic or non-aromatic heterocyclic group. Examples of the ring include pyridine ring, pyrimidine ring, imidazole ring, pyrazole ring, quinoline ring, isoquinoline ring, benzimidazole ring, thiazole ring, benzothiazole ring, piperidine ring, triazine ring and so forth.

$R^{20}$ is preferably an aryl group, especially preferably a phenyl group.

The group represented by $R^{20}$ may be substituted with a substituent. Typical examples of the substituent include, for example, a halogen atom (fluorine, chlorine, bromine or iodine atom), an alkyl group (including an aralkyl group, a cycloalkyl group, an active methine group etc.), an alkenyl group, an alkynyl group, an aryl group, a heterocyclic group, a quaternized nitrogen atom-containing heterocyclic group (e.g., pyridinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group containing a repeating unit of ethyleneoxy group or propyleneoxy group), an aryloxy group, a heterocyclyloxy group, an acyloxy group, an (alkoxy or aryloxy)carbonyloxy group, a carbamoyloxy group, a sulfonyloxy group, an amino group, an (alkyl, aryl or heterocyclyl)amino group, an N-substituted nitrogen-containing heterocyclic group, an acylamino group, a sulfonamido group, a ureido group, a thioureido group, a isothioureido group, an imido group, an (alkoxy or aryloxy) carbonylamino group, a sulfamoylamino group, a semicarbazido group, a thiosemicarbazido group, a hydrazino group, a quaternary ammonio group, an oxamoylamino group, an (alkyl or aryl)sulfonylureido group, an acylureido group, an N-acylsulfamoylamino group, a nitro group, a mercapto group, an (alkyl, aryl or heterocyclyl)thio group, an (alkyl or aryl)sulfonyl group, an (alkyl or aryl)sulfinyl group, a sulfo group or a salt thereof, a sulfamoyl group, an N-acylsulfamoyl group, a sulfonylsulfamoyl group or a salt thereof, a group having phosphoric acid amide or phosphoric acid ester structure and so forth.

These substituents may be further substituted with any of these substituents.

Preferred examples of the substituent that $R^{20}$ may have include an alkyl group having 1 to 30 carbon atoms (including an active methylene group), an aralkyl group, a heterocyclic group, a substituted amino group, an acylamino group, a sulfonamido group, a ureido group, a sulfamoylamino group, an imido group, a thioureido group, a phosphoric acid amido group, a hydroxyl group, an alkoxy group, an aryloxy group, an acyloxy group, an acyl group, an alkoxycarbonyl group, an aryloxycarbonyl group, a carbamoyl group, a carboxyl group or a salt thereof, an (alkyl, aryl or heterocyclyl)thio group, a sulfo group or a salt thereof, a sulfamoyl group, a halogen atom, a cyano group, a nitro group and so forth.

In the formula (D), $R^{10}$ represents a hydrogen atom or a blocking group, and specific examples of the blocking group include an alkyl group, an alkenyl group, an alkynyl group, an aryl group, a heterocyclic group, an alkoxy group, an aryloxy group, an amino group and a hydrazino group.

The alkyl group represented by $R^{10}$ is preferably an alkyl group having 1 to 10 carbon atoms. Examples of the alkyl group include methyl group, trifluoromethyl group, difluoromethyl group, 2-carboxytetrafluoroethyl group, pyridiniomethyl group, difluoromethoxymethyl group, difluorocarboxymethyl group, 3-hydroxypropyl group, methanesulfonamidomethyl group, benzenesulfonamidomethyl group, hydroxymethyl group, methoxymethyl group, methylthiomethyl group, phenylsulfonylmethyl group, o-hydroxybenzyl group and so forth. The alkenyl group is preferably an alkenyl group having 1 to 10 carbon atoms. Examples of the alkenyl group include vinyl group, 2,2-dicyanovinyl group, 2-ethoxycarbonylvinyl group, 2-trifluoro-2-methoxycarbonylvinyl group and so forth. The alkynyl group is preferably an alkynyl group having 1 to 10 carbon atoms. Examples of the alkynyl group include ethynyl group, 2-methoxycarbonylethynyl group and so forth. The aryl group is preferably a monocyclic or condensed-ring aryl group, and especially preferably an aryl group containing a benzene ring. Examples of the aryl group include phenyl group, 3,5-dichlorophenyl group, 2-methanesulfonamidophenyl group, 2-carbamoylphenyl group, 4-cyanophenyl group, 2-hydroxymethylphenyl group and so forth.

The heterocyclic group is preferably a 5- or 6-membered, saturated or unsaturated, monocyclic or condensed-ring heterocyclic group that contains at least one nitrogen, oxygen or sulfur atom, and it may be a heterocyclic group containing a quaternized nitrogen atom. Examples of the heterocyclic group include a morpholino group, a piperidino group (N-substituted), a piperazino group, an imidazolyl group, an indazolyl group (e.g., 4-nitroindazolyl group etc.), a pyrazolyl group, a triazolyl group, a benzimidazolyl group, a tetrazolyl group, a pyridyl group, a pyridinio group (e.g., N-methyl-3-pyridinio group), a quinolinio group, a quinolyl group and so forth. Among these, especially preferred are a morpholino group, a piperidino group, a pyridyl group, a pyridinio group and so forth.

The alkoxy group is preferably an alkoxy group having 1 to 8 carbon atoms. Examples of the alkoxy group include methoxy group, 2-hydroxyethoxy group, benzyloxy group and so forth. The aryloxy group is preferably a phenyloxy group. The amino group is preferably an unsubstituted amino group, an alkylamino group having 1 to 10 carbon atoms, an arylamino group or a saturated or unsaturated heterocyclylamino group (including a quaternized nitrogen atom-containing heterocyclic group). Examples of the amino group include 2,2,6,6-tetramethylpiperidin-4-ylamino group, propylamino group, 2-hydroxyethylamino group, anilino group, o-hydroxyanilino group, 5-benzotriazolylamino group, N-benzyl-3-pyridinioamino group and so forth. The hydrazino group is especially preferably a substituted or unsubstituted hydrazino group, a substituted or unsubstituted phenylhydrazino group (e.g., 4-benzenesulfonamidophenylhydrazino group) or the like.

The group represented by $R^{10}$ may be substituted with a substituent. Preferred examples of the substituent are the same as those exemplified as the substituent of $R^{20}$.

In the formula (D), $R^{10}$ may be a group capable of splitting the $G^{10}$—$R^{10}$ moiety from the residual molecule and subsequently causing a cyclization reaction that produces a cyclic structure containing atoms of the —$G^{10}$—$R^{10}$ moiety. Examples of such a group include those described in, for example, JP-A-63-29751 and so forth.

The hydrazine derivatives represented by the formula (D) may contain an absorptive group capable of being absorbed onto silver halide. Examples of the absorptive group include an alkylthio group, an arylthio group, a thiourea group, a thioamido group, a mercaptoheterocyclic group, a triazole group and so forth, described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. Further, these groups capable of being absorbed onto silver halide may be modified into a precursor thereof. Examples of the precursor include those groups described in JP-A-2-285344.

$R^{10}$ or $R^{20}$ in the formula (D) may contain a polymer or ballast group that is usually used for immobile photographic additives such as couplers. The ballast group used in the present invention means a group having 6 or more carbon atoms including such a linear or branched alkyl group (or an alkylene group), an alkoxy group (or an alkyleneoxy group), an alkylamino group (or an alkyleneamino group), an alkylthio group or a group having any of these groups as a partial structure, more preferably a group having 7 to 24 carbon atoms including such a linear or branched alkyl group (or an alkylene group), an alkoxy group (or an alkyleneoxy group), an alkylamino group (or an alkyleneamino group), an alkylthio group or a group having any of these groups as a partial structure. Examples of the polymer include those described in, for example, JP-A-1-100530.

$R^{10}$ or $R^{20}$ in the formula (D) may contain a plurality of hydrazino groups as substituents. In such a case, the compound represented by the formula (D) is a multi-mer for hydrazino group. Specific examples of such a compound include those described in, for example, JP-A-64-86134, JP-A-4-16938, JP-A-5-197091, WO95/32452, WO95/32453, JP-A-9-179229, JP-A-9-235264, JP-A-9-235265, JP-A-9-235266, JP-A-9-235267 and so forth.

$R^{10}$ or $R^{20}$ in the formula (D) may contain a cationic group (specifically, a group containing a quaternary ammonio group, a group containing a quaternized phosphorus atom, a nitrogen-containing heterocyclic group containing a quaternized nitrogen atom etc.), a group containing repeating units of ethyleneoxy group or propyleneoxy group, an (alkyl, aryl or heterocyclyl)thio group, or a dissociating group (this means a group or partial structure having a proton of low acidity that can be dissociated with an alkaline developer or a salt thereof, specifically, for example, carboxyl group (—COOH), sulfo group (—$SO_3H$), phosphonic acid group (—$PO_3H$), phosphoric acid group (—$OPO_3H$), hydroxy group (—OH), mercapto group (—SH), —$SO_2NH_2$ group, N-substituted sulfonamido group (—$SO_2NH$—, —$CONHSO_2$— group, —$CONHSO_2NH$— group, —$NHCONHSO_2$— group, —$SO_2NHSO_2$— group), —CONHCO— group, active methylene group, —NH— group contained in a nitrogen-containing heterocyclic group, a salt thereof etc.). Examples of the compounds containing these groups include those described in, for example, JP-A-7-234471, JP-A-5-333466, JP-A-6-19032, JP-A-6-19031, JP-A-5-45761, U.S. Pat. Nos. 4,994,365 and 4,988,604, JP-A-7-259240, JP-A-7-5610, JP-A-7-244348, and German Patent No. 4006032, JP-A-11-7093 and so forth.

In the formula (D), $A^{10}$ and $A^{20}$ each represent a hydrogen atom or an alkyl- or arylsulfonyl group having 20 or less carbon atoms (preferably, phenylsulfonyl group, or a phenylsulfonyl group substituted with substituent(s) so that the total of the Hammett substituent constant of the substituent(s) should become −0.5 or more), or an acyl group having 20 or less carbon atoms (preferably, benzoyl group, a benzoyl group substituted with substituent(s) so that the total of the Hammett substituent constant of the substituent(s) should become −0.5 or more, or a straight, branched or cyclic, substituted or unsubstituted aliphatic acyl group (examples of the substituent include a halogen atom, an ether group, a sulfonamido group, a carbonamido group, a hydroxyl group, a carboxyl group, a sulfo group etc.)). $A^{10}$ and $A^{20}$ each most preferably represent a hydrogen atom.

Hereafter, hydrazine derivatives especially preferably used for the present invention will be explained.

$R^{20}$ is especially preferably a substituted phenyl group. Particularly preferred as the substituent are a sulfonamido group, an acylamino group, a ureido group, a carbamoyl group, a thioureido group, an isothioureido group, a sulfamoylamino group, an N-acylsulfamoylamino group and so forth, further preferred are a sulfonamido group and a ureido group, and the most preferred is a sulfonamido group.

The hydrazine derivatives represented by the formula (D) particularly preferably have at least one substituent, directly or indirectly on $R^{20}$ or $R^{10}$, selected from the group consisting of a ballast group, a group that can be absorbed on silver halide, a group containing quaternary ammonio group, a nitrogen-containing heterocyclic group containing a quaternized nitrogen atom, a group containing repeating units of ethyleneoxy group, an (alkyl, aryl or heterocyclyl)thio group, a dissociating group capable of dissociating in an alkaline developer, and a hydrazino group capable of forming a multi-mer (group represented by —NHNH—$G^{10}$—$R^{10}$). Furthermore, $R^{20}$ preferably directly or indirectly has one group selected from the aforementioned groups as a substituent, and $R^{20}$ is most preferably a phenyl group substituted with a benzenesulfonamido group directly or indirectly having one of the aforementioned groups as a substituent on the benzene ring.

Among those groups represented by $R^{10}$, when $G^{10}$ is —CO— group, preferred are a hydrogen atom, an alkyl group, an alkenyl group, an alkynyl group, an aryl group and a heterocyclic group, more preferred are a hydrogen atom, an alkyl group or a substituted aryl group (the substituent is especially preferably an electron-withdrawing group or o-hydroxymethyl group), and the most preferred are a hydrogen atom and an alkyl group.

When $G^{10}$ is —COCO— group, an alkoxy group, an aryloxy group and an amino group are preferred, and a substituted amino group, specifically an alkylamino group, an arylamino group and a saturated or unsaturated heterocyclylamino group are especially preferred.

Further, when $G^{10}$ is —$SO_2$— group, $R^{10}$ is preferably an alkyl group, an aryl group or a substituted amino group.

In the formula (D), $G^{10}$ is preferably —CO— group or —COCO— group, especially preferably —CO— group.

Specific examples of the compounds represented by the formula (D) are illustrated below. However, the present invention is not limited to the following compounds.

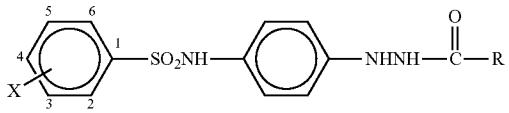
| | X = | R = —H | R = —$C_2F_4COOH$ (or —$C_2F_4COO^{\ominus}K^{\oplus}$) | R = 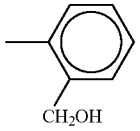 | R = 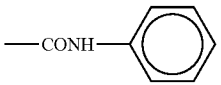 |
|---|---|---|---|---|---|
| D-1 | 3-$NHCOC_9H_{19}$(n) | 1a | 1b | 1c | 1d |
| D-2 | 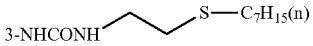 | 2a | 2b | 2c | 2d |
| D-3 | 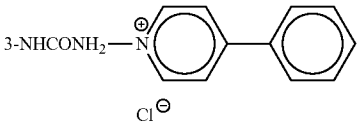 | 3a | 3b | 3c | 3d |
| D-4 | 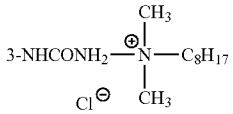 | 4a | 4b | 4c | 4d |
| D-5 | 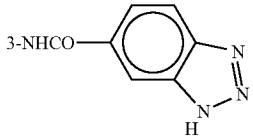 | 5a | 5b | 5c | 5d |
| D-6 | 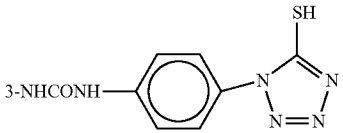 | 6a | 6b | 6c | 6d |
| D-7 | 2,4-$(CH_3)_2$'3-$SC_2H_4$-$(OC_2H_4)_4$-$OC_8H_{17}$ | 7a | 7b | 7c | 7d |

-continued
| | X = | R = —H | —$CF_2H$ | 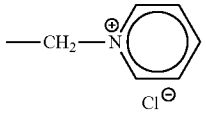 | 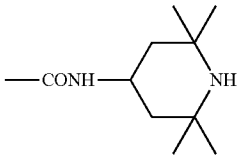 |
|---|---|---|---|---|---|
| D-8 | 3-$CONHCH_2CH(C_2H_5)C_4H_9$ | 8a | 8e | 8f | 8g |
| D-9 | 6-$OCH_3$-3-$C_5H_{11}$(t) | 9a | 9e | 9f | 9g |
| D-10 | 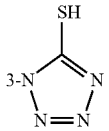 | 10a | 10e | 10f | 10g |
| D-11 | 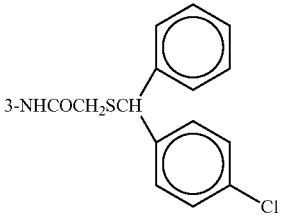 | 11a | 11e | 11f | 11g |
| D-12 | 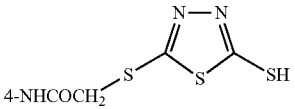 | 12a | 12e | 12f | 12g |
| D-13 | 3-$NHCOCH(CH_2COOH)C_8H_{17}$ | 13a | 13e | 13f | 13g |
| D-14 | 3,5-$(CONHCH_2CH(C_2H_5)C_4H_9)_2$ | 14a | 14e | 14f | 14g |

-continued
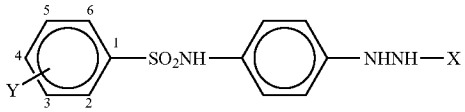
| | Y = | X = —CHO | —COCF$_3$ | —SO$_2$CH$_3$ | —P(=O)(OC$_2$H$_5$)$_2$ |
|---|---|---|---|---|---|
| D-15 | 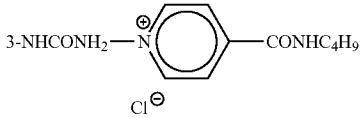 | 15a | 15h | 15i | 15j |
| D-16 | 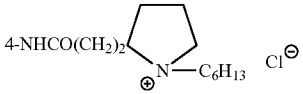 | 16a | 16h | 16i | 16j |
| D-17 | 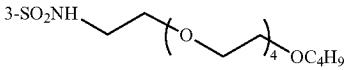 | 17a | 17h | 17i | 17j |
| D-18 | 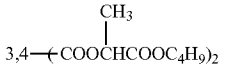 | 18a | 18h | 18i | 18j |
| D-19 | 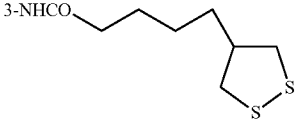 | 19a | 19h | 19i | 19j |
| D-20 | 3-NHSO$_2$NH—C$_8$H$_{17}$ | 20a | 20h | 20i | 20j |
| D-21 | 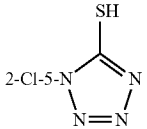 | 21a | 21h | 21i | 21j |

-continued
| | | R = | | | |
|---|---|---|---|---|---|
| | | —H | —$CF_2H$ | —$CH_2$— 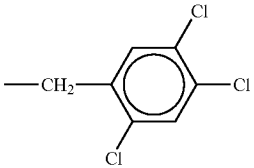 | —$CONHC_3H_7$ |
| D-22 | 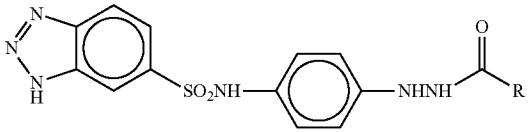 | 22a | 22e | 22k | 22l |
| D-23 | 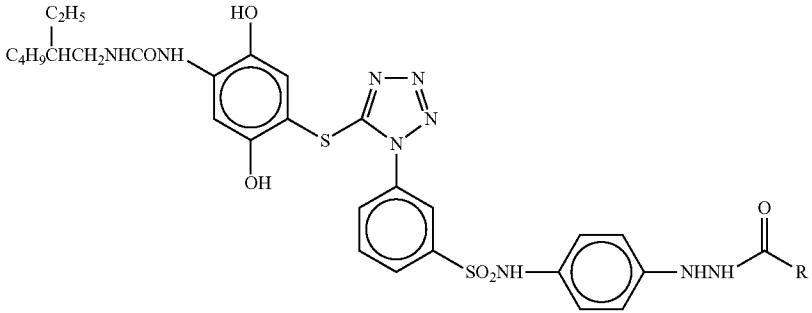 | 23a | 23e | 23k | 23l |
| D-24 | 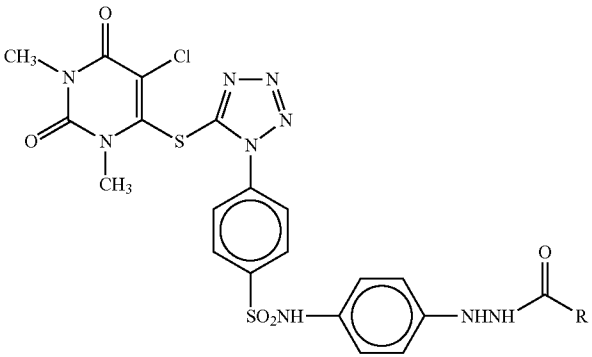 | 24a | 24e | 24k | 24l |

-continued
| | | | | | |
|---|---|---|---|---|---|
| D-25 | 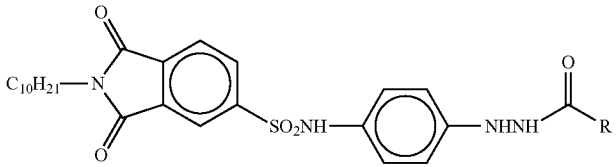 | 25a | 25e | 25k | 25l |
| D-26 | 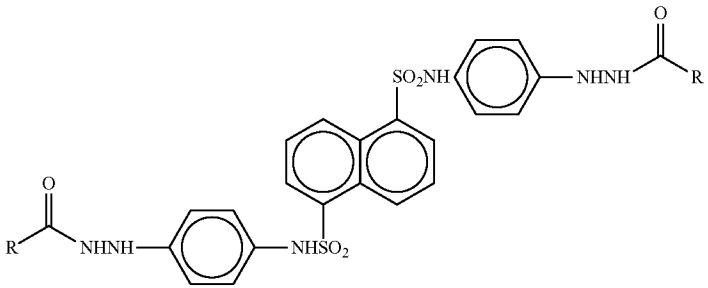 | 26a | 26e | 26k | 26l |
| D-27 | 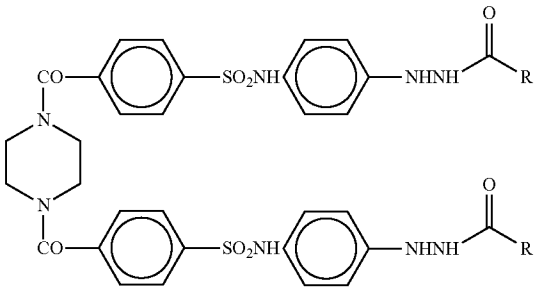 | 27a | 27e | 27k | 27l |
| D-28 | 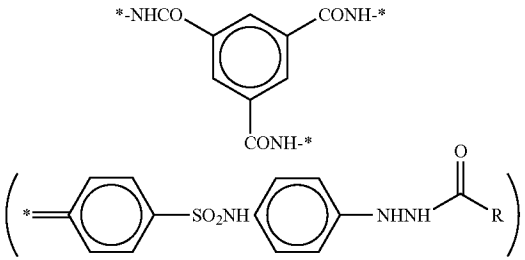 | 28a | 28e | 28k | 28l |

-continued
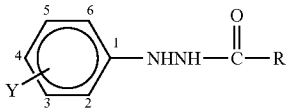
| | Y = | R = —H | —$CH_2OCH_3$ | 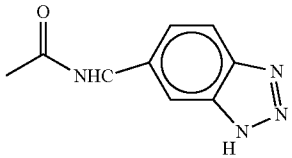 | 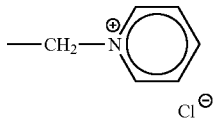 |
|---|---|---|---|---|---|
| D-29 | 4-NHC(=S)NH—$C_8H_{17}$(n) | 29a | 29m | 29n | 29f |
| D-30 | 4-NHP(=S)($OCH_2$)$_2$ | 30a | 30m | 30n | 30f |
| D-31 | 4-NHCONH—$(CH_2)_3O$ | 31a | 31m | 31n | 31f |
| D-32 | 4-OH, 3-NHCONH$CH_2$CH($C_2H_5$)—$C_4H_9$ | 32a | 32m | 32n | 32f |
| D-33 | 4-$NHSO_2(CH_2)_2NHCO$ | 33a | 33m | 33n | 33f |
| D-34 | 4-$OCH_2$ | 34a | 34m | 34n | 34f |
| D-35 | 4-NHCONHN($CH_2$)$_2$ | 35a | 35m | 35n | 35f |

-continued
| | Y = | R = —H | —$C_3F_4$—COOH | —$CONHCH_2$ | 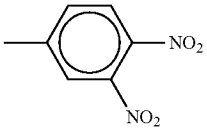 |
|---|---|---|---|---|---|
| D-36 | 2-$NHSO_2CH_3$— <br> 4-$NHCONH(CH_2)_3S$— 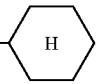 | 36a | 360 | 36p | 36q |
| D-37 | 2-$OCH_2$— <br> 4-$NHSO_2C_{12}H_{25}$ | 37a | 37o | 37p | 37q |
| D-38 | 2-$NHCOC_{11}H_{23}$— <br> 4-$NHSO_2CF_3$ | 38a | 38o | 38p | 38q |
| D-39 | 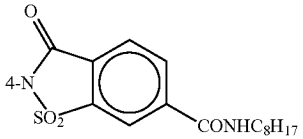 | 39a | 39o | 39p | 39q |
| D-40 | 4-$OCO(CH_2)_2COOC_6H_{13}$ | 40a | 40o | 40p | 40q |
| D-41 | 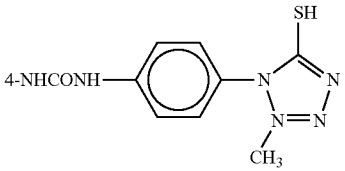 | 41a | 41o | 41p | 41q |
| D-42 | 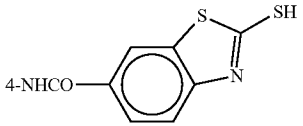 | 42a | 42o | 42p | 42q |

-continued
D-43
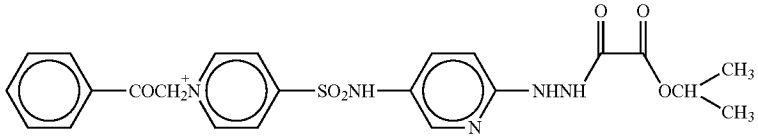
D-44
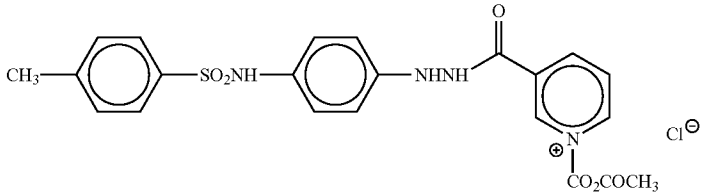
D-45
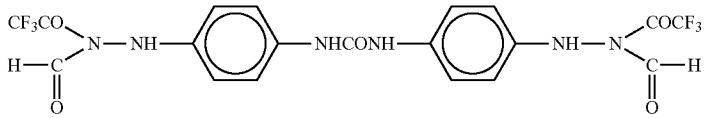
D-46
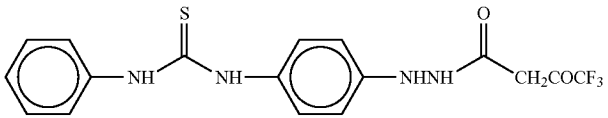
D-47
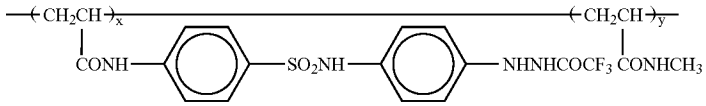
x:y = 3:97 MW ≈ 100,000
D-48
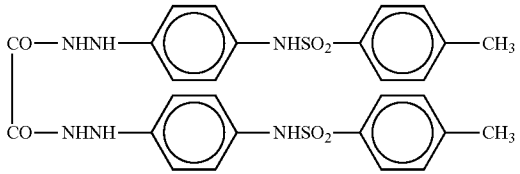
D-49
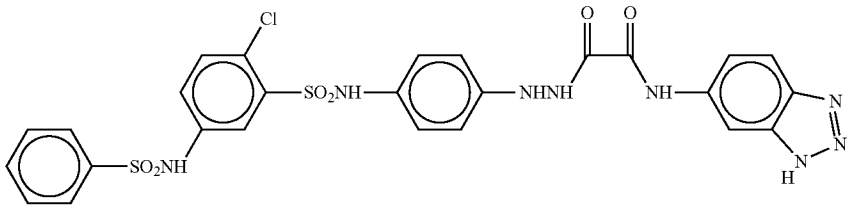
| No. |
|---|
D-50
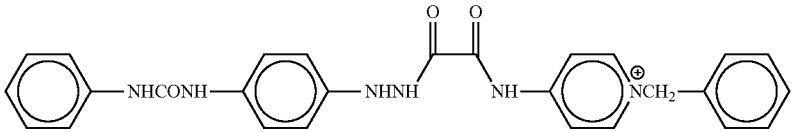
D-51
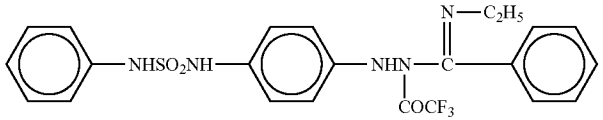

-continued
D-52
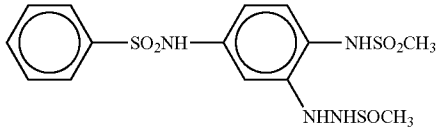
D-53
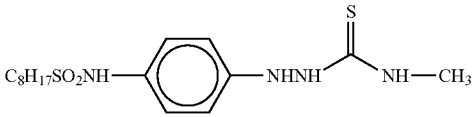
D-54
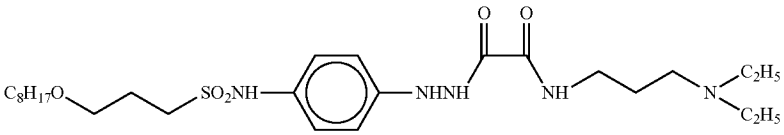
D-55
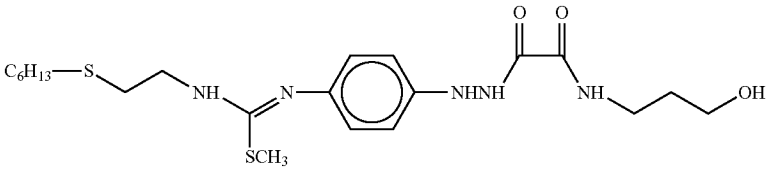
D-56
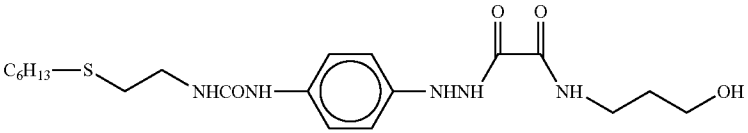
D-57
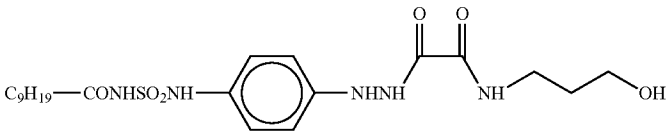
D-58
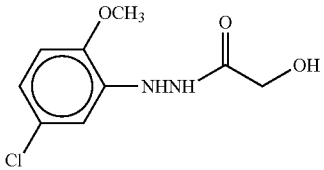

-continued
D-59
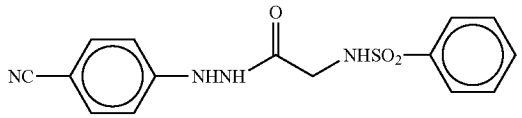
D-60
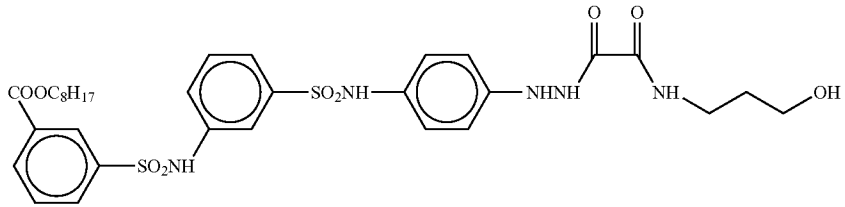
D-61
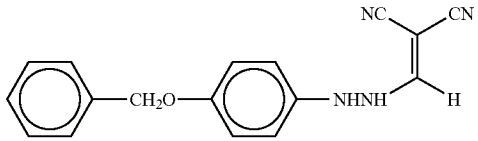
D-62
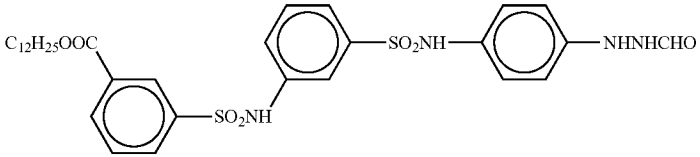
D-63
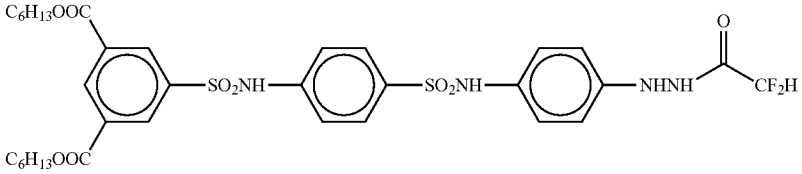
D-64
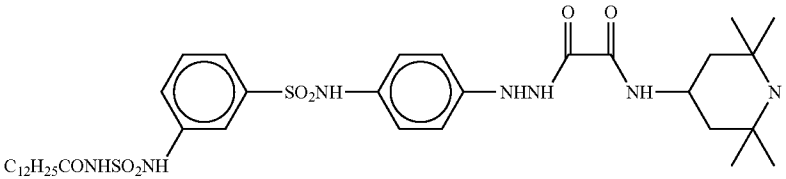

-continued
D-65
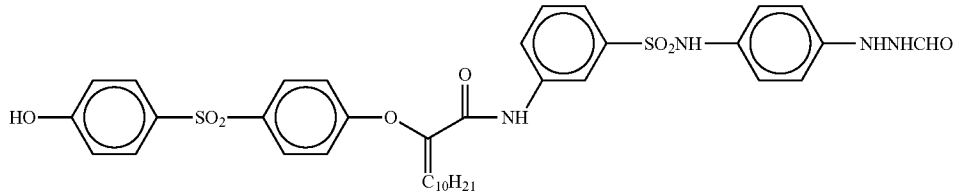
D-66
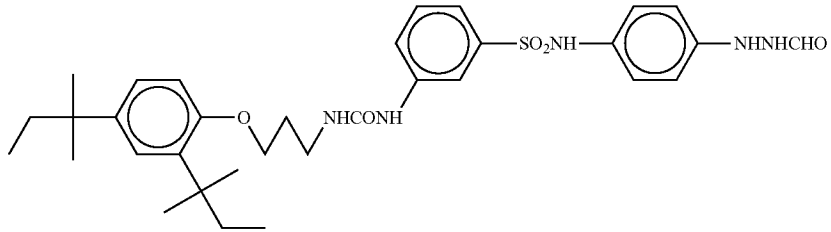
D-67
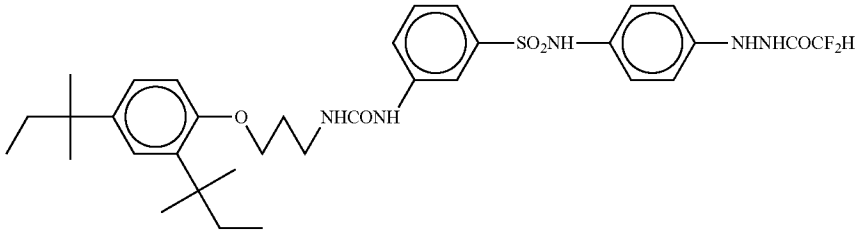
(D-68)
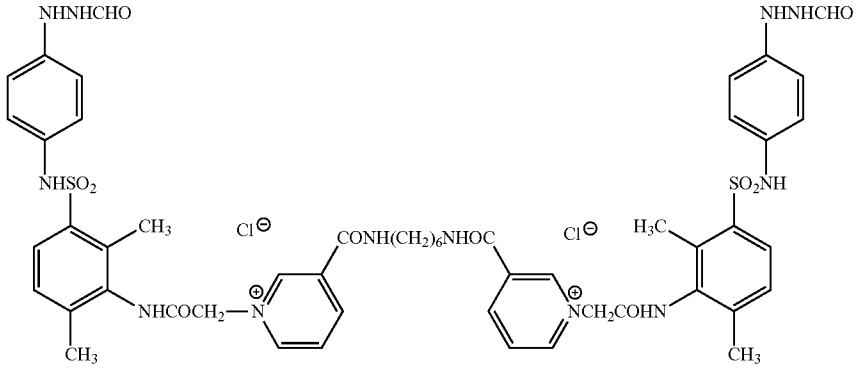

-continued
(D-69)
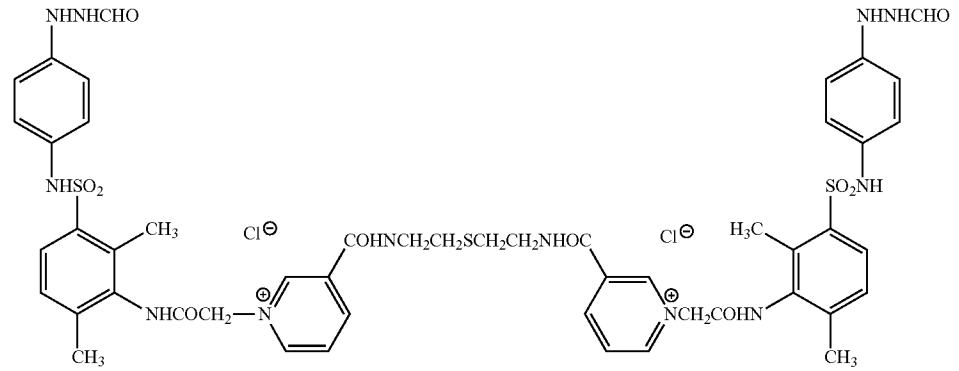
(D-70)
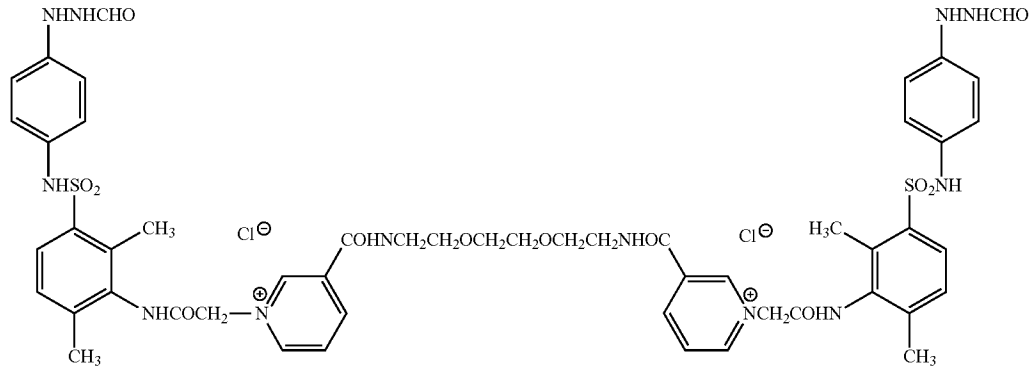

-continued
(D-71)
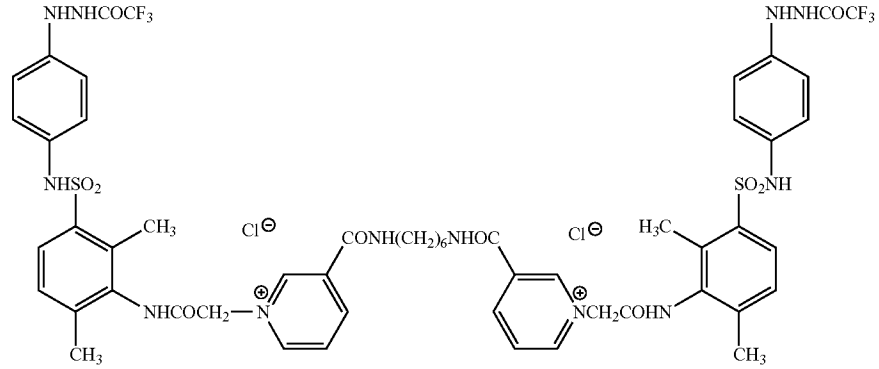
(D-72)
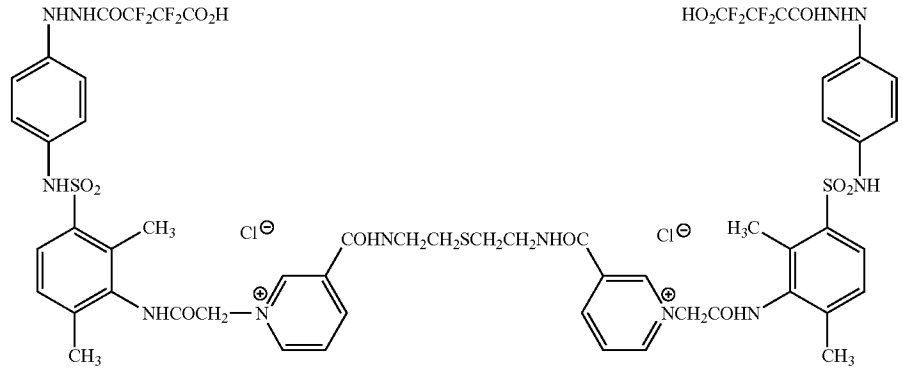

-continued
(D-73)
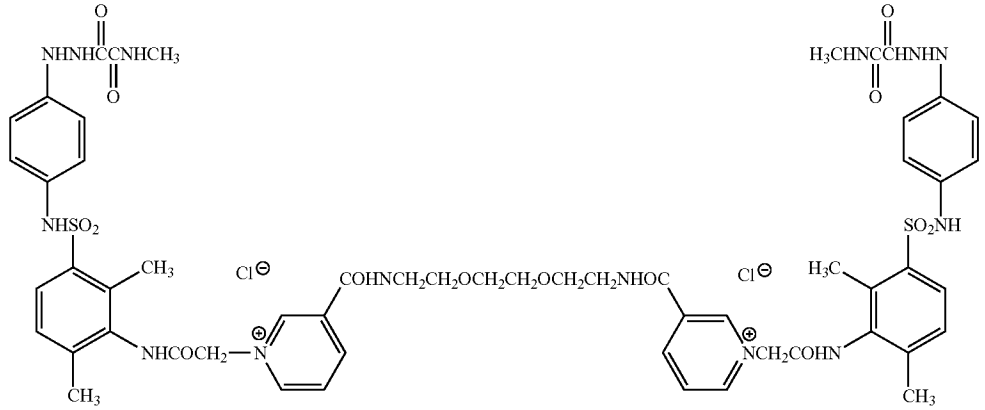
(D-74)
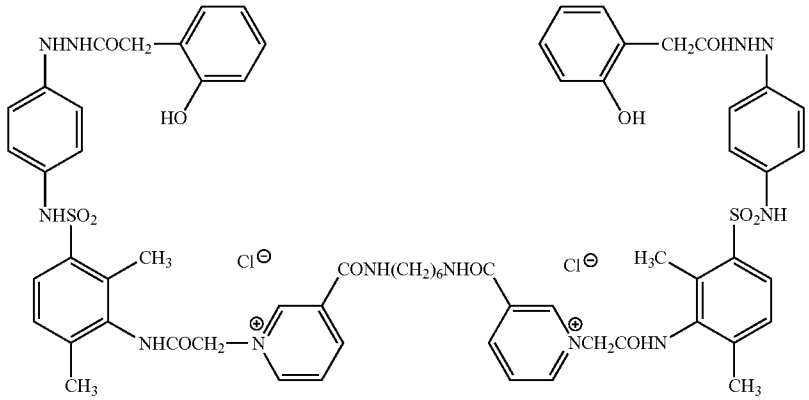

-continued
(D-75)
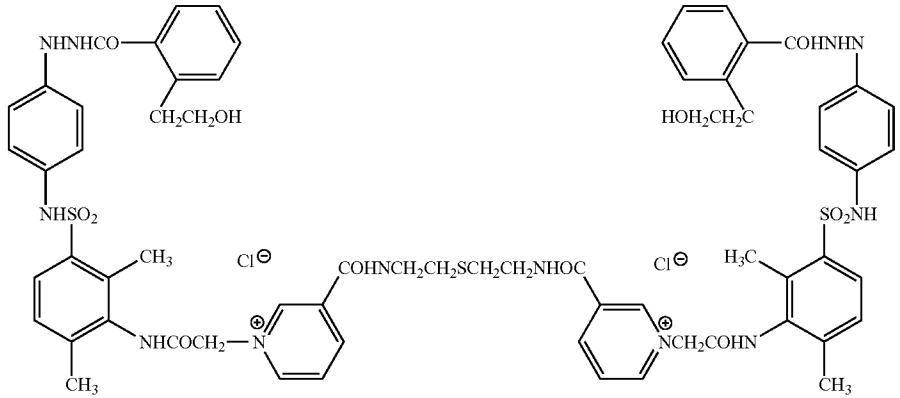
(D-76)
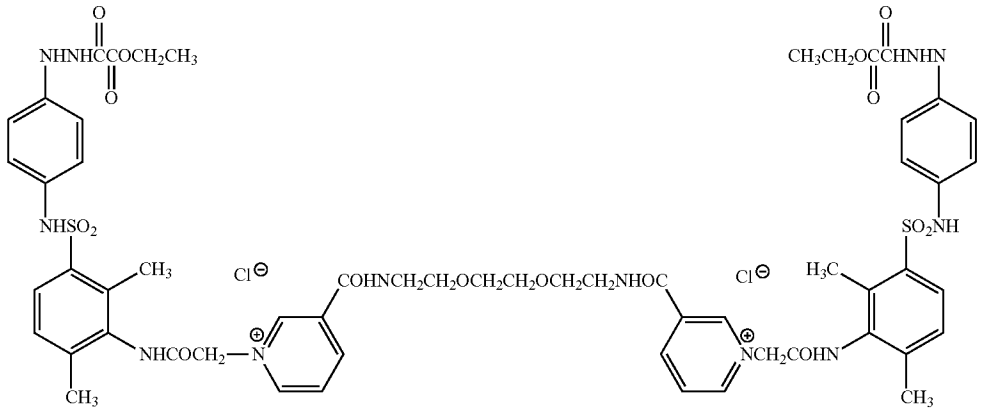

-continued
(D-77)
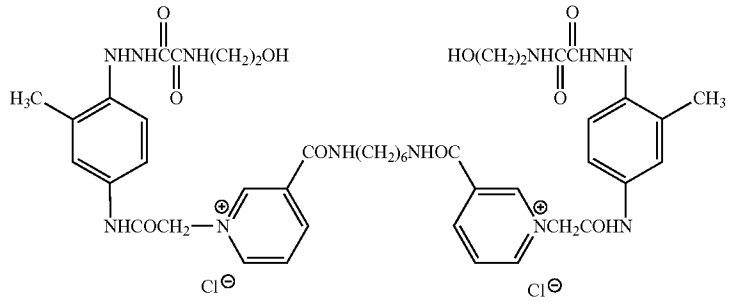
(D-78)
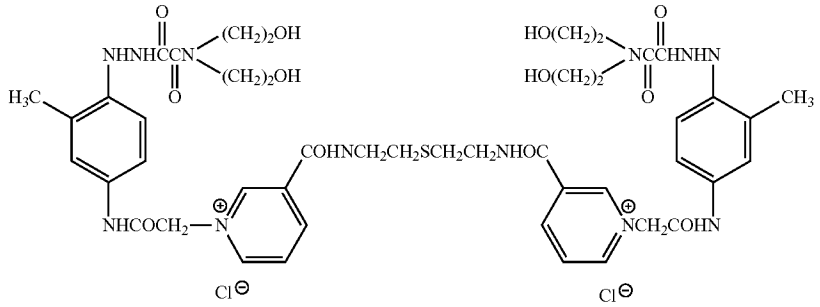
(D-79)
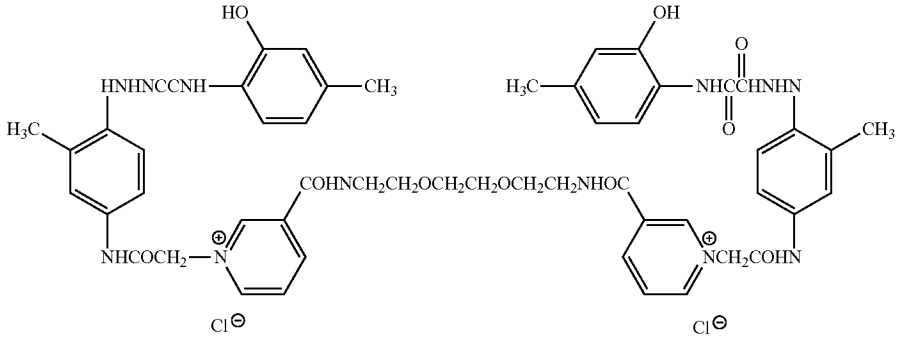

-continued
(D-80)
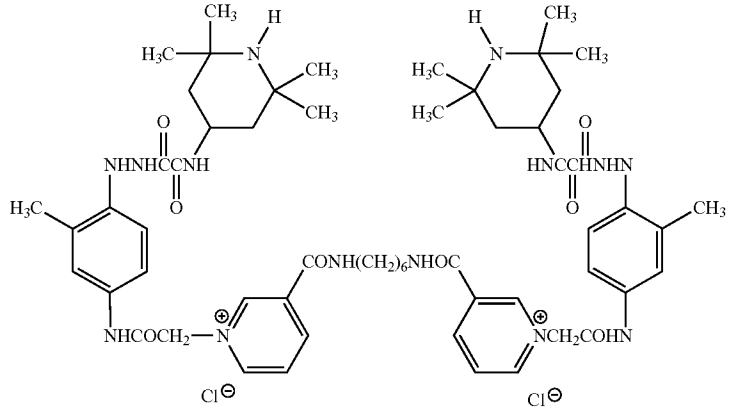
(D-81)
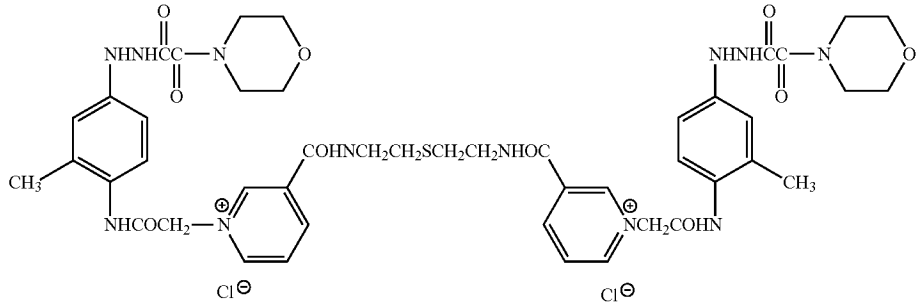
(D-82)
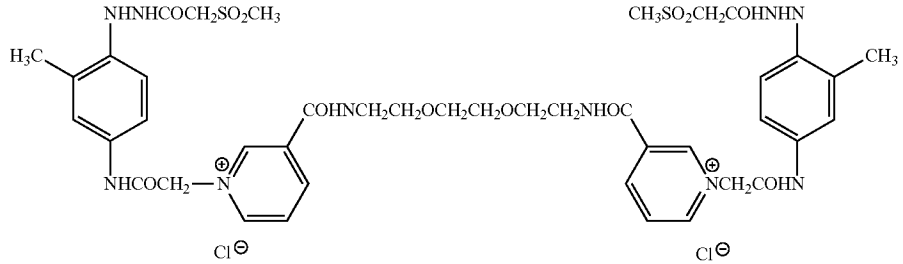

-continued
(D-83)
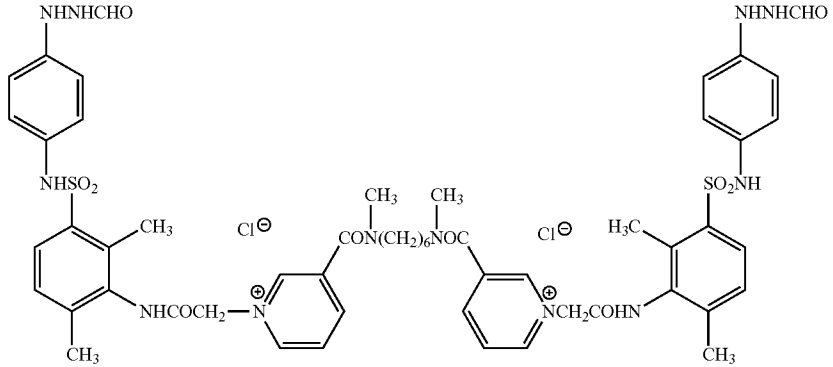
(D-84)
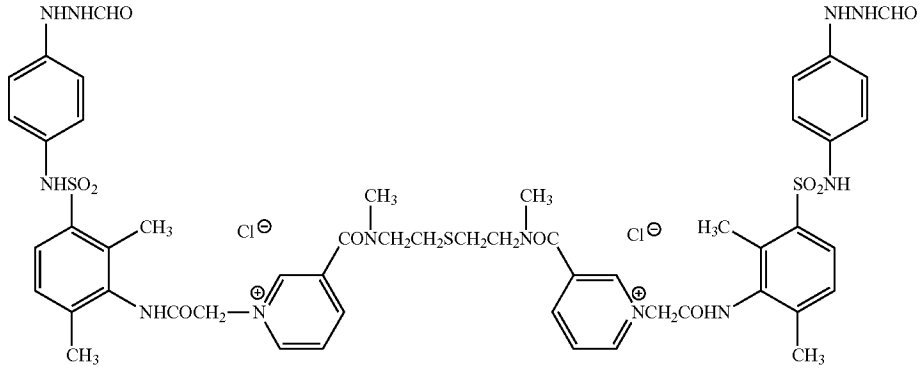

-continued
(D-85)
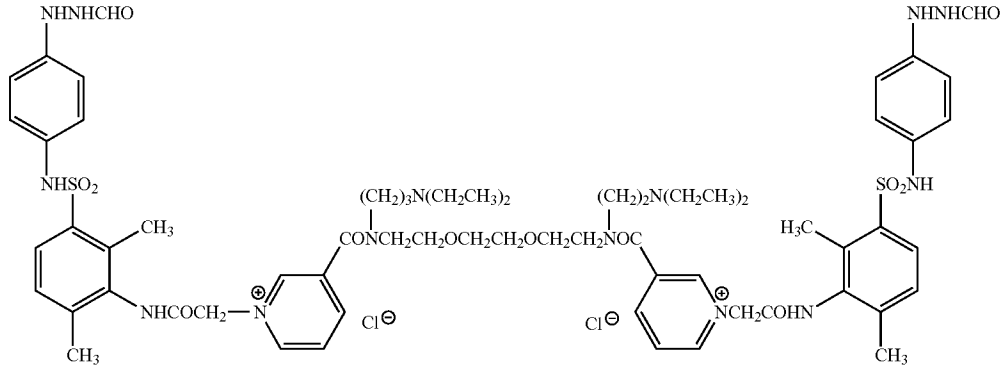
(D-86)
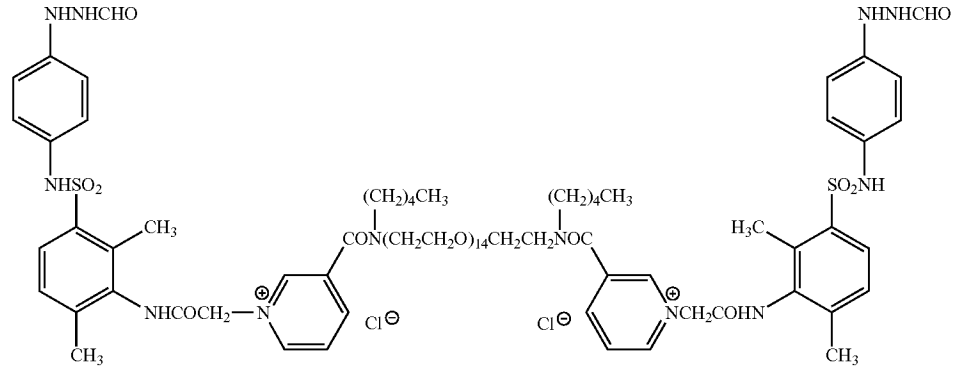

-continued
(D-87)
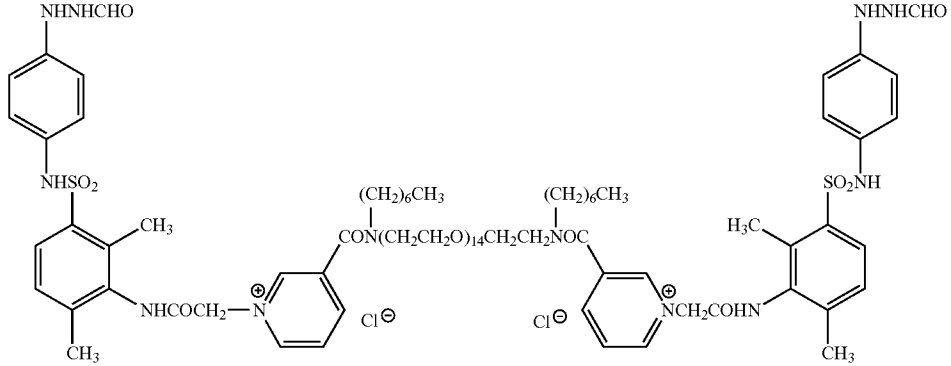
(D-88)
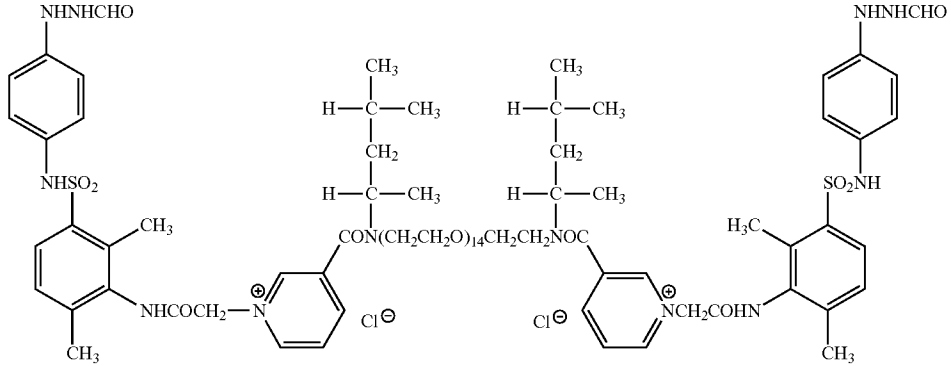

-continued
(D-89)
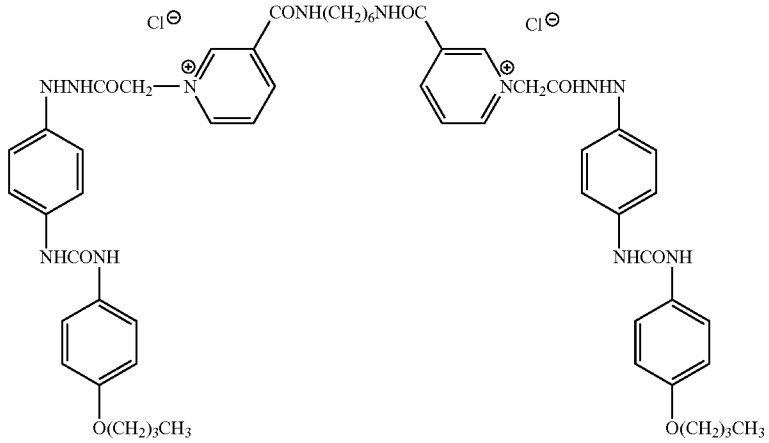
(D-90)
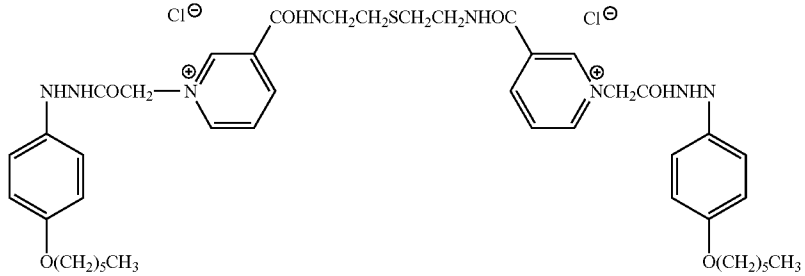
(D-91)
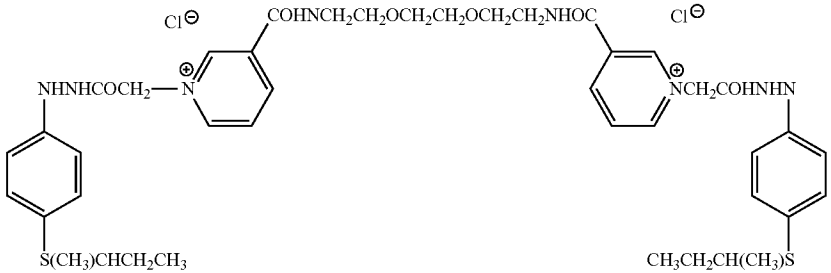

-continued
(D-92)
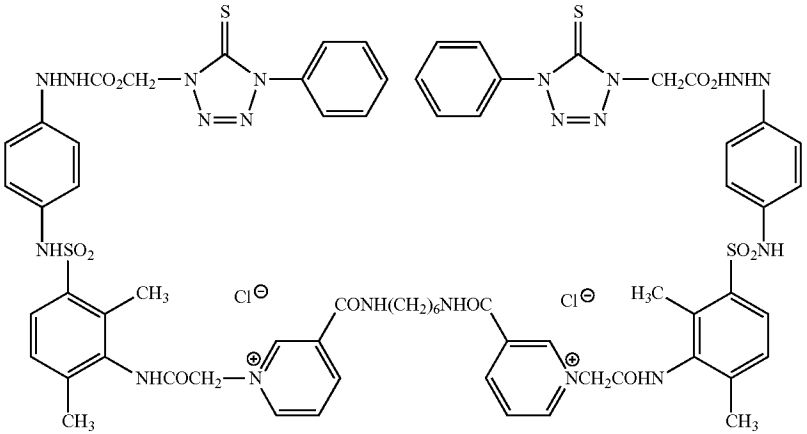
(D-93)
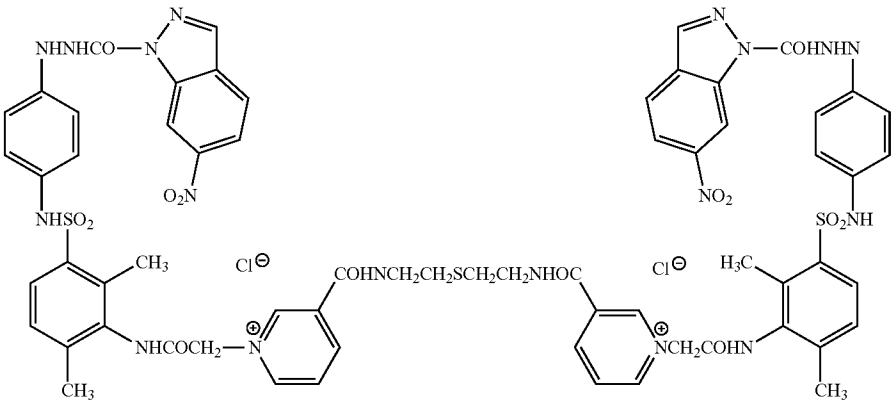

-continued
(D-94)
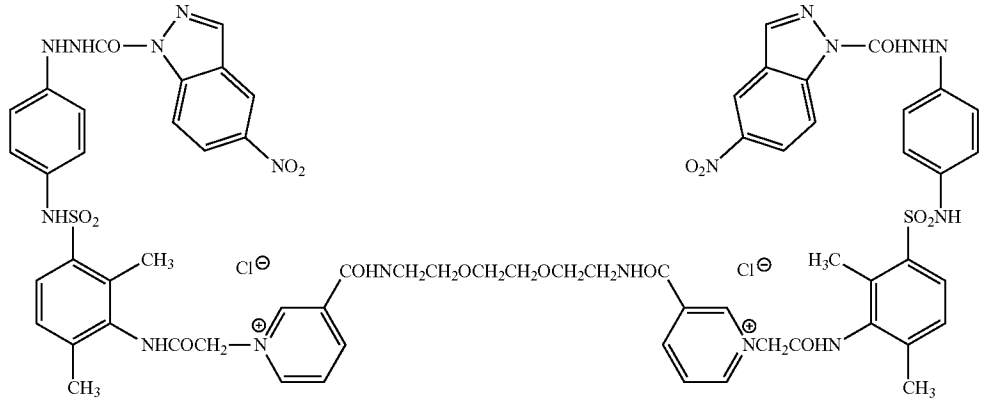
(D-95)
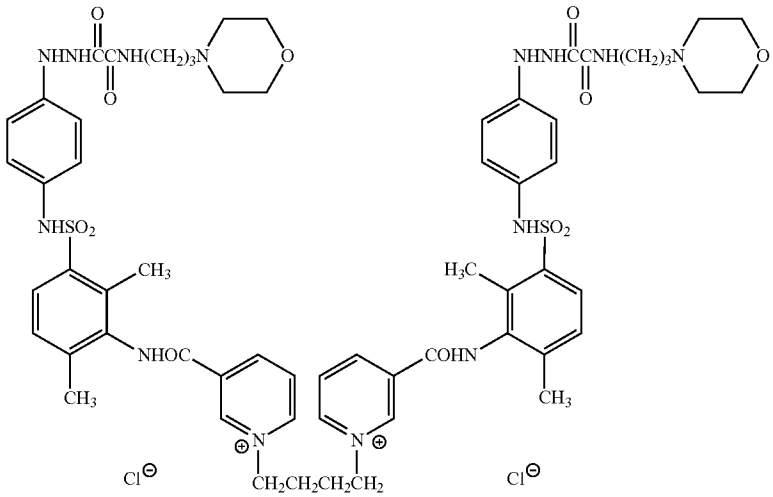

-continued
(D-96)
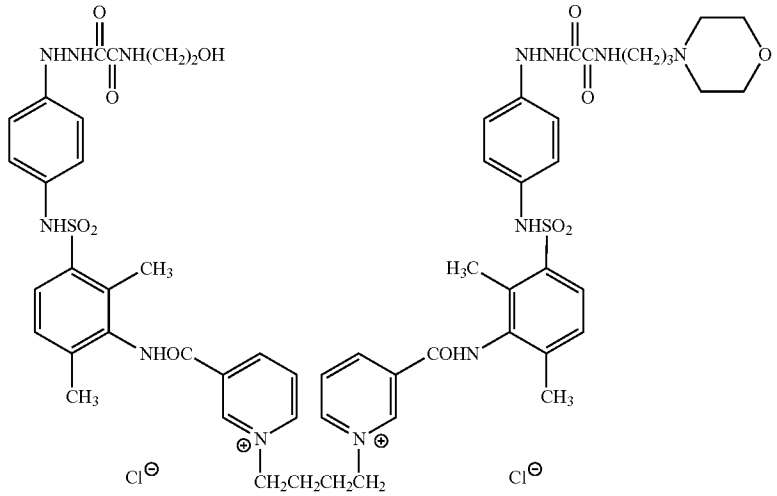
(D-97)
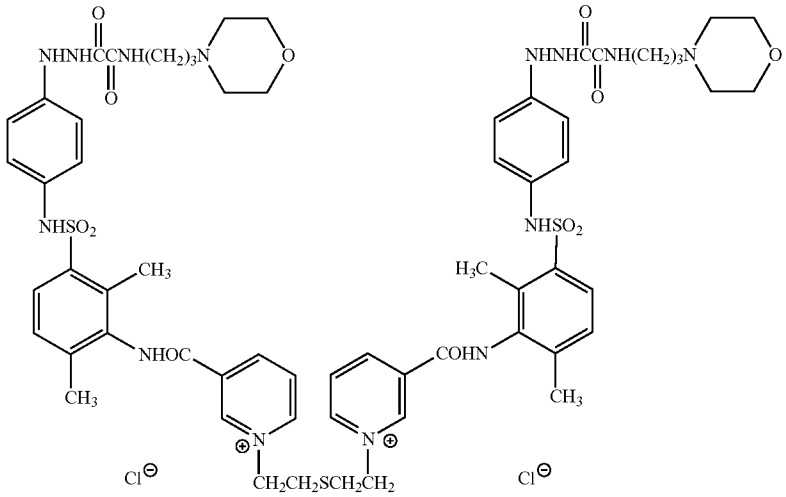

-continued
(D-98)
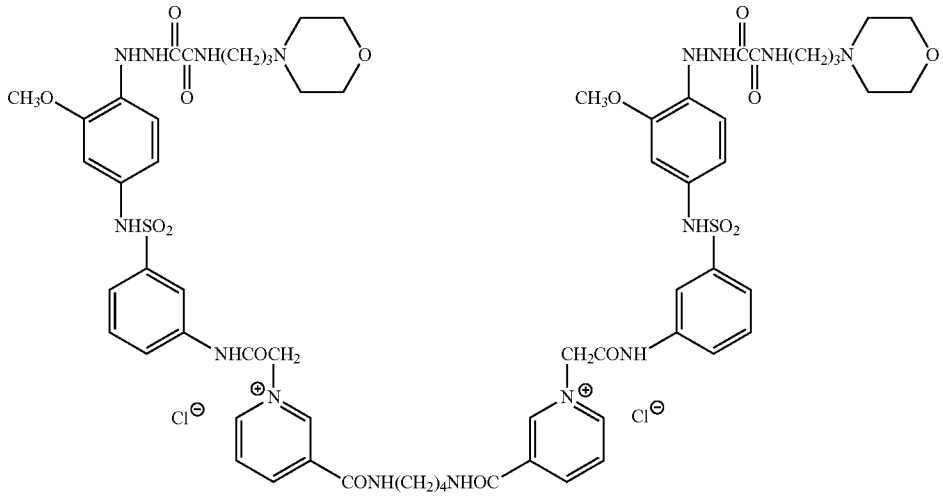
(D-99)
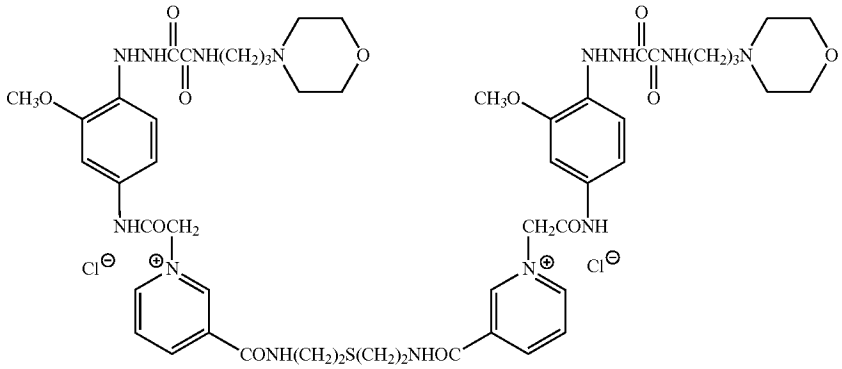

-continued
(D-100)
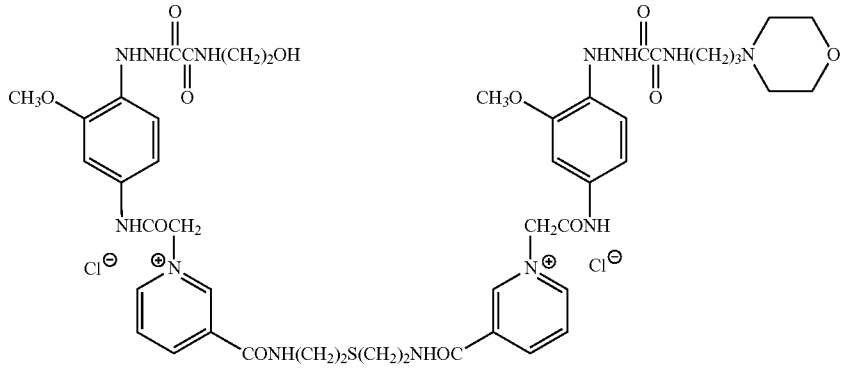
(D-101)
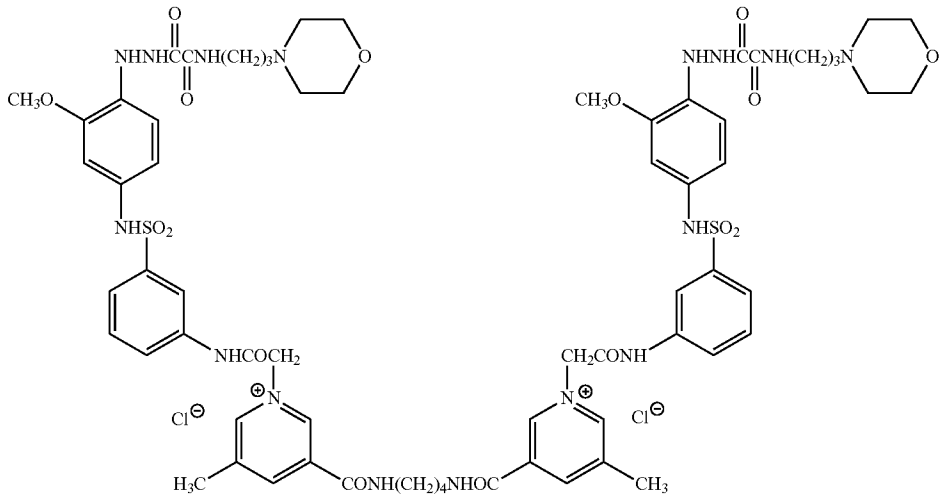

-continued
(D-102)
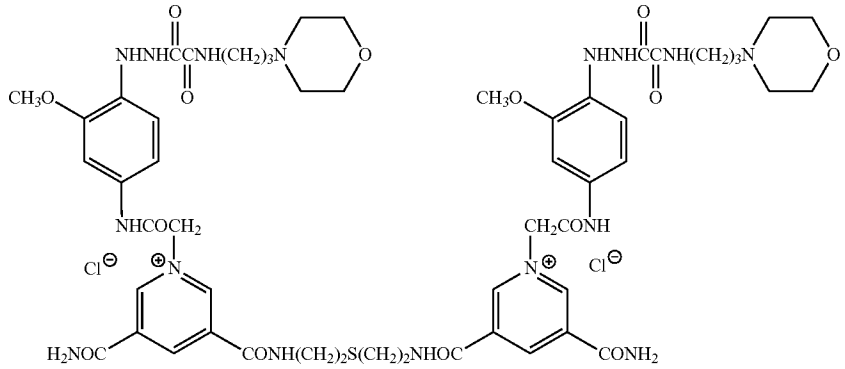
(D-103)
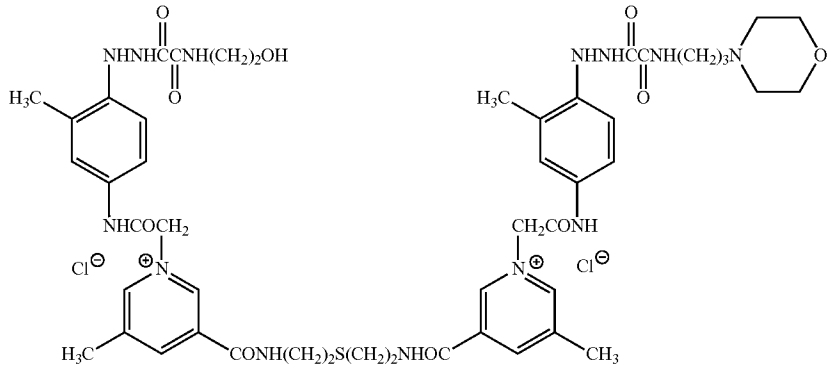

-continued
(D-104)
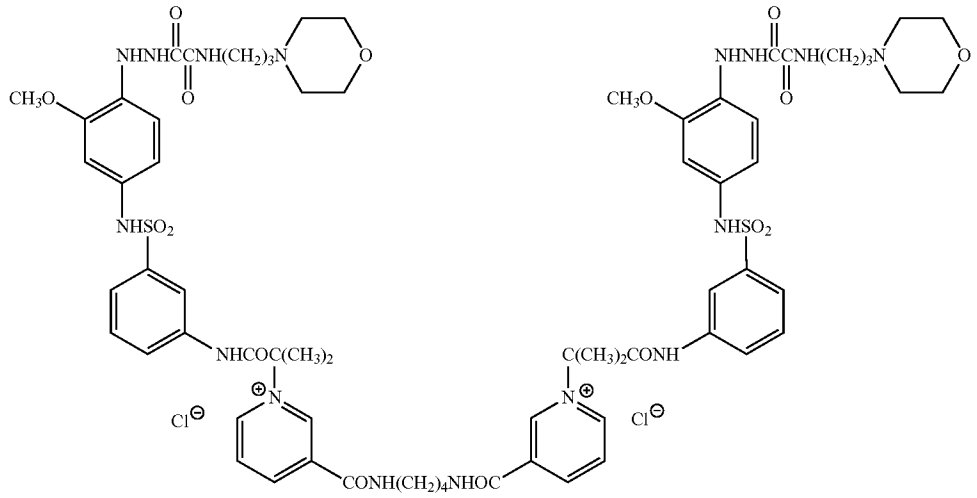
(D-105)
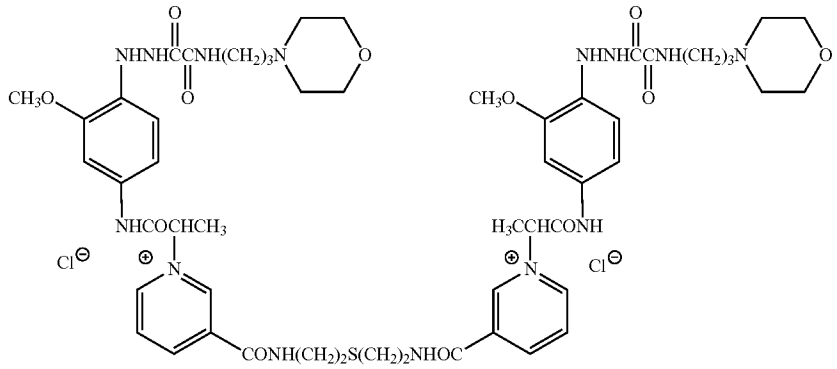

-continued
(D-106)
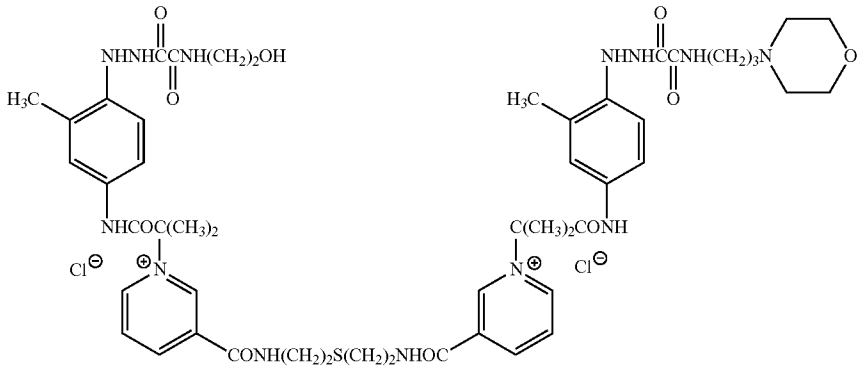
(D-107)
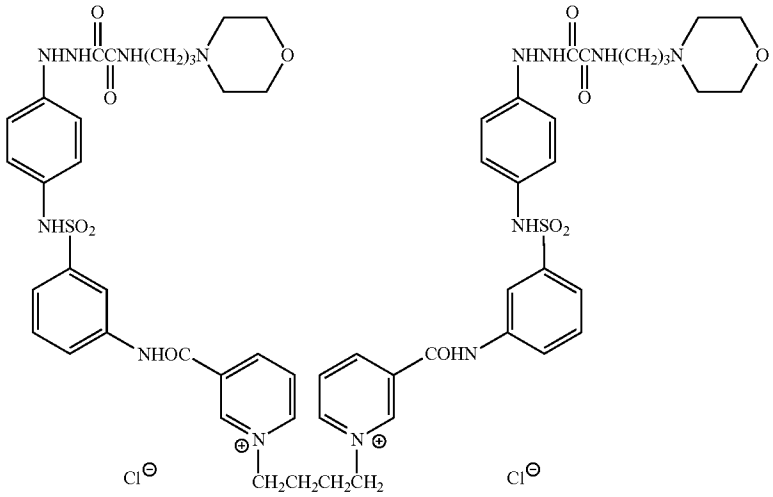

-continued
(D-108)
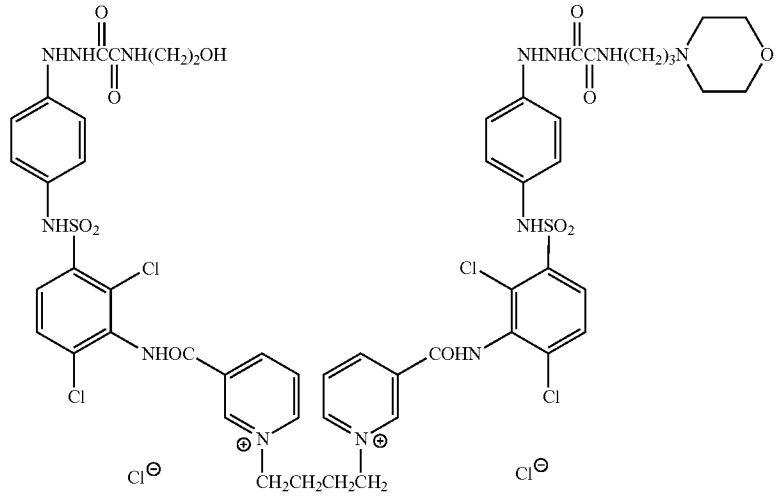
(D-109)
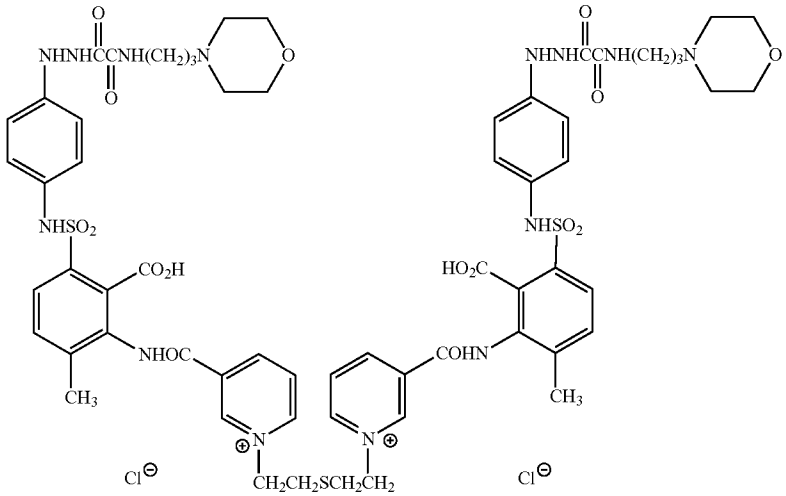

-continued
(D-110)
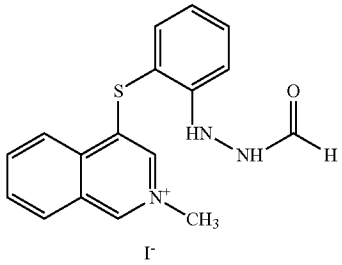
(D-111)
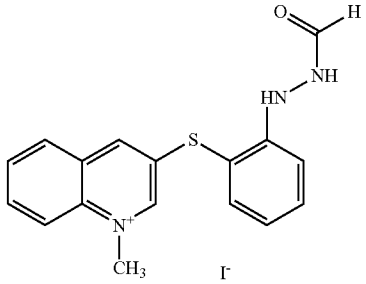
(D-112)
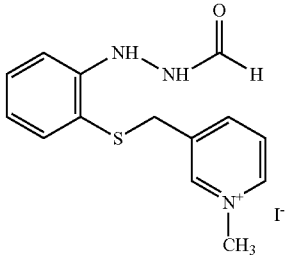
(D-113)
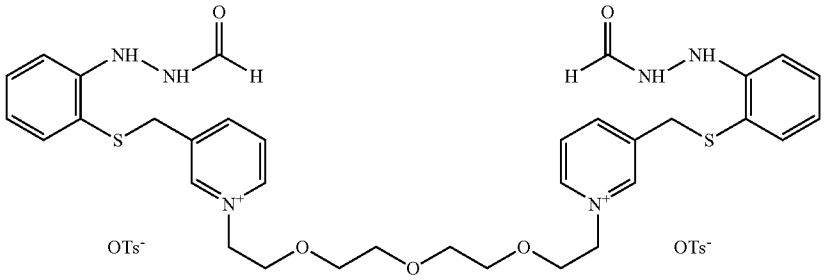

-continued
(D-114)
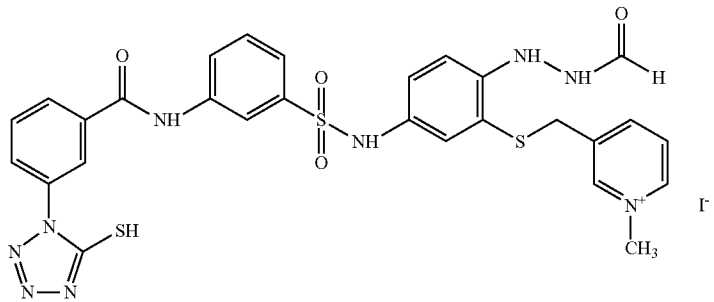
(D-115)
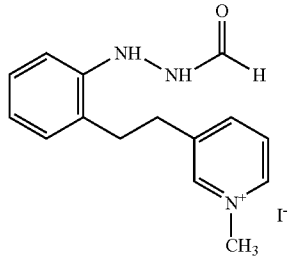
(D-116)
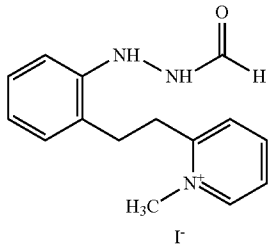
(D-117)
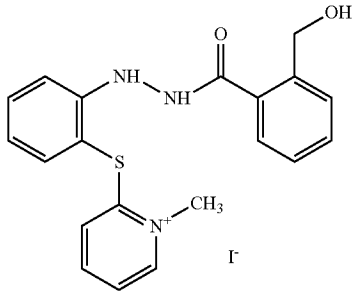
(D-118)
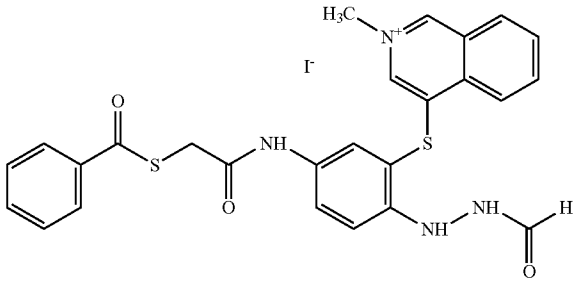
(D-119)
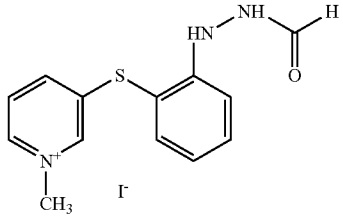

-continued
(D-120)
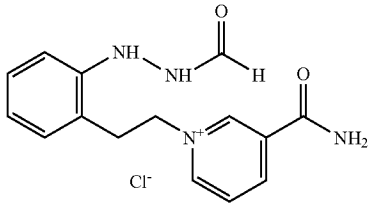
(D-121)
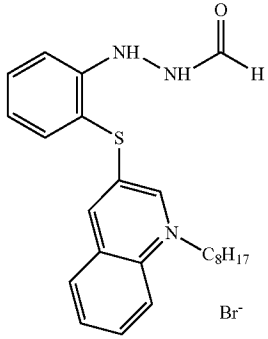
(D-122)
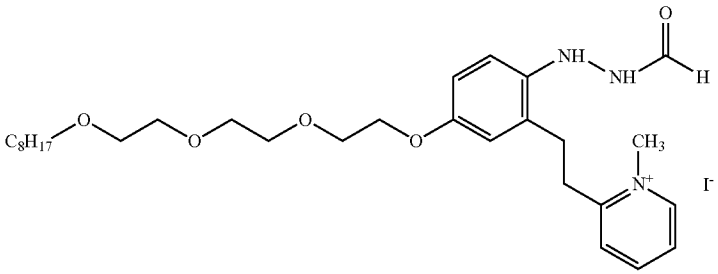
(D-123)
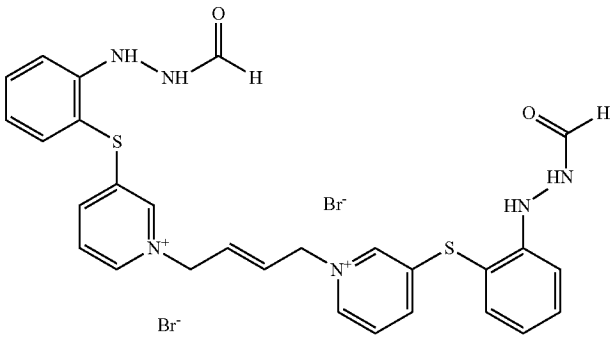
(D-124)
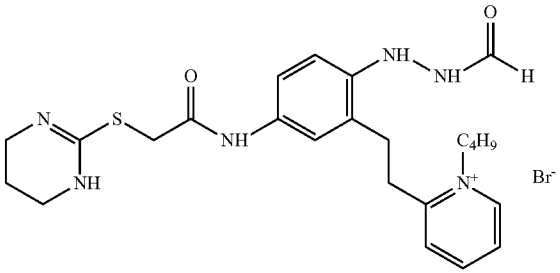
(D-125)
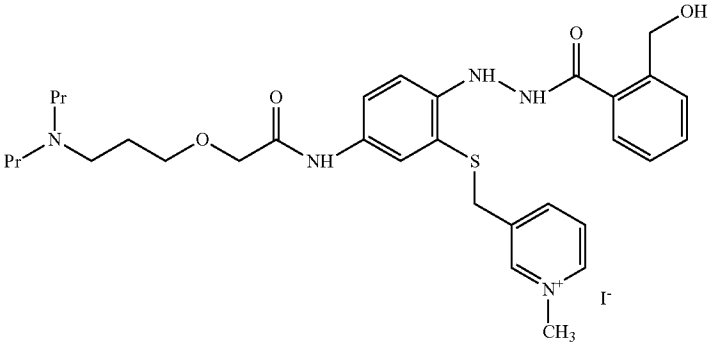

-continued
(D-126)
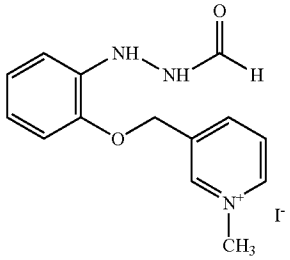
(D-127)
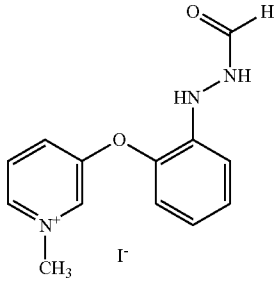
(D-128)
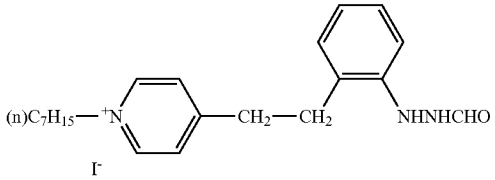

As the hydrazine derivatives used in the present invention, in addition to the above, the following hydrazine derivatives can also preferably be used. The hydrazine derivatives used in the present invention can be synthesized by various methods described in the following patent documents.

There are the compounds represented by (Chemical formula 1) described in JP-B-6-77138, specifically, compounds described on pages 3 and 4 of the same; compounds represented by formula (I) described in JP-B-693082, specifically, Compounds 1 to 38 described on pages 8 to 18 of the same; compounds represented by formulas (4), (5), and (6) described in JP-A-6-230497, specifically, Compound 4-1 to Compound 4-10 described on pages 25 and 26, Compound 5-1 to Compound 5-42 described on pages 28 to 36 and Compound 6-1 to Compound 6-7 described on pages 39 and 40 of the same; compounds represented by formulas (1) and (2) described in JP-A-6-289520, specifically, Compounds 1-1) to 1-17) and 2-1) described on pages 5 to 7 of the same; compounds represented by (Chemical formula 2) and (Chemical formula 3) described in JP-A-6-313936, specifically, compounds described on pages 6 to 19 of the same; compounds represented by (Chemical formula 1) described in JP-A-6-313951, specifically, compounds described on pages 3 to 5 of the same; compounds represented by formula (I) described in JP-A-7-5610, specifically, Compounds I-1 to I-38 described on pages 5 to 10 of the same; compounds represented by formula (II) described in JP-A-7-77783, specifically, Compounds II-1 to II-102 described on pages 10 to 27 of the same; compounds represented by formulas (H) and (Ha) described in JP-A-7-104426, specifically, Compounds H-1 to H-44 described on pages 8 to 15 of the same; compounds that have an anionic group or nonionic group for forming an intramolecular hydrogen bond with the hydrogen atom of the hydrazine in the vicinity of the hydrazine group described in JP-A-9-22082, especially compounds represented by formulas (A), (B), (C), (D), (E) and (F), specifically, Compounds N-1 to N-30 described in the same; compounds represented by formula (1) described in JP-A-9-22082, specifically, Compounds D-1 to D-55 described in the same as well as the hydrazine derivatives described in WO95/32452, WO95/32453, JP-A-9-179229, JP-A-9-235264, JP-A-9-235265, JP-A-9-235266, JP-A-9-235267, JP-A-9-319019, JP-A-9-319020, JP-A-10-130275, JP-A-11-7093, JP-A-6-332096, JP-A-7-209789, JP-A-8-6193, JP-A-8-248549, JP-A-8-248550, JP-A-8-262609, JP-A-8-314044, JP-A-8-328184, JP-A-9-80667, JP-A-9-127632, JP-A-9-146208, JP-A-9-160156, JP-A-10-161260, JP-A-10-221800, JP-A-10-213871, JP-A-10-254082, JP-A-10-254088, JP-A-7-120864, JP-A-7-244348, JP-A-7-333773, JP-A-8-36232, JP-A-8-36233, JP-A-8-36234, JP-A-8-36235, JP-A-8-272022, JP-A-9-22083, JP-A-9-22084, JP-A-9-54381 and JP-A-10-175946.

In the present invention, the hydrazine nucleating agents may be dissolved in an appropriate water-miscible organic solvent, such as an alcohol (e.g., methanol, ethanol, propanol, fluorinated alcohol), ketone (e.g., acetone, methyl ethyl ketone), dimethylformamide, dimethyl sulfoxide, methyl cellosolve or the like, before use.

The hydrazine nucleating agents may also be dissolved in an oil such as dibutyl phthalate, tricresyl phosphate, glyceryl triacetate or diethyl phthalate using an auxiliary solvent such as ethyl acetate or cyclohexanone and mechanically processed into an emulsion dispersion by a conventionally well-known emulsion dispersion method before use. Alternatively, powder of hydrazine nucleating agents may be dispersed in water by means of ball mill, colloid mill or ultrasonic waves according to a method known as solid dispersion method and used.

In the present invention, the hydrazine nucleating agent may be added to any layer on the silver halide emulsion layer side with respect to the support. For example, it can be added to a silver halide emulsion layer or another hydrophilic colloid layer. However, it is preferably added to a silver halide emulsion layer or a hydrophilic colloid layer adjacent thereto. Two or more kinds of hydrazine nucleating agents may be used in combination.

The addition amount of the nucleating agent in the present invention is preferably from $1\times10^{-5}$ to $1\times10^{-2}$ mol, more preferably from $1\times10^{-5}$ to $5\times10^{-3}$ mol, most preferably from $2\times10^{-5}$ to $5\times10^{-3}$ mol, per mol of silver halide.

The silver halide photographic light-sensitive material of the present invention may contain a nucleation accelerator.

Examples of the nucleation accelerator used in the present invention include amine derivatives, onium salts, disulfide derivatives, hydroxymethyl derivatives and so forth. Specific examples thereof include the compounds described in JP-A-7-77783, page 48, lines 2 to 37, specifically, Compounds A-1) to A-73) described on pages 49 to 58 of the same; compounds represented by (Chemical formula 21), (Chemical formula 22) and (Chemical formula 23) described in JP-A-7-84331, specifically, compounds described on pages 6 to 8 of the same; compounds represented by formulas [Na] and [Nb] described in JP-A-7-104426, specifically, Compounds Na-1 to Na-22 and Compounds Nb-1 to Nb-12 described on pages 16 to 20 of the same; compounds represented by the formulas (1), (2), (3), (4), (5), (6) and (7) described in JP-A-8-272023, specifically, Compounds 1-1 to 1-19, Compounds 2-1 to 2-22, Compounds 3-1 to 3-36, Compounds 4-1 to 4-5, Compounds 5-1 to 5-41, Compounds 6-1 to 6-58 and Compounds 7-1 to 7-38 mentioned in the same; and nucleation accelerators described in JP-A-9-297377, p. 55, column 108, line 8 to p. 69, column 136, line 44.

As the nucleation accelerator used for the present invention, the quaternary salt compounds represented by the following formulas (a) to (f) are preferred, and in particular, the compounds represented by the formula (b) are most preferred.

Formula (a)

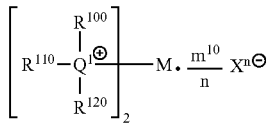

Formula (b)

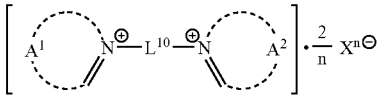

Formula (c)

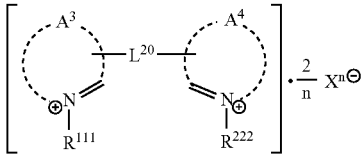

Formula (d)

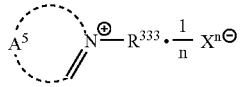

-continued

Formula (e)

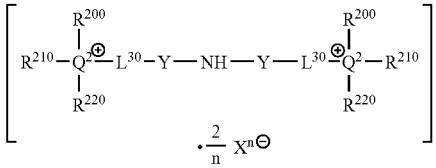

Formula (f)

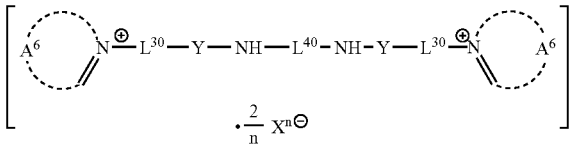

In the formula (a), Q represents a nitrogen atom or a phosphorus atom, $R^{100}$, $R^{110}$ and $R^{120}$ each represent an aliphatic group, an aromatic group or a heterocyclic group, and these may bond to each other to form a ring structure. M represents an $m^{10}$-valent organic group bonding to $Q^1$ at a carbon atom contained in M, and $m^{10}$ represents an integer of 1 to 4.

In the formulas (b), (c) and (d), $A^1$, $A^2$, $A^3$, $A^4$ and $A^5$ each represent an organic residue for completing an unsaturated heterocyclic ring containing a quaternized nitrogen atom, $L^{10}$ and $L^{20}$ represent a divalent bridging group, and $R^{111}$, $R^{222}$ and $R^{333}$ represent a substituent.

The quaternary salt compounds represented by the formula (a), (b), (c) or (d) have 20 or more in total of repeating units of ethyleneoxy group or propyleneoxy group in the molecule, and they may contain the units at two or more sites.

In the formula (e), $Q^2$ represents a nitrogen atom or a phosphorus atom. $R^{200}$, $R^{210}$ and $R^{220}$ represent groups having the same meanings of $R^{100}$, $R^{110}$, $R^{120}$ in the formula (a), respectively.

In the formula (f), $A^6$ represents a group having the same meaning of $A^1$ or $A^2$ in the formula (b). However, although the nitrogen-containing unsaturated heterocyclic ring formed with $A^6$ may have a substituent, it does not have a primary hydroxyl group on the substituent. In the formulas (e) and (f), $L^{30}$ represents an alkylene group, Y represents —C(═O)— or —$SO_2$—, and $L^{40}$ represents a divalent bridging group containing at least one hydrophilic group.

In the formulas (a) to (f), $X^{n-}$ represents an n-valent counter anion, and n represents an integer of 1 to 3. However, when another anionic group is present in the molecule and it forms an intramolecular salt with $(Q^1)^+$, $(Q^2)^+$ or $N^+$, $X^{n-}$ is not required.

Examples of the aliphatic group represented by $R^{100}$, $R^{110}$ and $R^{120}$ in the formula (a) include a linear or branched alkyl group such as methyl group, ethyl group, propyl group, isopropyl group, butyl group, isobutyl group, sec-butyl group, tert-butyl group, octyl group, 2-ethylhexyl group, dodecyl group, hexadecyl group and octadecyl group; an aralkyl group such as a substituted or unsubstituted benzyl group; a cycloalkyl group such as cyclopropyl groups, cyclopentyl group and cyclohexyl group; an alkenyl group such as allyl group, vinyl group and 5-hexenyl group; a cycloalkenyl group such as cyclopentenyl group and cyclohexenyl group; an alkynyl group such as phenylethynyl group and so forth. Examples of the aromatic group include an aryl group such as phenyl group, naphthyl group and phenanthoryl group, and examples of the heterocyclic group include pyridyl group, quinolyl group, furyl group, imidazolyl group, thiazolyl group, thiadiazolyl group, benzotriazolyl group, benzothiazolyl group, morpholyl group, pyrimidyl group, pyrrolidyl group and so forth.

Examples of the substituent substituting on these groups include, besides the groups represented by $R^{100}$, $R^{110}$ and $R^{120}$, a halogen atom such as fluorine atom, chlorine atom, bromine atom and iodine atom, a nitro group, an (alkyl or aryl)amino group, an alkoxy group, an aryloxy group, an (alkyl or aryl)thio group, a carbonamido group, a carbamoyl group, a ureido group, a thioureido group, a sulfonylureido group, a sulfonamido group, a sulfamoyl group, a hydroxyl group, a sulfonyl group, a carboxyl group (including a carboxylate), a sulfo group (including a sulfonate), a cyano group, an oxycarbonyl group, an acyl group, a heterocyclic group (including a heterocyclic group containing a quaternized nitrogen atom) and so forth. These substituents may be further substituted with any of these substituents.

The groups represented by $R^{100}$, $R^{110}$ and $R^{120}$ in the formula (a) may bond to each other to form a ring structure.

Example of the group represented by M in the formula (a) include, when $m^{10}$ represents 1, the same groups as the groups defined for $R^{100}$, $R^{110}$ and $R^{120}$. When $m^{10}$ represents an integer of 2 or more, M represents an $m^{10}$-valent bridging group bonding to $Q^1$ at a carbon atom contained in M. Specifically, it represents an $m^{10}$-valent bridging group formed with an alkylene group, an arylene group, a heterocyclic group or a group formed from any of these groups in combination with any of —CO— group, —O— group, —N($R^N$)— group, —S— group, —SO— group, —$SO_2$— group and —P═O— group ($R^N$ represents a hydrogen atom or a group selected from the groups defined for $R^{100}$, $R^{110}$, $R^{120}$, and when a plurality of $R^N$ exist in the molecule, they may be identical to or different from each other or one another, and may bond to each other or one another). M may have an arbitrary substituent, and examples of the substituent include the substituents that can be possessed by the groups represented by $R^{100}$, $R^{110}$ and $R^{120}$.

In the formula (a), $R^{100}$, $R^{110}$ and $R^{120}$ preferably represent a group having 20 or less carbon atoms. When $Q^1$ represents a phosphorus atom, an aryl group having 15 or less carbon atoms is particularly preferred, and when $Q^1$ represents a nitrogen atom, an alkyl group, aralkyl group and aryl group having 15 or less carbon atoms are particularly preferred. $m^{10}$ is preferably 1 or 2. When $m^{10}$ represents 1, M is preferably a group having 20 or less carbon atoms, and an alkyl group, aralkyl group and aryl group having 15 or less carbon atoms in total are particularly preferred. When $m^{10}$ represents 2, the divalent organic group represented by M is preferably a divalent group formed with an alkylene group or an arylene group, or a group formed from either of these groups in combination with any of —CO— group, —O— group, —N($R^N$) group, —S— group and —$SO_2$— group. When $m^{10}$ represents 2, M is preferably a divalent group having 20 or less carbon atoms and bonding to $Q^1$ at a carbon atom contained in M. When M or $R^{100}$, $R^{110}$ or $R^{120}$ contains a plurality of repeating units of ethyleneoxy group or propyleneoxy group, the preferred ranges for the total carbon numbers mentioned above may not be applied. Further, when $m^{10}$ represents an integer of 2 or more, a plurality of $R^{100}$, $R^{110}$ or $R^{120}$ exist in the molecule. In this case, a plurality of $R^{100}$, $R^{110}$ and $R^{120}$ may be identical to or different from each other or one another.

The quaternary salt compounds represented by the formula (a) contain 20 or more in total of repeating units of ethyleneoxy group or propyleneoxy group in the molecule, and they may exist at one site or two or more site. When $m^{10}$ represents an integer of 2 or more, it is more preferred that 20 or more in total of repeating units of ethyleneoxy group or propyleneoxy group should be contained in the bridging group represented by M.

In the formulas (b), (c) and (d), $A^1$, $A^2$, $A^3$, $A^4$ and $A^5$ represent an organic residue for completing a substituted or unsubstituted unsaturated heterocyclic ring containing a quaternized nitrogen atom, and it may contain a carbon atom, an oxygen atom, a nitrogen atom, a sulfur atom and a hydrogen atom and may be condensed with a benzene ring.

Examples of the unsaturated heterocyclic ring formed by $A^1$, $A^2$, $A^3$, $A^4$ or $A^5$ include pyridine ring, quinoline ring, isoquinoline ring, imidazole ring, thiazole ring, thiadiazole ring, benzotriazole ring, benzothiazole ring, pyrimidine ring, pyrazole ring and so forth. A pyridine ring, quinoline ring and isoquinoline ring are particularly preferred.

The unsaturated heterocyclic ring formed by $A^1$, $A^2$, $A^3$, $A^4$ or $A^5$ together with a quaternized nitrogen atom may have a substituent. Examples of the substituent include the same groups as the substituents that may be possessed by the groups represented by $R^{100}$, $R^{110}$ and $R^{120}$ in the formula (a). The substituent is preferably a halogen atom (in particular, chlorine atom), an aryl group having 20 or less carbon atoms (phenyl group is particularly preferred), an alkyl group, an alkynyl group, a carbamoyl group, an (alkyl or aryl)amino group, an (alkyl or aryl)oxycarbonyl group, an alkoxy group, an aryloxy group, an (alkyl or aryl)thio group, hydroxyl group, a mercapto group, a carbonamido group, a sulfonamido group, a sulfo group (including a sulfonate), a carboxyl group (including a carboxylate), a cyano group or the like, particularly preferably a phenyl group, an alkylamino group, a carbonamido group, a chlorine atom, an alkylthio group or the like, most preferably a phenyl group.

The divalent bridging group represented by $L^{10}$ or $L^{20}$ is preferably an alkylene group, an arylene group, an alkenylene group, an alkynylene group, a divalent heterocyclic group, —$SO_2$—, —SO—, —O—, —S—, —N($R^{N'}$)—, —C(=O)—, —PO— or a group formed by a combination of any of these. $R^{N'}$ represents an alkyl group, an aralkyl group, an aryl group or a hydrogen atom. The divalent bridging group represented by $L^{10}$ or $L^{20}$ may have an arbitrary substituent. Examples of the substituent include the substituents that may be possessed by the groups represented by $R^{100}$, $R^{110}$ and $R^{120}$ in the formula (a). Particularly preferred examples of $L^{10}$ or $L^{20}$ are an alkylene group, an arylene group, —C(=O)—, —O—, —S—, —$SO_2$—, —N($R^{N'}$)— and a group formed by a combination of any of these.

$R^{111}$, $R^{222}$ and $R^{333}$ preferably represent an alkyl group or aralkyl group having 1 to 20 carbon atoms, and they may be identical to or different from one another. $R^{111}$, $R^{222}$ and $R^{333}$ may have a substituent, and examples of the substituent include the substituents that may be possessed by the groups represented by $R^{100}$, $R^{110}$ and $R^{120}$ in the formula (a). $R^{111}$, $R^{222}$ and $R^{333}$ each particularly preferably represent an alkyl group or aralkyl group having 1 to 10 carbon atoms. Preferred examples of the substituent thereof include a carbamoyl group, an oxycarbonyl group, an acyl group, an aryl group, a sulfo group (including a sulfonate), a carboxyl group (including a carboxylate), a hydroxyl group, an (alkyl or aryl)amino group and an alkoxy group.

However, when a plurality of repeating units of ethyleneoxy group or propyleneoxy group are included in $R^{111}$, $R^{222}$ or $R^{333}$, the preferred ranges for the total carbon numbers mentioned above for $R^{111}$, $R^{222}$ and $R^{333}$ shall not be applied.

The quaternary salt compounds represented by the formula (b) or (c) contain 20 or more in total of repeating units of ethyleneoxy group or propyleneoxy group in the molecule, and they may exist at one site or two or more site and may be contained any of $A^1$, $A^2$, $A^3$, $A^4$, $R^{111}$, $R^{222}$, $L^{10}$ and $L^{20}$. However, it is preferred that 20 or more in total of repeating units of ethyleneoxy group or propyleneoxy group should be contained in the bridging group represented by $L^{10}$ or $L^{20}$.

The quaternary salt compounds represented by the formula (d) contain 20 or more in total of repeating units of ethyleneoxy group or propyleneoxy group in the molecule, and they may exist at one site or two or more site and may be contained any of $A^5$ and $R^{333}$. However, it is preferred that 20 or more in total of repeating units of ethyleneoxy group or propyleneoxy group should be contained in the bridging group represented by $R^{333}$.

The quaternary salt compounds represented by the formula (a), (b), (c) or (d) may contain both of a repeating unit of ethyleneoxy group and a repeating unit of propyleneoxy group. Further, when a plurality of repeating units of ethyleneoxy group or propyleneoxy group are contained, number of the repeating units may be defined strictly as one number or defined as an average number. In the latter case, each quaternary salt compound consists of a mixture having a certain degree of molecular weight distribution.

In the present invention, preferably 20 or more, more preferably 20 to 67, in total of repeating units of ethyleneoxy group should be contained.

In the formula (e), $Q^2$, $R^{200}$, $R^{210}$ and $R^{220}$ represent groups having the same meanings as $Q^1$, $R^{100}$, $R^{110}$ and $R^{120}$ in the formula (a), respectively, and the preferred ranges thereof are also the same.

In the formula (f), $A^6$ represents a group having the same meaning as $A^1$ or $A^2$ in the formula (b), and the preferred range thereof is also the same. The nitrogen-containing unsaturated heterocyclic ring formed with $A^6$ in the formula (f) together with a quaternized nitrogen atom may have a substituent, provided that it does not have a substituent containing a primary hydroxyl group.

In the formulas (e) and (f), $L^{30}$ represents an alkylene group. The alkylene group is preferably a linear, branched or cyclic substituted or unsubstituted alkylene group having 1 to 20 carbon atoms. Moreover, it may include not only a saturated alkylene group, of which typical example is ethylene group, but also an alkylene group containing an unsaturated group, of which typical examples are —$CH_2C_6H_4CH_2$— and —$CH_2CH$=$CHCH_2$—. Further, when $L^{30}$ has a substituent, examples of the substituent include the examples of the substituent that may be possessed by the groups represented by $R^{100}$, $R^{110}$ and $R^{120}$ in the formula (a).

$L^{30}$ is preferably a linear or branched saturated group having 1 to 10 carbon atoms. More preferably, it is a substituted or unsubstituted methylene group, ethylene group or trimethylene group, particularly preferably a substituted or unsubstituted methylene group or ethylene group, most preferably a substituted or unsubstituted methylene group.

In the formulas (e) and (f), $L^{40}$ represents a divalent bridging group having at least one hydrophilic group. The hydrophilic group used herein represents —$SO_2$—, —SO—, —O—, —P(=O)=, —C(=O)—, —CONH—, —$SO_2$NH—, —NH$SO_2$NH—, —NHCONH—, an amino group, a guanidino group, an ammonio group, a heterocyclic group containing a quaternized nitrogen atom or a group consisting of a combination of these groups. $L^{40}$ is formed by an arbitrary combination of any of these hydrophilic groups and an alkylene group, an alkenylene group, an arylene group or a heterocyclic group.

The groups constituting $L^{40}$ such as an alkylene group, an arylene group, an alkenylene group and a heterocyclic group may have a substituent. Examples of the substituent include the substituents that can be possessed by the groups represented by $R^{100}$, $R^{110}$ and $R^{120}$ in the formula (a).

Although the hydrophilic group in $L^{40}$ may exist so as to interrupt $L^{40}$ or as a part of a substituent on $L^{40}$, it is more preferably exist so as to interrupt $L^{40}$. For example, there can be mentioned a case where any one of —C(═O)—, —$SO_2$—, —SO—, —O—, —P(═O)═, —CONH—, —$SO_2$NH—, —NH$SO_2$NH—, —NHCONH—, a cationic group (specifically, a quaternary salt structure of nitrogen or phosphorus or a nitrogen-containing heterocyclic ring containing a quaternized nitrogen atom), an amino group and a guanidine group or a divalent group consisting of an arbitrary combination of these groups exists so as to interrupt $L^{40}$.

One of preferred examples of the hydrophilic group of $L^{40}$ is a group having a plurality of repeating units of ethyleneoxy group or propyleneoxy group consisting of a combination of ether bonds and alkylene groups. The polymerization degree or average polymerization degree of such a group is preferably 2 to 67.

The hydrophilic group of $L^{40}$ also preferably contains a dissociating group obtained as a result of combination of groups such as —$SO_2$—, —SO—, —O—, —P(═O)═, —C(═O)—, —CONH—, —$SO_2$NH—, —NH$SO_2$NH—, —NHCONH—, an amino group, a guanidino group, an ammonio group and a heterocyclic group containing a quaternized nitrogen atom, or as a substituent on $L^{40}$. The dissociating group referred to herein means a group or partial structure having a proton of low acidity that can be dissociated with an alkaline developer, or a salt thereof. Specifically, it means, for example, a carboxy group (—COOH), a sulfo group (—$SO_3$H), a phosphonic acid group (—$PO_3$H), a phosphoric acid group (—$OPO_3$H), a hydroxy group (—OH), a mercapto group (—SH), —$SO_2NH_2$ group, N-substituted sulfonamido group (—$SO_2$NH—, —CONH$SO_2$— group, —$SO_2$NH$SO_2$— group), —CONHCO— group, an active methylene group, —NH— group contained in a nitrogen-containing heterocyclic group, salts thereof etc.

$L^{40}$ consisting of a suitable combination of an alkylene group or arylene group with —C(═O)—, —$SO_2$—, —O—, —CONH—, —$SO_2$NH—, —NH$SO_2$NH—, —NHCONH— or an amino group is preferably used. More preferably, $L^{40}$ consisting of a suitable combination of an alkylene group having 2 to 5 carbon atoms with —C(═O)—, —$SO_2$—, —O—, —CONH—, —$SO_2$NH—, —NH$SO_2$NH— or —NHCONH— is used.

Y represents —C(═O)— or —$SO_2$—. —C(═O)— is preferably used.

Example of the counter anion represented by $X^{n-}$ in the formulas (a) to formula (f) include a halide ion such as chloride ion, bromide ion and iodide ion, a carboxylate ion such as acetate ion, oxalate ion, fumarate ion and benzoate ion, a sulfonate ion such as p-toluenesulfonate ion, methanesulfonate ion, butanesulfonate ion and benzenesulfonate ion, a sulfate ion, a perchlorate ion, a carbonate ion, a nitrate ion and so forth.

As the counter anion represented by $X^{n-}$, a halide ion, a carboxylate ion, a sulfonate ion and a sulfate ion are preferred, and n is preferably 1 or 2. As $X^{n-}$, a chloride ion or a bromide ion is particularly preferred, and a chloride ion is the most preferred.

However, when another anionic group is present in the molecule and it forms an intramolecular salt with $(Q^1)^+$, $(Q^2)^+$ or $N^+$, $X^{n-}$ is not required.

As the quaternary salt compound used in the present invention, the quaternary salt compounds represented by the formula (b), (c) or (f) are more preferred, and the quaternary salt compounds represented by the formula (b) or (f) are particularly preferred. Further, in the formula (b), preferably 20 or more, particularly preferably 20 to 67, in total of repeating units of ethyleneoxy group should be contained in the bridging group represented by $L^{10}$. Further, in the formula (f), the unsaturated heterocyclic compound formed with $A^6$ particularly preferably represents 4-phenylpyridine, isoquinoline or quinoline.

Specific examples of the quaternary salt compounds represented by any of the formulas (a) to (f) are listed below. In the following formulas, Ph represents a phenyl group. However, the quaternary salt compounds that can be used for the present invention are not limited to the following exemplary compounds.

$Q^+—L_0—Q^+ \cdot 2X^-$

| No. | $Q^+$ = | $L_0$ = | $X^-$ = |
|---|---|---|---|
| 1 | 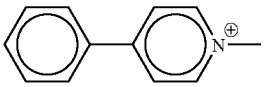 | —$C_2H_4$—$(OC_2H_4)_n$—$OC_2H_4$— n = 20 | $Cl^{\ominus}$ |
| 2 | 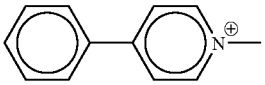 | —$C_2H_4$—$(OC_2H_4)_n$—$OC_2H_4$— n ≈ 32 | $Cl^{\ominus}$ |
| 3 | 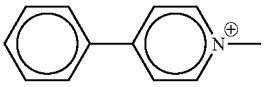 | —$C_2H_4$—$(OC_2H_4)_n$—$OC_2H_4$— n ≈ 43 | $Cl^{\ominus}$ |

-continued

| | | | |
|---|---|---|---|
| 4 | 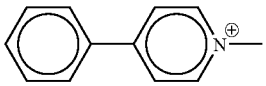 | $—C_2H_4—(OC_2H_4)_n—OC_2H_4—$<br>n ≈ 62 | $Cl^{\ominus}$ |
| 5 | 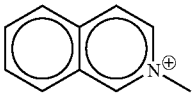 | $—C_2H_4—(OC_2H_4)_n—OC_2H_4—$<br>n ≈ 21 | $Cl^{\ominus}$ |
| 6 | 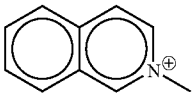 | $—C_2H_4—(OC_2H_4)_n—OC_2H_4—$<br>n ≈ 43 | $Cl^{\ominus}$ |
| 7 | 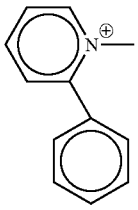 | $—C_2H_4—(OC_2H_4)_n—OC_2H_4—$<br>n = 20 | $Cl^{\ominus}$ |
| 8 | 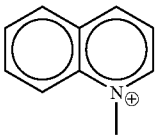 | $—C_2H_4—(OC_2H_4)_n—OC_2H_4—$<br>n ≈ 43 | $Cl^{\ominus}$ |
| 9 | 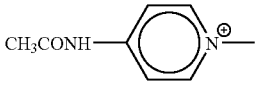 | $—C_2H_4—(OC_2H_4)_n—OC_2H_4—$<br>n ≈ 21 | $Cl^{\ominus}$ |
| 10 | 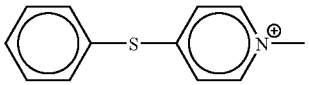 | $—C_2H_4—(OC_2H_4)_n—OC_2H_4—$<br>n ≈ 43 | $Cl^{\ominus}$ |
| 11 | 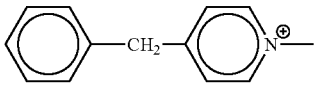 | $—C_2H_4—(OC_2H_4)_n—OC_2H_4—$<br>n ≈ 67 | $Cl^{\ominus}$ |
| 12 | 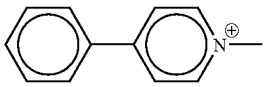 | 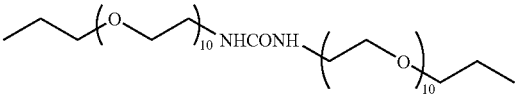 | $Cl^{\ominus}$ |
| 13 | 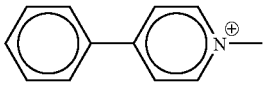 | 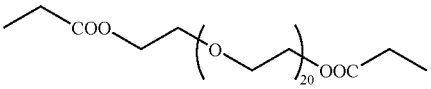 | $Cl^{\ominus}$ |
| 14 | 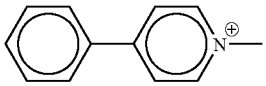 | 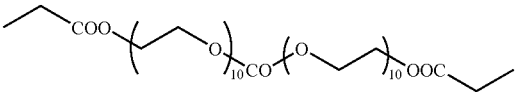 | $Cl^{\ominus}$ |
| 15 | 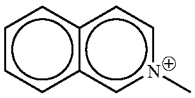 | 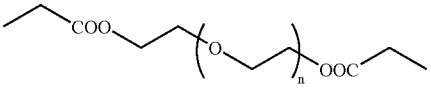 n ≈ 43 | $Cl^{\ominus}$ |
| 16 | 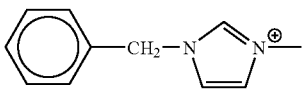 | $—C_2H_4—(OC_2H_4)_n—OC_2H_4—$<br>n ≈ 42 | $Cl^{\ominus}$ |

-continued
| | | | |
|---|---|---|---|
| 17 | 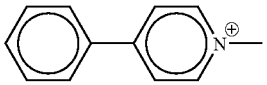 | —$C_2H_4$—$(OC_2H_4)_n$—$OC_2H_4$— n ≈ 62 | 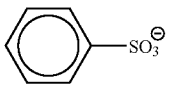 |
| 18 | 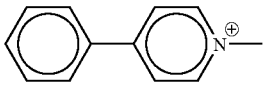 | —$C_2H_4$—$(OC_2H_4)_n$—$OC_2H_4$— n ≈ 43 | $Br^{\ominus}$ |
| 19 | 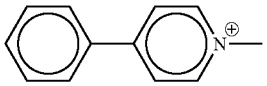 | —$C_2H_4$—$(OC_2H_4)_n$—$OC_2H_4$— n = 20 | $(COO)_2^{2\ominus}$ |
| 20 | 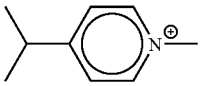 | —$C_2H_4$—$(OC_2H_4)_n$—$OC_2H_4$— n ≈ 34 | $Cl^{\ominus}$ |
| 21 | 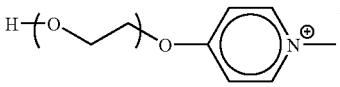 | —$(CH_2)_5$— | $CH_3SO_3^{\ominus}$ |
| 22 | 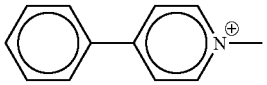 | 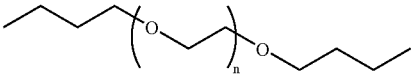 n ≈ 43 | $Cl^{\ominus}$ |
| 23 | 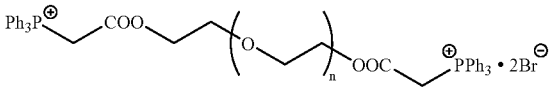 n ≈ 43 | | |
| 24 | 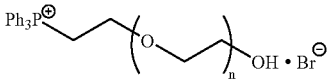 n ≈ 33 | | |
| 25 | 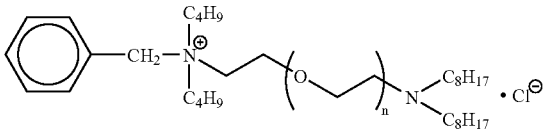 n ≈ 33 | | |
| 26 | 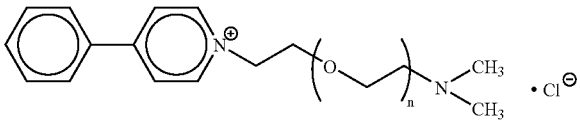 n ≈ 43 | | |
| 27 | 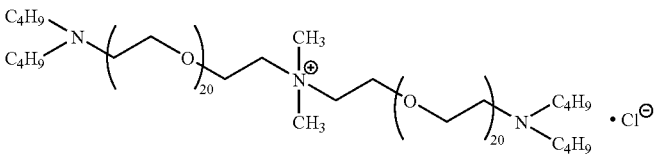 | | |
| 28 | 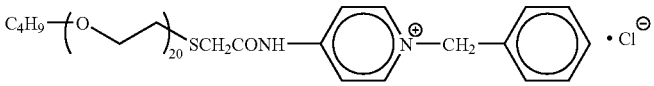 | | |
| 29 | 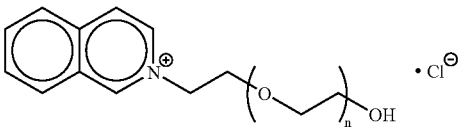 n ≈ 67 | | |

-continued
| | | | |
|---|---|---|---|
| 30 | 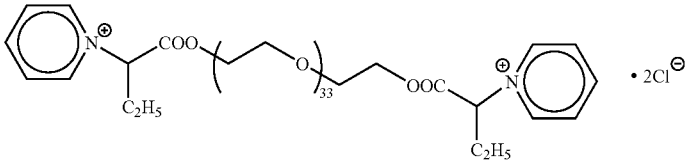 | | |
| 31 | 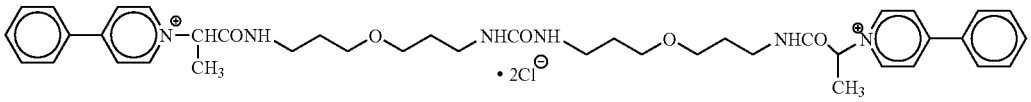 | | |
| 32 | 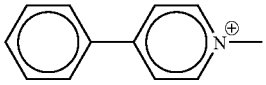 | 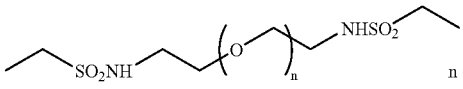 n = 12 | $Cl^{\ominus}$ |
| 33 | 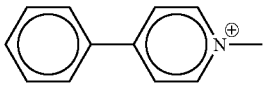 | 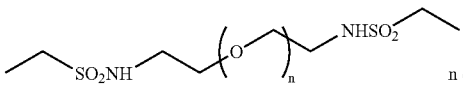 n ≈ 24 | $Br^{\ominus}$ |
| 34 | 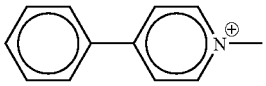 | 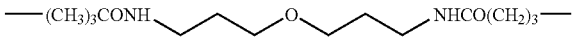 | $Cl^{\ominus}$ |
| 35 | 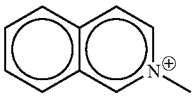 | 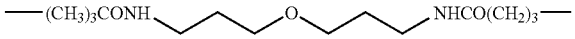 | $Cl^{\ominus}$ |
| 36 | 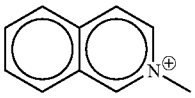 | 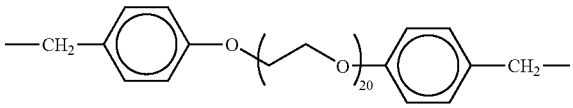 | $Cl^{\ominus}$ |
| 37 | 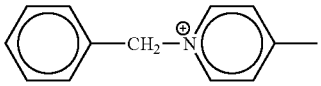 | 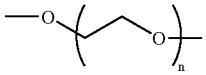 n ≈ 33 | $Cl^{\ominus}$ |
| 38 | 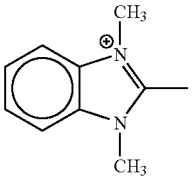 | 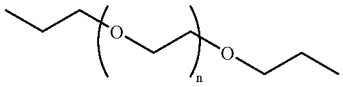 n ≈ 43 | $Cl^{\ominus}$ |
| 39 | $(C_4H_9)_3N^{\oplus}$— | 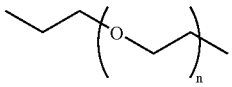 n = 20 | $Cl^{\ominus}$ |
| 40 | $(C_8H_{17})_2(CH_3)N^{\oplus}$— | 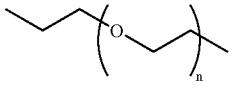 n ≈ 43 | $Cl^{\ominus}$ |
| 41 | $Ph_3P^{\oplus}$— | 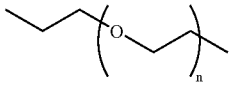 n = 20 | $Cl^{\ominus}$ |
| 42 | $Ph_3P^{\oplus}$— | 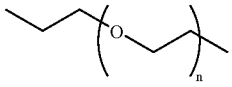 n ≈ 33 | $Br^{\ominus}$ |

-continued $Q^+$—$CH_2CONH$—L—$NHCOCH_2$—$Q^+ \cdot 2X^-$

| No. | $Q^+$= | L= | $X^-$= |
|---|---|---|---|
| 43 | $Ph_3P^{\oplus}$— | —$C_2H_4$—$(OC_2H_4)_n$—<br>n = 3 | $Cl^{\ominus}$ |
| 44 | $Ph_3P^{\oplus}$— | —$C_2H_4$—$(OC_2H_4)_n$—<br>n = 20 | $Br^{\ominus}$ |
| 45 | $Ph_3P^{\oplus}$— | —$C_2H_4$—$(OC_2H_4)_n$—<br>n ≈ 34 | $Cl^{\ominus}$ |
| 46 | $Ph_3P^{\oplus}$— | —$C_2H_4$—$(OC_2H_4)_n$—<br>n ≈ 67 | $Cl^{\ominus}$ |
| 47 | 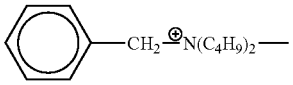 | —$C_2H_4$—$(OC_2H_4)_n$—<br>n = 12 | $Cl^{\ominus}$ |
| 48 | 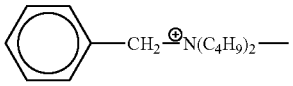 | —$C_2H_4$—$(OC_2H_4)_n$—<br>n = 30 | $Br^{\ominus}$ |
| 49 | 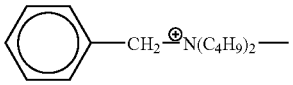 | —$C_2H_4$—$(OC_2H_4)_n$—<br>n ≈ 43 | 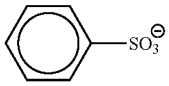 |
| 50 | 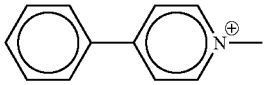 | —$C_2H_4$—$(OC_2H_4)_n$—<br>n = 3 | $Cl^{\ominus}$ |
| 51 | 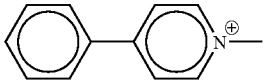 | —$C_2H_4$—$(OC_2H_4)_n$—<br>n = 12 | $Cl^{\ominus}$ |
| 52 | 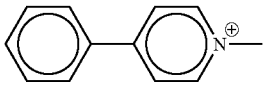 | —$C_2H_4$—$(OC_2H_4)_n$—<br>n = 20 | $Cl^{\ominus}$ |
| 53 | 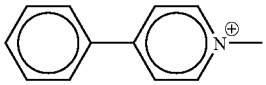 | —$C_2H_4$—$(OC_2H_4)_n$—<br>n ≈ 43 | $Cl^{\ominus}$ |
| 54 | 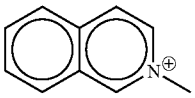 | —$C_2H_4$—$(OC_2H_4)_n$—<br>n = 2 | $Cl^{\ominus}$ |
| 55 | 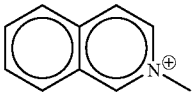 | —$C_2H_4$—$(OC_2H_4)_n$—<br>n = 12 | $Br^{\ominus}$ |
| 56 | 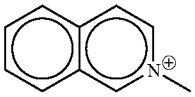 | —$C_2H_4$—$(OC_2H_4)_n$—<br>n = 30 | 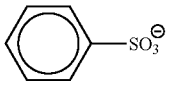 |
| 57 | 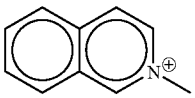 | —$C_2H_4$—$(OC_2H_4)_n$—<br>n ≈ 67 | $(COO)_2^{2\ominus}$ |
| 58 | 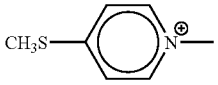 | —$C_2H_4$—$(OC_2H_4)_n$—<br>n = 12 | $Cl^{\ominus}$ |

-continued

| | | | |
|---|---|---|---|
| 59 | 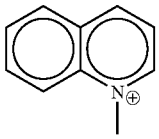 | $—C_2H_4—(OC_2H_4)_n—$<br>n = 20 | $Cl^{\ominus}$ |
| 60 | 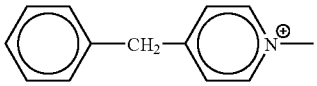 | $—C_2H_4—(OC_2H_4)_n—$<br>n = 30 | $Cl^{\ominus}$ |
| 61 | 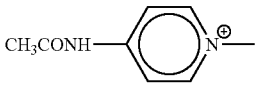 | $—C_2H_4—(OC_2H_4)_n—$<br>n ≈ 67 | $Cl^{\ominus}$ |
| 62 | 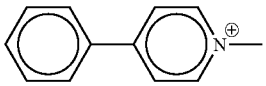 | $—C_2H_4—(OC_2H_4)_n—OC_3H_6—$<br>n = 2 | $Cl^{\ominus}$ |
| 63 | 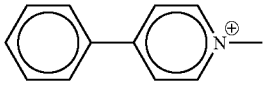 | $—C_2H_4—(OC_2H_4)_n—OC_3H_6—$<br>n = 20 | $Cl^{\ominus}$ |
| 64 | 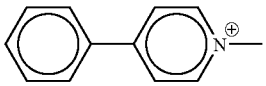 | $—C_2H_4—(OC_2H_4)_n—OC_3H_6—$<br>n ≈ 43 | $Cl^{\ominus}$ |
| 65 | $Ph_3P^{\oplus}—$ | $—C_3H_6—(OC_2H_4)_n—OC_3H_6—$<br>n = 2 | $Cl^{\ominus}$ |
| 66 | $Ph_3P^{\oplus}—$ | $—C_3H_6—(OC_2H_4)_n—OC_3H_6—$<br>n = 12 | $Cl^{\ominus}$ |
| 67 | 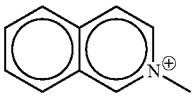 | $—C_3H_6—(OC_2H_4)_n—OC_3H_6—$<br>n = 20 | $Cl^{\ominus}$ |
| 68 | 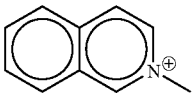 | $—C_3H_6—(OC_2H_4)_n—OC_3H_6—$<br>n ≈ 43 | $Cl^{\ominus}$ |
| 69 | $(C_3H_7)_3N^{\oplus}—$ | $—C_3H_6—(OC_2H_4)_n—OC_3H_6—$<br>n ≈ 67 | $Cl^{\ominus}$ |
| 70 | $(C_3H_7)_3N^{\oplus}—$ | $—CH(CH_3)CH_2—(OC_2H_4)_n—OCH_2CH(CH_3)—$<br>n = 12 | $Cl^{\ominus}$ |
| 71 | 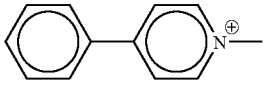 | $—CH(CH_3)CH_2—(OC_2H_4)_n—OCH_2CH(CH_3)—$<br>n ≈ 18 | $Cl^{\ominus}$ |
| 72 | 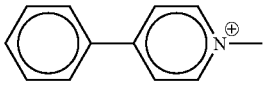 | $—CH(CH_3)CH_2—(OC_2H_4)_n—OCH_2CH(CH_3)—$<br>n = 20 | $Cl^{\ominus}$ |
| 73 | 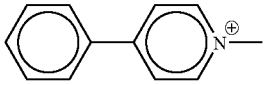 | $—C_2H_4—(O—CH_2—CH(CH_3))_n—$<br>n = 4 | $Cl^{\ominus}$ |
| 74 | 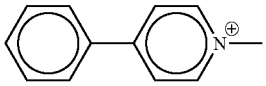 | $—C_2H_4—(O—CH_2—CH(CH_3))_n—$<br>n ≈ 13 | $Cl^{\ominus}$ |

-continued

| | | | |
|---|---|---|---|
| 75 | 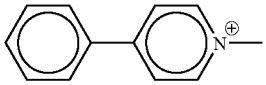 | 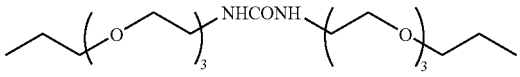 | $Cl^{\ominus}$ |
| 76 | 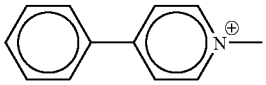 | 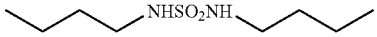 | $Cl^{\ominus}$ |
| 77 | 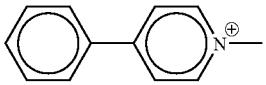 | 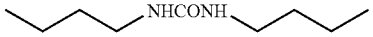 | $Cl^{\ominus}$ |
| 78 | 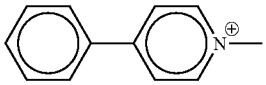 | 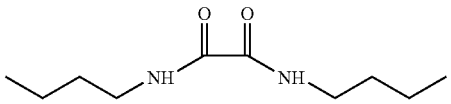 | $Cl^{\ominus}$ |
| 79 | 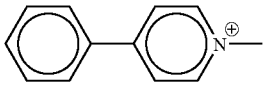 | 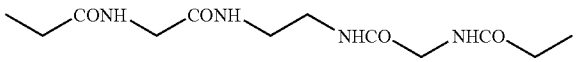 | $Cl^{\ominus}$ |
| 80 | 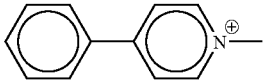 | 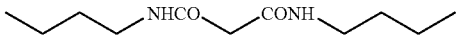 | $Cl^{\ominus}$ |
| 81 | 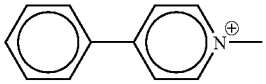 | 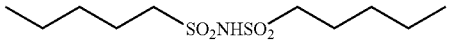 | $Cl^{\ominus}$ |
| 82 | 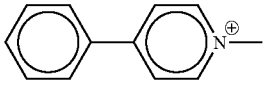 | 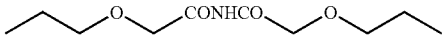 | $Cl^{\ominus}$ |
| 83 | 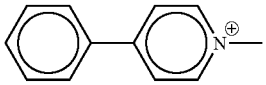 | 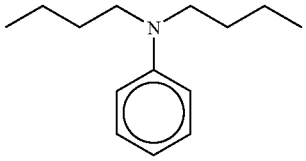 | $Cl^{\ominus}$ |
| 84 | 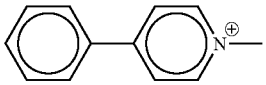 | 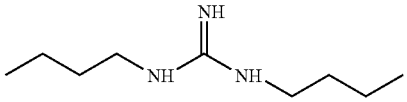 | $Cl^{\ominus}$ |
| 85 | 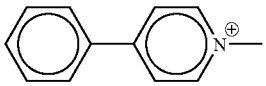 | 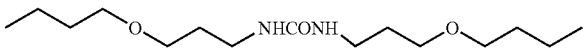 | $Cl^{\ominus}$ |
| 86 | 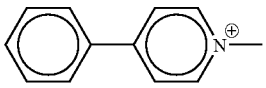 | 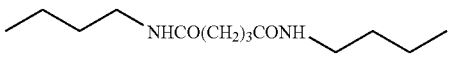 | $Cl^{\ominus}$ |

The quaternary salt compounds represented by the formulas (a) to (f) can be easily synthesized by known methods.

The nucleation accelerator that can be used in the present invention may be dissolved in an appropriate water-miscible organic solvent such as an alcohol (e.g., methanol, ethanol, propanol or a fluorinated alcohol), ketone (e.g., acetone or methyl ethyl ketone), dimethylformamide, dimethylsulfoxide or methyl cellosolve and used.

Alternatively, the nucleation accelerator may also be dissolved in an oil such as dibutyl phthalate, tricresyl phosphate, glyceryl triacetate or diethyl phthalate using an auxiliary solvent such as ethyl acetate or cyclohexanone and mechanically processed into an emulsion dispersion by a conventionally well-known emulsion dispersion method before use. Alternatively, powder of the nucleation accelerator may be dispersed in water by means of ball mill, colloid mill or ultrasonic waves according to a method known as solid dispersion method and used.

The nucleation accelerator that can be used in the present invention is preferably added to a non-photosensitive layer consisting of a hydrophilic colloid layer not containing silver halide emulsion provided on the silver halide emulsion layer side of the support, particularly preferably to a non-photosensitive layer consisting of a hydrophilic colloid layer between a silver halide emulsion layer and the support.

The nucleation accelerator is preferably used in an amount of $1\times10^{-6}$ to $2\times10^{-2}$ mol, more preferably $1\times10^{-5}$ to $2\times10^{-2}$ mol, most preferably $2\times10^{-5}$ to $1\times10^{-2}$ mol, per mol of silver halide. It is also possible to use two or more kinds of nucleation accelerators in combination. There are no particular limitations on various additives used in the silver halide photographic light-sensitive material of the present invention and, for example, those described below can be used: polyhydroxybenzene compounds described in JP-A-3-39948, page 10, right lower column, line 11 to page 12, left lower column, line 5, specifically, Compounds (III)-1 to (III)-25 described in the same; compounds that substantially do not have an absorption maximum in the visible region represented by the formula (I) described in JP-A-1-118832, specifically, Compounds I-1 to I-26 described in the same; antifoggants described in JP-A-2-103536, page 17, right lower column, line 19 to page 18, right upper column, line 4; polymer latexes described in JP-A-2-103536, page 18, left lower column, line 12 to left lower column, line 20, polymer latexes having an active methylene group represented by formula (I) described in JP-A-9-179228, specifically, Compounds I-1 to I-16 described in the same, polymer latexes having core/shell structure described in JP-A-9-179228, specifically, Compounds P-1 to P-55 described in the same, and acidic polymer latexes described in JP-A-7-104413, page 14, left column, line 1 to right column, line 30, specifically, Compounds II-1) to II-9) described on page 15 of the same; matting agents, lubricants and plasticizers described in JP-A-2-103536, page 19, left upper column, line 15 to right upper column, line 15; hardening agents described in JP-A-2-103536, page 18, right upper column, line 5 to line 17; compounds having an acid radical described in JP-A-2-103536, page 18, right lower column, line 6 to page 19, left upper column, line 1; conductive materials described in JP-A-2-18542, page 2, left lower column, line 13 to page 3, right upper column, line 7, specifically, metal oxides described in page 2, right lower column, line 2 to line 10 of the same, and conductive polymer compounds P-1 to P-7 described in the same; water-soluble dyes described in JP-A-2-103536, page 17, right lower column, line 1 to line 18; solid dispersion dyes represented by the formulas (FA), (FA1), (FA2) and (FA3) described in JP-A-9-179243, specifically, Compounds F1 to F34 described in the same; Compounds (II-2) to (II-24), Compounds (III-5) to (III-18) and Compounds (IV-2) to (IV-7) described in JP-A-7-152112, and solid dispersion dyes described in JP-A-2-294638 and JP-A-5-11382; redox compounds capable of releasing a development inhibitor by oxidation described in JP-A-5-274816, preferably redox compounds represented by the formulas (R-1), (R-2) and (R-3) described in the same, specifically, Compounds R-1 to R-68 described in the same; and binders described in JP-A-2-18542, page 3, right lower column, line 1 to line 20.

The swelling ratio of the hydrophilic colloid layers including the emulsion layers and protective layers of the silver halide photographic light-sensitive material of the present invention is preferably in the range of 80 to 150%, more preferably 90 to 140%. The swelling ratio of the hydrophilic colloid layer can be determined in the following manner. The thickness ($d_0$) of the hydrophilic colloid layers including the emulsion layers and protective layers of the silver halide photographic light-sensitive material is measured, and the swollen thickness ($\Delta d$) is measured after the silver halide photographic material is immersed in distilled water at 25° C. for one minute. Then, the swelling ratio is calculated from the following equation: Swelling ratio (%)= $(\Delta d/d_0)\times100$.

The silver halide photographic light-sensitive material of the present invention preferably has a film surface pH of 7.5 or lower, more preferably 4.5 to 6.0, further preferably 4.8 to 6.0, for the side on which silver halide emulsion layer is coated. If it is less than 4.5, hardening of the emulsion layer tends to be delayed.

Processing chemicals such as developing solution (developer) and fixing solution (fixer) and processing methods that can be used for the present invention are described below. However, of course the present invention should not be construed as being limited to the following description and specific examples.

For the development of the silver halide photographic light-sensitive material of the present invention, any of known methods can be used, and known developers can be used.

A developing agent for use in developer (hereinafter, starter developer and replenisher developer are collectively referred to as developer) used for the present invention is not particularly limited. However, the developer preferably contains a dihydroxybenzene compound, ascorbic acid derivative or hydroquinonemonosulfonate, and they can be used each alone or in combination. In particular, a dihydroxybenzene type developing agent and an auxiliary developing agent exhibiting superadditivity are preferably contained in combination, and combinations of a dihydroxybenzene compound or an ascorbic acid derivative with a 1-phenyl-3-pyrazolidone compound, or combinations of a dihydroxybenzene compound or ascorbic acid derivative with a p-aminophenol compound can be mentioned.

Examples of the dihydroxybenzene developing agent as a developing agent used for the present invention includes hydroquinone, chlorohydroquinone, isopropylhydroquinone, methylhydroquinone and so forth, and hydroquinone is particularly preferred. Examples of the ascorbic acid derivative developing agent include ascorbic acid, isoascorbic acid and salts thereof. Sodium erythorbate is particularly preferred in view of material cost.

Examples of the 1-phenyl-3-pyrazolidones or derivatives thereof as the developing agent used for the present invention include 1-phenyl-3-pyrazolidone, 1-phenyl-4,4-dimethyl-3-pyrazolidone, 1-phenyl-4-methyl-4-hydroxymethyl-3-pyrazolidone and so forth.

Examples of the p-aminophenol type developing agent that can be used for the present invention include N-methyl-p-aminophenol, p-aminophenol, N-(β-hydroxyphenyl)-p-aminophenol, N-(4-hydroxyphenyl)glycine, o-methoxy-p-(N,N-dimethylamino)phenol, o-methoxy-p-(N-methylamino)phenol etc., and N-methyl-p-aminophenol and aminophenols described in JP-A-9-297377 and JP-A-9-297378 are particularly preferred.

The dihydroxybenzene type developing agent is preferably used in an amount of generally 0.05 to 0.8 mol/L. When a dihydroxybenzene compound and a 1-phenyl-3-pyrazolidone compound or a p-aminophenol compound are used in combination, the former is preferably used in an amount of 0.05 to 0.6 mol/L, more preferably 0.10 to 0.5 mol/L, and the latter is preferably used in an amount of 0.06 mol/L or less, more preferably 0.003 to 0.03 mol/L.

The ascorbic acid derivative developing agent is preferably used in an amount of generally 0.01 to 0.5 mol/L, more preferably 0.05 to 0.3 mol/L. When an ascorbic acid derivative and a 1-phenyl-3-pyrazolidone compound or a p-aminophenol compound are used in combination, the ascorbic acid derivative is preferably used in an amount of from 0.01 to 0.5 mol/L, and the 1-phenyl-3-pyrazolidone compound or p-aminophenol compound is preferably used in an amount of 0.005 to 0.2 mol/L.

The developer used in processing of the silver halide photographic light-sensitive material of the present invention may contain additives (e.g., a developing agent, alkali agent, pH buffer, preservative, chelating agent etc.) that are commonly used. Specific examples thereof are described below. However, the present invention is by no means limited to them.

Examples of the buffer for use in the developer used in development include carbonates, boric acids described in JP-A-62-186259, saccharides (e.g., saccharose) described in JP-A-60-93433, oximes (e.g., acetoxime), phenols (e.g., 5-sulfosalicylic acid), tertiary phosphates (e.g., sodium salt and potassium salt) etc., and carbonates are preferably used. The amount of the buffer, in particular, the carbonates, is preferably 0.05 mol/L or more, particularly preferably 0.08 to 1.0 mol/L.

In the present invention, both the starter developer and the replenisher developer preferably have a property that the solution shows pH increase of 0.8 or less when 0.1 mol of sodium hydroxide is added to 1 L of the solution. As for the method of confirming whether the starter developer or replenisher developer used has the property, pH of the starter developer or replenisher developer to be tested is adjusted to 10.5, 0.1 mol of sodium hydroxide is added to 1 L of the solution, then pH of the solution is measured, and if increase of pH value is in the range of 0.8 or less, the solution is determined to have the property defined above. In the present invention, it is particularly preferable to use a starter developer and replenisher developer showing pH increase of 0.7 or less in the aforementioned test.

Examples of the preservative that can be used for the present invention include sodium sulfite, potassium sulfite, lithium sulfite, ammonium sulfite, sodium bisulfite, sodium methabisulfite, formaldehyde-sodium bisulfite and so forth. A sulfite is used in an amount of preferably 0.2 mol/L or more, particularly preferably 0.3 mol/L or more. However, if it is added in an unduly large amount, silver staining in the developer is caused. Accordingly, the upper limit is preferably 1.2 mol/L. The amount is particularly preferably 0.35 to 0.7 mol/L.

As the preservative for a dihydroxybenzene type developing agent, a small amount of the aforementioned ascorbic acid derivative may be used together with the sulfite. Sodium erythorbate is particularly preferably used in view of material cost. It is preferably added in an amount of 0.03 to 0.12, particularly preferably 0.05 to 0.10, in terms of molar ratio with respect to the dihydroxybenzene type developing agent. When an ascorbic acid derivative is used as the preservative, the developer preferably does not contain a boron compound.

Examples of additives to be used other than those described above include a development inhibitor such as sodium bromide and potassium bromide, an organic solvent such as ethylene glycol, diethylene glycol, triethylene glycol and dimethylformamide, a development accelerator such as an alkanolamine including diethanolamine, triethanolamine etc. and an imidazole and derivatives thereof, and an agent for preventing uneven physical development such as a heterocyclic mercapto compound (e.g., sodium 3-(5-mercaptotetrazol-1-yl)benzenesulfonate, 1-phenyl-5-mercaptotetrazole etc.) and the compounds described in JP-A-62-212651.

Further, a mercapto compound, indazole compound, benzotriazole compound or benzimidazole compound may be added as an antifoggant or a black spot (black pepper) inhibitor. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-((2-mercapto-1,3,4-thiadiazol-2-yl)thio)butanesulfonate, 5-amino-1,3,4-thiadiazole-2-thiol, methylbenzotriazole, 5-methylbenzotriazole, 2-mercaptobenzotriazole and so forth. The addition amount thereof is generally 0.01 to 10 mmol, preferably 0.1 to 2 mmol, per liter of the developer.

Further, various kinds of organic or inorganic chelating agents can be used individually or in combination in the developer used for the present invention.

As the inorganic chelating agents, sodium tetrapolyphosphate, sodium hexametaphosphate and so forth can be used.

As the organic chelating agents, organic carboxylic acid, aminopolycarboxylic acid, organic phosphonic acid, aminophosphonic acid and organic phosphonocarboxylic acid can be mainly used.

Examples of the organic carboxylic acid include acrylic acid, oxalic acid, malonic acid, succinic acid, glutaric acid, gluconic acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid, tartaric acid etc.

Examples of the aminopolycarboxylic acid include iminodiacetic acid, nitrilotriacetic acid, nitrilotripropionic acid, ethylenediaminemonohydroxyethyltriacetic acid, ethylenediaminetetraacetic acid, glycol ether-tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether-diaminetetraacetic acid, and compounds described in JP-A-52-25632, JP-A-55-67747, JP-A-57-102624 and JP-B-53-40900.

Examples of the organic phosphonic acid include hydroxyalkylidene-diphosphonic acids described in U.S. Pat. Nos. 3,214,454 and 3,794,591 and West German Patent Publication No. 2,227,369, and the compounds described in Research Disclosure, Vol. 181, Item 18170 (May, 1979) and so forth.

Examples of the aminophosphonic acid include aminotris (methylenephosphonic acid), ethylenediaminetetramethylenephosphonic acid, aminotrimethylenephosphonic acid and so forth, and the compounds described in Research Disclosure, No. 18170 (supra), JP-A-57-208554, JP-A-54-61125, JP-A-55-29883, JP-A-56-97347 and so forth can also be mentioned.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956, Research Disclosure, No. 18170 (supra) and so forth.

The organic and/or inorganic chelating agents are not limited to those described above. The organic and/or inorganic chelating agents may be used in the form of an alkali metal salt or an ammonium salt. The amount of the chelating agent added is preferably $1\times10^{-4}$ to $1\times10^{-1}$ mol, more preferably $1\times10^{-3}$ to $1\times10^{-2}$ mol, per liter of the developer.

Further, a silver stain inhibitor may be added to the developer, and examples thereof include, for example, the compounds described in JP-A-56-24347, JP-B-56-46585, JP-B-62-2849, JP-A-4-362942 and JP-A-8-6215; triazines having one or more mercapto groups (for example, the compounds described in JP-B-6-23830, JP-A-3-282457 and JP-A-7-175178); pyrimidines having one or more mercapto groups (e.g., 2-mercaptopyrimidine, 2,6-dimercaptopyrimidine, 2,4-dimercaptopyrimidine, 5,6-diamino-2,4-dimercaptopyrimidine, 2,4,6-trimercaptopyrimidine, the compounds described in JP-A-9-274289 etc.); pyridines having one or more mercapto groups (e.g., 2-mercaptopyridine, 2,6-dimercaptopyridine, 3,5-dimercaptopyridine, 2,4,6-trimercaptopyridine, compounds described in JP-A-7-248587 etc.); pyrazines having one or more mercapto groups (e.g., 2-mercaptopyrazine, 2,6-dimercaptopyrazine, 2,3-dimercaptopyrazine, 2,3,5-trimercaptopyrazine etc.); pyridazines having one or more mercapto groups (e.g., 3-mercaptopyridazine, 3,4-dimercaptopyridazine, 3,5-dimercaptopyridazine, 3,4,6-trimercaptopyridazine etc.); the compounds described in JP-A-7-175177, polyoxyalkylphosphonic acid esters described in U.S. Pat. No. 5,457,011 and so forth. These silver stain inhibitors may be used individually or in combination of two or more of these. The addition amount thereof is preferably 0.05 to 10 mmol, more preferably 0.1 to 5 mmol, per liter of the developer.

The developer may also contain the compounds described in JP-A-61-267759 as a dissolution aid.

Further, the developer may also contain a toning agent, surfactant, defoaming agent, hardening agent or the like, if necessary.

The developer preferably has a pH of 9.0 to 12.0, more preferably 9.0 to 11.0, particularly preferably 9.5 to 11.0. As the alkali agent used for adjusting pH, a usual water-soluble inorganic alkali metal salt (e.g., sodium hydroxide, potassium hydroxide, sodium carbonate, potassium carbonate etc.) may be used.

As for the cation of the developer, potassium ion less inhibits development and causes less indentations, called fringes, on peripheries of blackened portions, compared with sodium ion. Further, when the developer is stored as a concentrated solution, potassium salt is generally preferred, because of its higher solubility. However, since, in the fixer, potassium ion causes fixing inhibition on the same level as silver ion, a high potassium ion concentration in the developer disadvantageously causes increase of the potassium ion concentration in the fixer because of carrying over of the developer by the silver halide photographic light-sensitive material. In view of the above, the molar ratio of potassium ion to sodium ion in the developer is preferably between 20:80 and 80:20. The ratio of potassium ion to sodium ion can be freely controlled within the above-described range by a counter cation such as those derived from a pH buffer, pH adjusting agent, preservative, chelating agent or the like.

The replenishing amount of the developer is generally 470 mL or less, preferably 30 to 325 mL, per $m^2$ of the silver halide photographic light-sensitive material. The replenisher developer may have the same composition and/or concentration as the starter developer, or it may have a different composition and/or concentration from those of the starter developer.

Examples of the fixing agent in the fixing processing agent that can be used for the present invention include ammonium thiosulfate, sodium thiosulfate and ammonium sodium thiosulfate. Although the amount of the fixing agent may be varied appropriately, it is generally about 0.7 to 3.0 mol/L.

The fixer that can be used for the present invention may contain a water-soluble aluminum salt or a water-soluble chromium salt, which acts as a hardening agent, and of these salts, a water-soluble aluminum salt is preferred. Examples thereof include aluminum chloride, aluminum sulfate, potassium alum, ammonium aluminum sulfate, aluminum nitrate, aluminum lactate and so forth. These are preferably contained in an amount of 0.01 to 0.15 mol/L in terms of aluminum ion concentration in the solution used.

When the fixer is stored as a concentrated solution or a solid agent, it may be constituted by a plurality of parts including a hardening agent or the like as a separate part, or it may be constituted as a one-part agent containing all components.

The fixing processing agent may contain, if desired, a preservative (e.g., sulfite, bisulfite, metabisulfite etc. in an amount of 0.015 mol/L or more, preferably 0.02 to 0.3 mol/L), pH buffer (e.g., acetic acid, sodium acetate, sodium carbonate, sodium hydrogencarbonate, phosphoric acid, succinic acid, adipic acid etc. in an amount of generally 0.1 to 1 mol/L, preferably 0.2 to 0.7 mol/L), and a compound having aluminum-stabilizing ability or hard water-softening ability (e.g., gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, derivatives and salts thereof, saccharides etc. in an amount of 0.001 to 0.5 mol/L, preferably 0.005 to 0.3 mol/L). However, in view of environmental protection recently concerned, it is preferred that a boron compound is not contained.

In addition, the fixing processing agent may contain the compounds described in JP-A-62-78551, pH adjusting agent (e.g., sodium hydroxide, ammonia, sulfuric acid etc.), surfactant, wetting agent, fixing accelerator etc. Examples of the surfactant include anionic surfactants such as sulfated products and sulfonated products, polyethylene surfactants and amphoteric surfactants described in JP-A-57-6840. Known deforming agents may also be used. Examples of the wetting agent include alkanolamines and alkylene glycols. Examples of the fixing accelerator include alkyl- or aryl-substituted thiosulfonic acids and salts thereof described in JP-A-6-308681; thiourea derivatives described in JP-B-45-35754, JP-B-58-122535 and JP-B-58-122536; alcohols having a triple bond within the molecule; thioether compounds described in U.S. Pat. No. 4,126,459; mercapto compounds described in JP-A-64-4739, JP-A-1-4739, JP-A-1-159645 and JP-A-3-101728; mesoionic compounds and thiocyanates described in JP-A-4-170539.

pH of the fixer used for the present invention is preferably 4.0 or more, more preferably 4.5 to 6.0. pH of the fixer rises with processing by the contamination of developer. In such a case, pH of a hardening fixer is preferably 6.0 or less, more preferably 5.7 or less, and that of a non-hardening fixer is preferably 7.0 or less, more preferably 6.7 or less.

The replenishing rate of the fixer is preferably 500 mL or less, more preferably 390 mL or less, still more preferably 80 to 325 mL, per $m^2$ of the silver halide photographic light-sensitive material. The composition and/or the concentration of the replenisher fixer may be the same as or different from those of the starter fixer.

The fixer can be reclaimed for reuse according to known fixer reclaiming methods such as electrolytic silver recovery. As reclaiming apparatuses, there are FS-2000 produced by Fuji Photo Film Co., Ltd. and so forth.

Further, removal of dyes and so forth using an adsorptive filter such as those comprising activated carbon is also preferred.

When the developing and fixing processing chemicals used in the present invention are solutions, they are preferably preserved in packaging materials of low oxygen permeability as disclosed in JP-A-61-73147. Further, when these solutions are concentrated solutions, they are diluted with water to a predetermined concentration in the ratio of 0.2 to 3 parts of water to one part of the concentrated solutions.

Even if the developing processing chemicals and fixing processing chemicals used in the present invention are made as solids, the same effects as solutions can be obtained. Solid processing chemicals are described below.

Solid chemicals that can be used for the present invention may be made into known shapes such as powders, granular powders, granules, lumps, tablets, compactors, briquettes, plates, bars, paste or the like. These solid chemicals may be covered with water-soluble coating agents or films to separate components that react with each other on contact, or they may have a multilayer structure to separate components that react with each other, or both types may be used in combination.

Known coating agents and auxiliary granulating agents can be used, and polyvinylpyrrolidone, polyethylene glycol, polystyrenesulfonic acid and vinyl compounds are preferably used. Further, JP-A-5-45805, column 2, line 48 to column 3, line 13 can be referred to.

When a multilayer structure is used, components that do not react with each other on contact may be sandwiched with components that react with each other and made into tablets or briquettes, or components of known shapes may be made into a similar layer structure and packaged. Methods therefor are disclosed in JP-A-61-259921, JP-A-4-16841, JP-A-4-78848, JP-A-5-93991 and so forth.

The bulk density of the solid processing chemicals is preferably 0.5 to 6.0 g/cm$^3$, in particular, the bulk density of tablets is preferably 1.0 to 5.0 g/cm$^3$, and that of granules is preferably 0.5 to 1.5 g/cm$^3$.

Solid processing chemicals used for the present invention can be produced by using any known method, and one can refer to, for example, JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5-197070, JP-A-5-204098, JP-A-5-224361, JP-A-6-138604, JP-A-6-138605, JP-A-8-286329 and so forth.

More specifically, the rolling granulating method, extrusion granulating method, compression granulating method, cracking granulating method, stirring granulating method, spray drying method, dissolution coagulation method, briquetting method, roller compacting method and so forth can be used.

The solubility of the solid chemicals used in the present invention can be adjusted by changing state of surface (smooth, porous, etc.) or partially changing the thickness, or making the shape into a hollow doughnut type. Further, it is also possible to provide different solubilities to a plurality of granulated products, or it is also possible for materials having different solubilities to use various shapes to obtain the same solubilities. Multilayer granulated products having different compositions between the inside and the surface can also be used.

Packaging materials of solid chemicals preferably have low oxygen and water permeabilities, and those of known shapes such as bag-like, cylindrical and box-like shapes can be used. Packaging materials of foldable shapes are preferred for saving storage space of waste packaging materials as disclosed in JP-A-6-242585 to JP-A-6-242588, JP-A-6-247432, JP-A-6-247448, JP-A-6-301189, JP-A-7-5664, and JP-A-7-5666 to JP-A-7-5669. Takeout ports of these packaging materials for processing chemicals may be provided with a screw cap, pull-top or aluminum seal, or packaging materials may be heat-sealed, or other known types may be used, and there are no particular limitations. Waste packaging materials are preferably recycled or reused in view of environmental protection.

Methods of dissolution and replenishment of the solid processing chemicals are not particularly limited, and known methods can be used. Examples of these known methods include a method in which a certain amount of processing chemicals are dissolved and replenished by a dissolving apparatus having a stirring function, a method in which processing chemicals are dissolved by a dissolving apparatus having a dissolving zone and a zone where a finished solution is stocked and the solution is replenished from the stock zone as disclosed in JP-A-9-80718, and a method in which processing chemicals are fed to a circulating system of an automatic processor and dissolved and replenished, or processing chemicals are fed to a dissolving tank provided in an automatic processor with progress of the processing of silver halide photographic light-sensitive materials as disclosed in JP-A-5-119454, JP-A-6-19102 and JP-A-7-261357. In addition to the above methods, any of known methods can be used. The charge of processing chemicals may be conducted manually, or automatic opening and automatic charge may be conducted by using a dissolving apparatus or automatic processor provided with an opening mechanism as disclosed in JP-A-9-138495. The latter is preferred in view of the working environment. Specifically, there are methods of pushing through, unsealing, cutting off and bursting a takeout port of package, methods disclosed in JP-A-6-19102 and JP-A-6-95331 and so forth.

A silver halide photographic light-sensitive material is subjected to washing or stabilizing processing after being developed and fixed (hereinafter washing includes stabilization processing, and a solution used therefor is called water or washing water unless otherwise indicated). The water used for washing may be any of tap water, ion exchange water, distilled water and stabilized solution. The replenishing rate therefor is, in general, about 8 to 17 liters per m$^2$ of the silver halide photographic light-sensitive material. However, washing can be carried out with a replenishing rate less than the above. In particular, with a replenishing rate of 3 liters or less (including zero, i.e., washing in a reservoir), not only water saving processing can be carried out, but also piping for installation of an automatic processor becomes unnecessary. When washing is carried out with a reduced replenishing amount of water, it is more preferable to use a washing tank equipped with a squeegee roller or a crossover roller disclosed in JP-A-63-18350, JP-A-62-287252 or the like. The addition of various kinds of oxidizing agents (e.g., ozone, hydrogen peroxide, sodium hypochlorite, activated halogen, chlorine dioxide, sodium carbonate hydrogen peroxide salt etc.) and filtration through filters may be combined to reduce load on environmental pollution, which becomes a problem when washing is carried out with a small amount of water, and to prevent generation of scale.

As a method of reducing the replenishing amount of the washing water, a multistage countercurrent system (e.g., two stages or three stages) has been known for a long time. The replenishing amount of the washing water in this system is preferably 50 to 200 mL per m$^2$ of the silver halide photographic light-sensitive material. This effect can also similarly be obtained in an independent multistage system (a method in which a countercurrent is not used, and fresh solutions are separately replenished to multistage washing tanks).

Further, means for preventing generation of scale may be included in a washing process. The means for preventing generation of scale is not particularly limited, and known methods can be used. There are, for example, a method of adding an antifungal agent (so-called scale preventive), a method of using electroconduction, a method of irradiating ultraviolet ray, infrared ray or far infrared ray, a method of applying a magnetic field, a method of using ultrasonic wave processing, a method of applying heat, a method of emptying tanks when they are not used and so forth. These scale preventing means may be used with progress of the processing of silver halide photographic light-sensitive materials, may be used at regular intervals irrespective of usage conditions, or may be conducted only during the time when processing is not conducted, for example, during night. In addition, washing water previously subjected to a treatment with such means may be replenished. It is also preferable to use different scale preventing means for every given period of time for inhibiting proliferation of resistant fungi.

As a water-saving and scale-preventing apparatus, an apparatus AC-1000 produced by Fuji Photo Film Co., Ltd. and a scale-preventing agent AB-5 produced by Fuji Photo Film Co., Ltd. may be used, and the method disclosed in JP-A-11-231485 may also be used.

The antifungal agent is not particularly restricted, and a known antifungal agent may be used. Examples thereof include, in addition to the above-described oxidizing agents, glutaraldehyde, chelating agent such as aminopolycarboxylic acid, cationic surfactant, mercaptopyridine oxide (e.g., 2-mercaptopyridine-N-oxide) and so forth, and a sole antifungal agent may be used, or a plurality of antifungal agents may be used in combination.

The electricity may be applied according to the methods described in JP-A-3-224685, JP-A-3-224687, JP-A-4-16280, JP-A-4-18980 and so forth.

In addition, a known water-soluble surfactant or defoaming agent may be added so as to prevent uneven processing due to bubbling, or to prevent transfer of stains. Further, the dye adsorbent described in JP-A-63-163456 may be provided in the washing with water system so as to prevent stains due to a dye dissolved out from the silver halide photographic light-sensitive material.

The overflow solution from the washing with water step may be partly or wholly used by mixing it with the processing solution having fixing ability, as described in JP-A-60-235133. It is also preferable, in view of protection of the natural environment, to reduce the biochemical oxygen demand (BOD), chemical oxygen demand (COD), iodine consumption or the like in waste water before discharge by subjecting the solution to microbial treatment (for example, activated sludge treatment, treatment with a filter comprising a porous carrier such as activated carbon or ceramic carrying microorganisms such as sulfur-oxidizing bacteria etc.), electrification or oxidation treatment with an oxidizing agent before discharge, or to reduce the silver concentration in waste water by passing the solution through a filter using a polymer having affinity for silver, or by adding a compound that forms a hardly soluble silver complex, such as trimercaptotriazine, to precipitate silver, and then passing the solution through a filter.

In some cases, stabilization may be performed subsequent to the washing with water, and as an example thereof, a bath containing the compounds described in JP-A-2-201357, JP-A-2-132435, JP-A-1-102553 and JP-A-46-44446 may be used as a final bath of the silver halide photographic light-sensitive material. This stabilization bath may also contain, if desired, an ammonium compound, metal compound such as those of Bi or Al, fluorescent brightening agent, various chelating agents, film pH-adjusting agent, hardening agent, bactericide, antifungal agent, alkanolamine or surfactant.

The additives such as antifungal agent and the stabilizing agent added to the washing with water or stabilization bath may be formed into a solid agent like the aforementioned development and fixing processing agents.

Waste solutions of the developer, fixer, washing water or stabilizing solution used for the present invention are preferably burned for disposal. The waste solutions can also be concentrated or solidified by a concentrating apparatus such as those described in JP-B-7-83867 and U.S. Pat. No. 5,439,560, and then disposed.

When the replenishing amount of the processing agents is reduced, it is preferable to prevent evaporation or air oxidation of the solution by reducing the opening area of the processing tank. A roller transportation-type automatic developing machine is described in, for example, U.S. Pat. Nos. 3,025,779 and 3,545,971, and in the present specification, it is simply referred to as a roller transportation-type automatic processor. This automatic processor performs four steps of development, fixing, washing with water and drying, and it is most preferable to follow this four-step processing also in processing of the silver halide photographic light-sensitive material of the present invention, although other steps (e.g., stopping step) are not excluded. Further, a rinsing bath, tank for washing with water or washing tank may be provided between the development and fixing and/or between the fixing and washing with water.

In the development of the silver halide photographic light-sensitive material of the present invention, the dry-to-dry time from the start of processing to finish of drying is preferably 25 to 160 seconds, the development time and the fixing time are each preferably 40 seconds or less, more preferably 6 to 35 seconds, and the temperature of each solution is preferably 25 to 50° C., more preferably 30 to 40° C. The temperature and the time of washing with water are preferably 0 to 50° C. and 40 seconds or less, respectively. According to this method, the silver halide photographic light-sensitive material after development, fixing and washing with water may be passed between squeeze rollers for squeezing washing water, and then dried. The drying is generally performed at a temperature of from about 40° C. to about 100° C. The drying time may be appropriately varied depending on the ambient conditions. The drying method is not particularly limited, and any known method may be used. Hot-air drying and drying by a heat roller or far infrared rays as described in JP-A-4-15534, JP-A-5-2256 and JP-A-5-289294 may be used, and a plurality of drying methods may also be used in combination.

The present invention will be specifically explained with reference to the following examples and comparative examples. The materials, amounts, ratios, types and procedures of processes and so forth shown in the following examples can be optionally changed so long as such change does not depart from the gist of the present invention. Therefore, the scope of the present invention should not be construed in any limitative way based on the following examples. The term "part" used in the examples means part by weight unless otherwise indicated.

EXAMPLE 1

<<Preparation of Emulsion A>>

| Solution 1 | |
|---|---|
| Water | 750 mL |
| Gelatin | 20 g |
| Sodium chloride | 3 g |
| 1,3-Dimethylimidazolidine-2-thione | 20 mg |
| Sodium benzenethiosulfonate | 10 mg |
| Citric acid | 0.7 g |
| Solution 2 | |
| Water | 300 mL |
| Silver nitrate | 150 g |
| Solution 3 | |
| Water | 300 mL |
| Sodium chloride | 38 g |
| Potassium bromide | 32 g |
| $K_3IrCl_6$ (0.005% in 20% KCl aqueous solution) | $6.0 \times 10^{-7}$ mol/Ag mol |
| $(NH_4)_3[RhCl_5(H_2O)]$ (0.001% in 20% NaCl aqueous solution) | $2.5 \times 10^{-7}$ mol/Ag mol |

$K_3IrCl_6$ (0.005%) and $(NH_4)_3[RhCl_5(H_2O)]$ (0.001%) used for Solution 3 were prepared by dissolving powder of each in 20% aqueous solution of KCl or 20% aqueous solution of NaCl and heating the solution at 40° C. for 120 minutes.

Solution 2 and Solution 3 in amounts corresponding to 90% of each were simultaneously added to Solution 1 maintained at 38° C. and pH 4.5 over 20 minutes with stirring to form nucleus grains having a diameter of 0.21 μm. Subsequently, Solution 4 and Solution 5 shown below were added over 8 minutes. Further, the remaining 10% portions of Solution 2 and Solution 3 were added over 2 minutes to allow growth of the grains to a diameter of 0.23 μm. Further, 0.15 g of potassium iodide was added, and ripening was allowed for 5 minutes to complete the grain formation.

| Solution 4 | |
|---|---|
| Water | 100 mL |
| Silver nitrate | 50 g |
| Solution 5 | |
| Water | 100 mL |
| Sodium chloride | 13 g |
| Potassium bromide | 11 g |
| $K_4[Fe(CN)_6].3H_2O$ (potassium ferrocyanide) | $8.0 \times 10^{-7}$ mol/Ag mol |

Then, the resulting grains were washed according to a conventional flocculation method. Specifically, after the temperature of the mixture was lowered to 35° C., 3 g of Anionic precipitating agent 1 shown below was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes.

The emulsion after the washing with water and desalting was added with 45 g of gelatin, and after pH was adjusted to 5.6 and pAg was adjusted to 7.5, added with 10 mg of sodium benzenethiosulfonate, 3 mg of sodium benzenethiosulfinate, 15 mg of sodium thiosulfate pentahydrate and 4.0 mg of chloroauric acid to perform chemical sensitization at 55° C. for obtaining optimal sensitivity, and then added with 100 mg of 4-hydroxy-6-methyl-1,3,3a,7-tetrazaindene as a stabilizer and 100 mg of an antiseptic (Proxcel, ICI).

Finally, there was obtained an emulsion of cubic silver iodochlorobromide grains containing 30 mol % of silver bromide and 0.08 mol % of silver iodide and having an average grain size of 0.24 μm with a variation coefficient of 9%. The emulsion finally showed pH of 5.7, pAg of 7.5, electric conductivity of 40 μS/m, density of 1.2 to $1.25\times10^3$ kg/m$^3$ and viscosity of 50 mPa·s. The molar amount of silver in the internal portions containing the metal complex corresponded to 92.5% of the total silver amount.

Anionic Precipitating Agent 1

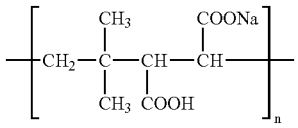

Average molecular weight: 120,000

<<Preparation of Emulsion B>>

Emulsion B containing 55 mol % of silver bromide and having an average grain size of 0.21 μm was prepared in the same manner as the preparation of Emulsion A except that the doping amount of $K_4[Fe(CN)_6].3H_2O$ (potassium ferrocyanide) was changed to $3.0\times10^{-5}$ mol/Ag mol. The halogen composition was controlled by changing addition amounts of sodium chloride and potassium bromide in Solutions 3 and 5, and the grain size was controlled by changing addition amount of sodium chloride and preparation temperature for Solution 1.

<<Preparation of Coating Solutions>>

The silver halide photographic light-sensitive materials prepared in this example had a structure where UL layer, emulsion layer, lower protective layer and upper protective layer were formed in this order on one surface of the following polyethylene terephthalate film support having moisture-proof layers comprising vinylidene chloride on the both surfaces, and an electroconductive layer and back layer were formed in this order on the opposite surface.

Compositions of coating solutions used for forming the layers are shown below.

| Coating solution for UL layer | |
|---|---|
| Gelatin | 0.5 g/m$^2$ |
| Polyethyl acrylate latex | 150 mg/m$^2$ |
| Compound (Cpd-7) | 40 mg/m$^2$ |
| Compound (Cpd-14) | 10 mg/m$^2$ |
| 5-Methylbenzotriazole | 20 mg/m$^2$ |
| Antiseptic (Proxcel, ICI Co., Ltd.) | 1.5 mg/m$^2$ |

Coating solution for emulsion layer

| Emulsion A | Amount providing coating amount of 2.9 g/m$^2$ |
|---|---|
| Spectral sensitization dye (SD-1) | $5.7 \times 10^{-4}$ mol/Ag mol |
| KBr | $3.4 \times 10^{-4}$ mol/Ag mol |
| Compound (Cpd-1) | $2.0 \times 10^{-4}$ mol/Ag mol |
| Compound (Cpd-2) | $2.0 \times 10^{-4}$ mol/Ag mol |
| Compound (Cpd-3) | $8.0 \times 10^{-4}$ mol/Ag mol |
| 4-Hydroxy-6-methyl-1,3,3a,7-tetrazaindene | $1.2 \times 10^{-4}$ mol/Ag mol |
| Hydroquinone | $1.2 \times 10^{-2}$ mol/Ag mol |
| Citric acid | $3.0 \times 10^{-4}$ mol/Ag mol |
| 5-Methylbenzotriazole | 20 mg/m$^2$ |
| Hydrazine compound (Cpd-4) | $6.0 \times 10^{-4}$ mol/Ag mol |
| Nucleation accelerator (Cpd-5) | Amount shown in Table 6 |
| 2,4-Dichloro-6-hydroxy-1,3,5-triazine sodium salt | 90 mg/m$^2$ |
| Aqueous latex (Cpd-6) | 100 mg/m$^2$ |
| Polyethyl acrylate latex | 150 mg/m$^2$ |
| Colloidal silica (particle size: 10 μm) | 15 weight % as for gelatin |
| Compound (Cpd-7) | 4 weight % as for gelatin |

-continued

Coating solution for emulsion layer

| Emulsion A | Amount providing coating amount of 2.9 g/m$^2$ |
|---|---|
| Latex of copolymer of methyl acrylate, 2-acrylamido-2-methypropanesulfonic acid sodium salt and 2-acetoxyethyl methacrylate (weight ratio = 88:5:7) | 150 mg/m$^2$ |
| Core/shell type latex (core: styrene/butadiene copolymer (weight ratio = 37/63), shell: styrene/2-acetoxyethyl acrylate copolymer (weight ratio = 84/16), core/shell ratio = 50/50) | 150 mg/m$^2$ |

pH of the coating solution was adjusted to 5.6 by using citric acid.

The coating solution for emulsion layer prepared as described above was coated on the support mentioned below so that the coated silver amount and coated gelatin amount should become 2.9 g/m$^2$ and 1.2 g/m$^2$, respectively.

Cpd-1

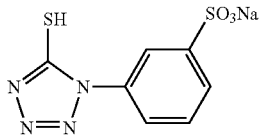

Cpd-2

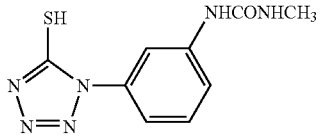

Cpd-3

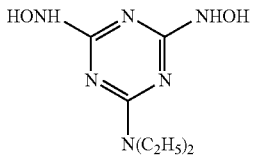

Cpd-4

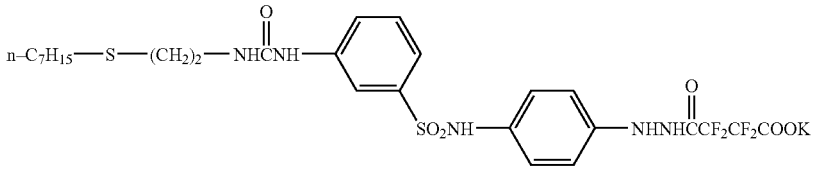

Cpd-5

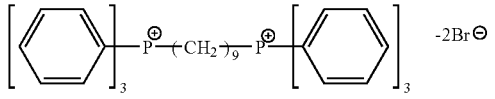

Cpd-6

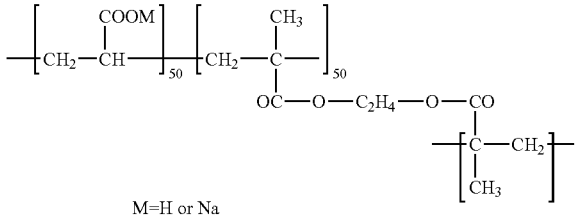

M=H or Na

-continued

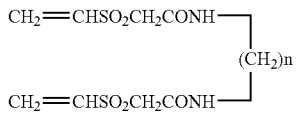

(n=2) : (n=3) = 3:1

Spectral Sensitization Dye(SD-1)

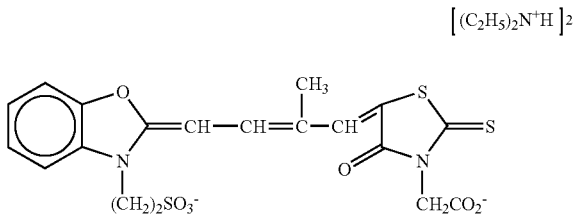

| Coating solution for lower protective layer | |
|---|---|
| Gelatin | 0.5 g/m$^2$ |
| Compound (Cpd-12) | 15 mg/m$^2$ |
| 1,5-Dihydroxy-2-benzaldoxime | 10 mg/m$^2$ |
| Polyethyl acrylate latex | 150 mg/m$^2$ |
| Compound (Cpd-13) | 3 mg/m$^2$ |
| Compound (Cpd-20) | 5 mg/m$^2$ |
| Antiseptic (Proxcel, ICI Co., Ltd.) | 1.5 mg/m$^2$ |
| Coating solution for upper protective layer | |
| Gelatin | 0.3 g/m$^2$ |
| Amorphous silica matting agent (average particle size: 3.5 μm) | 25 mg/m$^2$ |
| Compound (Cpd-8) (gelatin dispersion) | 20 mg/m$^2$ |
| Colloidal silica (particle size: 10 to 20 μm, Snowtex C, Nissan Chemical) | 30 mg/m$^2$ |
| Compound of the formula (1) or comparative compound | Amount shown in Table 6 |
| Compound of any one of the formulas (2A) to (2D) or comparative compound | Amount shown in Table 6 |
| Compound of the formula (4) or comparative compound | Amount shown in Table 6 |
| Sodium dodecylbenzenesulfonate | 20 mg/m$^2$ |
| Antiseptic (Proxcel, ICI Co., Ltd.) | 1 mg/m$^2$ |

Viscosity of the coating solutions for the layers was adjusted by adding Thickener Z mentioned below.

Cpd-8

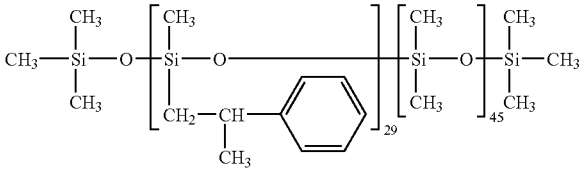

Comparative compound C

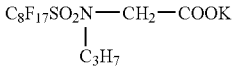

Cpd-7

-continued

Comparative compound A

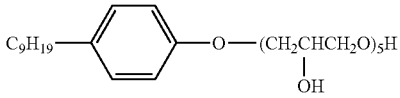

Comparative compound B

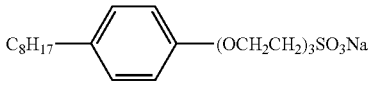

Cpd-12

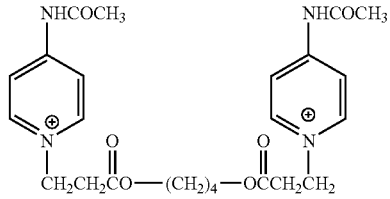

Cpd-13

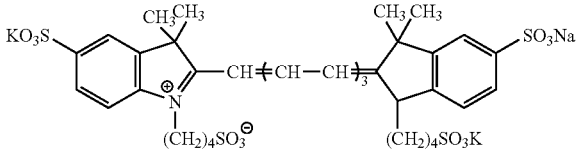

Cpd-14

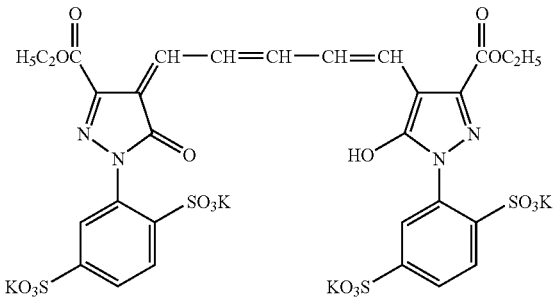

Thickener Z

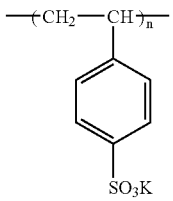

| Coating solution for back layer | |
|---|---|
| Gelatin | 3.3 g/m$^2$ |
| Compound (Cpd-15) | 40 mg/m$^2$ |

-continued

| | |
|---|---|
| Compound (Cpd-16) | 20 mg/m$^2$ |
| Compound (Cpd-17) | 90 mg/m$^2$ |
| Compound (Cpd-18) | 40 mg/m$^2$ |
| Compound (Cpd-19) | 26 mg/m$^2$ |
| 1,3-Divinylsulfonyl-2-propanol | 60 mg/m$^2$ |
| Polymethyl methacrylate microparticles (mean particle sizes: 6.5 μm) | 30 mg/m$^2$ |
| Liquid paraffin | 78 mg/m$^2$ |
| Compound (Cpd-7) | 120 mg/m$^2$ |
| Compound (Cpd-20) | 5 mg/m$^2$ |
| Colloidal silica (particle size: 10 μm) | 15 weight % as for gelatin |
| Calcium nitrate | 20 mg/m$^2$ |
| Antiseptic (Proxcel, ICI Co., Ltd.) | 12 mg/m$^2$ |
| Coating solution for electroconductive layer | |
| Gelatin | 0.1 g/m$^2$ |
| Sodium dodecylbenzenesulfonate | 20 mg/m$^2$ |
| $SnO_2$/Sb (weight ratio = 9:1, average particle size: 0.25 μm) | 200 mg/m$^2$ |
| Antiseptic (Proxcel, ICI Co., Ltd.) | 0.3 mg/m$^2$ |

Cpd-15

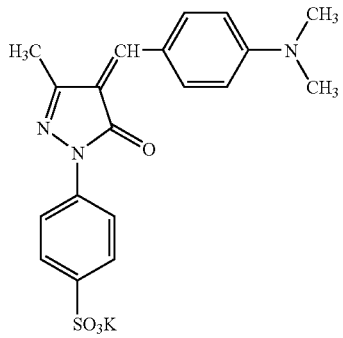

Cpd-16

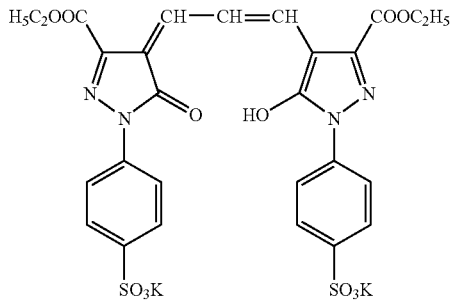

Cpd-17

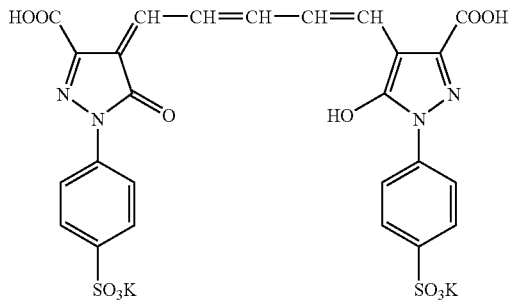

Cpd-18 $CH_3(CH_2)_{11}$—$CH_2$=$CHSO_3Na$

Cpd-19 $CH_3(CH_2)_{11}$—$CH_2$—$CH_2SO_3Na$

Cpd-20

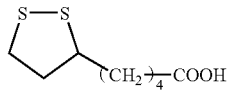

<Preparation of Support>

Polyethylene terephthalate (PET) prepared by direct polymerization in a conventional manner with addition of spherical silica particles having an average particle size of 0.3 μm in an amount of 60 ppm and having an intrinsic viscosity of 0.65 was palletized, and dried at 170° C. for 4 hours. This PET was melted at 300° C., then filtered through a melt filter of 3, 5, 7 or 10-μm mesh size as shown in Table 6, extruded from a T-die, quenched on a drum using the electrostatic voltage applying method (applied voltage: 5 kV), and subjected to heat fixation to prepare an unstretched film. This film was stretched 3.0 times along the longitudinal direction, and then stretched 4.0 times along the transverse direction. The temperatures used for these stretching operations were 90° C. and 105° C., respectively. Then, the film was subjected to heat fixation at 230° C. for 20 seconds, relaxed by 3% along the transverse direction at the same temperature, and rolled up to obtain a PET support having a thickness of 175 μm.

On both surfaces of the biaxially stretched support mentioned above (thickness: 175 μm), the coating solutions for first undercoat layer and second undercoat layer having the following compositions were coated.

| Coating solution for first undercoat layer | |
|---|---|
| Core/shell type vinylidene chloride copolymer 1) | 15 g |
| 2,4-Dichloro-6-hydroxy-s-triazine | 0.25 g |
| Polystyrene microparticles (mean particle size: 3 μm) | 0.05 g |
| Compound (Cpd-21) | 0.20 g |
| Colloidal silica (particle size: 70 to 100 μm Snowtex ZL, Nissan Chemical) | 0.12 g |
| Water | Amount |
| making | total amount 100 g |

The coating solution adjusted to pH 6 with further addition of 10 weight % of KOH was coated so that a dry thickness of 0.9 μm should be obtained after drying at a drying temperature of 180° C. for 2 minutes.

| Coating solution for second undercoat layer | |
|---|---|
| Gelatin | 1 g |
| Methylcellulose | 0.05 g |
| Compound (Cpd-22) | 0.02 g |
| $C_{12}H_{25}O(CH_2CH_2O)_{10}H$ | 0.03 g |
| Antiseptic (Proxcel, ICI Co., Ltd.) | 3.5 × 10$^{-3}$ g |
| Acetic acid | 0.2 g |
| Water | Amount |
| making | total amount 100 g |

This coating solution was coated so that a dry thickness of 0.1 μm should be obtained after drying at a drying temperature of 170° C. for 2 minutes.

Core/Shell Type Vinylidene Chloride Copolymer 1)

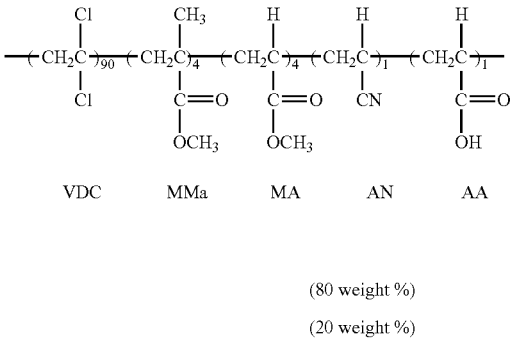

Average particle size: 70 nm

Compound (Cpd-21)

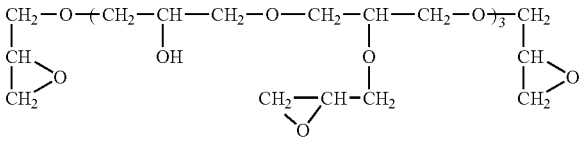

Compound (Cpd-22)

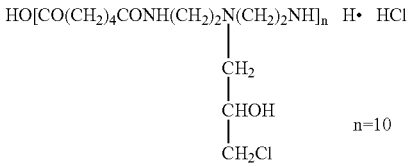

<<Method for Coating on Support>>

First, on the aforementioned support coated with the undercoat layers, for the emulsion layer side, four layers of UL layer, emulsion layer, lower protective layer and upper protective layer were simultaneously coated as stacked layers in this order from the support at 35° C. by the slide bead coating method while adding a hardening agent solution, and passed through a cold wind setting zone (5° C.). Then, on the side opposite to the emulsion layer side, an electroconductive layer and a back layer were simultaneously coated as stacked layers in this order from the support by the curtain coating method while adding a hardening agent solution, and passed through a cold wind setting zone (5° C.). After the coated support was passed through each setting zone, the coating solutions showed sufficient setting. Subsequently, the layers coated on the both surfaces of the support were simultaneously dried in a drying zone of the drying conditions mentioned below. The coated support was transported without any contact with rollers and the other members after the coating of the back surface until it was rolled up. The coating speed was 200 m/min.

<<Drying Conditions>>

After the setting, the coated layers were dried with a drying wind at 30° C. until the water/gelatin weight ratio became 800%, and then with a drying wind at 35° C. and relative humidity of 30% for the period where the ratio became 200% from 800%. The coated layers were further blown with the same wind, and 30 second after the point where the surface temperature became 34° C. (regarded as completion of drying), the layers were dried with air at 48° C. and relative humidity of 2% for 1 minute. In this operation, the drying time was 50 seconds from the start to the water/gelatin ratio of 800%, 35 seconds from 800% to 200% of the ratio, and 5 seconds from 200% of the ratio to the end of the drying.

<<Preparation of Package>>

Each of the above silver halide photographic light-sensitive materials was rolled up at 25° C. and a relative humidity of 65%, and then cut into 100 sheets having a size of 50.8×61 cm in the same environment. As shown in FIG. 1, a stack of the silver halide photographic light-sensitive materials was packaged with a protection plate consisting of a polypropylene sheet, and stored in an interior bag (consisting of a composite material having a four-layer structure of polypropylene, polyethylene, nylon and polyethylene from the outer side), and the four sides were heat-sealed. The heat-sealing portions had a rigidity of 0.0015 N·m. As shown in FIG. 2, the interior bag was stored in a fittable box in a state that cushioning members covering the full lengths of the heat sealing portions were placed under the heat sealing portions (lower enclosure) with pressing. The relative humidity in the bag of the package was measured on 7th day after the heat sealing, and it was found to be 50%. Samples shown in Table 6 were prepared in the same manner except that the humidity was controlled during the rolling up of the light-sensitive materials, cutting, and entry into the interior bag so that the relative humidity in the bag should become 20%, 35%, 40%, 45%, 55%, or 60%, on 7th day after the heat sealing.

Figure 5:
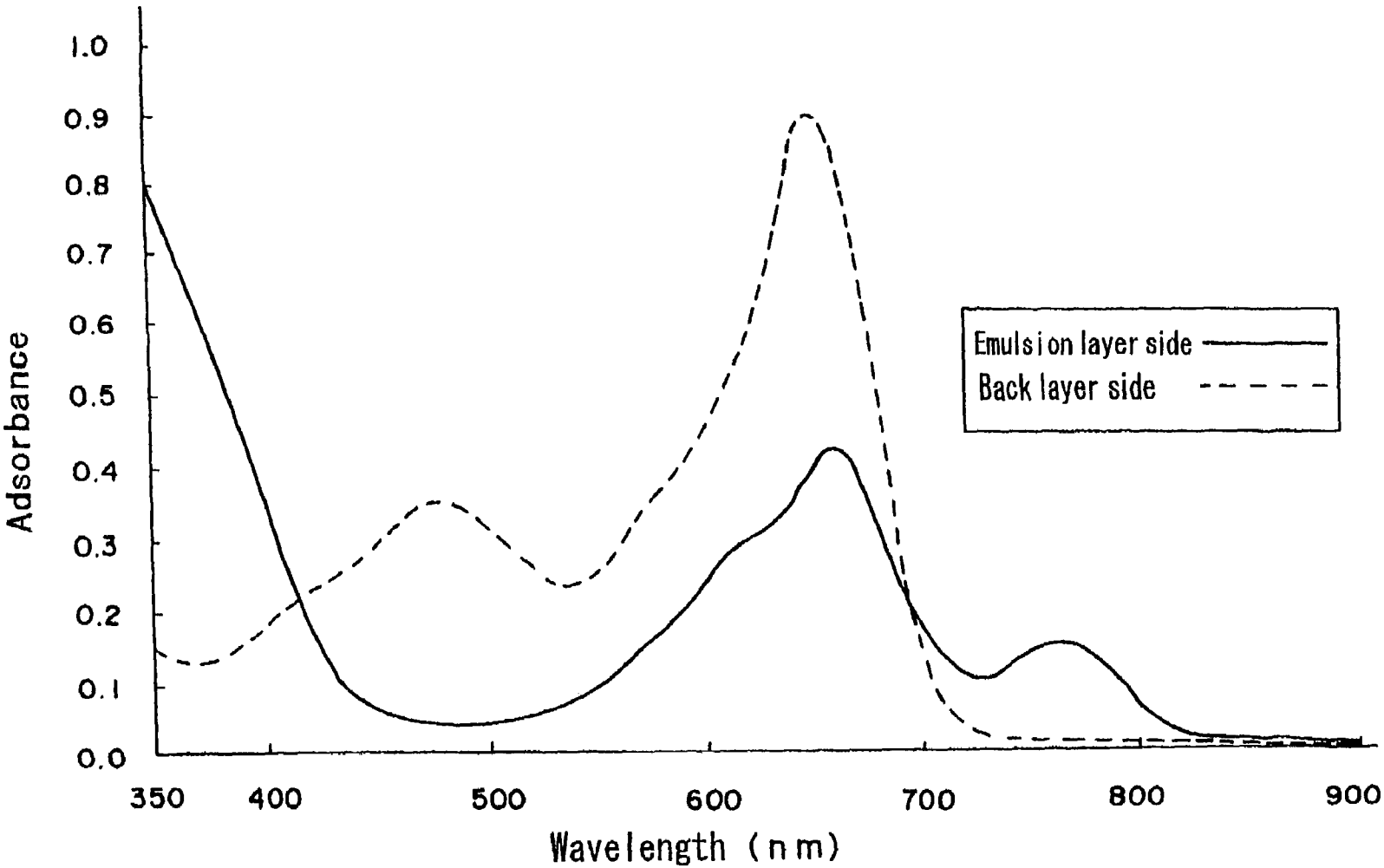
FIG. 5 shows absorption spectra for emulsion layer side and back layer side of a silver halide photographic light-sensitive material according to an embodiment of the present invention. The longitudinal axis represents absorbance (graduated in 0.1), and the transverse axis represents wavelength of from 350 nm to 900 nm. The solid line represents the absorption spectrum of the emulsion layer side, and the broken line represents the absorption spectrum of the back layer side.

The obtained samples (silver halide photographic light-sensitive materials) had a film surface pH of 5.5 to 5.8 for the emulsion layer side and 6.0 to 6.5 for the back side. Absorption spectra of the emulsion layer side and back layer side are shown in FIG. 5.

<Light Exposure and Development>

Each of the obtained samples was exposed with xenon flash light for an emission time of $10^{-6}$ second through an interference filter having a peak at 667 nm and a step wedge.

Then, the sample was processed at 35° C. for 30 seconds by using a developer (ND-1, Fuji Photo Film Co., Ltd.), a fixer (NF-1, Fuji Photo Film Co., Ltd.) and an automatic developing machine (FG-860XK, Fuji Photo Film Co., Ltd.).

<Evaluation>

Gradation (gamma), transportability, processing unevenness, and storage stability of the samples were measured by the methods described below.

<Gamma>

A characteristic curve drawn in orthogonal coordinates of optical density (y-axis) and common logarithm of light exposure x-axis) using equal unit lengths for the both axes is prepared, and inclination of a straight line connecting two points on the curve corresponding to optical densities of 0.3 and 3.0 was determined as gamma.

<Transportability>

A sheet-shaped sample (50.8×61.0 cm) was set on a laser plotter for production of printed boards, RG-8000 (Dainippon Screen Mfg.), exposed, transported, and developed in an automatic developing machine (FG-860XK, Fuji Photo Film Co., Ltd.). As a test for forcibly loaded bad condition, a sample rolled around a core having a diameter of 3 inches and heated to 45° C. for 3 days was used, and the test was performed in an environment of 25° C. and relative humidity of 10%.

The exposure and processing was repeated 100 times for each sample, and whether the sample could be transported or not was tested. Transportability is represented by transported ratio. The transported ratio of a sample transported 100 times without problem was represented as 100%, a sample transported 50 times without problem as 50%, and a sample that could not transported even once as 0%. A transported ratio of 70% or more in the test for forcibly loaded bad condition is at a level not causing problems in practical use concerning transportability.

<Processing Unevenness>

A sample (size: 50.8×61.0 cm) was uniformly exposed for the whole surface so as to obtain a density of 1.0 to 1.2, and subjected to the processing described above, and unevenness of density was evaluated by visual inspection using a 5-grade evaluation system. The score 5 represents the best result, and 1 represents the worst result. The scores 5 and 4 indicate a practically usable level, 3 indicates a barely usable level in spite of bad result, and 2 and 1 indicate a practically unusable level.

<Storage Stability of Silver Halide Photographic Light-Sensitive Material>

Each of the produced samples was stored for 5 days or 10 days under the conditions of 55° C. as a forced storage condition test, and evaluated by sensitometry to determine sensitivity S1.5 (Thermo). Variation in the sensitivity (ΔS1.5) compared with sensitivity of a corresponding sample not subjected to the forced storage condition test (S1.5 (Fr)) was calculated in accordance with the equation mentioned below and represented in terms of percentage.

$$\Delta S1.5=(S1.5(\text{Thermo})-S1.5(\text{Fr}))/S1.5(\text{Fr})\times 100$$

The value of sensitivity variation (ΔS1.5) becomes positive when the sensitivity increases, and conversely becomes negative when the sensitivity decreases. A smaller value is more desirable, and as for the 5-day storage, it is required to be 20% or less as an absolute value for practical use. It is more preferably 10% or less.

TABLE 6

| Sample No. | Emulsion | Amount of nucleation accelerator (Cpd-5, mol/Agmol) | Compound of formula (1) or comparative compound | Compound of formula (2A) to (2D) or comparative compound | Compound of formula (4) | Mash size of melt filter used in preparation of support |
|---|---|---|---|---|---|---|
| 1 | B | — | Comparative compound-A 20 mg/nf | Comparative compound-C 4 mg/nf | — | 10 μm |
| 2 | B | $5.0 \times 10^{-4}$ | Comparative compound-A 20 mg/nf | — | — | 10 μm |
| 3 | B | $5.0 \times 10^{-4}$ | Comparative compound-A 20 mg/nf | Comparative compound-C 4 mg/nf | — | 10 μm |
| 4 | B | $5.0 \times 10^{-4}$ | Comparative compound-A 20 mg/nf | FS-201 4 mg/nf | — | 10 μm |
| 5 | B | — | Comparative compound-B 20 mg/nf | Comparative compound-C 4 mg/nf | — | 10 μm |
| 6 | B | $5.0 \times 10^{-4}$ | Comparative compound-B | — | — | 10 μm |
| 7 | B | $5.0 \times 10^{-4}$ | Comparative compound-B 20 mg/nf | Comparative compound-C 4 mg/nf | — | 10 μm |
| 8 | B | $5.0 \times 10^{-4}$ | Comparative compound-B 20 mg/nf | FS-219 4 mg/nf | — | 10 μm |
| 9 | B | $5.0 \times 10^{-4}$ | — | — | — | 10 μm |
| 10 | B | $5.0 \times 10^{-4}$ | — | Comparative compound-C 4 mg/nf | — | 10 μm |
| 11 | B | $5.0 \times 10^{-4}$ | — | FS-201 4 mg/nf | — | 10 μm |
| 12 | B | $5.0 \times 10^{-4}$ | WX-10 20 mg/nf | — | — | 10 μm |
| 13 | B | $5.0 \times 10^{-4}$ | WX-10 20 mg/nf | Comparative compound-C | — | 10 μm |
| 14 | B | $5.0 \times 10^{-4}$ | WX-10 20 mg/nf | FS-201 4 mg/nf | — | 10 μm |
| 15 | B | $5.0 \times 10^{-4}$ | WX-10 20 mg/nf | FS-219 4 mg/nf | — | 10 μm |
| 16 | B | $5.0 \times 10^{-4}$ | WX-10 20 mg/nf | FS-219 4 mg/nf | CW-3 50 mg/nf | 10 μm |
| 17 | B | $5.0 \times 10^{-4}$ | WX-10 20 mg/nf | FS-219 4 mg/nf | CW-19 50 mg/nf | 10 μm |
| 18 | B | $5.0 \times 10^{-4}$ | WX-18 20 mg/nf | FS-201 4 mg/nf | — | 10 μm |
| 19 | B | $5.0 \times 10^{-4}$ | WX-18 20 mg/nf | FS-201 4 mg/nf | CW-19 50 mg/nf | 10 μm |
| 20 | A | $5.0 \times 10^{-4}$ | WX-10 20 mg/nf | — | — | 10 μm |

TABLE 6-continued

| | | | | | | |
|---|---|---|---|---|---|---|
| 21 | A | $5.0 \times 10^{-4}$ | WX-10<br>20 mg/nf | Comparative compound-C<br>4 mg/nf | — | 10 μm |
| 22 | A | $5.0 \times 10^{-4}$ | WX-10<br>20 mg/nf | FS-201<br>4 mg/nf | — | 10 μm |
| 23 | A | $5.0 \times 10^{-4}$ | WX-10<br>20 mg/nf | FS-219<br>4 mg/nf | — | 10 μm |
| 24 | A | $5.0 \times 10^{-4}$ | WX-10<br>20 mg/nf | FS-219<br>4 mg/nf | CW-3<br>50 mg/nf | 10 μm |
| 25 | A | $5.0 \times 10^{-4}$ | WX-10<br>20 mg/nf | FS-219<br>4 mg/nf | CW-19<br>50 mg/nf | 10 μm |
| 26 | A | $5.0 \times 10^{-4}$ | WX-10<br>20 mg/nf | FS-201<br>4 mg/nf | CW-19<br>50 mg/nf | 10 μm |
| 27 | B | $5.0 \times 10^{-4}$ | WX-10<br>20 mg/nf | FS-219<br>4 mg/nf | CW-19<br>50 mg/nf | 7 μm |
| 28 | B | $5.0 \times 10^{-4}$ | WX-10<br>20 mg/nf | FS-219<br>4 mg/nf | CW-19<br>50 mg/nf | 5 μm |
| 29 | B | $5.0 \times 10^{-4}$ | WX-10<br>20 mg/nf | FS-219<br>4 mg/nf | CW-19<br>50 mg/nf | 3 μm |
| 30 | B | $5.0 \times 10^{-4}$ | WX-10<br>20 mg/nf | FS-219<br>4 mg/nf | CW-19<br>50 mg/nf | 5 μm |
| 31 | B | $5.0 \times 10^{-4}$ | WX-10<br>20 mg/nf | FS-219<br>4 mg/nf | CW-19<br>50 mg/nf | 5 μm |
| 32 | B | $5.0 \times 10^{-4}$ | WX-10<br>20 mg/nf | FS-219<br>4 mg/nf | CW-19<br>50 mg/nf | 5 μm |
| 33 | B | $5.0 \times 10^{-4}$ | WX-10<br>20 mg/nf | FS-219<br>4 mg/nf | CW-19<br>50 mg/nf | 5 μm |
| 34 | B | $5.0 \times 10^{-4}$ | WX-10<br>20 mg/nf | FS-219<br>4 mg/nf | CW-19<br>50 mg/nf | 5 μm |

| Sample No. | Relative humidity in bag on 7th day after heat sealing | Gradation (gamma) | Processing unevenness | Transportability | Storage stability 5 days | Storage stability 10 days | Note |
|---|---|---|---|---|---|---|---|
| 1 | 45% | 4.5 | 4 | 24% | 12% | 30% | Comparative |
| 2 | 45% | 19.5 | 2 | 15% | 62% | 95% | Comparative |
| 3 | 45% | 20.9 | 2 | 22% | 59% | 86% | Comparative |
| 4 | 45% | 19.8 | 2 | 25% | 72% | 105% | Comparative |
| 5 | 45% | 4.1 | 4 | 30% | 13% | 28% | Comparative |
| 6 | 45% | 22.3 | 1 | 28% | 55% | 78% | Comparative |
| 7 | 45% | 21.6 | 1 | 32% | 49% | 69% | Comparative |
| 8 | 45% | 20.6 | 1 | 40% | 46% | 68% | Comparative |
| 9 | 45% | 19.4 | 1 | 12% | 68% | 98% | Comparative |
| 10 | 45% | 18.9 | 1 | 25% | 57% | 95% | Comparative |
| 11 | 45% | 20.1 | 1 | 36% | 41% | 75% | Comparative |
| 12 | 45% | 22.6 | 3 | 34% | 68% | 97% | Comparative |
| 13 | 45% | 19.3 | 2 | 55% | 70% | 102% | Comparative |
| 14 | 45% | 21.3 | 4 | 88% | 14% | 25% | Invention |
| 15 | 45% | 20.5 | 4 | 95% | 15% | 27% | Invention |
| 16 | 45% | 22.4 | 5 | 96% | 4% | 10% | Invention |
| 17 | 45% | 21.8 | 5 | 98% | 5% | 10% | Invention |
| 18 | 45% | 22.3 | 4 | 95% | 15% | 29% | Invention |
| 19 | 45% | 24.0 | 5 | 96% | 5% | 8% | Invention |
| 20 | 45% | 19.3 | 3 | 33% | 70% | 103% | Comparative |
| 21 | 45% | 20.3 | 2 | 55% | 71% | 105% | Comparative |
| 22 | 45% | 21.5 | 4 | 88% | 18% | 32% | Invention |
| 23 | 45% | 22.7 | 4 | 95% | 17% | 30% | Invention |
| 24 | 45% | 19.5 | 4 | 96% | 10% | 19% | Invention |
| 25 | 45% | 19.4 | 4 | 98% | 9% | 17% | Invention |
| 26 | 45% | 20.4 | 4 | 97% | 10% | 18% | Invention |
| 27 | 45% | 21.8 | 5 | 97% | 5% | 12% | Invention |
| 28 | 45% | 22.3 | 5 | 96% | 3% | 6% | Invention |
| 29 | 45% | 21.9 | 5 | 97% | 2% | 5% | Invention |
| 30 | 20% | 16.8 | 4 | 90% | 15% | 35% | Invention |
| 31 | 35% | 19.8 | 5 | 95% | 7% | 15% | Invention |
| 32 | 40% | 22.3 | 5 | 97% | 5% | 9% | Invention |
| 33 | 55% | 24.3 | 5 | 98% | 5% | 8% | Invention |
| 34 | 60% | 19.8 | 4 | 90% | −16% | −32% | Invention |

The samples containing both of a compound of the formula (1) and a compound of any of the formulas (2A) to (2D) exhibited superior properties for all of processing unevenness, transportability, and storage stability. In particular, the samples also containing a compound represented by the formula (4) of the present invention, those prepared by using a melt filter having a mesh size of 5 μm or smaller in the preparation of the support, and those exhibiting a relative humidity of 30 to 55% in the bag exhibited superior storage stability.

EXAMPLE 2

<<Preparation of Emulsion C>>

| | |
|---|---|
| Solution 1 | |
| Water | 750 mL |
| Gelatin | 20 g |
| Sodium chloride | 1 g |
| 1,3-Dimethylimidazolidine-2-thione | 20 mg |
| Sodium benzenethiosulfonate | 10 mg |
| Citric acid | 0.7 g |
| Solution 2 | |
| Water | 300 mL |
| Silver nitrate | 150 g |
| Solution 3 | |
| Water | 300 mL |
| Sodium chloride | 38 g |
| Potassium bromide | 32 g |
| $K_3IrCl_6$ (0.005% in 20% KCl aqueous solution) | $6.0 \times 10^{-7}$ mol/Ag mol |
| $(NH_4)_3[RhCl_5(H_2O)]$ (0.001% in 20% NaCl aqueous solution) | $6.0 \times 10^{-7}$ mol/Ag mol |

$K_3IrCl_6$ (0.005%) and $(NH_4)_3[RhCl_5(H_2O)]$ (0.001%) used for Solution 3 were prepared by dissolving powder of each in 20% aqueous solution of KCl or 20% aqueous solution of NaCl and heating the solution at 40° C. for 120 minutes.

Solution 2 and Solution 3 in amounts corresponding to 90% of each were simultaneously added to Solution 1 maintained at 38° C. and pH 4.5 over 20 minutes with stirring to form nucleus grains having a diameter of 0.17 μm. Subsequently, 500 mg of 4-hydroxy-6-methyl-1,3,3a,7-tetrazaindene was added, and then Solution 4 and Solution 5 shown below were added over 8 minutes. Further, the remaining 10% portions of Solution 2 and Solution 3 were added over 2 minutes to allow growth of the grains to a diameter of 0.17 μm. Further, 0.15 g of potassium iodide was added, and ripening was allowed for 5 minutes to complete the grain formation.

| | |
|---|---|
| Solution 4 | |
| Water | 100 mL |
| Silver nitrate | 50 g |
| Solution 5 | |
| Water | 100 mL |
| Sodium chloride | 13 g |
| Potassium bromide | 11 g |
| $K_4[Fe(CN)_6].3H_2O$ (potassium ferrocyanide) | $8.0 \times 10^{-7}$ mol/Ag mol |

Then, the resulting grains were washed according to a conventional flocculation method. Specifically, after the temperature of the mixture was lowered to 35° C., 3 g of Anionic precipitating agent 1 shown below was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.6 and pAg was adjusted to 7.5, added with 10 mg of sodium benzenethiosulfonate, 3 mg of sodium benzenethiosulfinate, 2 mg of triphenylphosphine selenide and 1 mg of chloroauric acid to perform chemical sensitization at 55° C. for obtaining optimal sensitivity, and then added with 100 mg of 4-hydroxy-6-methyl-1,3,3a,7-tetrazaindene as a stabilizer and 100 mg of an antiseptic (Proxcel, ICI).

Finally, there was obtained an emulsion of cubic silver iodochlorobromide grains containing 30 mol % of silver bromide and 0.08 mol % of silver iodide and having an average grain size of 0.19 μm with a variation coefficient of 10%. The emulsion finally showed pH of 5.7, pAg of 7.5, electric conductivity of 40 μS/m, density of $1.2\times10^3$ kg/m$^3$ and viscosity of 50 mPa·s.

<<Preparation of Non-Photosensitive Silver Halide Grains>>

| | |
|---|---|
| Solution 1 | |
| Water | 1 L |
| Gelatin | 20 g |
| Sodium chloride | 3.0 g |
| 1,3-Dimethylimidazolidine-2-thione | 20 mg |
| Sodium benzenethiosulfonate | 8 mg |
| Solution 2 | |
| Water | 400 mL |
| Silver nitrate | 100 g |
| Solution 3 | |
| Water | 400 mL |
| Sodium chloride | 13.5 g |
| Potassium bromide | 45.0 g |
| $(NH_4)_3[RhCl_5(H_2O)]$ (0.001% in 20% NaCl aqueous solution) | $4 \times 10^{-5}$ mol/Ag mol |

Solutions 1, 2 and 3 maintained at 70° C. and pH 4.5 were simultaneously added over 15 minutes with stirring to form nucleus grains. Subsequently, Solution 4 and Solution 5 shown above were added over 15 minutes, and 0.15 g of potassium iodide was added to complete the grain formation.

Then, the resulting grains were washed with water according to a conventional flocculation method. Specifically, after the temperature of the mixture was lowered to 35° C., 3 g of Anionic precipitating agent 1 was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.7 and pAg to 7.5, added with phenoxyethanol as an antiseptic to finally obtain a dispersion of non-post ripened cubic silver chloroiodobromide emulsion grains containing 30 mol % of silver chloride and 0.08 mol % of silver iodide in average and having an average grain size of 0.45 μm with a variation coefficient of 10%. The emulsion finally showed pH of 5.7, pAg of 7.5, electric conductivity of 40 μS/m, density of 1.3 to $1.35\times10^3$ kg/m$^3$ and viscosity of 50 mPa·s.

<<Preparation of Coating Solutions>>

The silver halide photographic light-sensitive materials prepared in this example had a structure where UL layer, emulsion layer, lower protective layer and upper protective layer were formed in this order on one surface of the following polyethylene terephthalate film support having moisture-proof layers comprising vinylidene chloride on the both surfaces, and an electroconductive layer and back layer were formed in this order on the opposite surface.

Compositions of coating solutions used for forming the layers are shown below.

| Coating solution for UL layer | |
|---|---|
| Gelatin | 0.5 g/m$^2$ |
| Polyethyl acrylate latex | 150 mg/m$^2$ |
| Compound (Cpd-7) | 40 mg/m$^2$ |
| Compound (Cpd-14) | 10 mg/m$^2$ |
| Antiseptic (Proxcel, ICI Co., Ltd.) | 1.5 mg/m$^2$ |
| **Coating solution for emulsion layer** | |
| Mixture of Emulsions A and C Emulsion A:C = 2:1 (weight ratio = 37/63), shell: styrene/2-acetoxyethyl acrylate copolymer (weight ratio = 84/16), core/shell ratio = 50/50) | 150 mg/m$^2$ |

pH of the coating solution was adjusted to 5.6 by using citric acid.

The coating solution for emulsion layer prepared as described above was coated on the support mentioned below so that the coated silver amount and coated gelatin amount should become 3.5 g/m$^2$ and 1.5 g/m$^2$, respectively.

| Coating solution for lower protective layer | |
|---|---|
| Gelatin | 0.5 g/m$^2$ |
| Non-photosensitive silver halide grains | 0.1 g/m$^2$ as silver amount |
| Compound (Cpd-12) | 15 mg/m$^2$ |
| 1,5-Dihydroxy-2-benzaldoxime | 10 mg/m$^2$ |
| Polyethyl acrylate latex | 150 mg/m$^2$ |
| Compound (Cpd-13) | 3 mg/m$^2$ |
| Compound (Cpd-20) | 5 mg/m$^2$ |
| Antiseptic (Proxcel, ICI Co., Ltd.) | 1.5 mg/m$^2$ |
| **Coating solution for upper protective layer** | |
| Gelatin | 0.3 g/m$^2$ |
| Amorphous silica matting agent (average particle size: 3.5 μm) | 25 mg/m$^2$ |
| Compound (Cpd-8) (gelatin dispersion) | 20 mg/m$^2$ |
| Colloidal silica (particle size: 10 to 20 μm, Snowtex C, Nissan Chemical) | 30 mg/m$^2$ |
| Sodium dodecylbenzenesulfonate | 20 mg/m$^2$ |
| Antiseptic (Proxcel, ICI Co., Ltd.) | 1 mg/m$^2$ |
| **For samples of the present invention:** | |
| WX-10 as compound of the formula (1) | 20 mg/m$^2$ |
| FS-219 as compound of any one of the formulas (2A) to (2D) | 4 mg/m$^2$ |
| For comparative samples: | |
| Comparative compound A | 20 mg/m$^2$ |
| Comparative compound B | 25 mg/m$^2$ |
| Comparative compound C | 3 mg/m$^2$ |

Viscosity of the coating solutions for the layers was adjusted by adding Thickener Z mentioned below.

| Coating solution for back layer | |
|---|---|
| Gelatin | 3.3 g/m$^2$ |
| Compound (Cpd-15) | 40 mg/m$^2$ |
| Compound (Cpd-16) | 20 mg/m$^2$ |
| Compound (Cpd-17) | 90 mg/m$^2$ |
| Compound (Cpd-18) | 40 mg/m$^2$ |
| Compound (Cpd-19) | 26 mg/m$^2$ |
| 1,3-Divinylsulfonyl-2-propanol | 60 mg/m$^2$ |
| Polymethyl methacrylate microparticles (mean particle sizes: 6.5 μm) | 30 mg/m$^2$ |
| Liquid paraffin | 78 mg/m$^2$ |
| Compound (Cpd-7) | 120 mg/m$^2$ |
| Compound (Cpd-20) | 5 mg/m$^2$ |
| Colloidal silica (particle size: 10 μm) | 15 weight % as for gelatin |
| Calcium nitrate | 20 mg/m$^2$ |
| Antiseptic (Proxcel, ICI Co., Ltd.) | 12 mg/m$^2$ |
| For samples of the present invention: | |
| FS-219 as compound of any one of the formulas (2A) to (2D) | 15 mg/m$^2$ |
| For comparative samples: | |
| Comparative compound C | 15 mg/m$^2$ |
| **Coating solution for electroconductive layer** | |
| Gelatin | 0.1 g/m$^2$ |
| Sodium dodecylbenzenesulfonate | 20 mg/m$^2$ |
| $SnO_2$/Sb (weight ratio = 9:1, average particle size: 0.25 μm) | 200 mg/m$^2$ |
| Antiseptic (Proxcel, ICI Co., Ltd.) | 0.3 mg/m$^2$ |

<<Support>>

A polyethylene terephthalate support prepared in the same manner as in Example 1 except that a melt filter of 3-μm mesh size was used, and having a thickness of 100 μm was used. On both surfaces of the support, the coating solutions for first undercoat layer and second undercoat layer having the following compositions were coated.

| Coating solution for first undercoat layer | |
|---|---|
| Core/shell type vinylidene chloride copolymer 1) | 15 g |
| 2,4-Dichloro-6-hydroxy-s-triazine | 0.25 g |
| Polystyrene microparticles (mean particle size: 3 μm) | 0.05 g |
| Compound (Cpd-21) | 0.20 g |
| Colloidal silica (particle size: 70 to 100 μm Snowtex ZL, Nissan Chemical) | 0.12 g |
| Water | Amount |
| making total amount | 100 g |

The coating solution adjusted to pH 6 with further addition of 10 weight % of KOH was coated so that a dry thickness of 0.9 μm should be obtained after drying at a drying temperature of 180° C. for 2 minutes.

| Coating solution for second undercoat layer | |
|---|---|
| Gelatin | 1 g |
| Methylcellulose | 0.05 g |
| Compound (Cpd-22) | 0.02 g |
| $C_{12}H_{25}O(CH_2CH_2O)_{10}H$ | 0.03 g |
| Antiseptic (Proxcel, ICI Co., Ltd.) | $3.5\times10^{-3}$ g |
| Acetic acid | 0.2 g |
| Water | Amount |
| making | total amount 100 g |

This coating solution was coated so that a dry thickness of 0.1 μm should be obtained after drying at a drying temperature of 170° C. for 2 minutes.

<<Method for Coating on Support>>

First, on the aforementioned support coated with the undercoat layers, for the emulsion layer side, four layers of UL layer, emulsion layer, lower protective layer and upper protective layer were simultaneously coated as stacked layers in this order from the support at 35° C. by the slide bead coating method while adding a hardening agent solution, and passed through a cold wind setting zone (5° C.). Then, on the side opposite to the emulsion layer side, an electroconductive layer and a back layer were simultaneously coated as stacked layers in this order from the support by the curtain coating method while adding a hardening agent solution, and passed through a cold wind setting zone (5° C.). After the coated support was passed through each setting zone, the coating solutions showed sufficient setting. Subsequently, the layers coated on the both surfaces of the support were simultaneously dried in a drying zone of the drying conditions mentioned below. The coated support was transported without any contact with rollers and the other members after the coating of the back surface until it was rolled up. The coating speed was 200 m/min.

<<Drying Conditions>>

After the setting, the coated layers were dried with a drying wind at 30° C. until the water/gelatin weight ratio became 800%, and then with a drying wind at 35° C. and relative humidity of 30% for the period where the ratio became 200% from 800%. The coated layers were further blown with the same wind, and 30 second after the point where the surface temperature became 34° C. (regarded as completion of drying), the layers were dried with air at 48° C. and relative humidity of 2% for 1 minute. In this operation, the drying time was 50 seconds from the start to the water/gelatin ratio of 800%, 35 seconds from 800% to 200% of the ratio, and 5 seconds from 200% of the ratio to the end of the drying.

Each of the above silver halide photographic light-sensitive materials was rolled up at 25° C. and a relative humidity of 55%, then cut in the same environment, conditioned for moisture content at 25° C. and relative humidity of 50% for 8 hours and then sealed in a barrier bag conditioned for moisture content for 6 hours together with a cardboard conditioned for moisture content at 25° C. and relative humidity of 50% for 2 hours to prepare a sample.

The relative humidity in the barrier bag was measured, and it was found to be 45%. The obtained sample had a film surface pH of 5.5 to 5.8 for the emulsion layer side and 6.0 to 6.5 for the back side. Absorption spectra of the emulsion layer side and back layer side are as shown in FIG. 5.

<Evaluation>

Each of the samples was evaluated for gradation (gamma), transportability, processing unevenness, and storage stability in the same manners as in Example 1, and the light-sensitive materials having the characteristic of the present invention showed good performance. For the evaluation of transportability, any one of Lux Setter RC-5600V produced by Fuji Photo Film Co., Ltd, Image setter FT—R5055 produced by Dainippon Screen Mfg. Co., Ltd., Select Set 5000, Avantra 25 and Acuset 1000 produced by Agfa Gevaert AG, Dolev 450 and Dolev 800 produced by Scitex, Lino 630, Quasar, Herkules ELITE and Signasetter produced by Heidelberg Co., Ltd., Lux Setters Luxel F-9000 and F-6000 produced by Fuji Photo Film Co., Ltd. and Panther Pro 62 produced by PrePRESS Inc. was used to perform the evaluation.

EXAMPLE 3

<<Preparation of Emulsion D>>

In a volume of 500 mL of a silver nitrate aqueous solution dissolving 150 g of silver nitrate and 500 mL of a halide salt aqueous solution containing $(NH_4)_2RhCl_5(H_2O)$ in an amount corresponding to $2\times10^{-7}$ mol per mol of silver after grain formation and $K_3IrCl_6$ in an amount corresponding to $1\times10^{-7}$ mol per mol of silver after grain formation and dissolving 44 g of potassium bromide and 34 g of sodium chloride were added to a 2% gelatin aqueous solution dissolving 3 g/L of sodium chloride, 0.02 g/L of 1,3-dimethyl-imidazolinethione, 0.5 g/L of citric acid, 4 mg/L of sodium benzenethiosulfonate and 1 mg/L of sodium benezenesulfinate at 38° C. by the controlled double jet method over 20 minutes with stirring to obtain silver chlorobromide grains having a mean grain size of 0.21 μm and a silver chloride content of 58 mol %, and thereby perform nucleation. Subsequently, 200 mL of a silver nitrate aqueous solution dissolving 50 g of silver nitrate and 200 mL of a halide salt solution containing potassium hexacyanoferrate (II) in an amount corresponding to $1\times10^{-5}$ mol per mol of silver in the whole emulsion and dissolving 12 g of potassium bromide and 13 g of sodium chloride were added over 10 minutes by the controlled double jet method.

Then, a KI solution was added to a concentration of $1\times10^{-3}$ mol per mol of silver to perform conversion, and the resulting grains were washed according to a conventional flocculation method. Specifically, after the temperature of the mixture was lowered to 35° C., 3 g of Anionic precipitating agent 1 was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes. The emulsion after the washing with water and desalting was added with 40 g/Ag mol of silver of gelatin, and after pH was adjusted to 5.9 and pAg to 7.5, added with 8 mg/Ag mol of sodium benzenethiosulfonate, 2 mg/Ag mol of sodium benzenesulfinate, 3 mg/Ag mol of sodium thiosulfate, 2 mg/Ag mol of triphenylphosphine selenide and 8 mg/Ag mol of chloroauric acid to perform chemical sensitization at 55° C. for 60 minutes. Then, the emulsion was added with 150 mg of 4-hydroxy-6-methyl-1,3,3a,7-tetrazaindene as a stabilizer and 100 mg of Proxcel (trade name, produced by ICI Co., Ltd.) as an antiseptic. The obtained grains were cubic silver iodochlorobromide grains having an average grain size of 0.23 μm, variation coefficient of 10% and silver chloride content of 60 mol %. The emulsion finally showed pH of 5.9, pAg of 7.2, electric conductivity of 37 μS/m, density of $1.20\times10^{-3}$ kg/m$^3$ and viscosity of 20 mPa·s.

<<Preparation of Emulsion E>>

In a volume of 250 mL of a silver nitrate aqueous solution dissolving 75 g of silver nitrate and 250 mL of a halide salt aqueous solution containing $(NH_4)_2RhCl_5(H_2O)$ in an amount corresponding to $4\times10^{-7}$ mol per mol of silver in the whole emulsion and $K_3IrCl_6$ in an amount corresponding to $1\times10^{-7}$ mol per mol of silver in the whole emulsion and dissolving 16 g of potassium bromide and 20 g of sodium chloride were added to a 2% gelatin aqueous solution dissolving 4 g/L of sodium chloride, 0.02 g/L of 1,3-dimethyl-imidazolinethione, 0.5 g/L of citric acid, 4 mg/L of sodium benzenethiosulfonate and 1 mg/L of sodium benezenesulfinate at 45° C. by the controlled double jet method over 12 minutes with stirring to obtain silver chlorobromide grains having a mean grain size of 0.20 μm and silver chloride content of 70 mol % and thereby perform nucleation. Subsequently, 400 mL of silver nitrate aqueous solution dissolving 125 g of silver nitrate and 400 mL of a halide salt solution dissolving 26 g of potassium bromide and 34 g of sodium chloride were added over 20 minutes by the controlled double jet method.

Then, a KI solution was added to a concentration of $1\times10^{-3}$ mol per mol of silver to perform conversion, and the resulting grains were washed according to a conventional flocculation method. The specific procedure was the same as that used for Emulsion A. The emulsion after the washing with water and desalting was added with 40 g/Ag mol of gelatin, and after pH was adjusted to 6.0 and pAg to 7.5, further added with 7 mg/Ag mol of sodium benzenethiosulfonate, 2 mg/Ag mol of sodium benzenesulfinate, 8 mg/Ag mol of chloroauric acid and 5 mg/Ag mol of sodium thiosulfate to perform chemical sensitization at 60° C. for 60 minutes. Then, the emulsion was added with 250 mg of 4-hydroxy-6-methyl-1,3,3a,7-tetrazaindene as a stabilizer and 100 mg of Proxcel (trade name, produced by ICI Co., Ltd.) as an antiseptic. The obtained grains were cubic silver iodochlorobromide grains having an average grain size of 0.28 μm, variation coefficient of 10% and silver chloride content of 70 mol %. The emulsion finally showed pH of 6.1, pAg of 7.5, electric conductivity of 46 μS/m, density of $1.20\times10^{-3}$ kg/m$^3$ and viscosity of 62 mPa·s.

<<Preparation of Coated Sample>>

On a polyethylene terephthalate film support having moisture proof layers comprising vinylidene chloride on the both surfaces mentioned above, UL layer, hydrazine-containing emulsion layer, intermediate layer, redox compound-containing emulsion layer and protective layer were coated in this order to prepare a sample.

The preparation methods, coated amounts and coating method of the layers are shown below.

| Coating solution for UL layer | |
|---|---|
| Gelatin (containing Proxcel (trade name: produced by ICI Co., Ltd.) as antiseptic) | 0.3 g/m$^2$ |
| Nucleation accelerator A | 20 mg/m$^2$ |
| Polyethyl acrylate dispersion | 0.25 g/m$^2$ |
| Hardening agent (1,2-bis(vinylsulfonyl-acetamido) ethane) | 50 mg/m$^2$ |

pH of the coating solution was adjusted to 5.8.

Nucleation Accelerator A

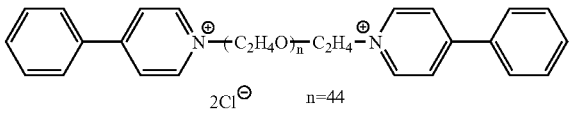

| Coating solution for hydrazine-containing emulsion layer | |
|---|---|
| Emulsion A | |
| Sensitizing dye of formula (s-1) | $5\times10^{-4}$ mol/Ag mol |
| Potassium bromide | $1\times10^{-3}$ mol/Ag mol |
| Mercapto compound of formula (a) | $5\times10^{-4}$ mol/Ag mol |
| Mercapto compound of formula (b) | $5\times10^{-4}$ mol/Ag mol |
| Triazine compound of formula (c) | $1\times10^{-4}$ mol/Ag mol |
| Hydrazine nucleating agents A and B | $1\times10^{-4}$ mol/Ag mol |
| Colloidal silica | |
| (Snowtex C, Nissan Chemical) | 500 mg/m$^2$ |
| Dispersion of polyethyl acrylate | 500 mg/m$^2$ |

pH of the coating solution was adjusted to 5.8.

(S-1)

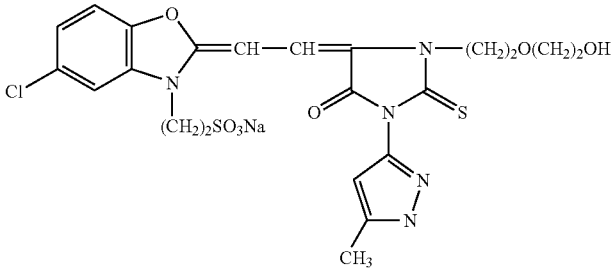

-continued
(a)
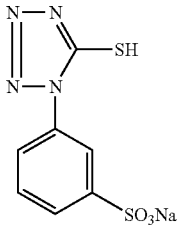
(b)
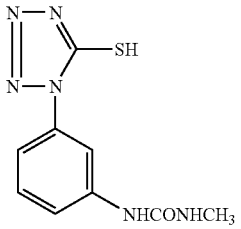
(c)
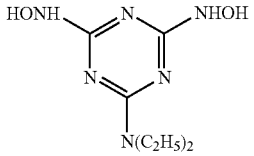
Hydrazine nucleating agent A
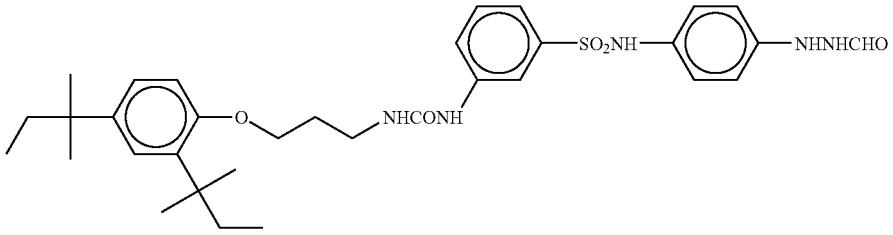
Hydrazine nucleating agent B
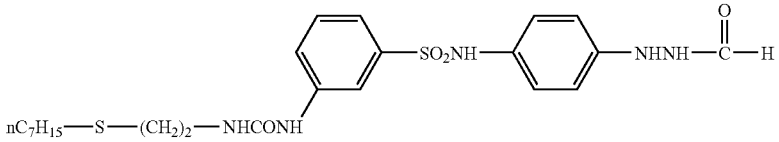

The completed silver halide emulsion coating solution was coated so that the coated silver amount and gelatin amount should become 3.4 g/m$^2$ and 1.6 mg/m$^2$, respectively.

| Coating solution for intermediate layer | |
|---|---|
| Gelatin (containing Proxcel (trade name: produced by ICI Co., Ltd.) as antiseptic) | 1.0 g/m$^2$ |
| Sodium ethanethiosulfonate | 5 mg/m$^2$ |
| Dye (e) | 50 g/m$^2$ |
| Hydroquinone | 100 mg/m$^2$ |
| 5-Chloro-8-hydroxyquinoline | 10 mg/m$^2$ |
| Dispersion of polyethyl acrylate | 100 mg/m$^2$ |

pH of the solution was adjusted to 7.0.

Coating Solution for Redox Compound-Containing Emulsion Layer

Emulsion B

| | |
|---|---|
| Sensitizing dye of formula (s-1) | $1 \times 10^{-4}$ mol/Ag mol |
| Mercapto compound of formula (a) | $5 \times 10^{-4}$ mol/Ag mol |
| Triazine compound of formula (c) | $1 \times 10^{-4}$ mol/Ag mol |
| Dye of formula (f) | 5 mg/m$^2$ |
| Dispersion of polyethyl acrylate | 100 mg/m$^2$ |
| Hardening agent (1,2-bis(vinylsulfonyl-acetamido)ethane) | 50 mg/m$^2$ |
| Redox compound (R-1) | $2.1 \times 10^{-4}$ mol/m$^2$ |

pH of the solution was adjusted to 5.4.

As the redox compound, an emulsion prepared as described below was dissolved at 60° C. and added to the coating solution.

Redox Emulsion

| Solution A (prepared by dissolving a mixture of the following components at 60° C.) | |
|---|---|
| Ethyl acetate | 30 mL |
| Redox compound mentioned above | 8 g |

-continued

| | |
|---|---|
| Sodium p-dodecylbenzensulfonate | 0.3 g |
| Oils of formulas (P-1) and (P-2) | 4 g each |
| Solution B (prepared by dissolving a mixture of the following components at 60° C.) | |
| Water | 170 g |
| Gelatin | 8.5 g |
| Proxcel (trade name, produced by ICI Co., Ltd.) | 0.05 g |

Solutions A and B were mixed and emulsion-dispersed in a high speed homogenizer. After the emulsion-dispersion, the solvent was removed at 60° C. under reduced pressure to obtain 4% emulsion dispersion of the redox compound. The prepared coating solution for redox compound containing emulsion layer was coated so that the coated silver amount and gelatin amount should become 0.4 g/m$^2$ and 0.5 mg/m$^2$, respectively.

| Coating solution for protective layer | |
|---|---|
| Gelatin | 0.2 g/m$^2$ |
| $SiO_2$ matting agent (amorphous, average particle size: 3.5 μm) | 50 mg/m$^2$ |
| Colloidal silica (Snowtex C, Nissan Chemical) | 60 mg/m$^2$ |
| Liquid paraffin | 50 mg/m$^2$ |
| Fluorine-containing surfactant of formula (g) | 1 mg/m$^2$ |
| Sodium p-dodecylbenzensulfonate | 10 mg/m$^2$ |
| FS-219 as compound of any one of the formulas (2A) to (2D) | 5 mg/m$^2$ |
| For comparative samples: | |
| Comparative compound C | 5 mg/m$^2$ |

A thickener represented by the following formula (Z) was added to the coating solutions for the layers to adjust the viscosity.

(e)

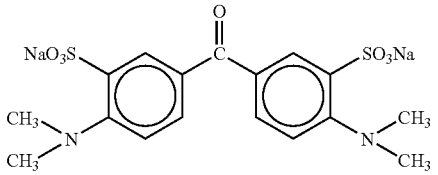

(f)

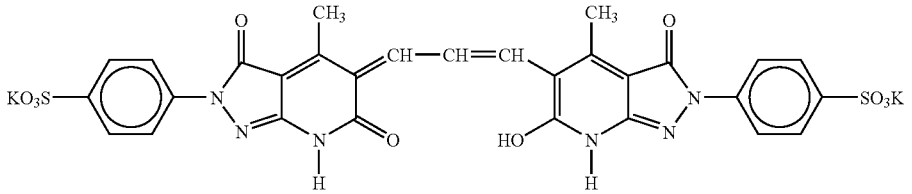

-continued (R-1)

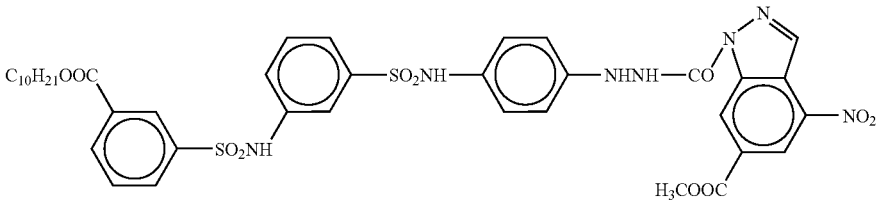

(P-1)

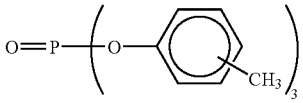

(P-2)

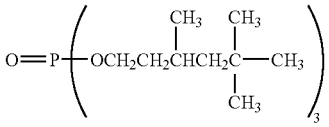

(g)

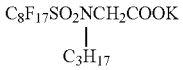

(Z)

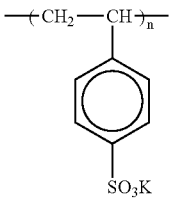

A back layer was coated by using the following formulation.

| Coating solution for back layer | |
|---|---|
| Gelatin | 2.8 g/m$^2$ |
| Surfactants | |
| p-Dodecylbenzenesulfonic acid sodium salt | 40 mg/m$^2$ |
| Dihexyl-α-sulfosuccinate sodium salt | 40 mg/m$^2$ |
| Gelatin hardening agent | |
| 1,2-Bis(vinylsulfonyl acetamido)ethane | 200 mg/m$^2$ |
| $SnO_2$/Sb (weight ratio = 90:10, average particle size: 0.20 μm) | 200 mg/m$^2$ |
| Dye: mixture of the following Dyes (h-1), (h-2), (h-3) and (h-4) | |
| Dye (h-1) | 20 mg/m$^2$ |
| Dye (h-2) | 50 mg/m$^2$ |
| Dye (h-3) | 20 mg/m$^2$ |
| Dye (h-4) | 30 mg/m$^2$ |
| Antiseptic (Proxcel) | 10 mg/m$^2$ |

-continued (h-1)

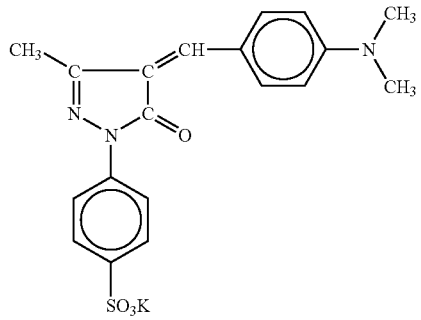

(h-2)

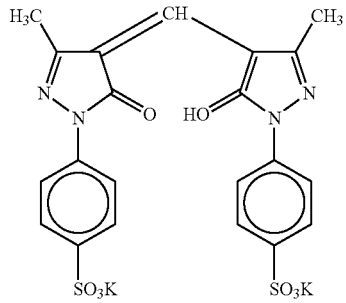

-continued (h-3) 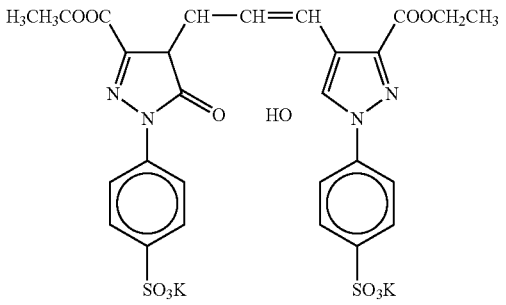

(h-4) 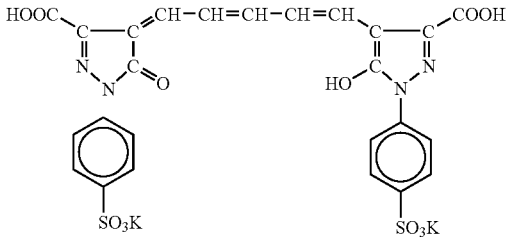

Coating solution for back protective layer

| | |
|---|---|
| Gelatin | 1.1 g/m$^2$ |
| Polymethyl methacrylate microparticles (average particle size: 2.5 μm) | 20 mg/m$^2$ |
| p-Dodecylbenzenesulfonic acid sodium salt | 15 mg/m$^2$ |
| Dihexyl-α-sulfosuccinate sodium salt | 15 mg/m$^2$ |
| Sodium acetate | 60 mg/m$^2$ |
| Antiseptic (Proxcel) | 1 mg/m$^2$ |

The support, first undercoat layer and second undercoat layer were the same as those used in Example 1.

<<Coating Method>>

First, on the aforementioned support coated with the undercoat layers, as the emulsion layer side, five layers of UL layer, hydrazine-containing emulsion layer, intermediate layer, redox compound containing emulsion layer and protective layer were simultaneously coated as stacked layers in this order from the support at 35° C. by the slide bead coating method while adding a hardening agent solution and passed through a cold wind setting zone (5° C.). Then, on the side opposite to the emulsion layer side, a back layer and a back protective layer were simultaneously coated as stacked layers in this order from the support by the curtain coating method while adding a hardening agent solution, and passed through a cold wind setting zone (5° C.). After the coated support was passed through each setting zone, the coating solutions showed sufficient setting. Subsequently, the support coated with the layers was dried for the both surfaces in a drying zone of the drying conditions mentioned below. The coated support was transported without any contact with rollers and the other members after the coating of the back surface until it was rolled up. The coating speed was 200 m/min.

<<Drying Conditions>>

After the setting, the coated layers were dried with a drying wind at 30° C. until the water/gelatin weight ratio became 800%, and then with a drying wind at 35° C. and relative humidity of 30% for the period where the ratio became 200% from 800%. The coated layers were further blown with the same wind, and 30 second after the point where the surface temperature became 34° C. (regarded as completion of drying), the layers were dried with air at 48° C. and relative humidity of 2% for 1 minute. In this operation, the drying time was 50 seconds from the start to the water/gelatin ratio of 800%, 35 seconds from 800% to 200% of the ratio, and 5 seconds from 200% of the ratio to the end of the drying.

Each of the silver halide photographic light-sensitive materials was rolled up at 25° C. and relative humidity of 55%, cut in the same environment, conditioned for moisture content at 25° C. and relative humidity of 50% for 8 hours and then sealed in a barrier bag conditioned for moisture content for 6 hours together with a cardboard conditioned for moisture content at 25° C. and relative humidity of 50% for 2 hours to prepare samples. The heat-sealing portion had a rigidity of 0.0015 N·m. Humidity in the barrier bag was 53%. The obtained samples had a film surface pH of 5.5 to 5.8 for the emulsion layer side.

<Evaluation>

Each of the samples was evaluated for gradation (gamma), transportability, processing unevenness, and storage stability in the same manners as in Example 1, and the light-sensitive materials having the characteristic of the present invention showed good performance. For the evaluation of transportability, a platemaking camera produced by Dainippon Screen Mfg. Co., Ltd., FINEZOOM C-880, was used (processed by using a camera-integrated automatic developing machine, LD-281Q).

The present disclosure relates to the subject matter contained in Japanese Patent Application No. 325425/2003 filed on Sep. 18, 2003 and Japanese Patent Application No. 079635/2004 filed on Mar. 19, 2004, which are expressly incorporated herein by reference in their entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A silver halide photographic light-sensitive material having one or more layers including at least one light-sensitive silver halide emulsion layer on a support, which contains a compound represented by the following formula (1) and a fluorine compound in at least one layer among the layers formed on the support, and has a characteristic curve drawn in orthogonal coordinates of logarithm of light exposure (x-axis) and optical density (y-axis) using equal unit lengths for the both axes, on which gamma is 5.0 or more for the optical density range of 0.3 to 3.0:

Formula (1)

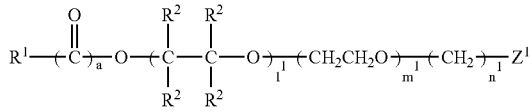

wherein $R^1$ represents a substituted or unsubstituted alkyl group having 6 to 25 carbon atoms or a substituted or unsubstituted alkenyl group having 6 to 25 carbon atoms, the groups of $R^2$ may be identical or different, and represent a hydrogen atom, a substituted or unsubstituted alkyl group having 1 to 14 carbon atoms, a substituted or unsubstituted alkenyl group having 1 to 14 carbon atoms, a substituted or unsubstituted aralkyl group having 7 to 20 carbon atoms or a substituted or unsubstituted aryl group having 6 to 18 carbon atoms, $l^1$ represents an integer of 1 to 10, $m^1$ represents an integer of 1 to 30, $n^1$ represents an integer of 0 to 4, a represents 0 or 1, and $Z^1$ represents $OSO_3M$ or $SO_3M$, where M represents a cation.

2. The silver halide photographic light-sensitive material according to claim 1, wherein the fluorine compound is a compound represented by the following formula (2A):

Formula (2A)

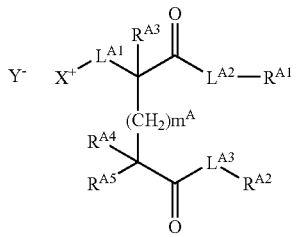

wherein $R^{A1}$ and $R^{A2}$ each represent a substituted or unsubstituted alkyl group provided that at least one of $R^{A1}$ and $R^{A2}$ represents an alkyl group substituted with one or more fluorine atoms; $R^{A3}$, $R^{A4}$ and $R^{A5}$ each independently represent a hydrogen atom or a substituent; $L^{A1}$, $L^{A2}$ and $L^{A3}$ each independently represent a single bond or a divalent bridging group; $X^+$ represents a cationic substituent; $Y^-$ represents a counter anion, provided that $Y^-$ may not be present when the intramolecular charge is 0 without $Y^-$; and $m^A$ represents 0 or 1.

3. The silver halide photographic light-sensitive material according to claim 1, wherein the fluorine compound is a compound represented by the following formula (2A-1):

Formula (2A-1)

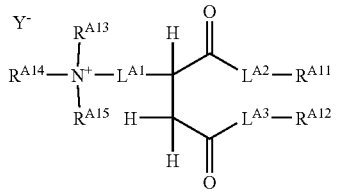

wherein $R^{A11}$ and $R^{A12}$ each represent a substituted or unsubstituted alkyl group, provided that at least one of $R^{A11}$ and $R^{A12}$ represents an alkyl group substituted with one or more fluorine atoms, and the total carbon atom number of $R^{A11}$ and $R^{A12}$ is 19 or less; $L^{A2}$ and $L^{A3}$ each independently represent —O—, —S— or —$NR^{100}$— where $R^{100}$ represents a hydrogen atom or a substituent; $L^{A1}$ represents a single bond or a divalent bridging group; $R^{13A}$, $R^{14A}$ and $R^{15A}$ each independently represent a substituted or unsubstituted alkyl group; and $Y^-$ represents a counter anion, provided that $Y^-$ may not be present when the intramolecular charge is 0 without $Y^-$.

4. The silver halide photographic light-sensitive material according to claim 1, wherein the fluorine compound is a compound represented by the following formula (2A-2):

Formula (2A-2)

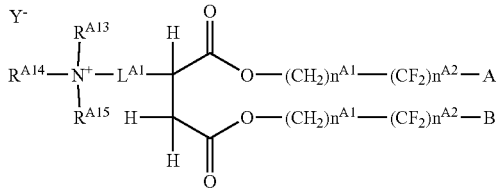

wherein A and B each independently represent a fluorine atom or a hydrogen atom; $n^{A1}$ represents an integer of 1 to 6; $n^{A2}$ represents an integer of 3 to 8; $L^{A1}$ represents a single bond or a divalent bridging group; $R^{13A}$, $R^{14A}$ and $R^{15A}$ each independently represent a substituted or unsubstituted alkyl group; and $Y^-$ represents a counter anion, provided that $Y^-$ may not be present when the intramolecular charge is 0 without $Y^-$.

5. The silver halide photographic light-sensitive material according to claim 1, wherein the fluorine compound is a compound represented by the following formula (2A-3):

Formula (2a-3)

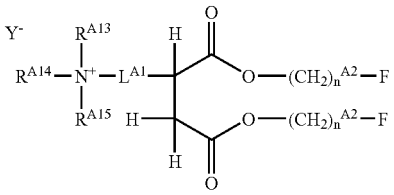

wherein $n^{A1}$ represents an integer of 1 to 6; $n^{A2}$ represents an integer of 3 to 8, provided that $2(n^{A1}+n^{A2})$ is 19 or less; $L^{A1}$ represents a single bond or a divalent bridging group; $R^{13A}$, $R^{14A}$ and $R^{15A}$ each independently represent a substituted or unsubstituted alkyl group; and $Y^-$ represents a counter anion, provided that $Y^-$ may not be present when the intramolecular charge is 0 without $Y^-$.

6. The silver halide photographic light-sensitive material according to claim 1, wherein the fluorine compound is a compound represented by the following formula (2B):

Formula (2B)

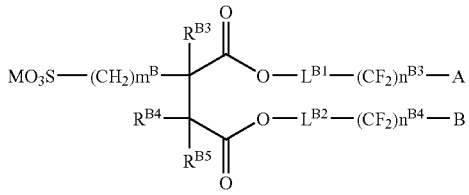

wherein A and B each independently represent a fluorine atom or a hydrogen atom; $n^{B3}$ and $n^{B4}$ each independently represent an integer of 4 to 8; $L^{B1}$ and $L^{B2}$ each independently represent a substituted or unsubstituted alkylene group, a substituted or unsubstituted alkyleneoxy group or a divalent bridging group consisting of a combination of these; $R^{B3}$, $R^{B4}$ and $R^{B5}$ each independently represent a hydrogen atom or a substituent; $m^B$ represents 0 or 1; and M represents a cation.

7. The silver halide photographic light-sensitive material according to claim 1, wherein the fluorine compound is a compound represented by the following formula (2B-1):

Formula (2B-1)

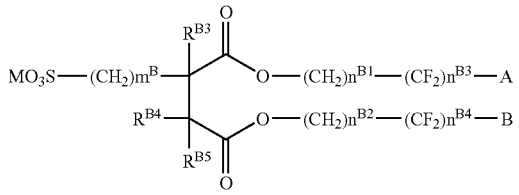

wherein A and B each independently represent a fluorine atom or a hydrogen atom; $n^{B1}$ and $n^{B2}$ each independently represent an integer of 1 to 6; $n^{B3}$ and $n^{B4}$ each independently represent an integer of 4 to 8; $R^{B3}$, $R^{B4}$ and $R^{B5}$ each independently represent a hydrogen atom or a substituent; $m^B$ represents 0 or 1; and M represents a cation.

8. The silver halide photographic light-sensitive material according to claim 1, wherein the fluorine compound is a compound represented by the following formula (2B-2):

Formula (2B-2)

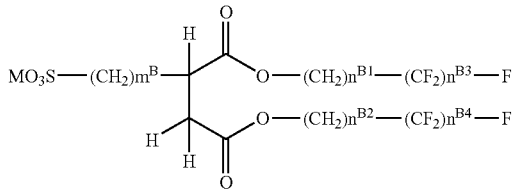

wherein $n^{B1}$ and $n^{B2}$ each independently represent an integer of 1 to 6; $n^{B3}$ and $n^{B4}$ each independently represent an integer of 4 to 8; $m^B$ represents 0 or 1; and M represents a cation.

9. The silver halide photographic light-sensitive material according to claim 1, wherein the fluorine compound is a compound represented by the following formula (2B-3):

Formula (2B-3)

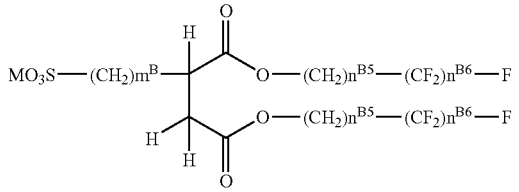

wherein $n^{B5}$ represents 2 or 3; $n^{B6}$ represents an integer of 4 to 6; $m^B$ represents 0 or 1; and M represents a cation.

10. The silver halide photographic light-sensitive material according to claim 1, wherein the fluorine compound is a compound represented by the following formula (2C):

Formula (2C)

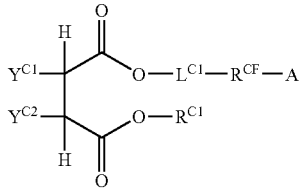

wherein $R^{C1}$ represents a substituted or unsubstituted alkyl group; $R^{CF}$ represents a perfluoroalkylene group; A represents a hydrogen atom or a fluorine atom; $L^{C1}$ represents a substituted or unsubstituted alkylene group, a substituted or unsubstituted alkyleneoxy group or a divalent bridging group consisting of a combination of these; and one of $Y^{C1}$ and $Y^{C2}$ represents a hydrogen atom, and the other represents —$L^{C1}$—$SO_3M$, where M represents a cation, and $L^{C2}$ represents a single bond or a substituted or unsubstituted alkylene group.

11. The silver halide photographic light-sensitive material according to claim 1, wherein the fluorine compound is a compound represented by the following formula (2D):

$$[Rf^D—(L^D)_{nD}]_{mD}—W \qquad \text{Formula (2D)}$$

wherein $Rf^D$ represents a perfluoroalkyl group; $L^D$ represents an alkylene group; W represents a group having an anionic, cationic or betaine group or nonionic polar group required for imparting surface activity; $n^D$ represents 0 or 1; and $m^D$ represents an integer of 1 to 3.

12. The silver halide photographic light-sensitive material according to claim 1, which contains a compound represented by the following formula (4):

Formula (4)

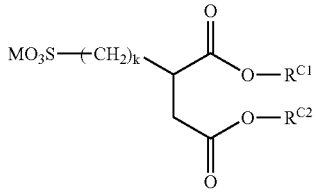

wherein $R^{C1}$ and $R^{C2}$ each represent an alkyl group having 4 to 22 carbon atoms or an alkylene group having 4 to 22 carbon atoms; k represents 0 or 1; and M represents a cation.

13. The silver halide photographic light-sensitive material according to claim 1, wherein the support comprises polymer filtered through a melt filter of 5-μm mesh or smaller mesh size.

14. The silver halide photographic light-sensitive material according to claim 1, wherein the support comprises polyester filtered through a melt filter of 5-μm mesh or smaller mesh size.

15. A package comprising a stack of the silver halide photographic light-sensitive materials according to claim 1 packaged with a packaging bag.

16. The package according to claim 15, wherein the packaging bag has a heat-sealing portion for packaging the stack in the bag and the heat-sealing portion has a rigidity of 0.0005 N·m or more.

17. The package according to claim 16, wherein the heat-sealing portion has a rigidity of 0.0005 to 0.01 N·m.

18. The package according to claim 16, wherein the heat-sealing portion is formed on each of the four sides of the packaging bag.

19. The package according to claim 16, wherein relative humidity in the packaging bag is 30 to 55%.

20. The package according to claim 16, wherein the stack of the silver halide photographic light-sensitive materials is packaged with a protection plate and then stored in the packaging bag.

* * * * *